US008763673B2

(12) United States Patent
Jelic et al.

(10) Patent No.: US 8,763,673 B2
(45) Date of Patent: Jul. 1, 2014

(54) RETRACTABLE SHADE FOR COVERINGS FOR ARCHITECTURAL OPENINGS

(75) Inventors: Ralph G. Jelic, Boulder, CO (US); Wendell B. Colson, Weston, MA (US); Paul G. Swiszcz, Niwot, CO (US); Kim Jelic, Boulder, CO (US); Daniel M. Fogarty, Framingham, MA (US); Jason T. Throne, Rockport, ME (US)

(73) Assignee: Hunter Douglas Inc., Pearl River, NY (US)

( * ) Notice: Subject to any disclaimer, the term of this patent is extended or adjusted under 35 U.S.C. 154(b) by 145 days.

(21) Appl. No.: 12/837,086

(22) Filed: Jul. 15, 2010

(65) Prior Publication Data

US 2010/0276088 A1 Nov. 4, 2010

Related U.S. Application Data

(62) Division of application No. 10/581,872, filed as application No. PCT/US2004/043043 on Dec. 21, 2004, now abandoned.

(60) Provisional application No. 60/531,874, filed on Dec. 22, 2003, provisional application No. 60/571,605, filed on May 13, 2004.

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***A47H 1/00*** | (2006.01) |

(52) U.S. Cl.

USPC ..... 160/84.05; 160/84.08; 160/126

(58) Field of Classification Search

USPC ..... 160/113, 119, 124, 115, 166.1, 184, 160/236, 237, 84.01, 84.04, 84.05, 84.08

See application file for complete search history.

(56) References Cited

U.S. PATENT DOCUMENTS

| | | | |
|---|---|---|---|
| 2,118,134 | A | 5/1938 | Allison |
| 2,201,356 | A | 5/1940 | Terrell |

(Continued)

FOREIGN PATENT DOCUMENTS

| | | | |
|---|---|---|---|
| CN | 2545343 | Y | 4/2003 |
| EP | 0427477 | A2 | 5/1991 |

(Continued)

OTHER PUBLICATIONS

Author Unknown, "Roman Shades", seamstobe.com/Romanshades.htm, at least as early as May 26, 2009, 2 pages.

(Continued)

*Primary Examiner* — Katherine Mitchell
*Assistant Examiner* — Jeremy Ramsey
(74) *Attorney, Agent, or Firm* — Dorsey & Whitney LLP

(57) ABSTRACT

A retractable cellular shade is illustrated in various embodiments to consist of a support structure that could assume numerous forms including cellular material, flexible sheets of material, tapes or ribbons, or flexible monofilaments or similar cords of natural or synthetic fibers with the support structure supporting a plurality of vanes or slats in various configurations and orientations. The movement of the vanes or slats is totally dependent upon movement of the support structure. The fabric so formed can be incorporated into a covering for architectural openings with the covering including a headrail with means for gathering the fabric material within the headrail.

20 Claims, 97 Drawing Sheets

(56) References Cited

U.S. PATENT DOCUMENTS

| | | | | | |
|---|---|---|---|---|---|
| RE22,311 | E | | 5/1943 | Roy | |
| 2,318,525 | A | | 5/1943 | Renton | |
| 3,386,490 | A | | 6/1968 | Kandel | |
| 3,487,875 | A | | 1/1970 | Shukat et al. | |
| 3,490,515 | A | | 1/1970 | Kandel | |
| 4,069,857 | A | | 1/1978 | Brookshire | |
| 4,397,346 | A | | 8/1983 | Chumbley et al. | |
| D277,061 | S | | 1/1985 | Picoy | |
| 4,542,602 | A | | 9/1985 | Hoverson | |
| 4,675,060 | A | | 6/1987 | Schnebly et al. | |
| 4,677,013 | A | * | 6/1987 | Anderson | 428/116 |
| 4,739,816 | A | | 4/1988 | Dodich et al. | |
| 4,846,243 | A | | 7/1989 | Schneider | |
| 4,884,612 | A | | 12/1989 | Schnebly et al. | |
| 4,915,153 | A | * | 4/1990 | Toti | 160/84.04 |
| 4,921,032 | A | | 5/1990 | May | |
| 4,984,617 | A | * | 1/1991 | Corey | 160/84.02 |
| 5,090,098 | A | | 2/1992 | Seveik et al. | |
| 5,129,440 | A | | 7/1992 | Colson | |
| 5,205,333 | A | * | 4/1993 | Judkins | 160/84.02 |
| 5,207,257 | A | | 5/1993 | Rupel | |
| 5,313,998 | A | * | 5/1994 | Colson et al. | 160/84.02 |
| 5,409,050 | A | | 4/1995 | Hong | |
| 5,425,408 | A | | 6/1995 | Colson | |
| 5,490,533 | A | | 2/1996 | Carter | |
| 5,503,210 | A | | 4/1996 | Colson et al. | |
| 5,547,006 | A | | 8/1996 | Auger | |
| 5,560,976 | A | | 10/1996 | Huang | |
| 5,566,735 | A | | 10/1996 | Jelic | |
| 5,620,035 | A | | 4/1997 | Judkins | |
| 5,632,316 | A | | 5/1997 | Cohen | |
| 5,649,583 | A | | 7/1997 | Hsu | |
| 5,690,156 | A | | 11/1997 | Ruggles | |
| 5,706,876 | A | | 1/1998 | Lysyj | |
| 5,746,266 | A | | 5/1998 | Colson et al. | |
| 5,787,951 | A | | 8/1998 | Tonomura et al. | |
| 5,791,390 | A | | 8/1998 | Watanabe | |
| 6,006,812 | A | | 12/1999 | Corey | |
| 6,033,504 | A | | 3/2000 | Judkins | |
| 6,103,336 | A | * | 8/2000 | Swiszcz | 428/116 |
| D436,783 | S | | 1/2001 | Cooper et al. | |
| 6,257,300 | B1 | | 7/2001 | Brownlie | |
| 6,461,464 | B1 | | 10/2002 | Swiszcz | |
| 6,497,264 | B1 | | 12/2002 | Paskevicius | |
| 6,520,238 | B2 | | 2/2003 | Allsopp | |
| 6,572,725 | B2 | | 6/2003 | Goodhue | |
| 6,601,637 | B2 | | 8/2003 | Toti | |
| 6,662,845 | B1 | | 12/2003 | Palmer | |
| 6,675,859 | B2 | | 1/2004 | Nien | |
| 6,792,996 | B1 | | 9/2004 | Yu et al. | |
| D498,105 | S | | 11/2004 | Tyner | |
| 6,834,702 | B2 | | 12/2004 | Nien | |
| 6,932,138 | B2 | | 8/2005 | Yu et al. | |
| 6,988,526 | B2 | | 1/2006 | Judkins | |
| 7,021,359 | B2 | | 4/2006 | Yu et al. | |
| 7,117,919 | B2 | | 10/2006 | Judkins | |
| 7,124,802 | B2 | | 10/2006 | Sudano | |
| 7,143,802 | B2 | | 12/2006 | Strand et al. | |
| 7,159,634 | B1 | | 1/2007 | Judkins | |
| 7,275,580 | B2 | | 10/2007 | Yu et al. | |
| 7,290,582 | B2 | | 11/2007 | Lin | |
| 7,353,856 | B2 | | 4/2008 | Pon et al. | |
| D568,082 | S | | 5/2008 | Bohlen | |
| 7,415,845 | B1 | | 8/2008 | Graichen | |
| 7,513,292 | B2 | | 4/2009 | Auger | |
| 7,523,777 | B2 | | 4/2009 | Kim | |
| 7,832,450 | B2 | | 11/2010 | Brace et al. | |
| D636,204 | S | | 4/2011 | Elinson et al. | |
| D640,472 | S | | 6/2011 | Colson et al. | |
| D646,516 | S | | 10/2011 | Ehrsam | |
| D668,090 | S | | 10/2012 | Colson et al. | |
| 2002/0043346 | A1 | | 4/2002 | Zorbas | |
| 2002/0043347 | A1 | | 4/2002 | Rupel | |
| 2004/0065417 | A1 | | 4/2004 | Vanpoelvoorde | |
| 2004/0079492 | A1 | * | 4/2004 | Lin | 160/84.01 |
| 2005/0155721 | A1 | | 7/2005 | Pon | |
| 2006/0048901 | A1 | | 3/2006 | Nien | |
| 2007/0074826 | A1 | | 4/2007 | Jelic et al. | |
| 2010/0126675 | A1 | | 5/2010 | Jelic et al. | |
| 2010/0186903 | A1 | | 7/2010 | Liang | |
| 2010/0276089 | A1 | | 11/2010 | Jelic et al. | |
| 2010/0288446 | A1 | | 11/2010 | Foley | |
| 2011/0088852 | A1 | | 4/2011 | Hu | |
| 2012/0103537 | A1 | | 5/2012 | Dogger | |
| 2012/0175068 | A1 | | 7/2012 | Cleaver | |
| 2012/0175069 | A1 | | 7/2012 | Rupel | |

FOREIGN PATENT DOCUMENTS

| | | | |
|---|---|---|---|
| EP | 0 451 912 | A1 | 10/1991 |
| EP | 0 779 407 | B1 | 7/2002 |
| EP | 1 431 506 | A2 | 6/2004 |
| EP | 1 479 867 | A2 | 11/2004 |
| EP | 1 561 896 | A2 | 8/2005 |
| EP | 1561896 | A2 | 8/2005 |
| EP | 1 619 348 | A1 | 1/2006 |
| JP | 37-26369 | | 9/1937 |
| WO | 88/07345 | A1 | 10/1988 |
| WO | 93/07353 | A1 | 4/1993 |

OTHER PUBLICATIONS

Author Unknown, "Understanding Roman Shades", terrelldesigns.com, at least as early as May 26, 2009, 4 pages.

PCT International Search Report and Written Opinion dated Feb. 14, 2006; International Application No. PCT/US04/43043, 7 pages.

U.S. Appl. No. 29/441,626, filed Jan. 8, 2013, Jelic et al.

* cited by examiner

RETRACTABLE SHADE FOR COVERINGS FOR ARCHITECTURAL OPENINGS

CROSS REFERENCE TO RELATED APPLICATION

This application is a divisional of U.S. application Ser. No. 10/581,872 filed 5 Jun. 2006, which application is a 371 national phase application of PCT/US2004/043043 filed Dec. 21, 2004, which application claims the benefit under 35 U.S.C. §119(e) to U.S. provisional patent application No. 60/571,605 filed 13 May 2004, and U.S. provisional application No. 60/531,874 filed 22 Dec. 2003. Each of the above-identified patent applications is hereby incorporated by reference as if fully disclosed herein.

BACKGROUND OF THE INVENTION

1. Field of the Invention

The present invention relates generally to retractable coverings for architectural openings and fabrics for use therein wherein the fabric includes a flexible support structure and a plurality of vanes or slats mounted on the support structure with the movement of the vanes or slats being dependent upon the movement of the support structure.

2. Description of the Relevant Art

Retractable coverings for architectural openings have assumed numerous forms over a long period of time. Originally, coverings for architectural openings such as windows, doors, archways or the like consisted principally of fabric draped across the architectural openings. Such early forms of coverings evolved into retractable roller shades, curtains, draperies, and the like wherein the covering could be extended across the architectural opening or retracted to a top or side of the opening.

An early but still popular form of covering for architectural openings is the Venetian blind wherein a plurality of vertically extending cord ladders support parallel horizontally extending slats in a manner such that the slats can be pivoted about their longitudinal axes between open and closed positions and the entire blind can be moved between an extended position wherein it extends across the architectural opening and a retracted position where the slats are accumulated in a vertical stack adjacent to the top of the architectural opening.

Vertical blinds are also available which are very similar to Venetian blinds except the slats or vanes extend vertically and are suspended from their upper ends for pivotal movement about their longitudinal vertical axes. The entire blind can be extended across the opening or retracted adjacent to one or more sides of the opening in a horizontal stack.

More recently, cellular shades have become popular not only because they are aesthetically attractive but also because they provide improved insulation across architectural openings where typically heat can otherwise be lost. Cellular shades have assumed numerous forms including a plurality of longitudinally extending tubes made of a flexible or semi-rigid material which can be transversely collapsed. The cellular shade can thereby be extended across an architectural opening or retracted adjacent the top or bottom edge of the opening with the cells transversely collapsed in a vertical stack.

A more recent form of cellular shade includes a pair of spaced flexible sheets, which are typically sheer fabric, with the sheets being interconnected by vertically spaced horizontally extending vanes which may be rigid or flexible. The vanes are movable between open and closed positions by shifting the sheets of material in opposite vertical directions.

The entire covering can be extended across the opening or retracted along one edge of the opening typically by rolling the fabric material comprised of the sheets of material and interconnecting vanes about a roller.

The recent emphasis on design in homes and building structures has maintained pressure on the industry to create unique aesthetically attractive coverings for architectural openings which also have utilitarian functions such as insulating the opening to minimize the loss of heat therethrough.

It is to respond to the demand of the market that the present invention has been made.

SUMMARY OF THE INVENTION

The covering of the present invention includes a fabric material that can be extended across an architectural opening or retracted adjacent an edge of the opening and a control system for manipulating the fabric material. The fabric material can assume various forms but wherein generally a support structure supports a plurality of slats or vanes in a manner such that the movement of the vanes is dependent upon movement of the support structure. The support structure could be in the form of a sheet of flexible material, strips of flexible ribbon, tape, or the like, flexible elongated strands or elements which could be monofilaments, cord or string made of natural or synthetic fibers, transversely collapsible cellular structures, or the like. The support structure while typically being vertically oriented can also be horizontally disposed so the covering can be used in a skylight as well as on windows, doors, archways, or the like.

The slats or vanes, which are supported on the support structure, can assume numerous forms including rigid, semi-rigid or flexible strips of material of various configurations and relationships connected to the support structure at spaced locations to define cellular vanes between connection locations. The vanes formed from the strips of material are connected to the support structure in a manner such that they can be gathered into a compact stack adjacent one edge of an architectural opening when the fabric is mounted on a control system for extending or retracting the fabric structure across the architectural opening. The control system for such a covering in the preferred embodiment is a lift mechanism which lifts or gathers the support structure and consequently the vanes that follow into a stack adjacent to an edge of the architectural opening.

As will be appreciated with the detailed description that follows, the vanes can be interconnected with each other, connected individually to the support structure or they can be mounted on the support structure so that each vane is not directly secured to the support structure but rather the support structure is used to engage and lift the lowermost vanes in the fabric when the covering is being retracted thereby causing the remaining vanes to accumulate and stack on the lowermost vanes.

Other aspects, features and details of the present invention can be more completely understood by reference to the following detailed description of preferred embodiments, taken in conjunction with the drawings and from the appended claims.

BRIEF DESCRIPTION OF THE DRAWINGS

FIG. 27L is another arrangement of a fabric in accordance with the present invention which is similar to the embodiment of FIG. 27K except the support structure is in the form of a plurality of flexible monofilaments or the like.

FIG. 34C is a side elevation of a slat used in the fabric of FIG. 34A.

FIG. 35A is a side elevation of a twenty-eighth embodiment of a fabric in accordance with the present invention shown in a fully extended position.

FIG. 35B is an enlarged side elevation of the fabric of FIG. 35A in a fully retracted position.

FIG. 35C is a side elevation of a slat used in the fabric of FIG. 35A.

FIG. 36A is a side elevation of a shade incorporating a hybrid fabric having an upper component with a plurality of arcuate slats suspended off front and rear sides of a support structure and an integrated lower component of a sheet of fabric connected to a roller along its bottom edge.

FIG. 36B is a fragmentary isometric of the shade shown in FIG. 36A.

FIG. 37A is a side elevation of a hybrid shade having an upper fabric component of a plurality of interconnected hexagonal cells and a lower component of a plurality of arcuate slats suspended from a support system.

FIG. 37B is a fragmentary isometric of the shade shown in FIG. 37A.

FIG. 38A is a front elevation of a shade having a control system for moving both a top rail and a bottom rail having a fabric extending therebetween and wherein the bottom rail is in a fully extended and lowered position and the top rail is partially lowered.

FIG. 38B is a front elevation similar to FIG. 38A wherein the top and bottom rails are both positioned at an intermediate location between the top and bottom of an architectural opening in which the shade is disposed.

FIG. 39A is a front elevation of a shade used in an architectural opening having a semi-circular top edge and wherein the top edge of the fabric in the shade is movable vertically between a raised fully extended position and a lowered fully retracted position wherein slats in the fabric of the shade are accumulated adjacent to a bottom edge of the architectural opening.

FIG. 39B is a front elevation of the shade of FIG. 39A with the top edge of the shade partially lowered.

Figure 39C:
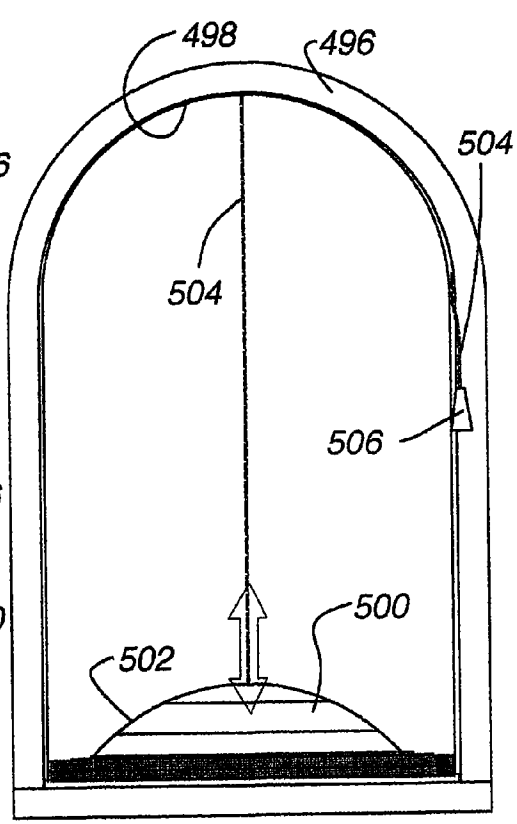
Figure 39B:
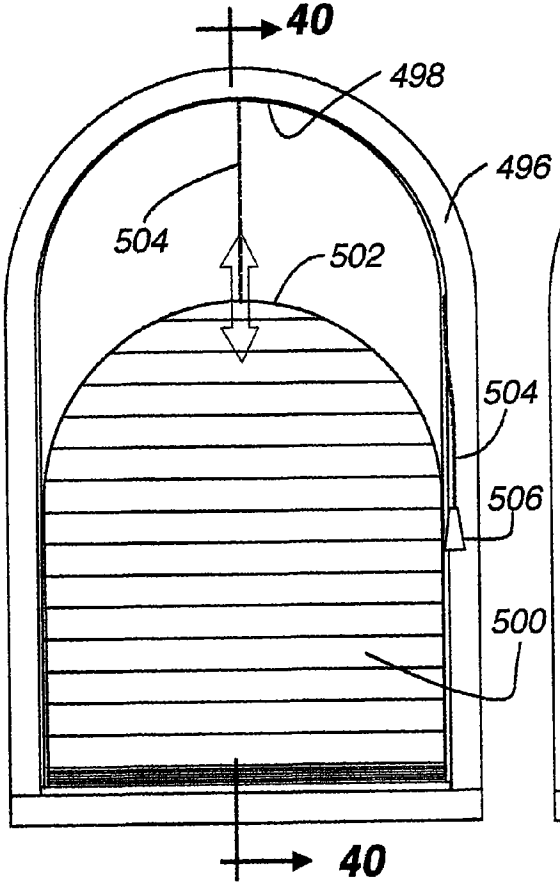

FIG. 39C is a front elevation similar to FIG. 39B with the shade almost entirely retracted.

Figure 40:
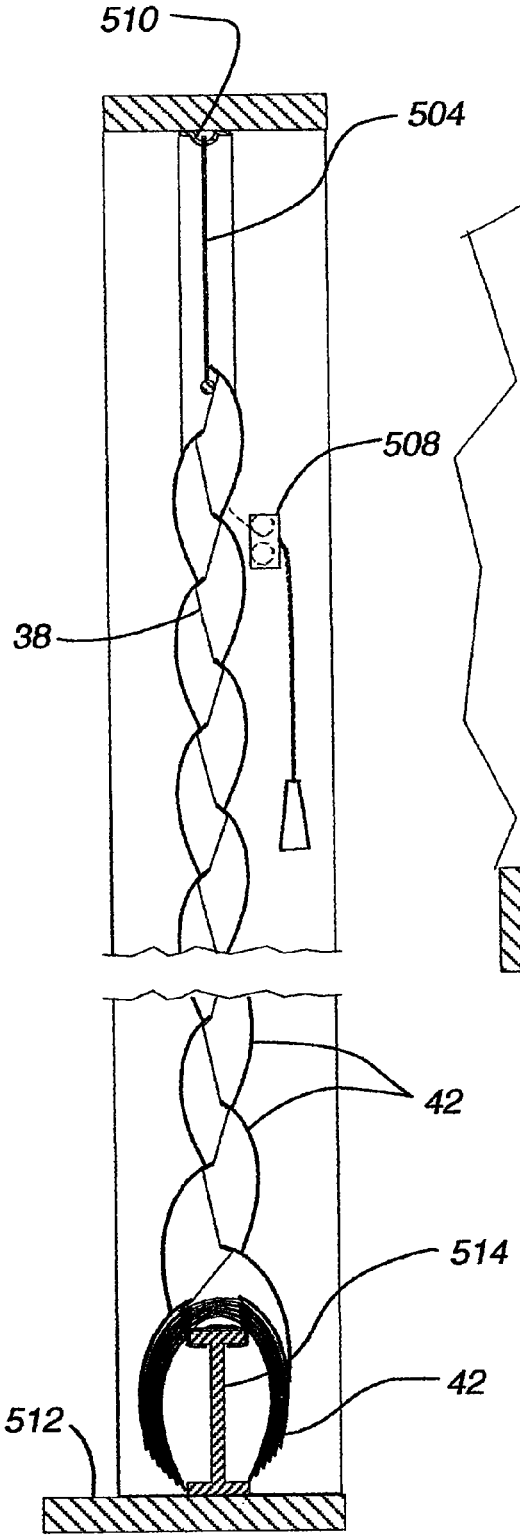

FIG. 40 is an enlarged section taken along line 40-40 of FIG. 39B.

Figure 41:
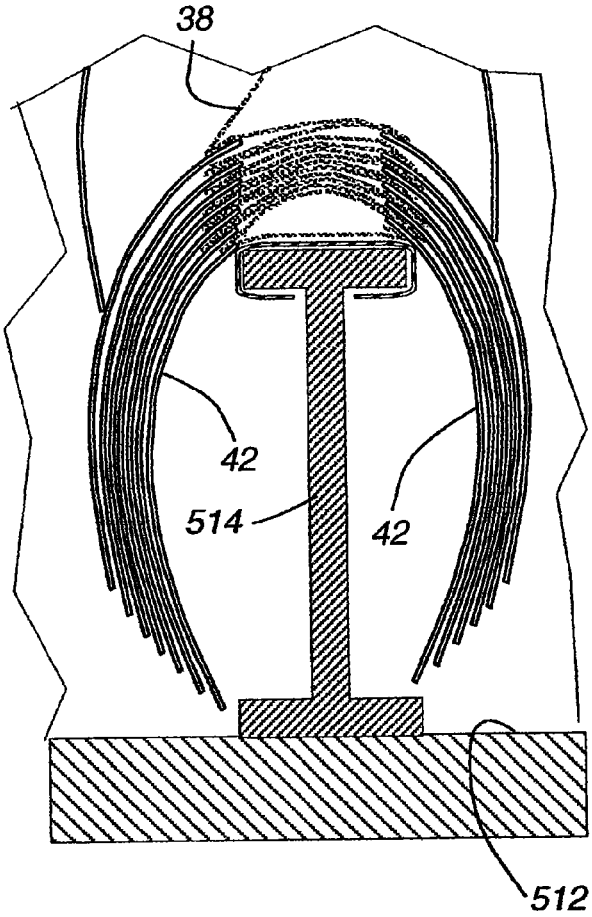

FIG. 41 is an enlarged fragmentary side elevation of the lower end of the shade shown in FIG. 40.

Figure 42:
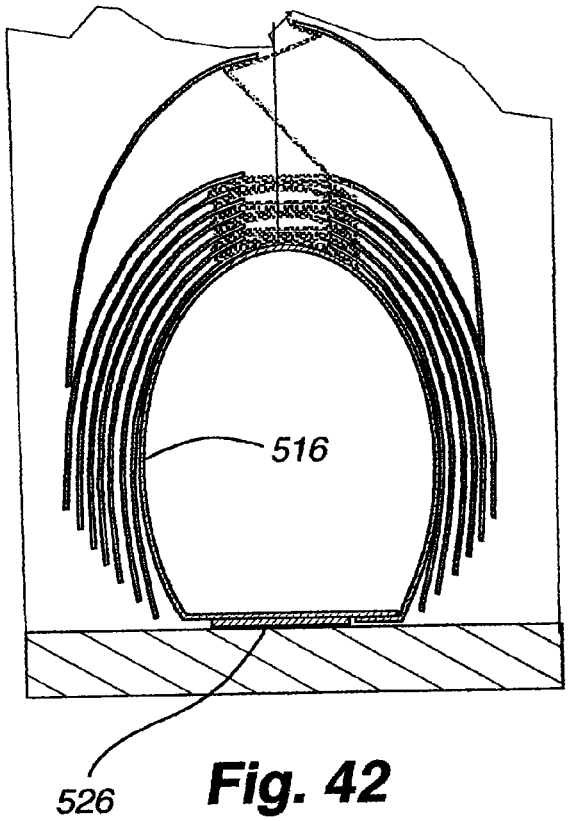

FIG. 42 is a fragmentary side elevation similar to FIG. 41 wherein the shade utilizes a bottom accumulating rail of a different configuration than that used in the embodiment of FIG. 41.

Figure 43:
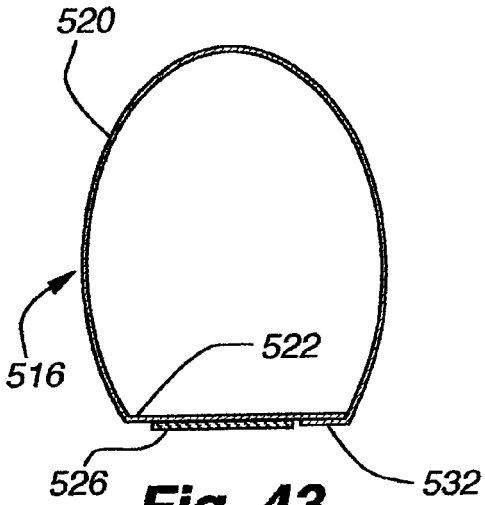

FIG. 43 is a side elevation of the accumulating rail shown in FIG. 42.

Figure 44:
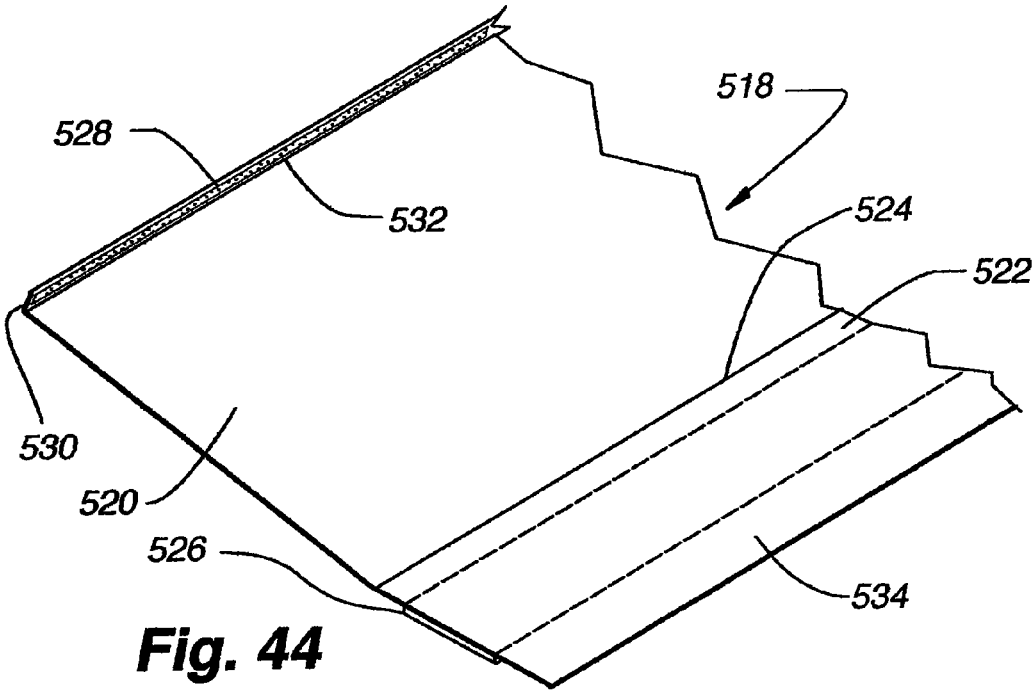

FIG. 44 is a fragmentary isometric of a material used to form the accumulating rail of FIGS. 42 and 43.

Figure 45:
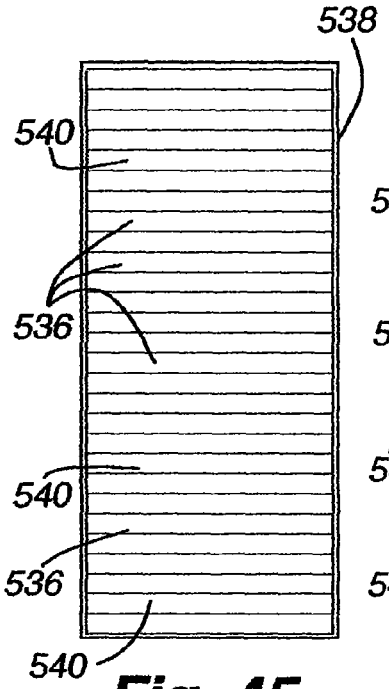

FIG. 45 is a front elevation of a shade in accordance with the present invention utilizing a plurality of vertically adjacent shades for use in a single architectural opening and wherein each of the shades are fully extended.

Figure 46:
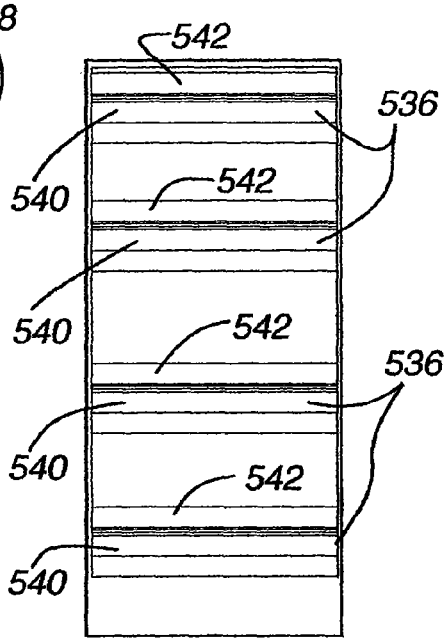

FIG. 46 is a front elevation similar to FIG. 45 with each shade partially retracted.

Figure 47:
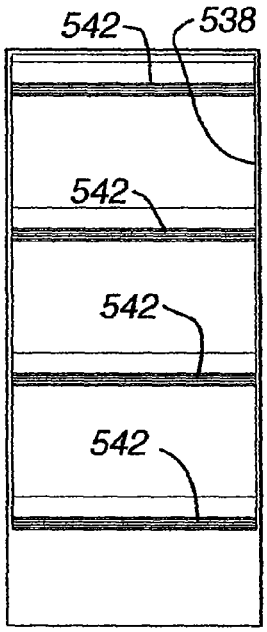

FIG. 47 is a front elevation similar to FIG. 46 with the shades fully retracted.

Figure 48A:
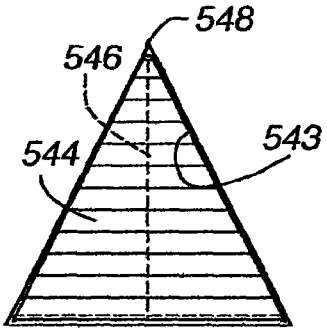

FIG. 48A is a front elevation of a fully-extended shade in accordance with the present invention utilizing a plurality of horizontally disposed interconnected slats supported on a support structure wherein the fabric is of a triangular configuration having its base horizontally disposed at the bottom of the fabric.

Figure 48B:
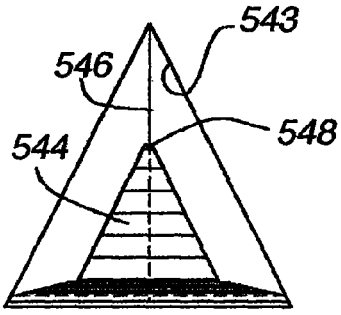

FIG. 48B is a front elevation similar to FIG. 48A with the shade partially retracted.

Figure 49A:
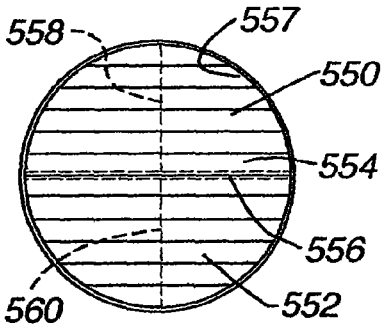

FIG. 49A is a front elevation of a shade in accordance with the present invention having a circular shape wherein horizontally disposed slats are supported on support structures adapted to move the slats from a fully extended position to a retracted position on a horizontal diametric rail at the center of the circular fabric.

Figure 49B:
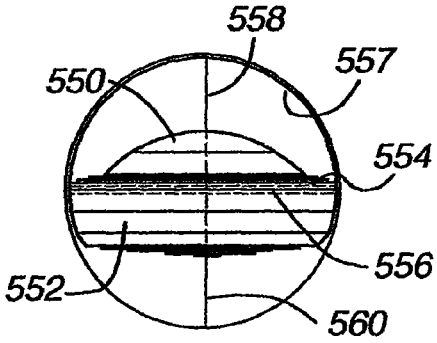

FIG. 49B is a front elevation similar to FIG. 49A with the shade partially retracted.

Figure 50A:
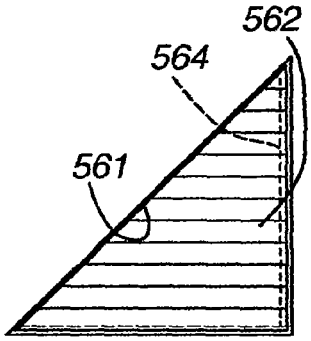

FIG. 50A is a front elevation of a shade formed of a right triangular configuration again with a plurality of horizontally disposed slats on a support structure wherein the top edge of the fabric is adapted to be lowered toward the bottom edge when retracting the fabric.

Figure 50B:
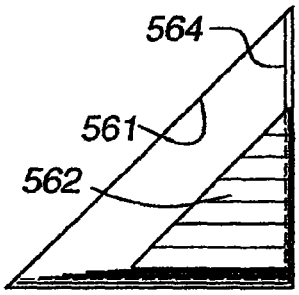

FIG. 50B is a front elevation similar to FIG. 50A with the shade partially retracted.

Figure 51A:
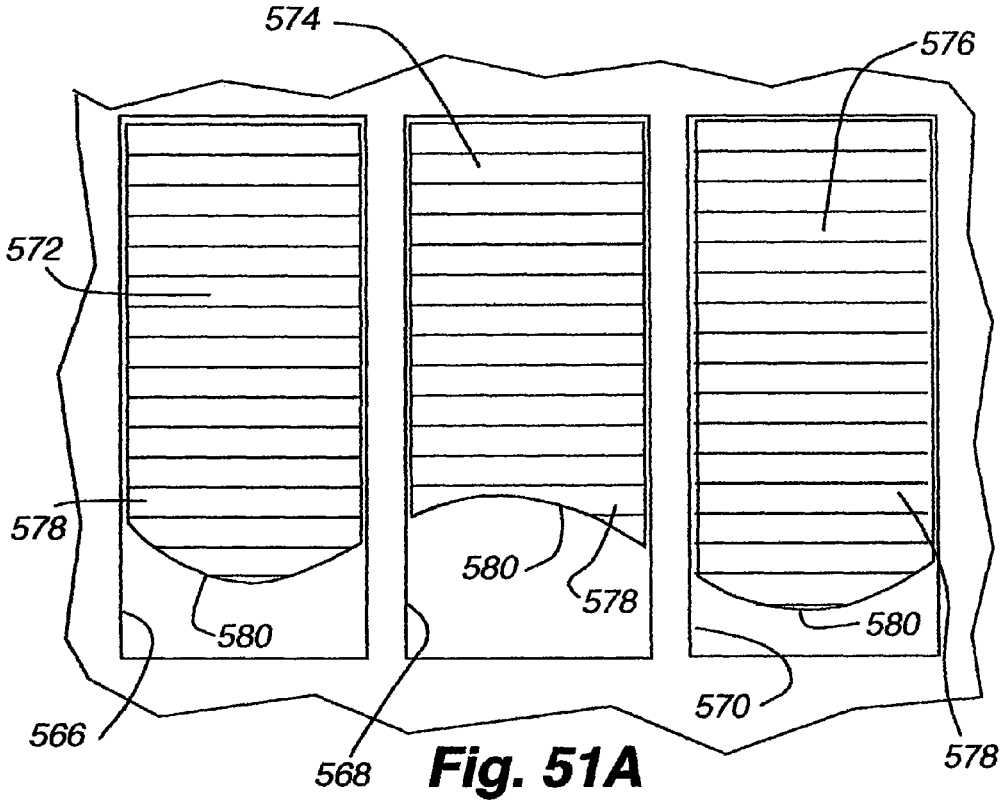

FIG. 51A is a front elevation of three adjacent side-by-side architectural openings having a shade in accordance with the present invention incorporated into each opening and wherein the lower edge of the fabric in the shade is contoured so as to complement the lower edge of the fabric in adjacent openings and wherein the shade in each opening is nearly fully extended.

Figure 51B:
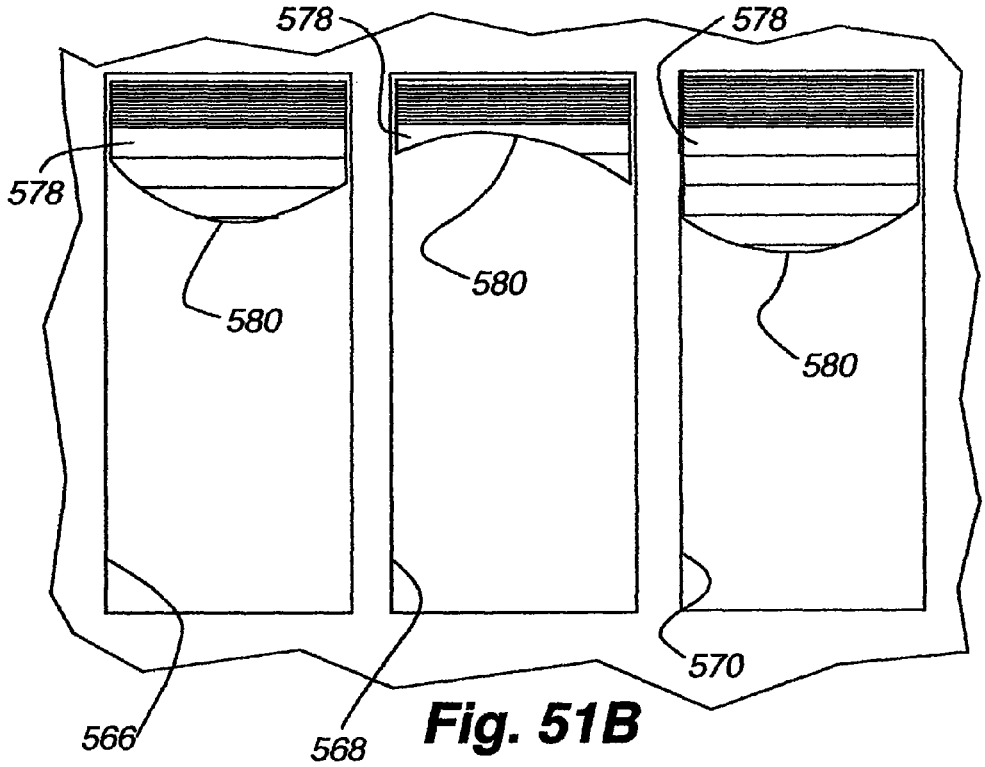

FIG. 51B is a front elevation of the architectural openings and shades shown in FIG. 51A with the shades substantially fully retracted.

Figure 52:
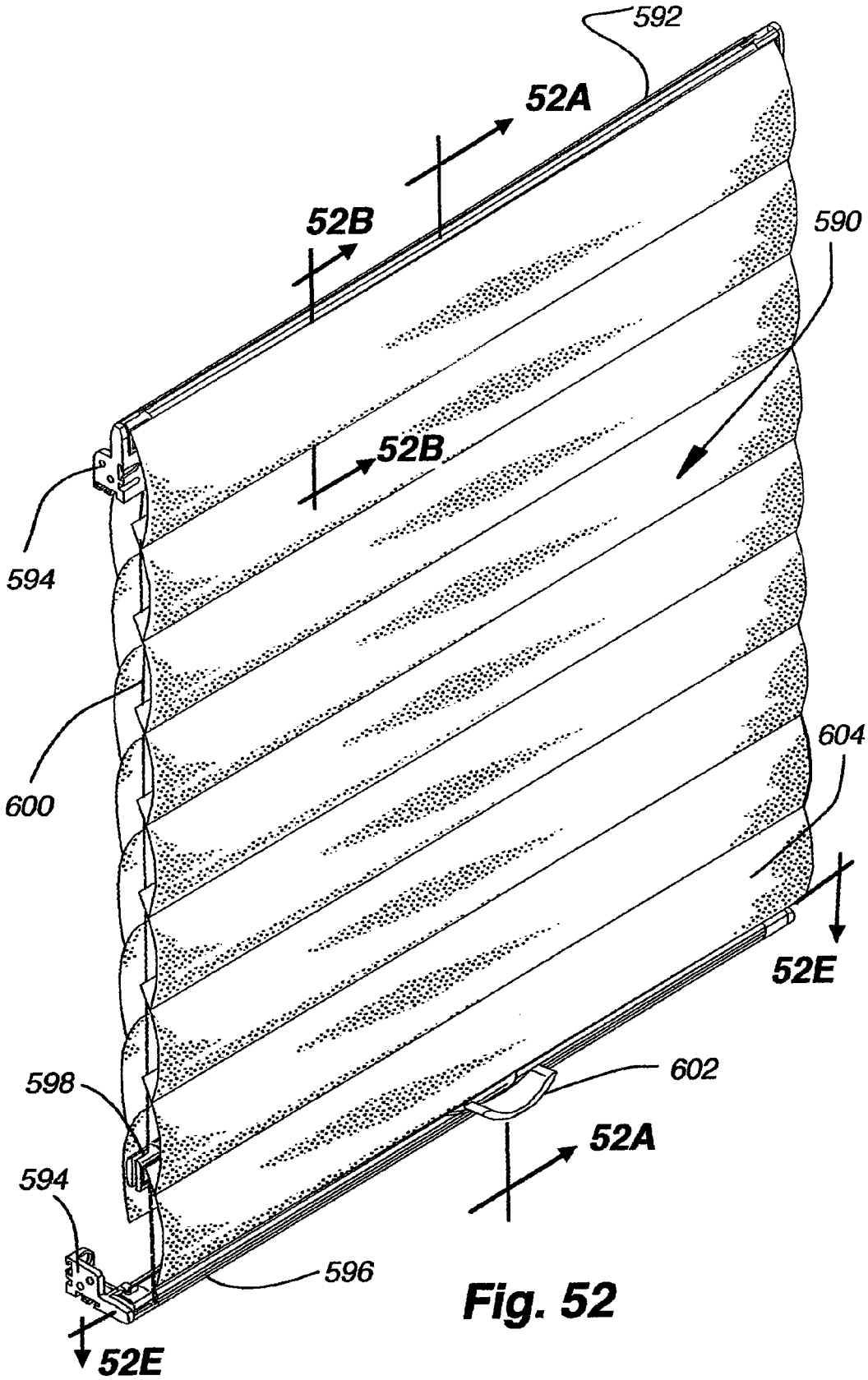

FIG. 52 is an isometric of a shade incorporating a further embodiment having manually operated lift rails.

Figure 52A:
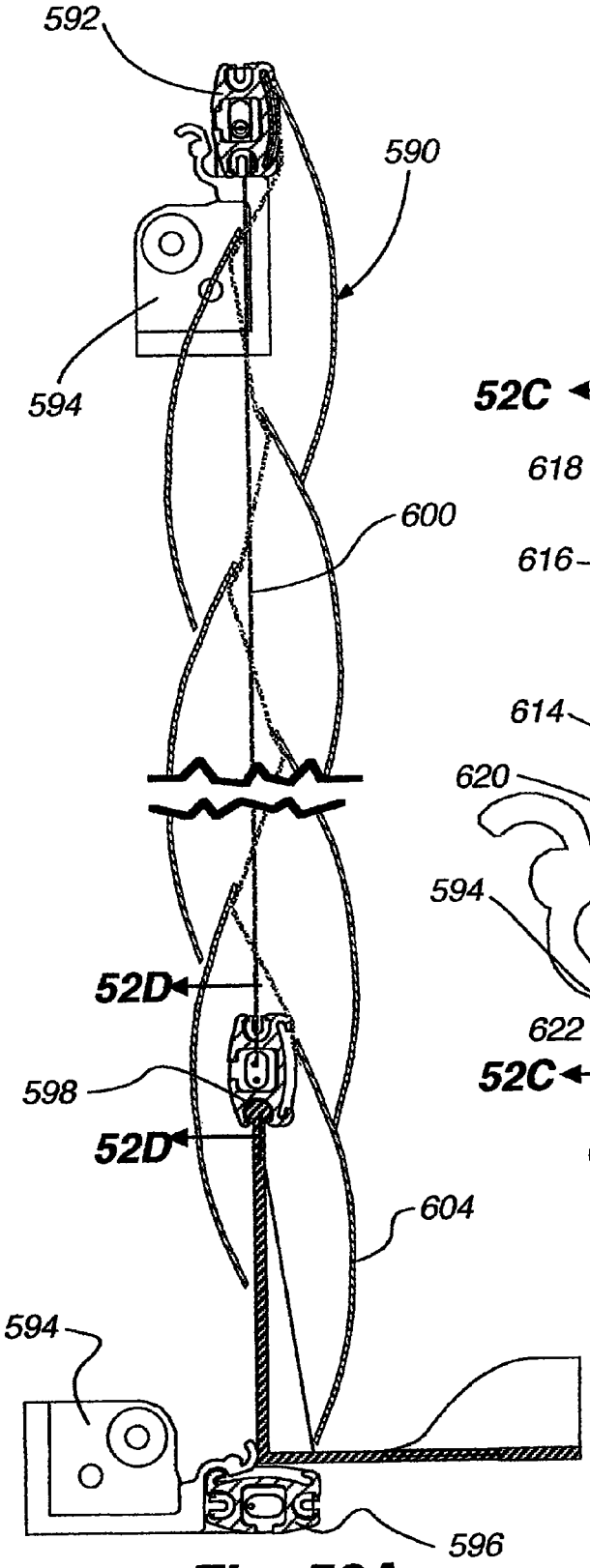

FIG. 52A is an enlarged section taken along line 52A-52A of FIG. 52.

Figure 52B:
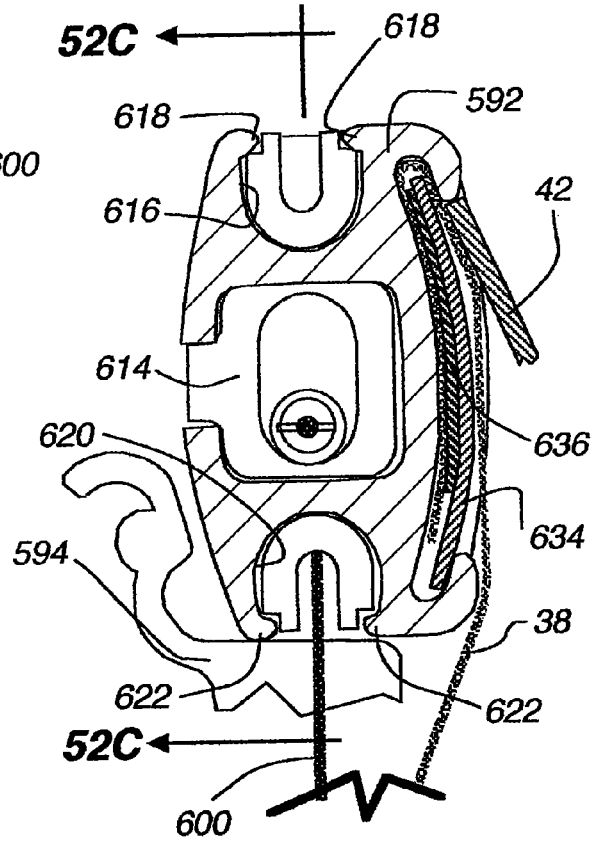

FIG. 52B is an enlarged fragmentary section taken along line 52B-52B of FIG. 52.

Figure 52C:
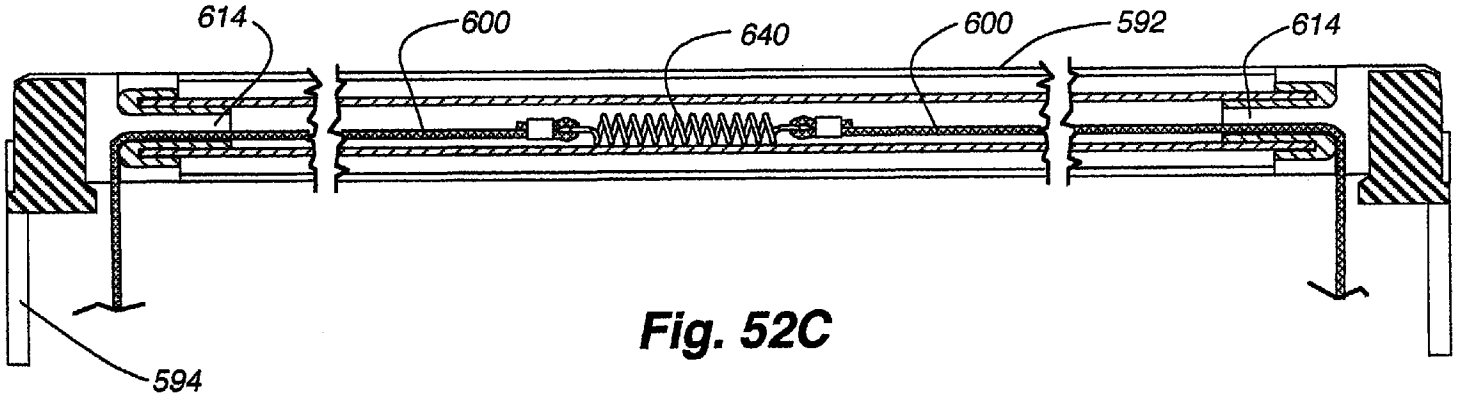

FIG. 52C is a section taken along line 52C-52C of FIG. 52B.

Figure 52D:
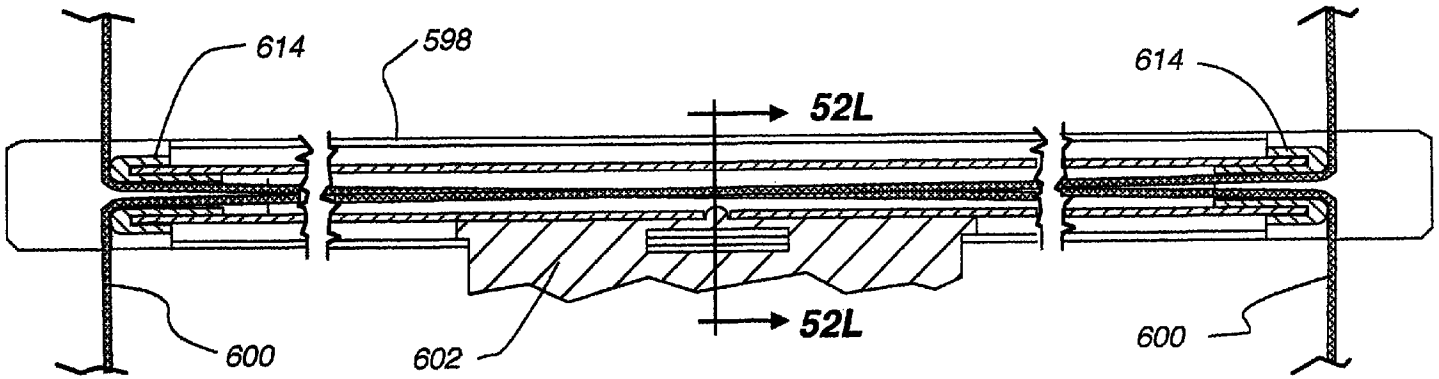

FIG. 52D is a section taken along line 52D-52D of FIG. 52A.

Figure 52E:
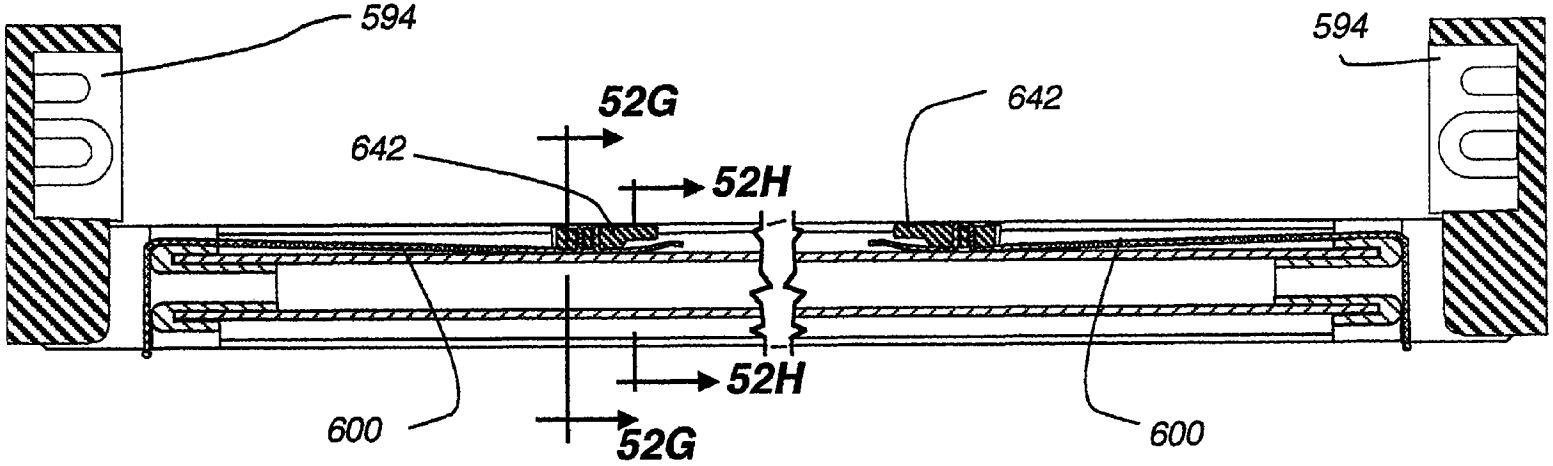

FIG. 52E is a section taken along line 52E-52E of FIG. 52.

Figure 52F:
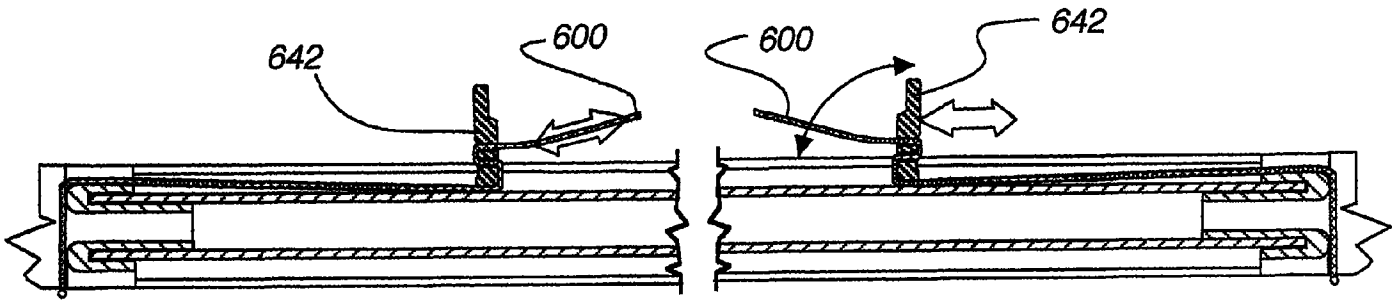

FIG. 52F is a section similar to FIG. 52 showing the clamp fingers in an unlocking position.

Figure 52L:
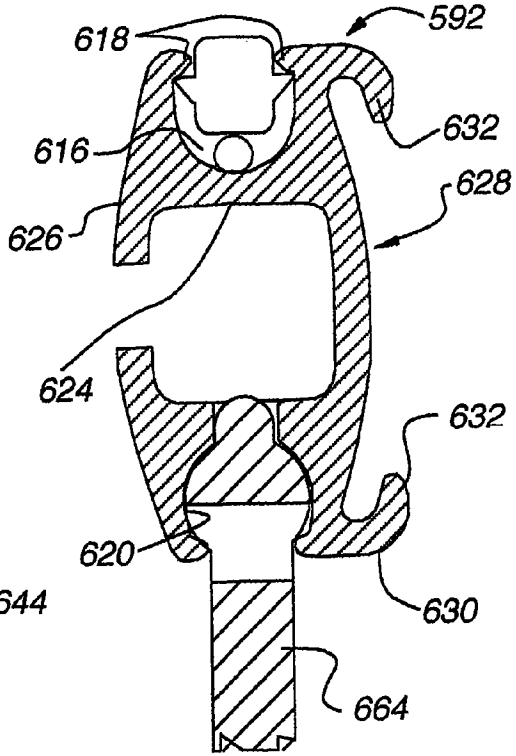
Figure 52J:
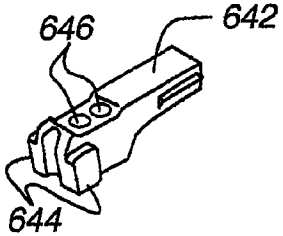
Figure 52K:
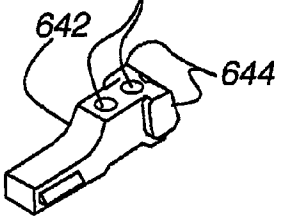
Figure 52H:
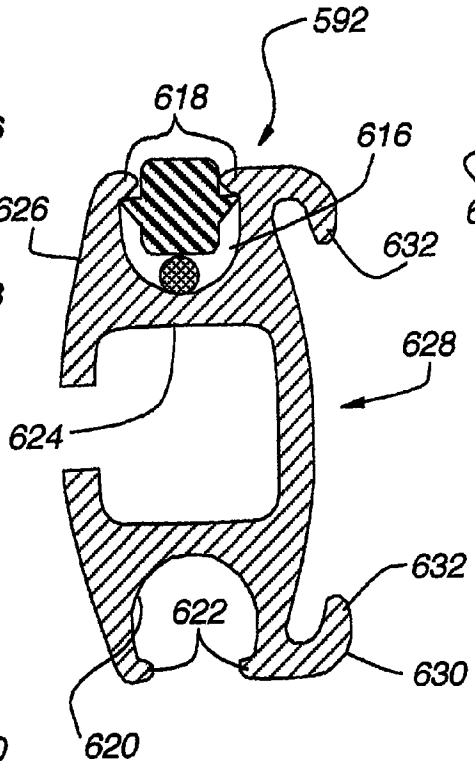
Figure 52G:
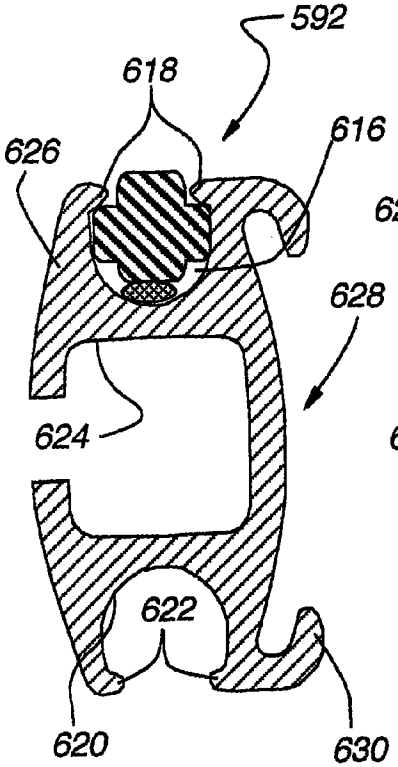

FIG. 52G is an enlarged section taken along line 52G-52G of FIG. 52E.

FIG. 52H is an enlarged section taken along line 52H-52H of FIG. 52E.

FIG. 52J is an isometric looking at the top of a locking finger.

FIG. 52K is an isometric looking at the bottom of the locking finger of FIG. 52J.

FIG. 52L is an enlarged section taken along line 52L-52L of FIG. 52D.

Figure 53:
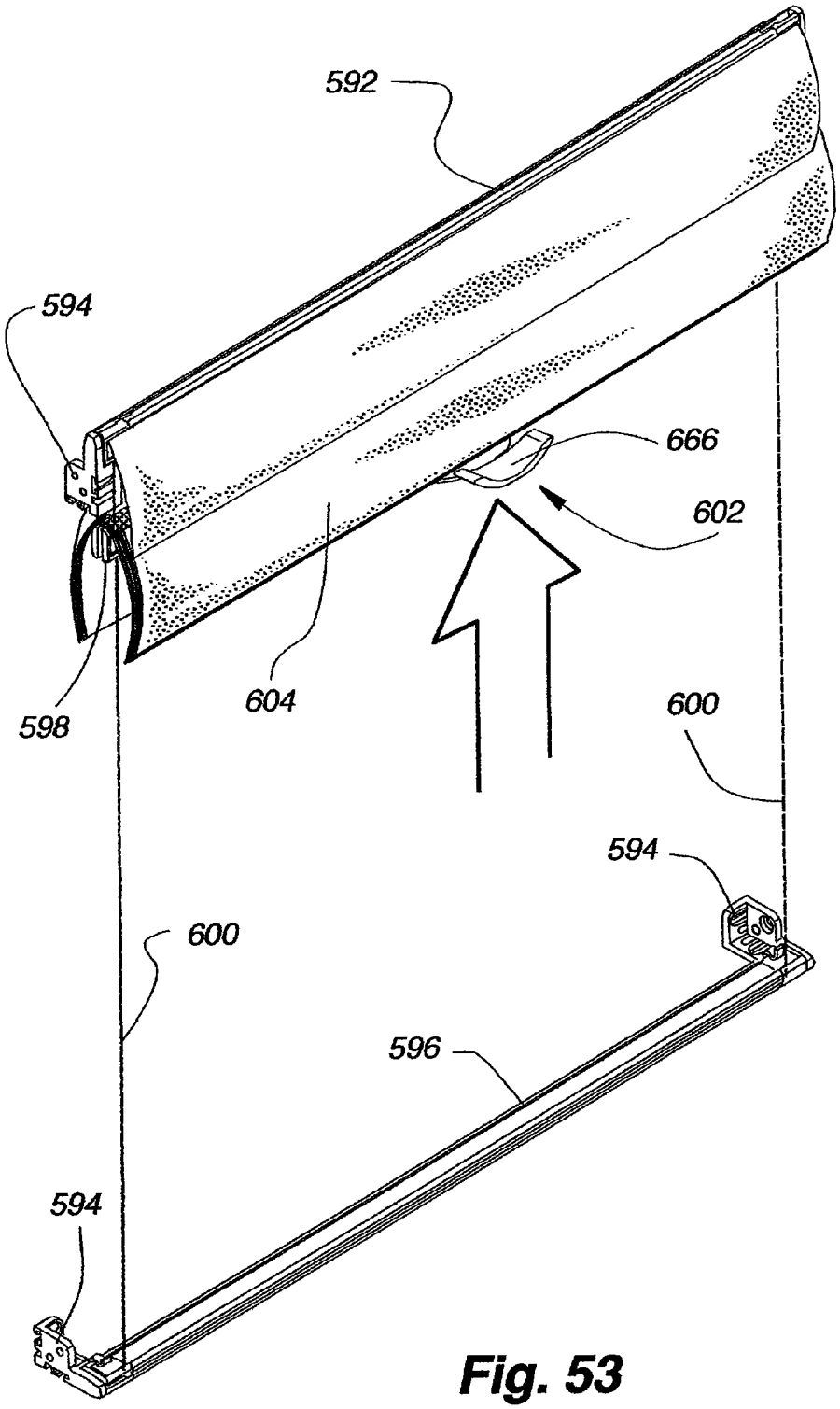

FIG. 53 is an isometric of the shade of FIG. 52 showing the midrail at an elevated position.

Figure 54:
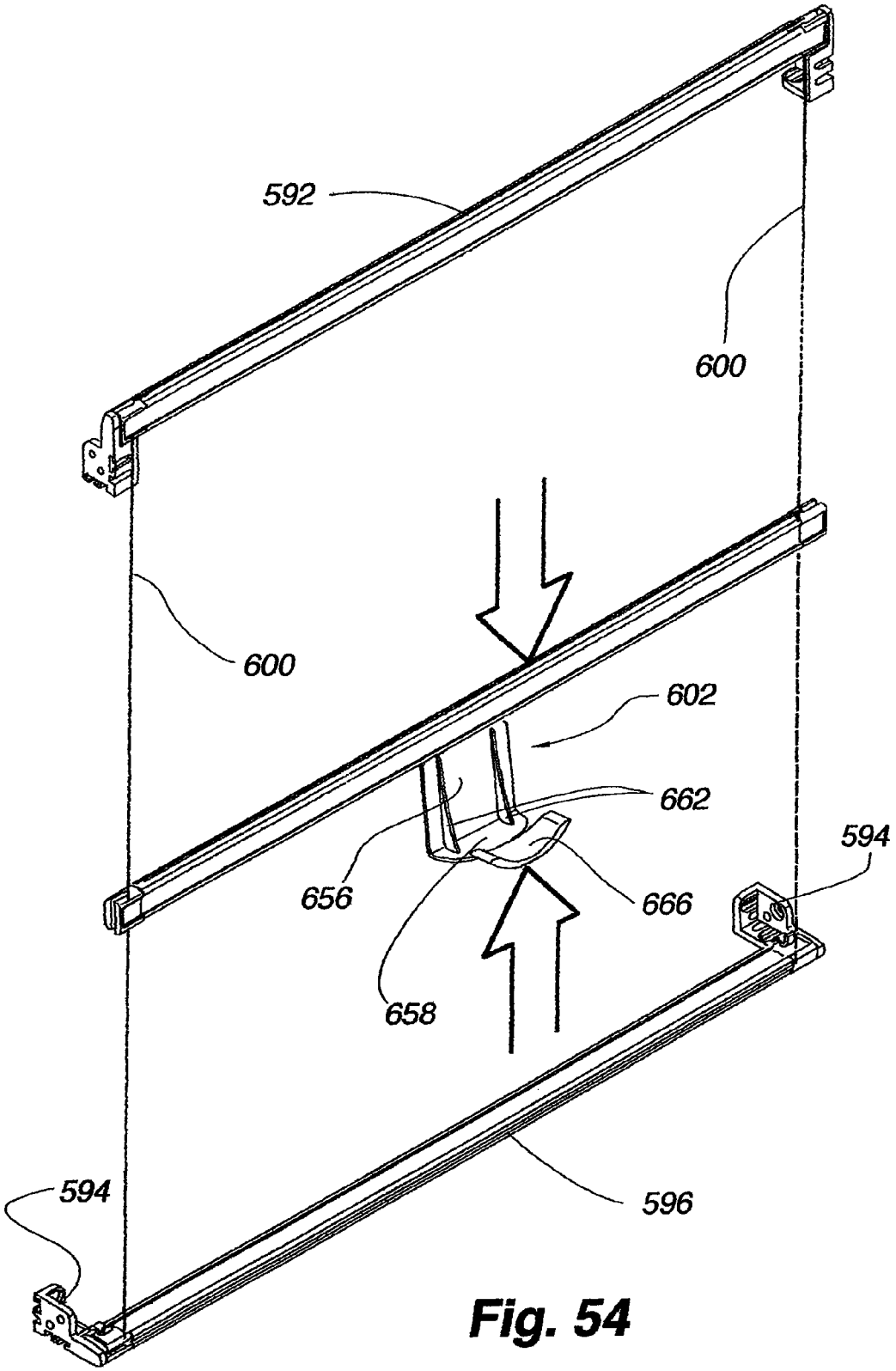

FIG. 54 is a section similar to FIG. 53 with the midrail at an intermediate location and with the fabric removed to show the operating system.

Figure 55:
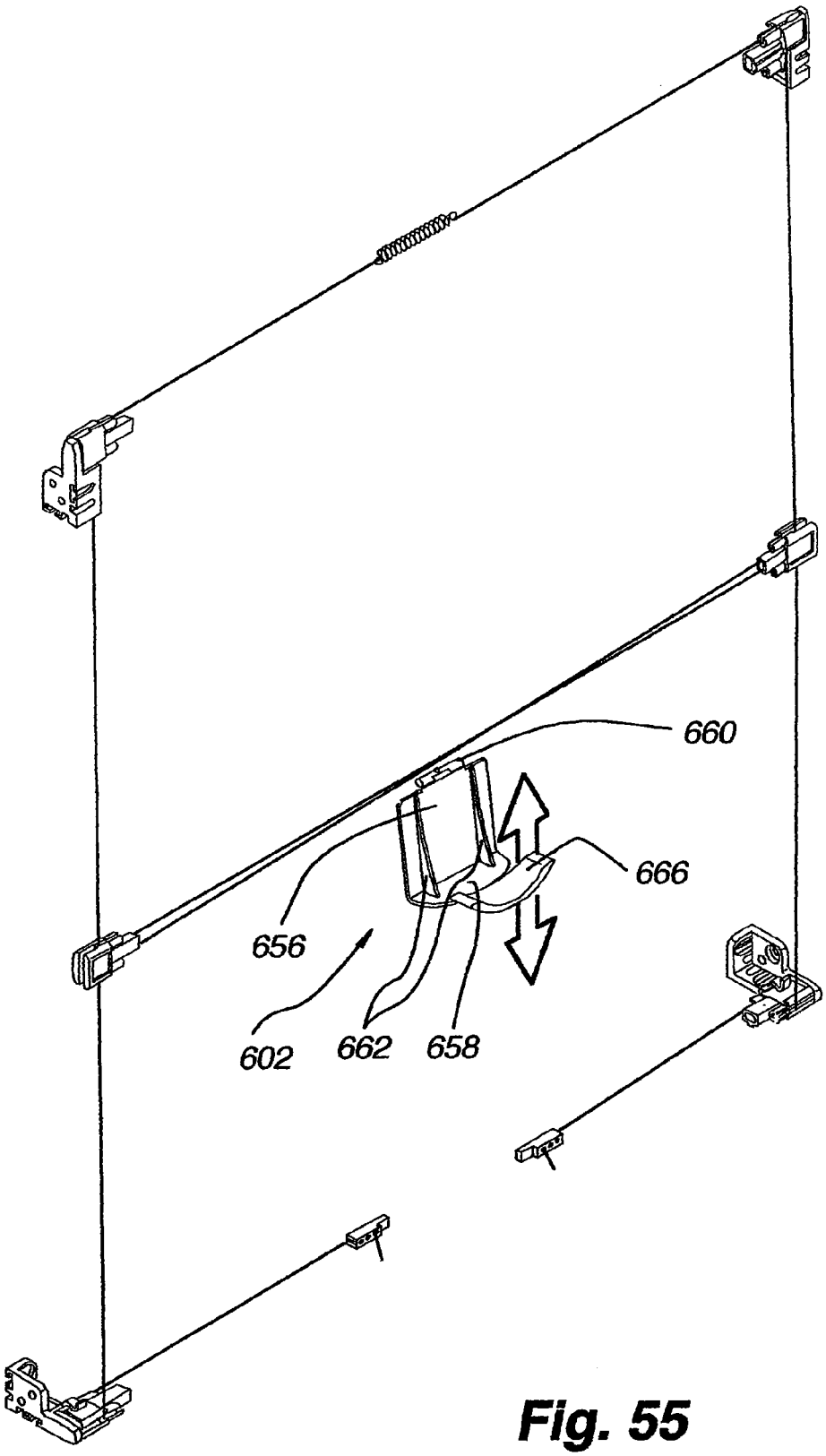

FIG. 55 is an isometric similar to FIG. 54 with the rails removed so as to show more clearly the guide cords for guiding movement of the midrail.

Figure 56:
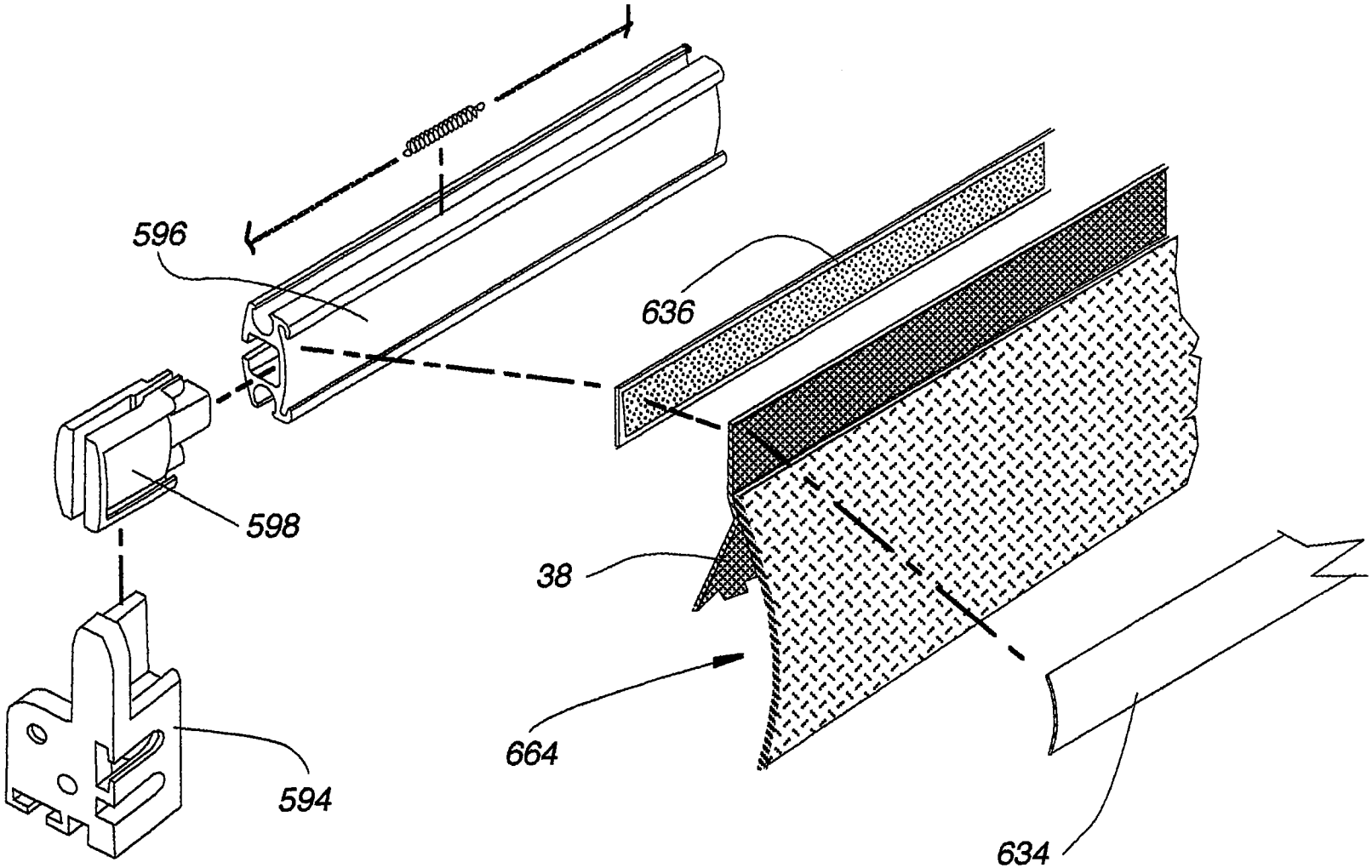

FIG. 56 is an exploded fragmentary isometric showing the interconnection of the top rail with the mounting bracket and the fabric.

Figure 57:
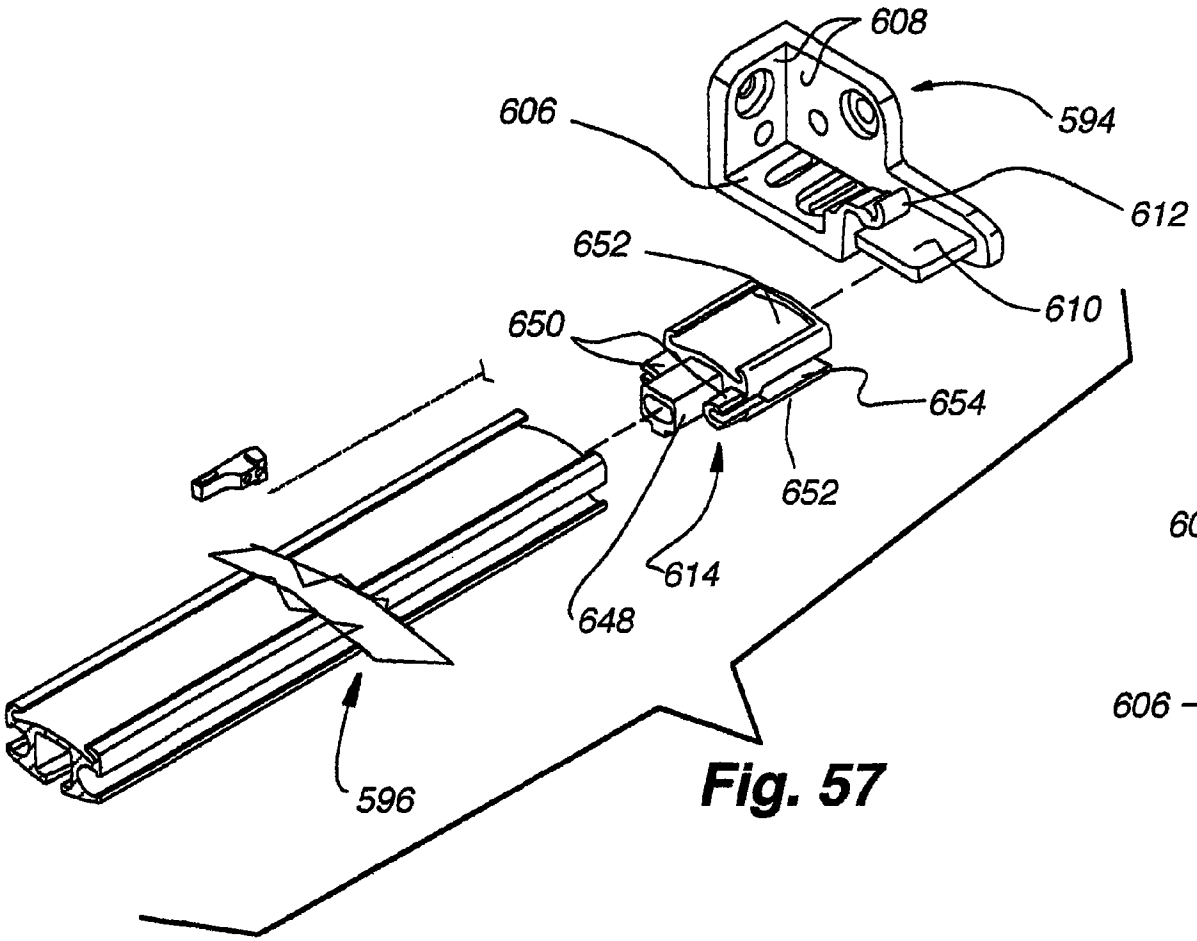

FIG. 57 is a fragmentary isometric showing one end of the bottom rail and its connection to a mounting bracket.

Figure 58:
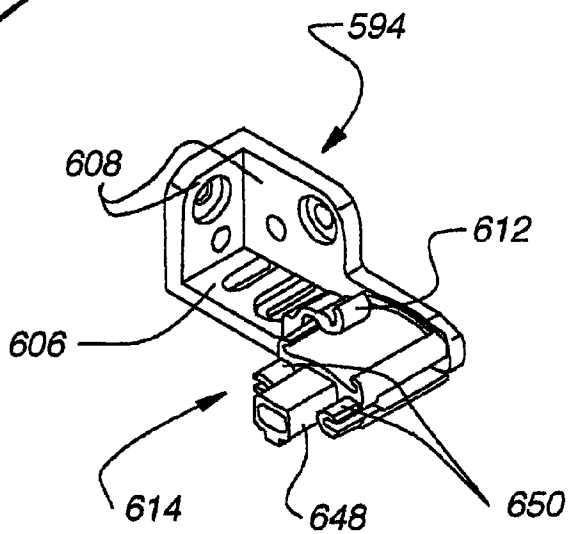

FIG. 58 is a isometric of the interconnection of the bottom rail with a mounting bracket.

Figure 59:
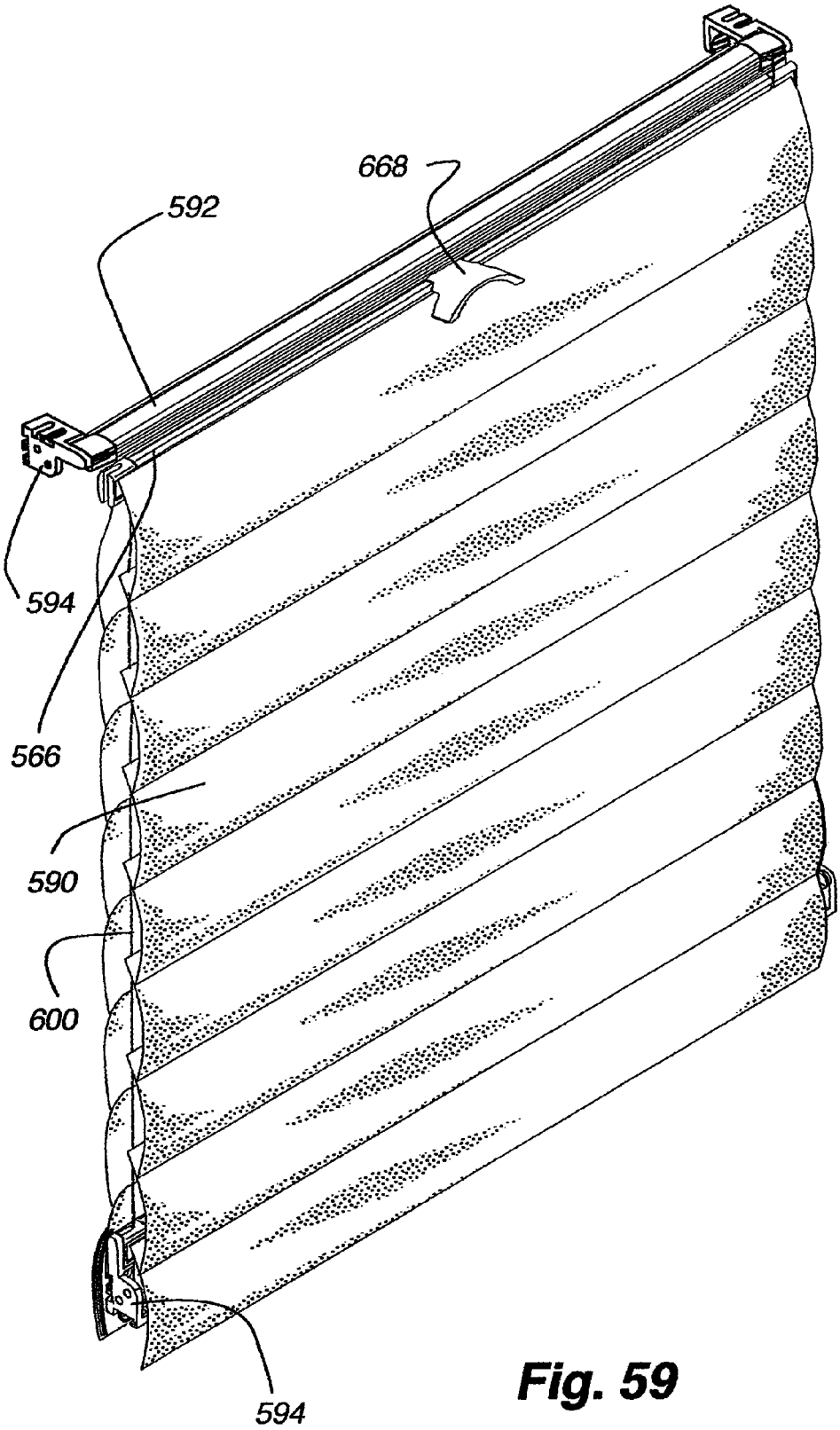

FIG. 59 is an isometric similar to FIG. 52 except where the covering is a top down covering as opposed to a bottom up covering as shown in FIG. 52 and with the midrail in an elevated extended position.

Figure 60:
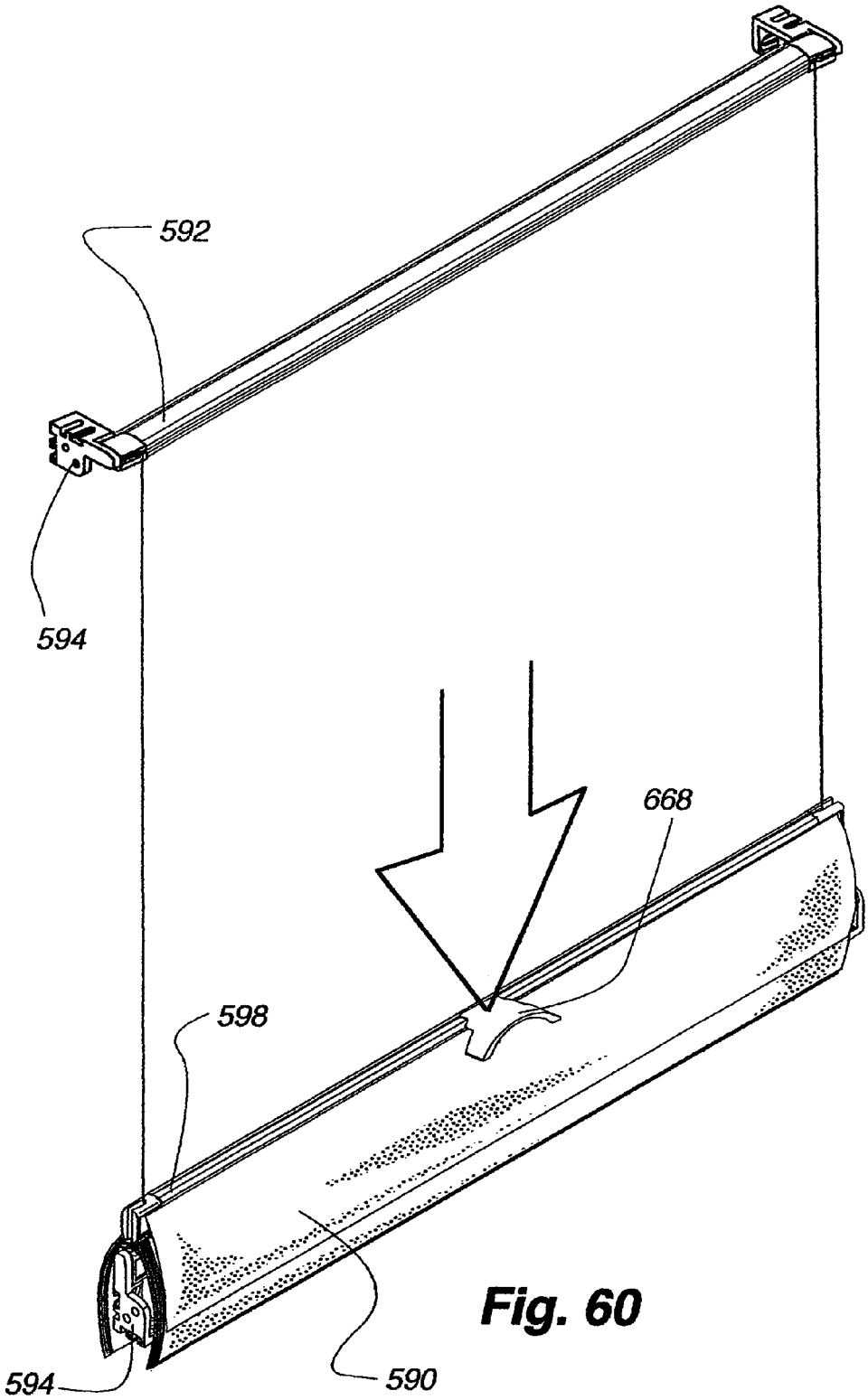

FIG. 60 is an isometric similar to FIG. 59 with the midrail in a lowered extended position.

Figure 61:
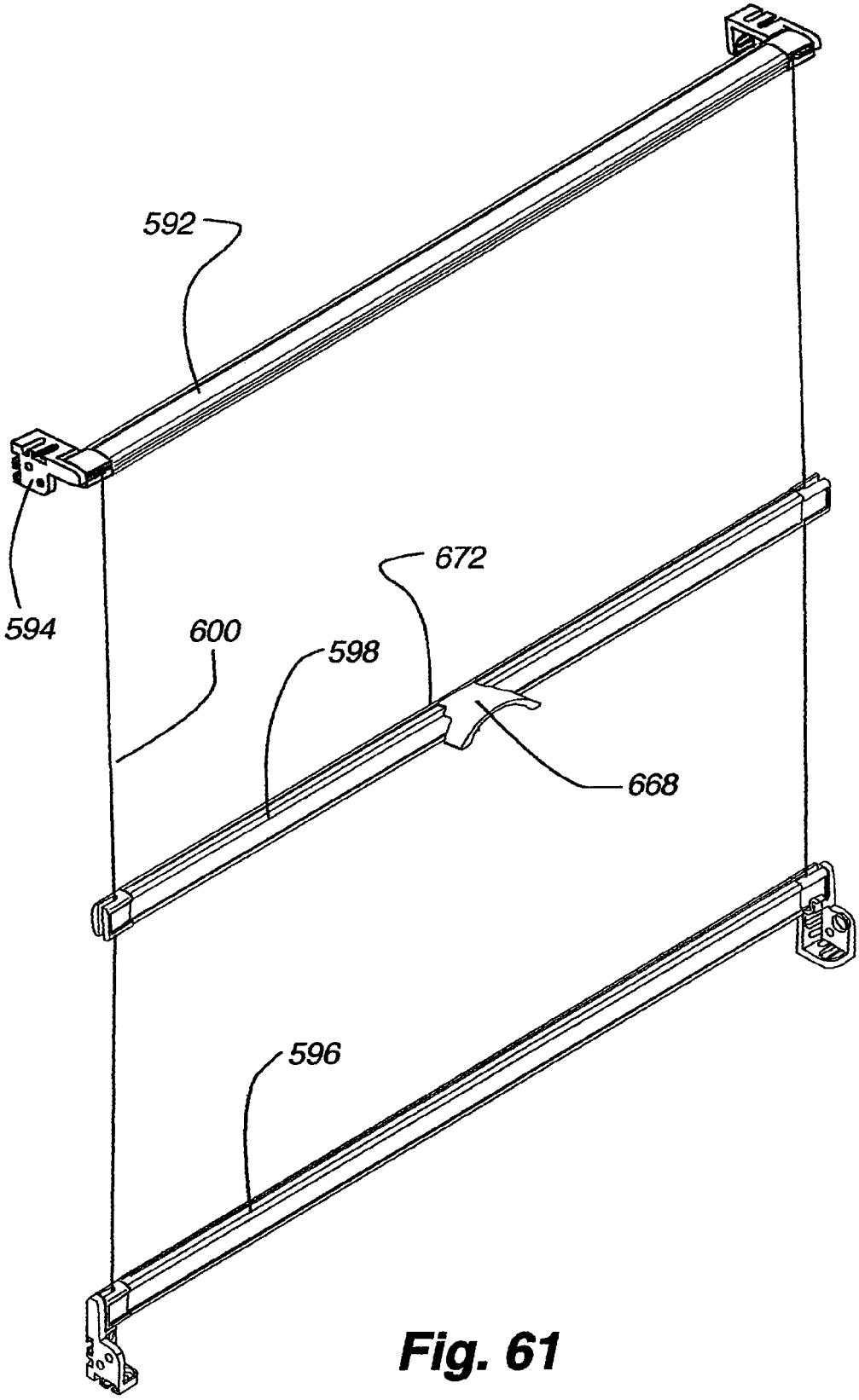

FIG. 61 is an isometric of the shade of FIG. 59 with the fabric removed to show the control system.

Figure 62:
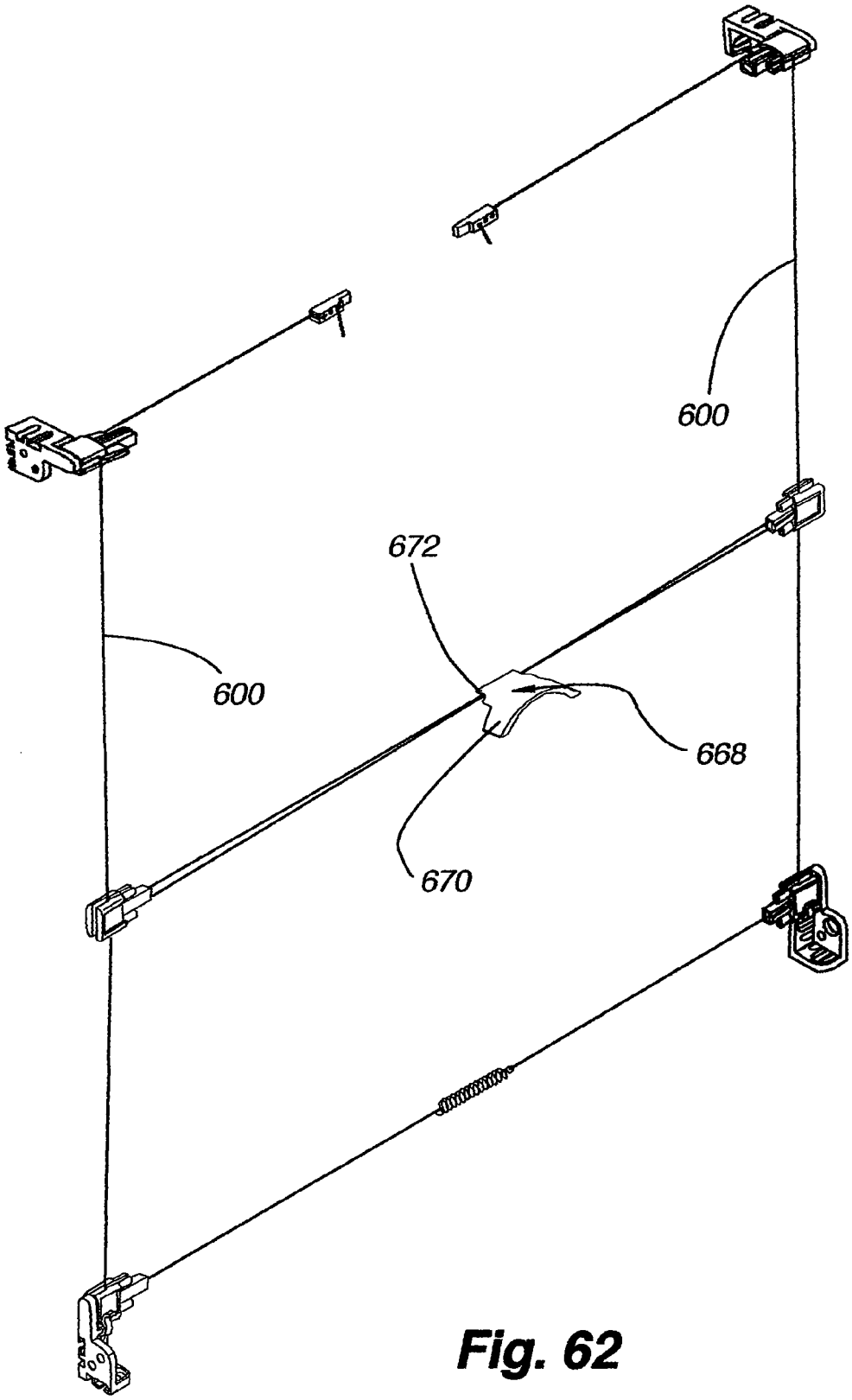

FIG. 62 is an isometric similar to FIG. 51 with the rails also removed so as to show the guide cord system.

Figure 63:
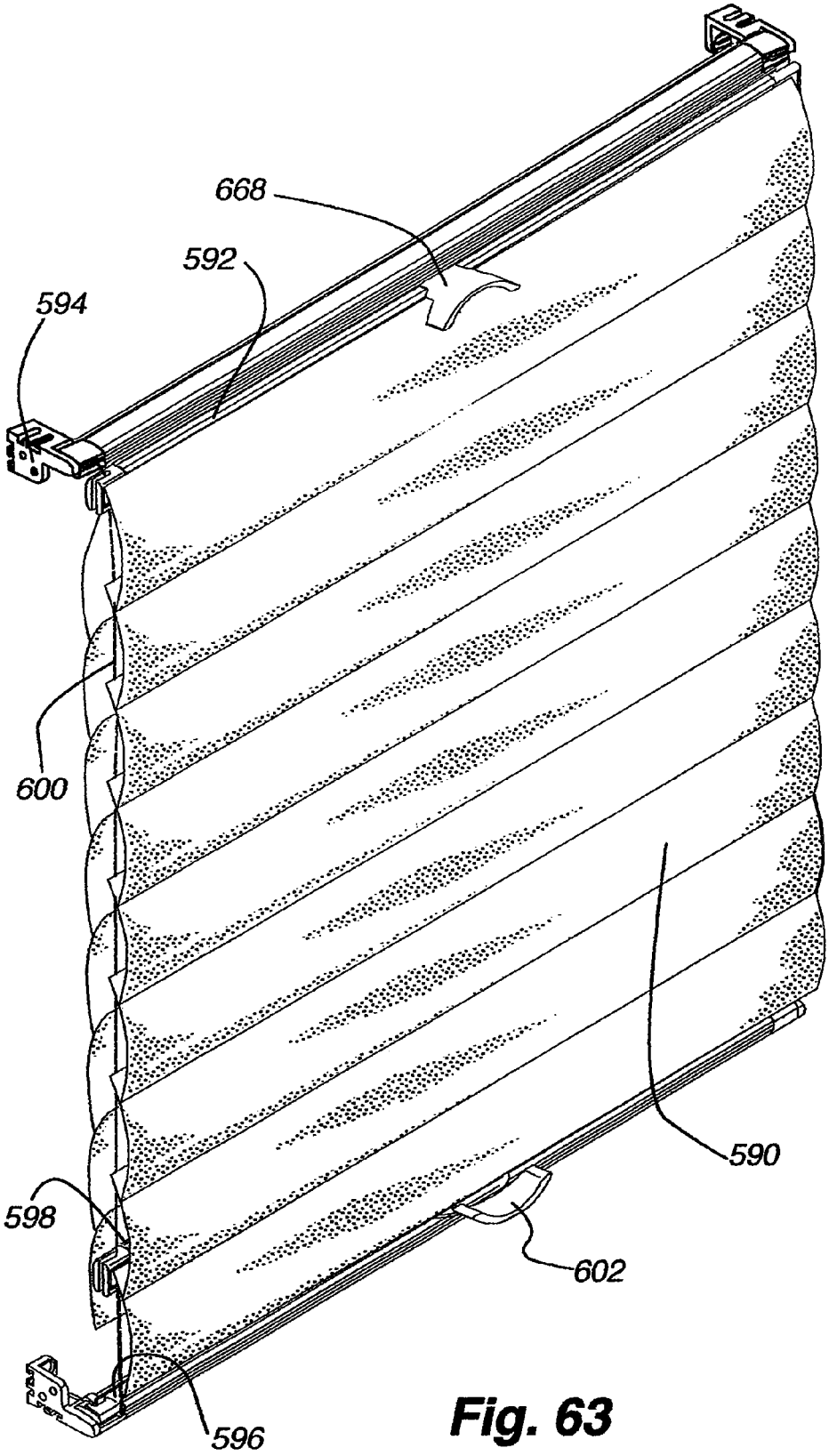

FIG. 63 is an isometric of a shade similar to FIG. 52 wherein there are upper and lower midrails for a top down/bottom up covering and wherein the covering is in a fully extended position.

Figure 64:
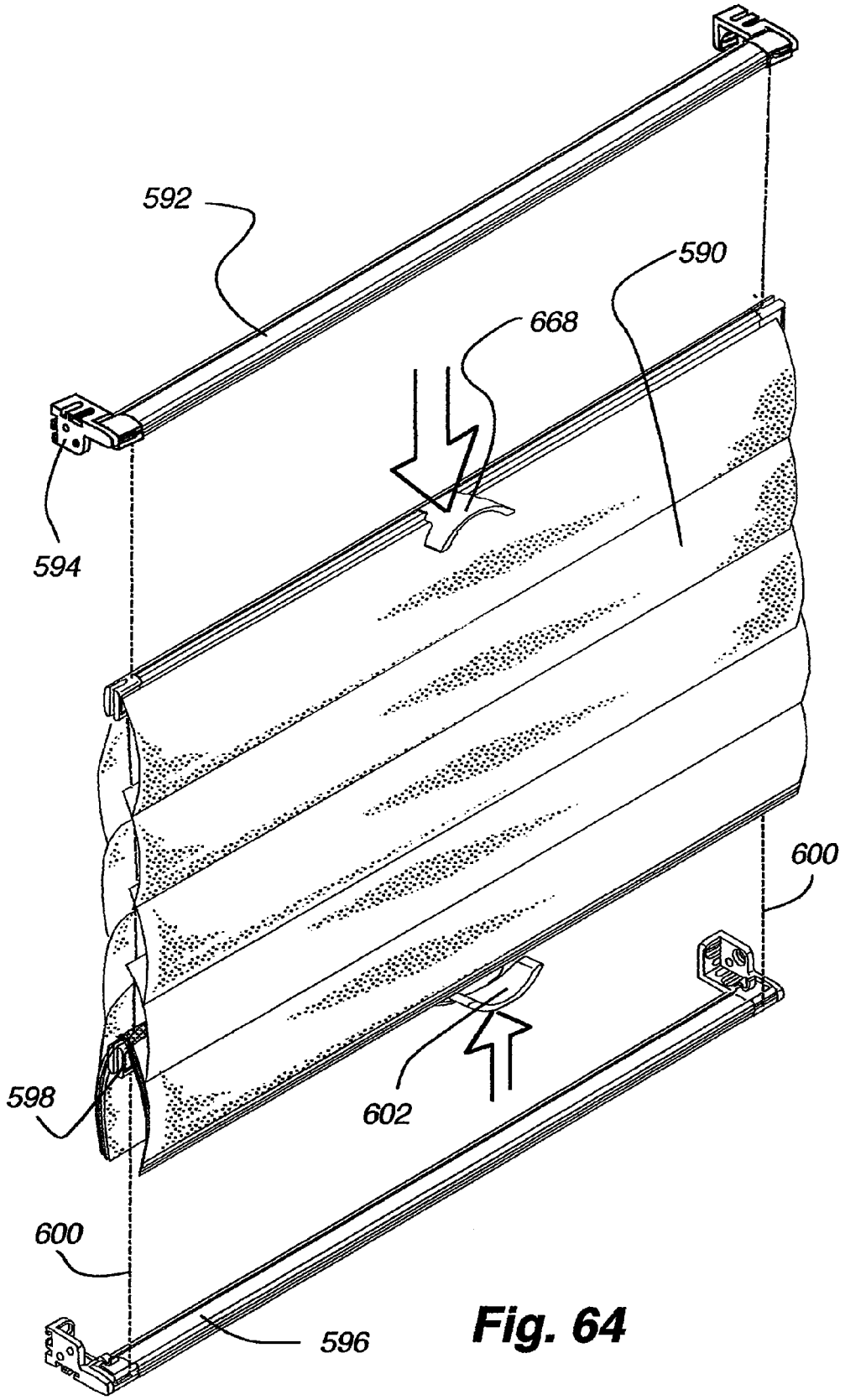

FIG. 64 is an isometric of the covering of FIG. 63 with the upper midrail having been dropped and the lower midrail raised into intermediate positions.

Figure 65:
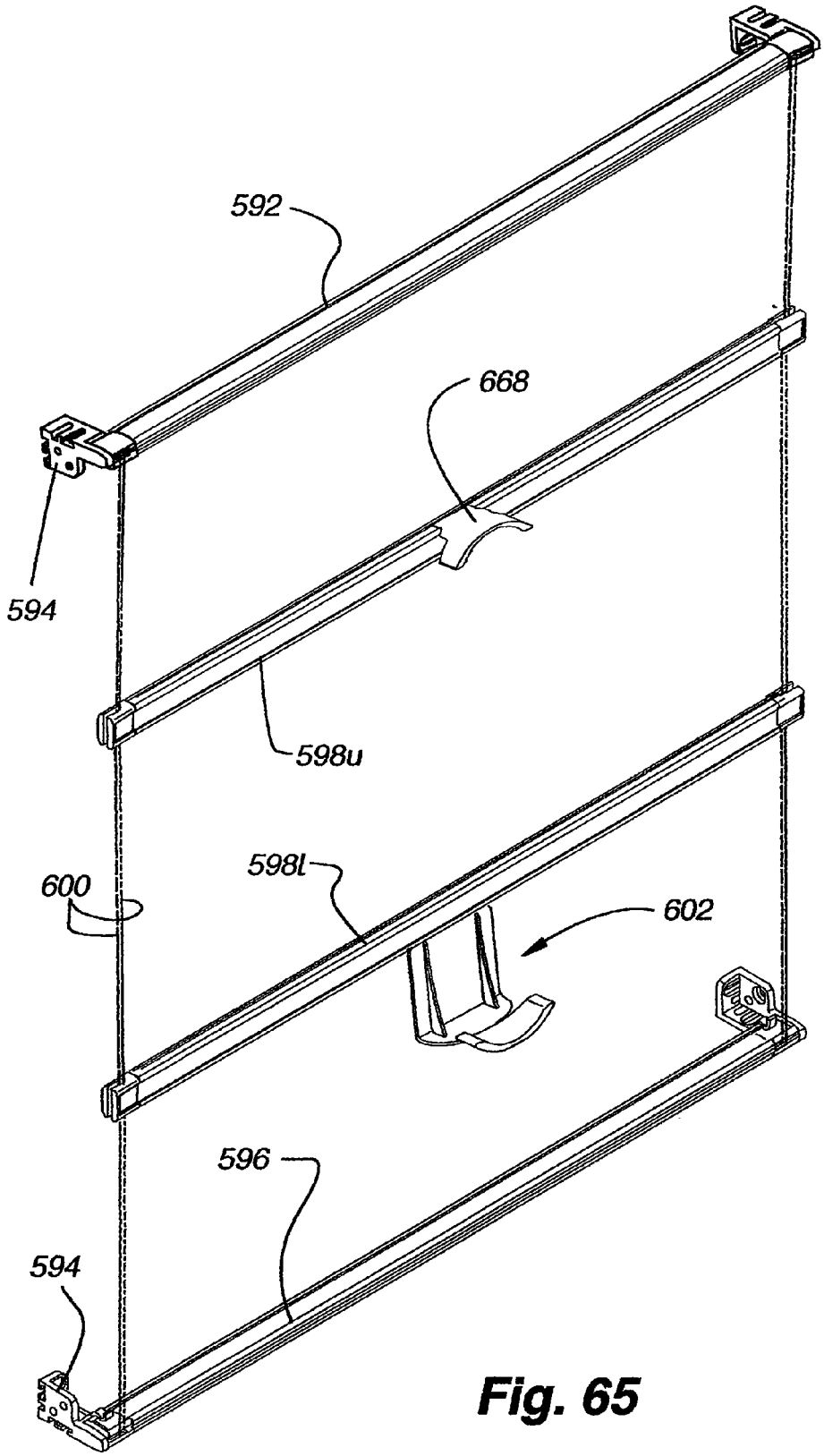

FIG. 65 is an isometric similar to FIG. 64 with the fabric material removed.

Figure 66:
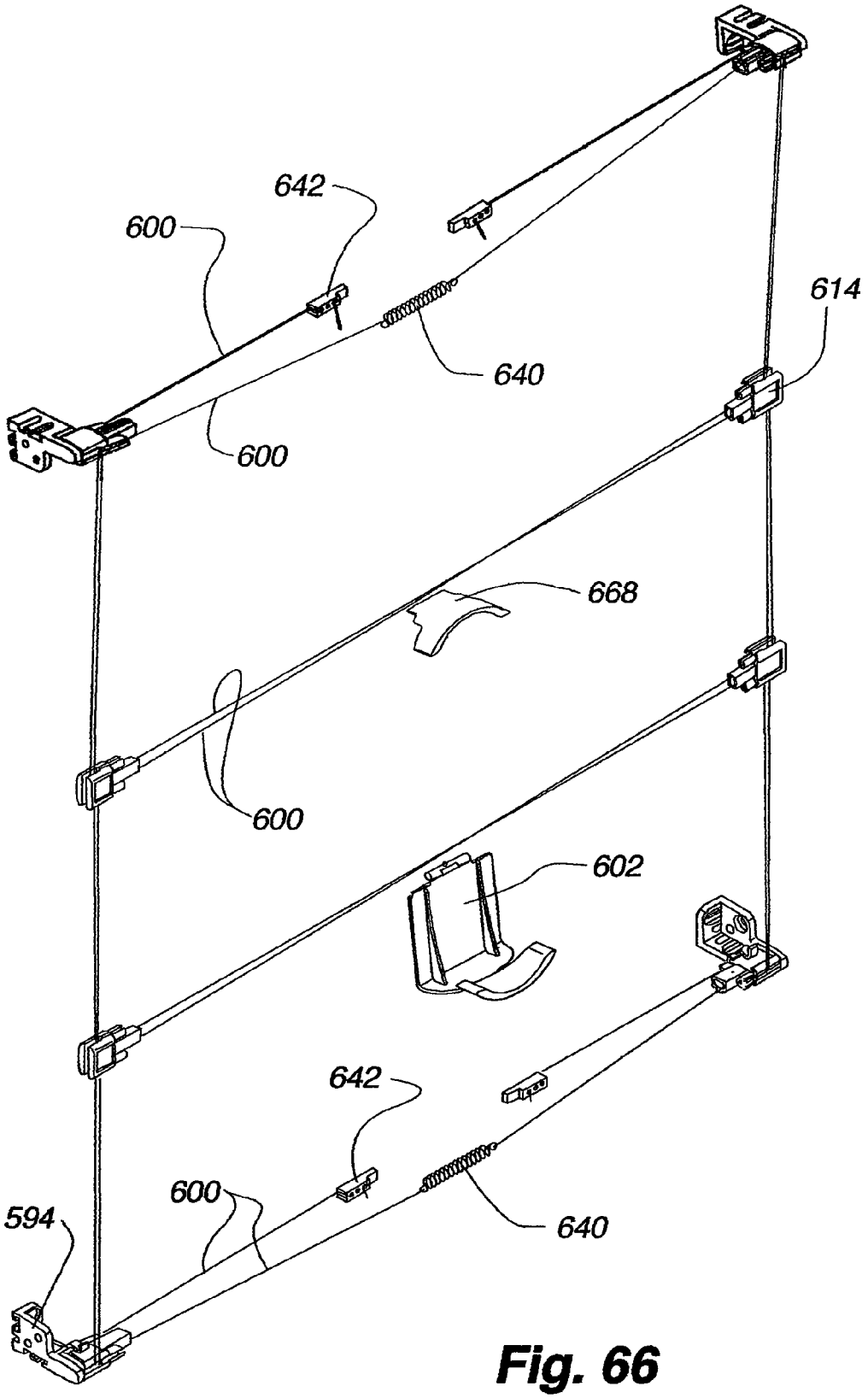

FIG. 66 is an isometric similar to FIG. 65 with the rails removed so as to show the guide cords.

Figure 67:
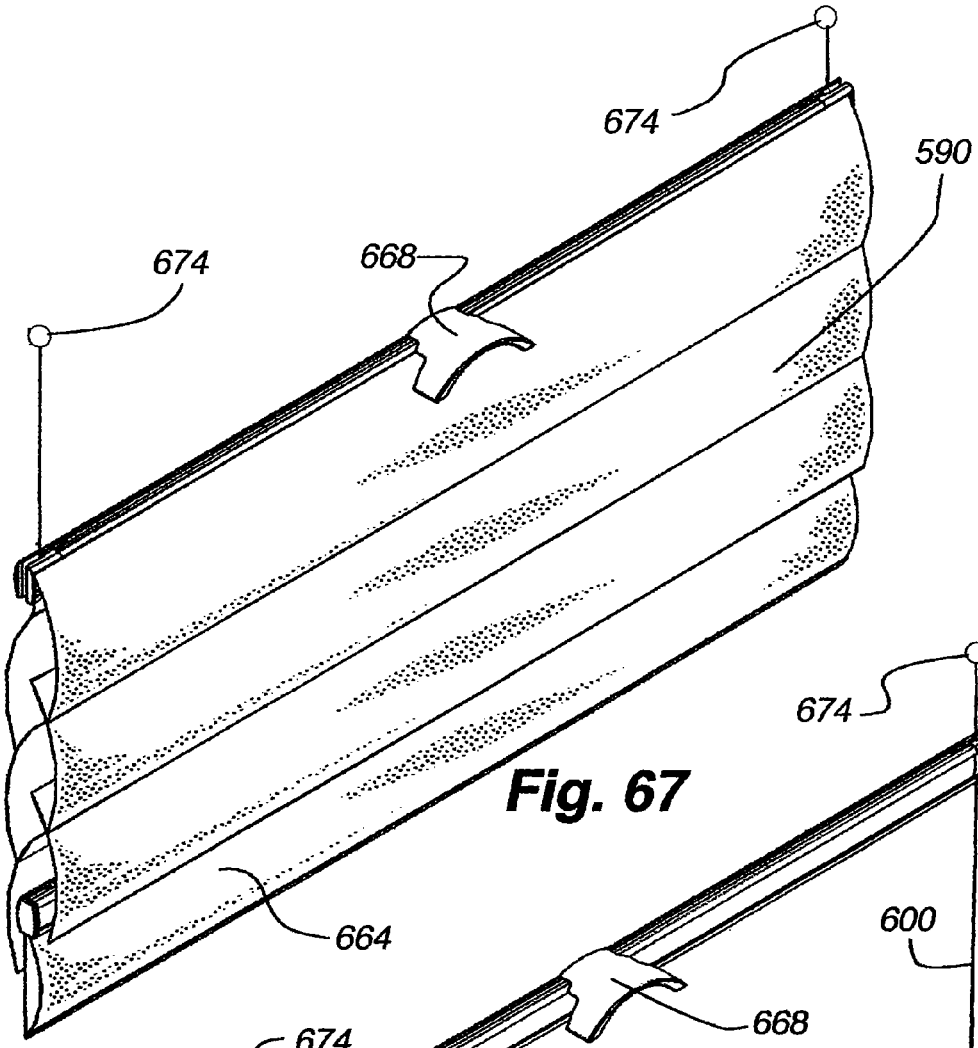

FIG. 67 is an isometric of a further embodiment of the covering of FIG. 52 wherein the covering is a top down covering and the bottom rail supports a dummy vane.

Figure 68:
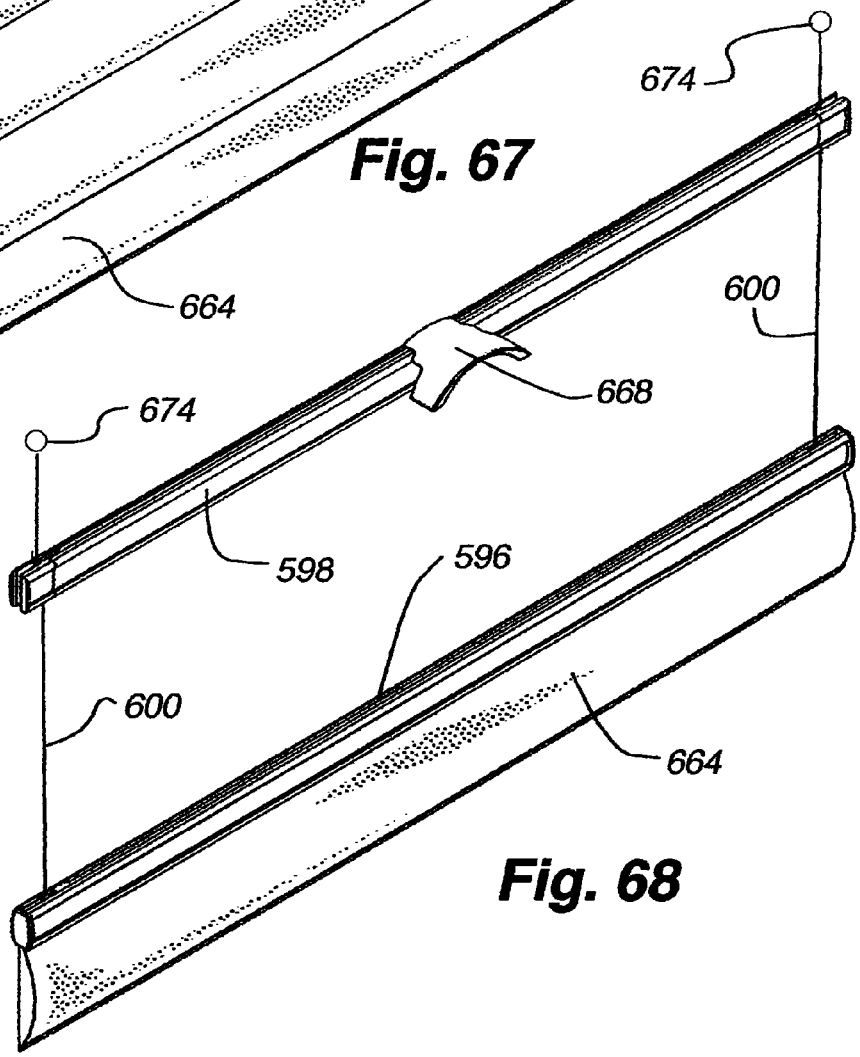

FIG. 68 is an isometric similar to FIG. 67 with the fabric having been removed.

Figure 69:
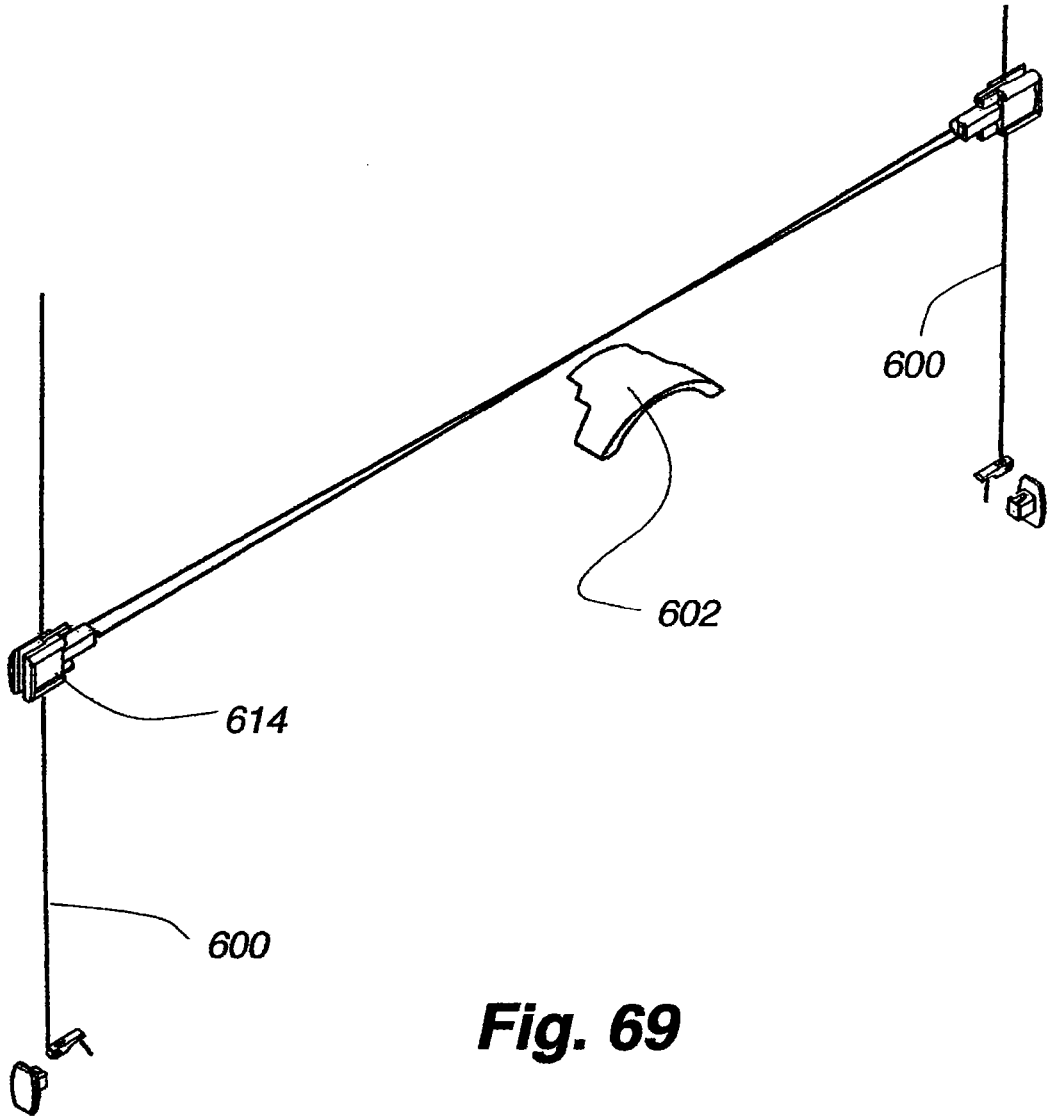

FIG. 69 is an isometric similar to FIG. 68 with the rails having also been removed.

Figure 70:
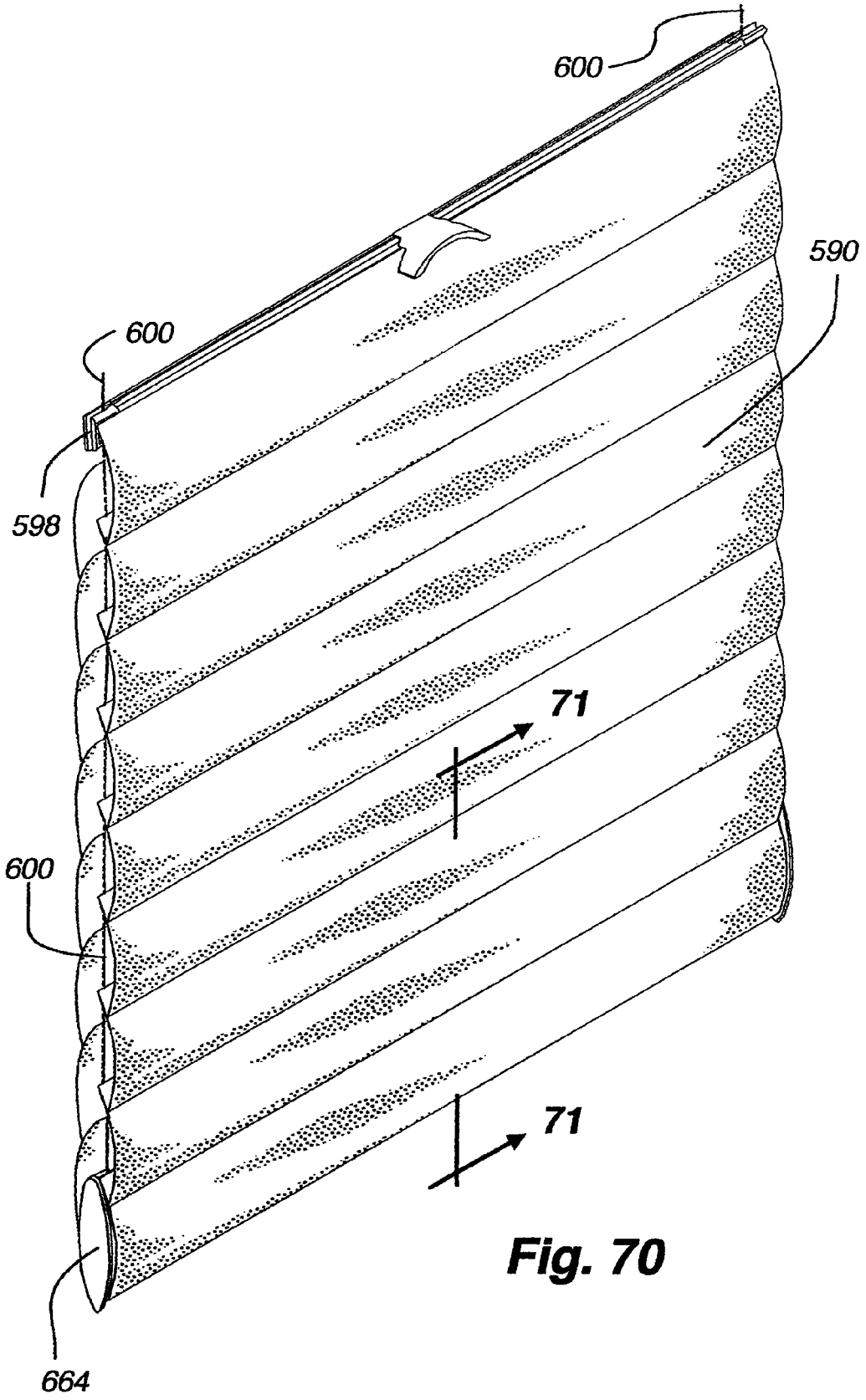

FIG. 70 is an isometric of a further embodiment consistent with the present invention wherein guide cords are suspended in an architectural opening and a fabric is mounted on the guide cords having a weighted bottom vane and a movable top rail.

Figure 71:
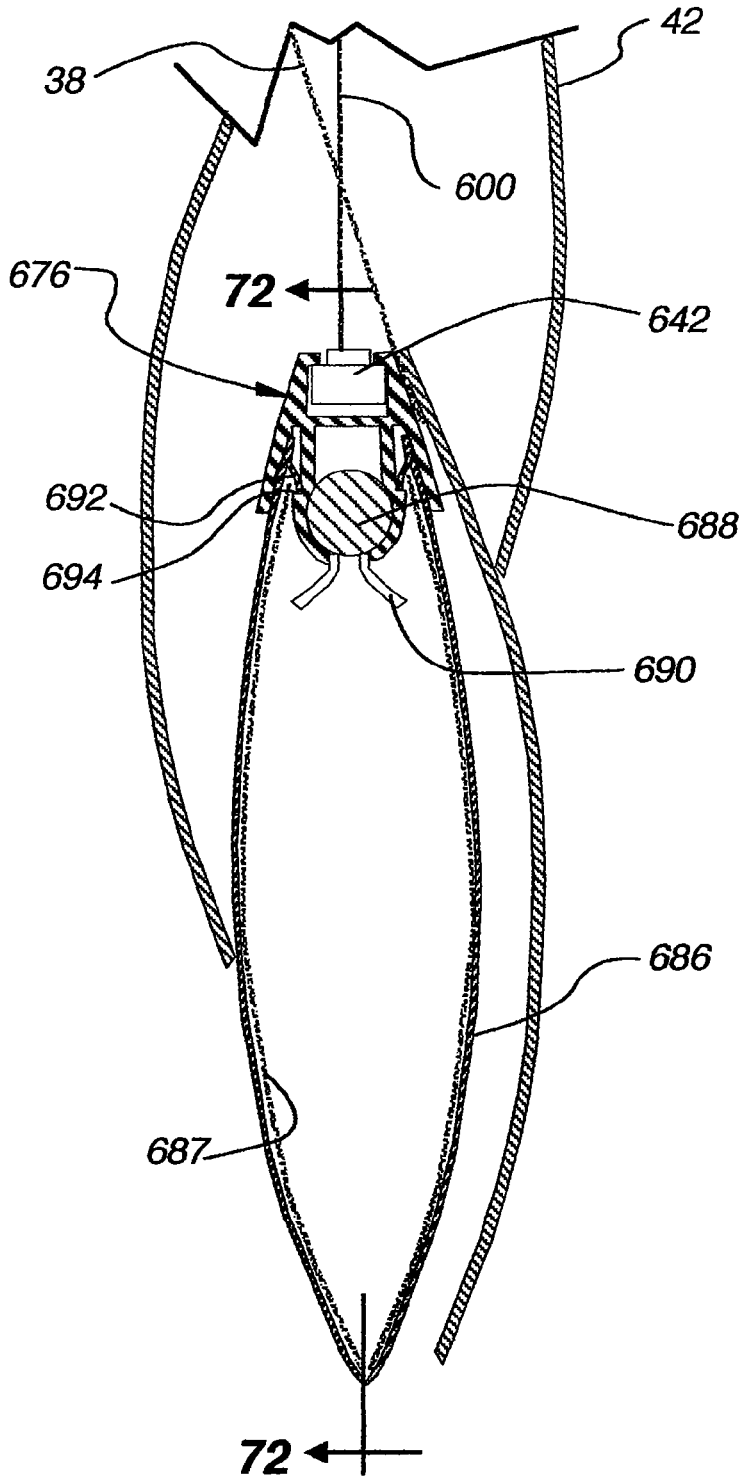

FIG. 71 is an enlarged section taken along line 71-71 of FIG. 70.

Figure 72:
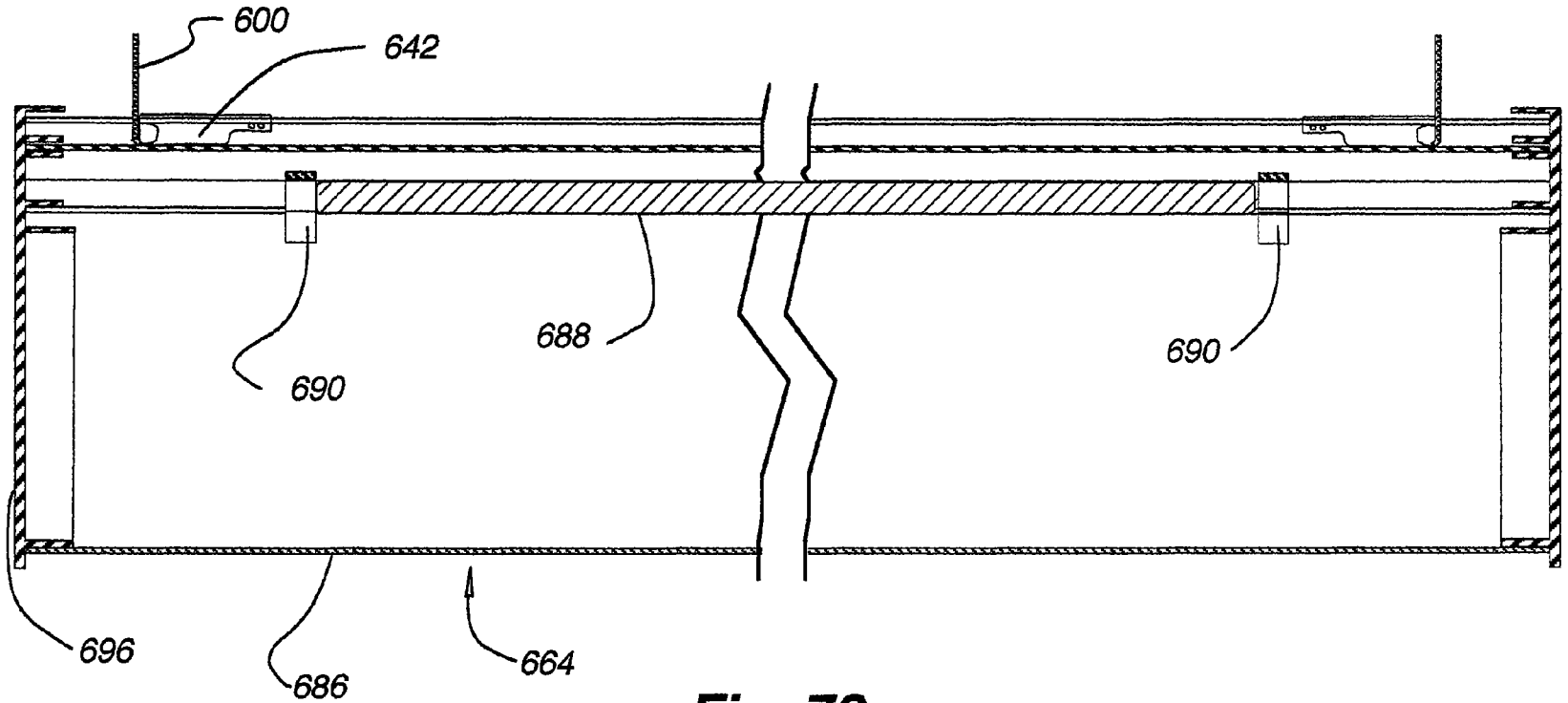

FIG. 72 is a section taken along line 72-72 of FIG. 71.

Figure 73A:
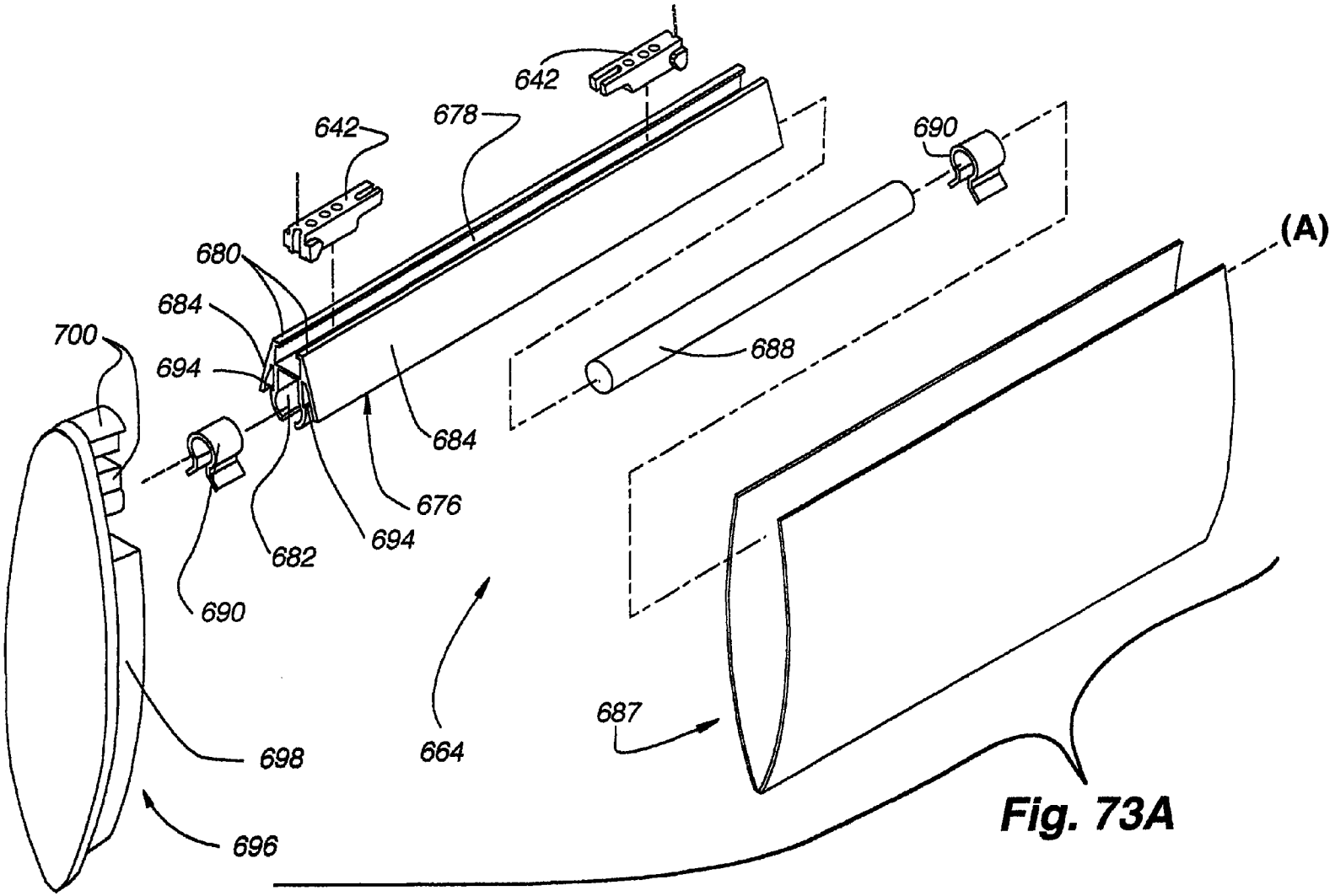

FIG. 73A is an exploded isometric showing the weighted bottom vane for the covering shown in FIG. 70.

Figure 73B:
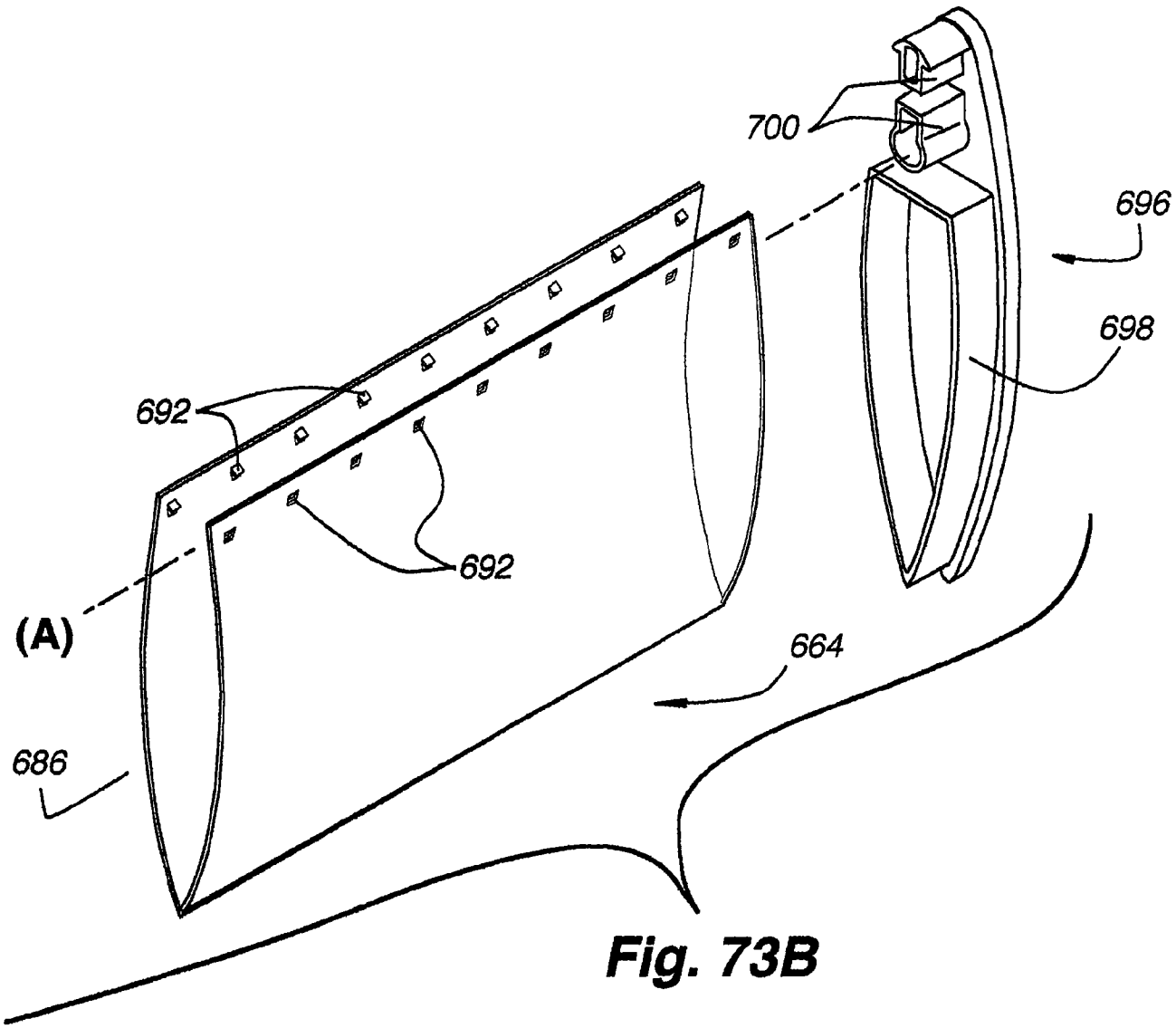

FIG. 73B is an exploded isometric showing the opposite end of the vane from that shown in FIG. 73A.

Figure 74:
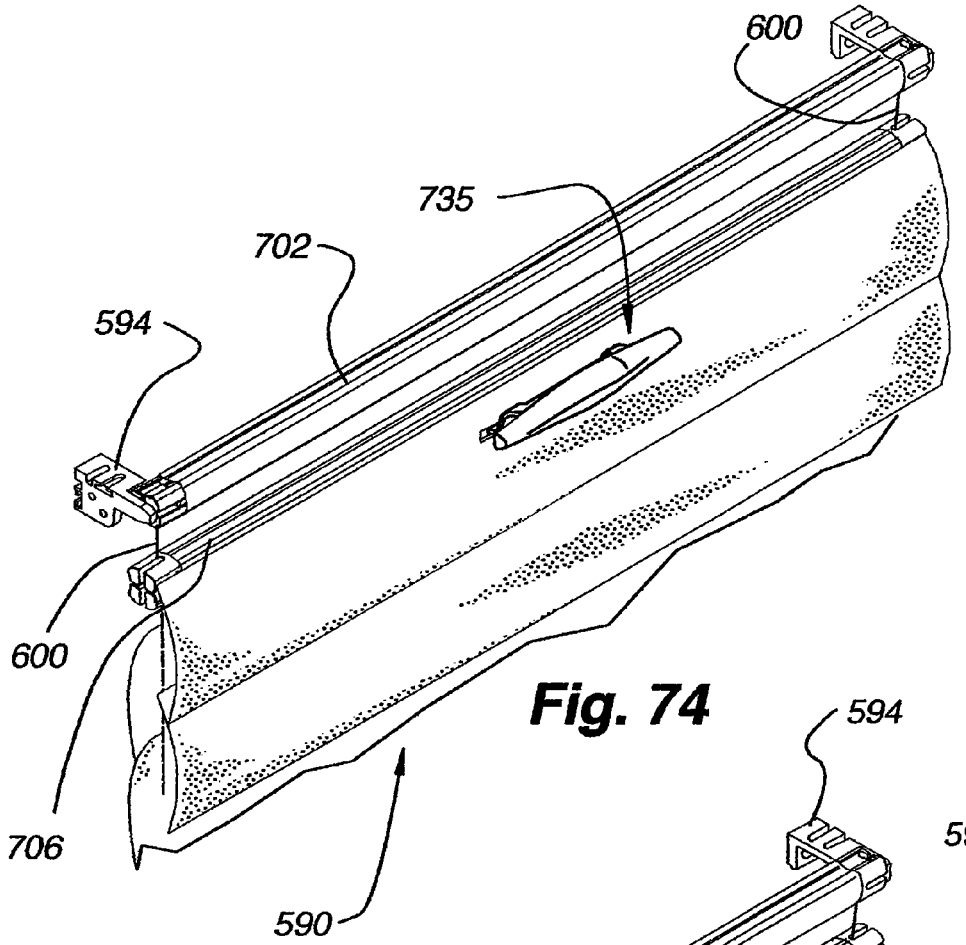

FIG. 74 is a fragmentary isometric of a top-down version of a further embodiment similar to that illustrated in FIGS. 52-73B.

Figure 75:
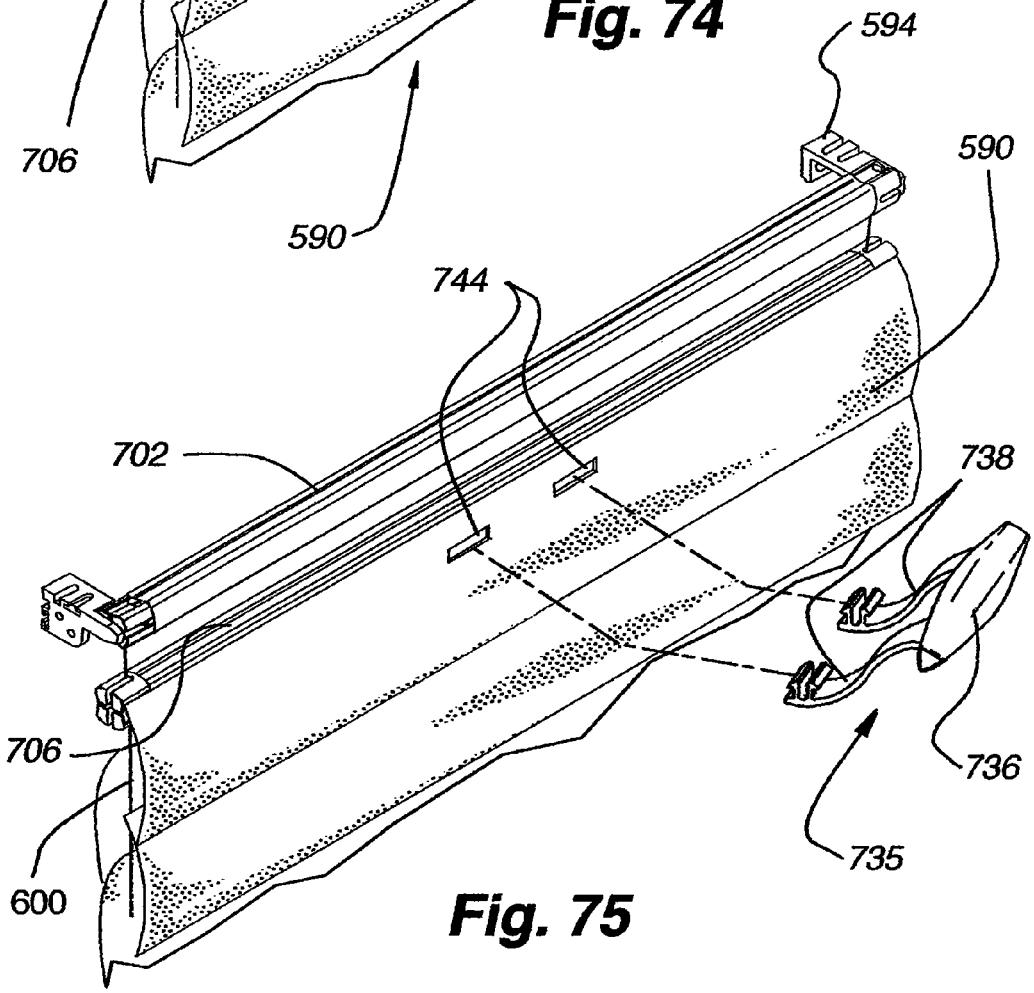

FIG. 75 is a fragmentary isometric similar to FIG. 74 with the handle for moving the shade shown exploded.

Figure 76:
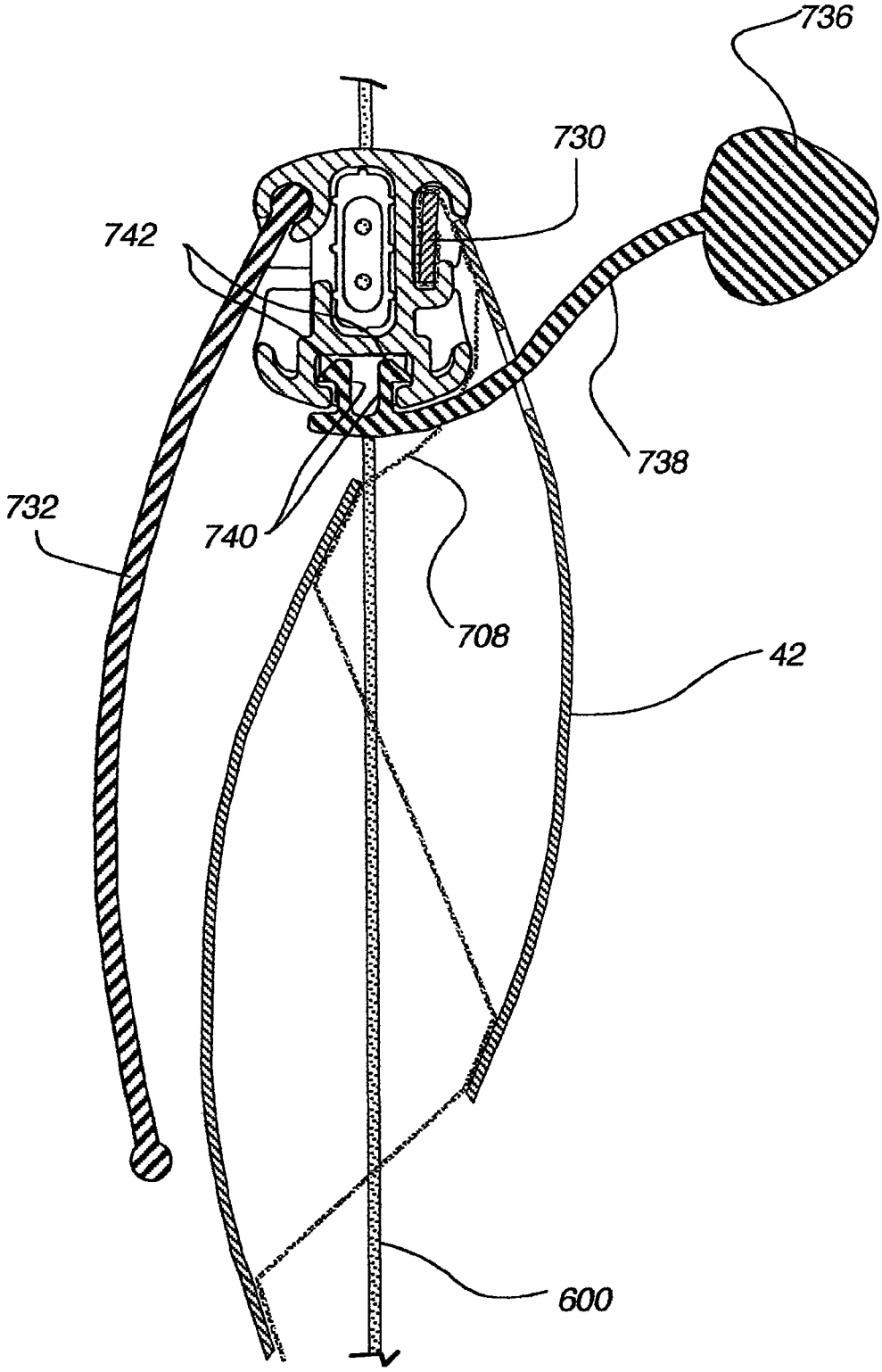

FIG. 76 is a fragmentary vertical section taken through the shade as shown in FIG. 74.

Figure 77:
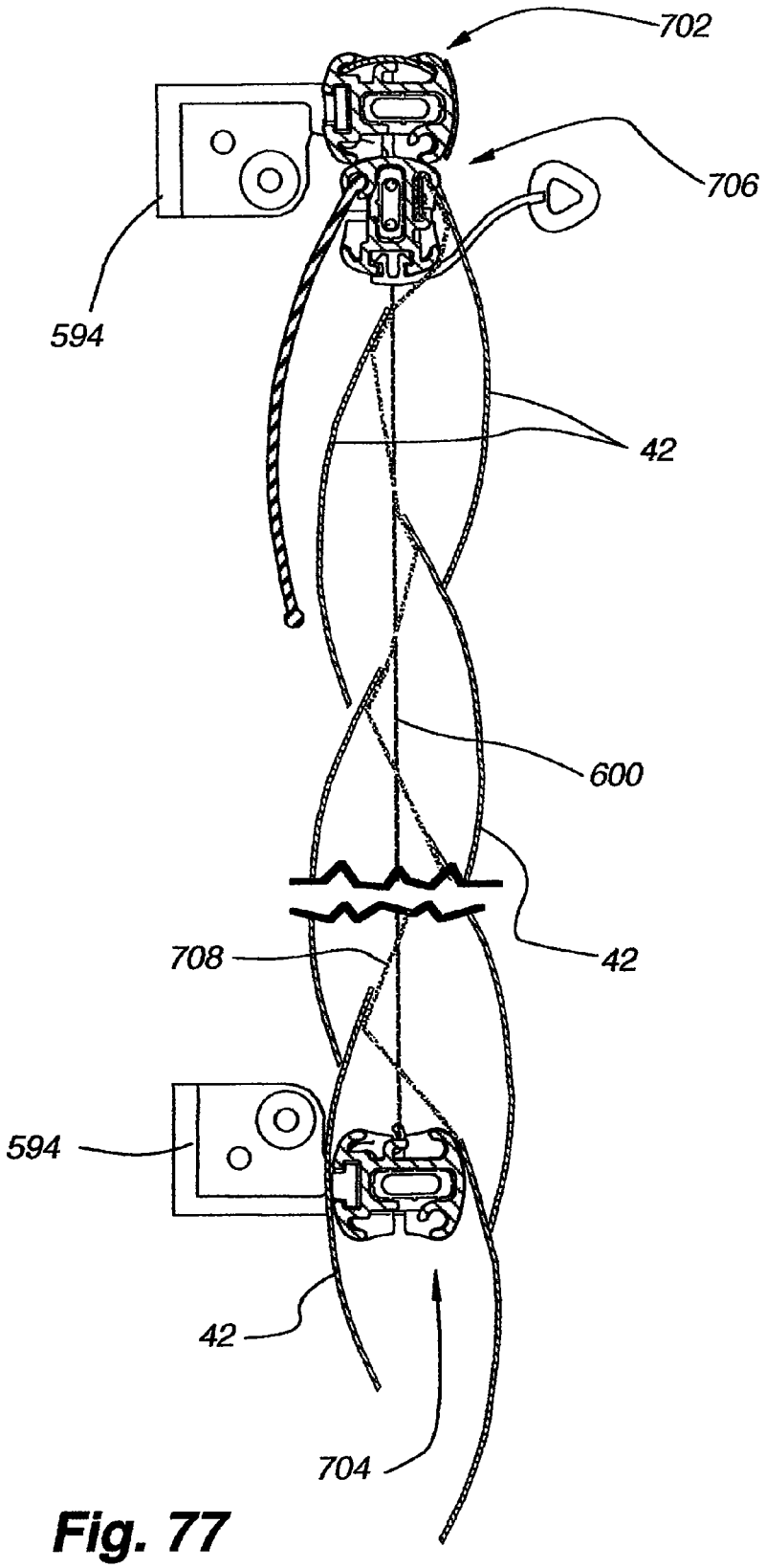

FIG. 77 is a vertical section with parts removed taken through the shade of FIG. 74.

Figure 78:
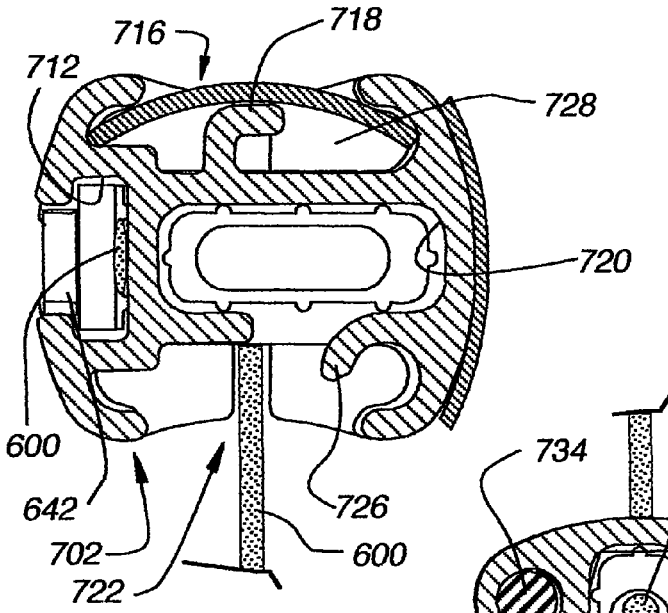

FIG. 78 is an enlarged fragmentary vertical section taken through the top rail of the shade of FIG. 74.

Figure 79:
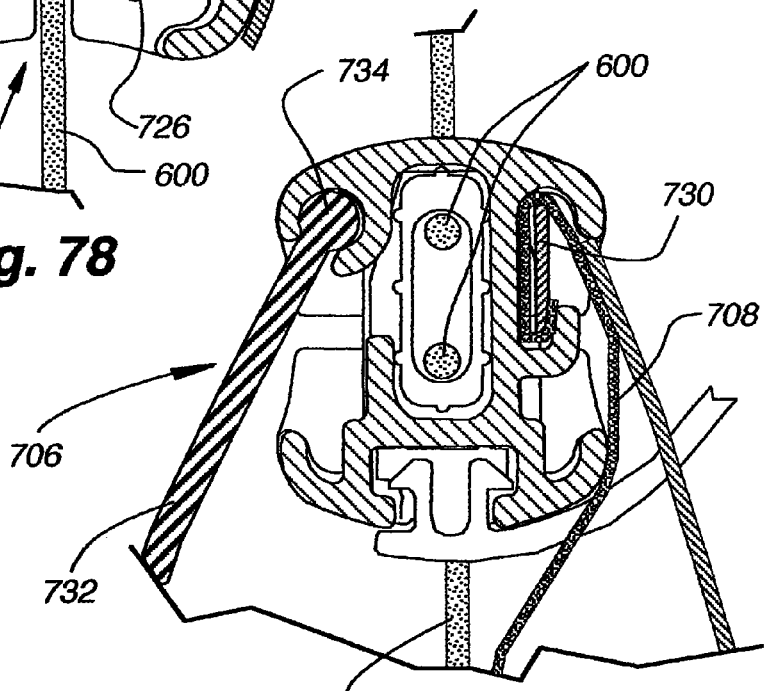

FIG. 79 is an enlarged fragmentary vertical section taken through the midrail of the shade of FIG. 74.

Figure 80:
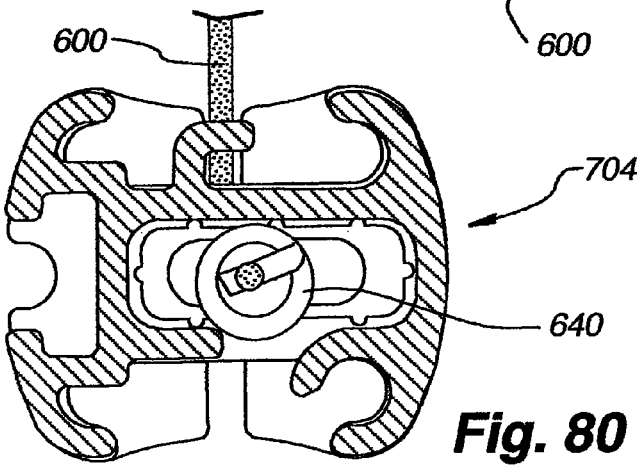

FIG. 80 is a fragmentary vertical section through the bottom rail of the shade of FIG. 74.

Figure 81:
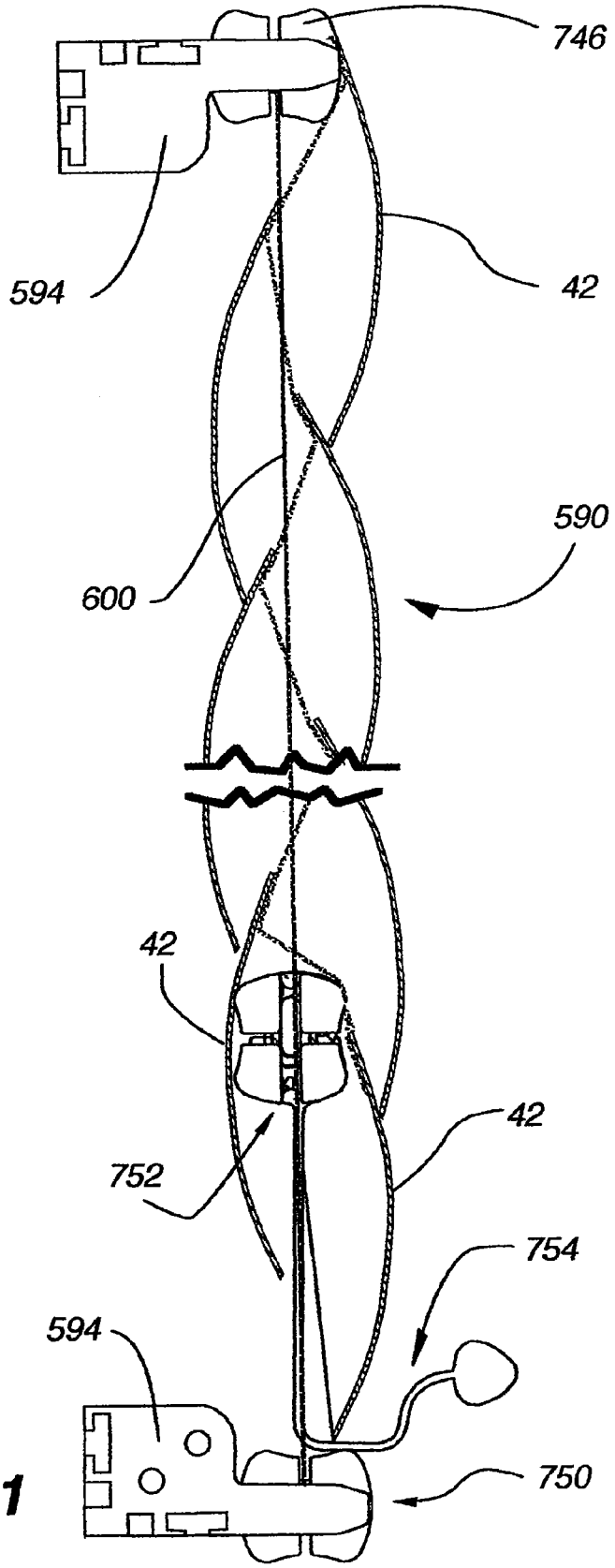

FIG. 81 is a side elevation of a bottom-up version of the shade of FIG. 74.

Figure 82:
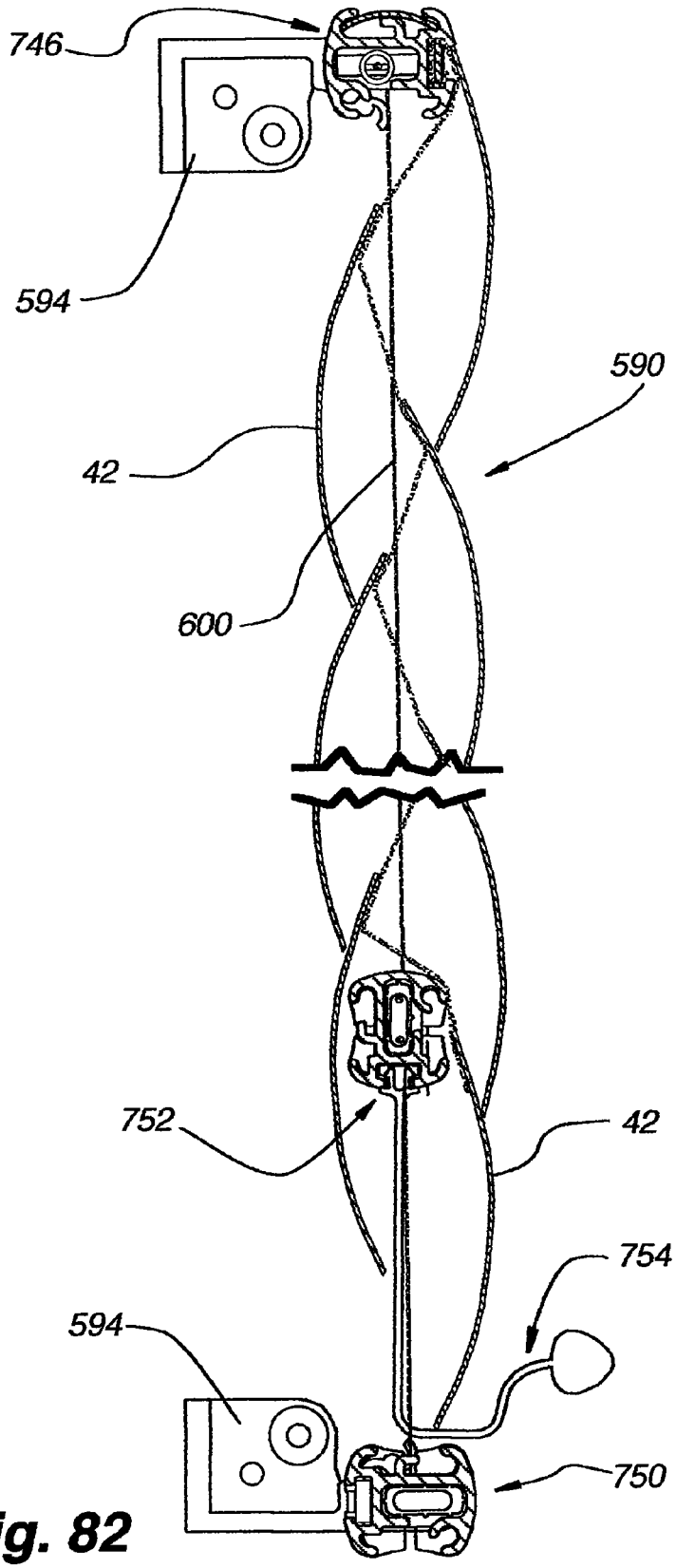

FIG. 82 is a vertical section with parts removed similar to FIG. 81.

Figure 83:
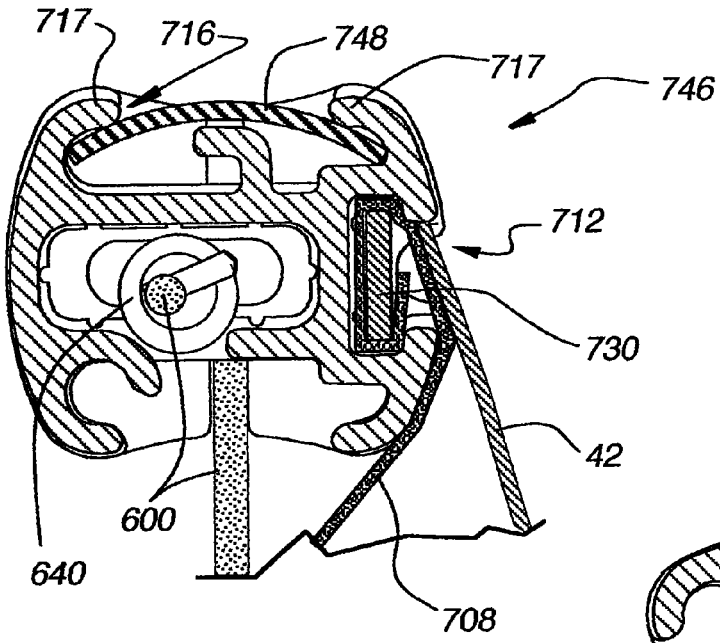

FIG. 83 is an enlarged fragmentary vertical section taken through the top rail of the shade of FIG. 81.

Figure 84:
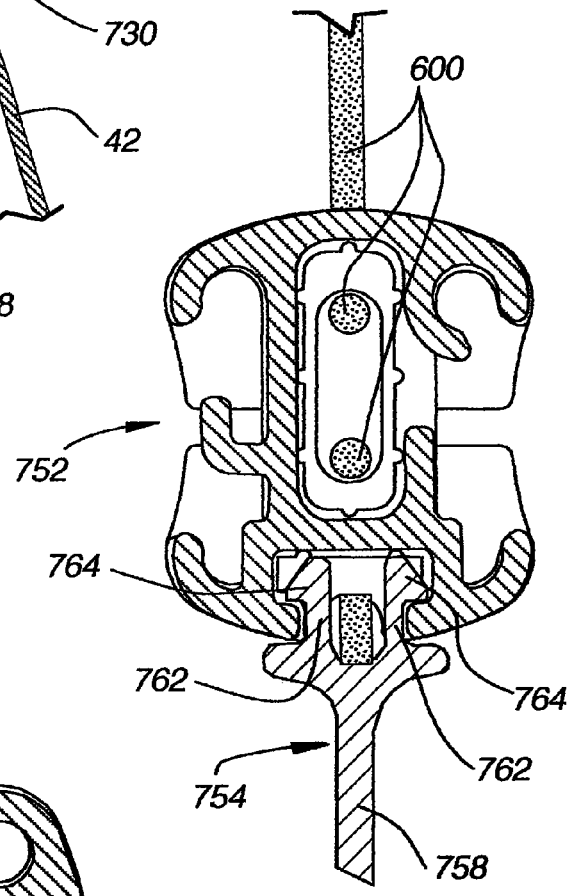

FIG. 84 is an enlarged fragmentary vertical section taken through the midrail of the shade of FIG. 81.

Figure 85:
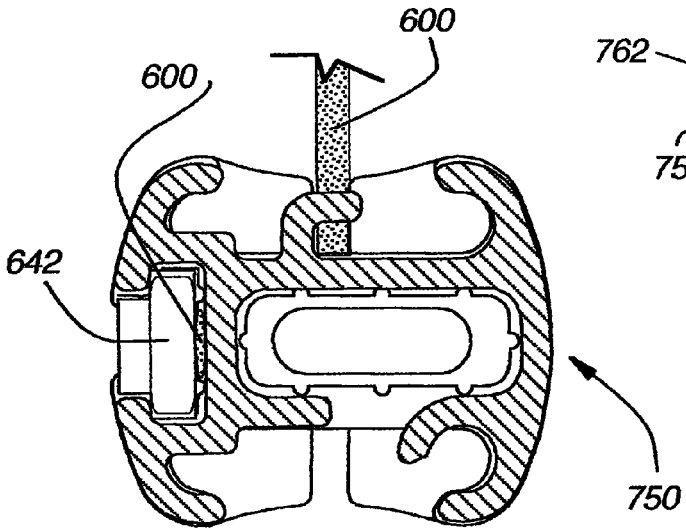

FIG. 85 is a fragmentary vertical section through the bottom rail of the shade of FIG. 81.

Figure 86:
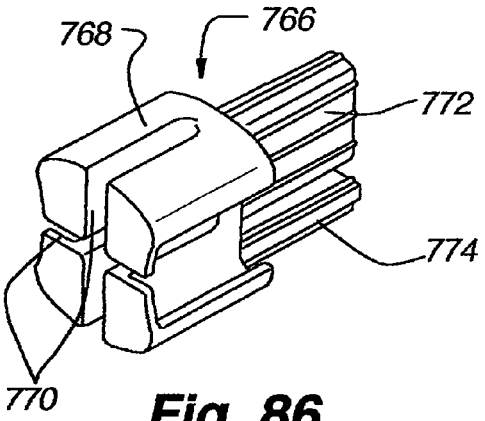

FIG. 86 is an isometric looking at the outer end of an insert used in the shade of FIG. 74.

Figure 87:
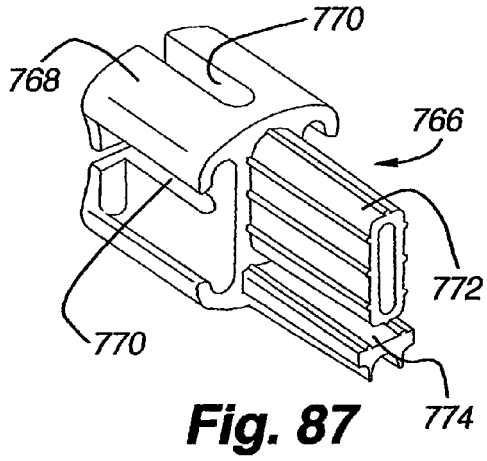

FIG. 87 is an isometric looking at the inner end of the insert shown in FIG. 86.

Figure 88:
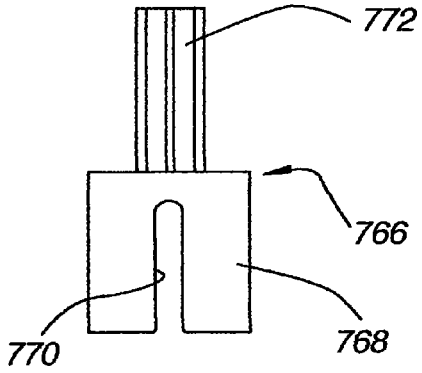

FIG. 88 is a top plan view of the insert as shown in FIG. 86.

Figure 89:
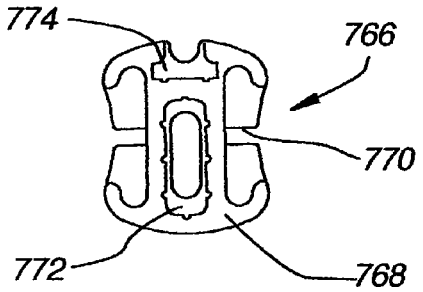

FIG. 89 is an inner end elevation of the insert as shown in FIG. 87.

Figure 90:
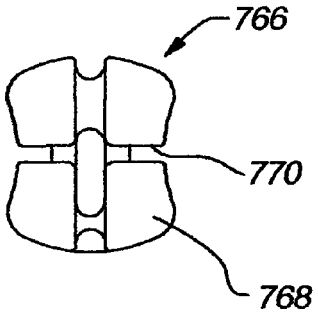

FIG. 90 is an outer end elevation of the insert as shown in FIG. 86.

Figure 91:
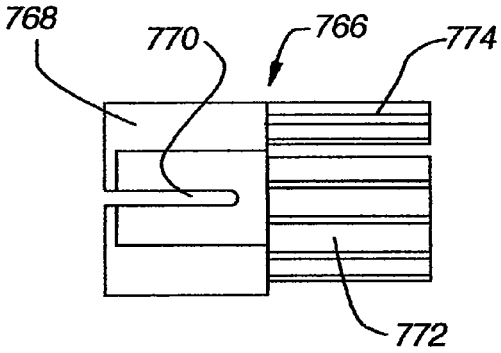

FIG. 91 is a side elevation of the insert as shown in FIG. 86.

Figure 92:
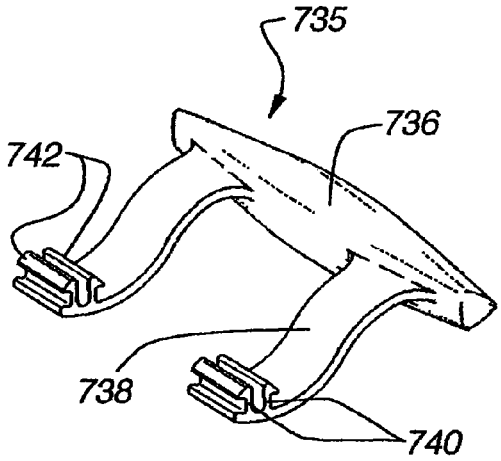

FIG. 92 is an isometric of the handle used in the top-down version of the shade of FIG. 74.

Figure 93:
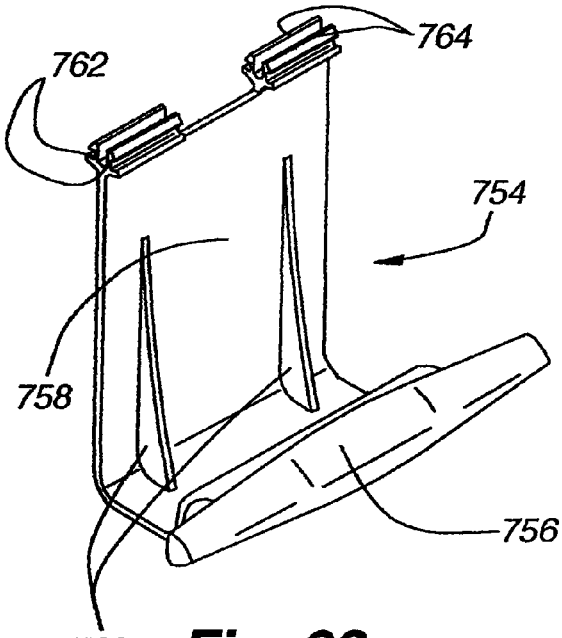

FIG. 93 is an isometric of the handle used in the bottom-up version of the shade of FIGS. 81, 82, and 85.

Figure 94:
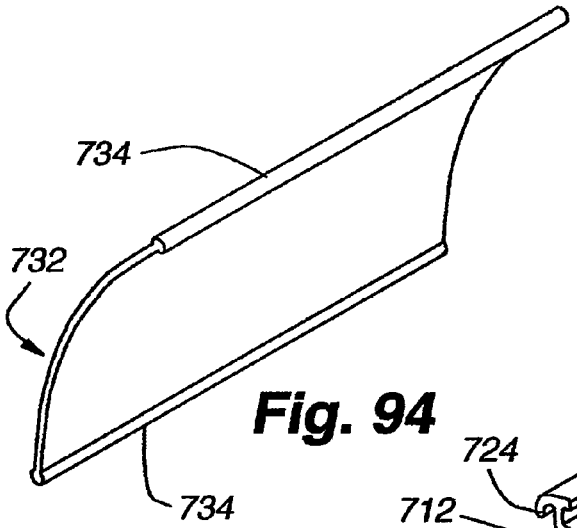

FIG. 94 is an isometric of a protective strip used in the shade of FIG. 74 and as shown in section in FIG. 76.

Figure 95:
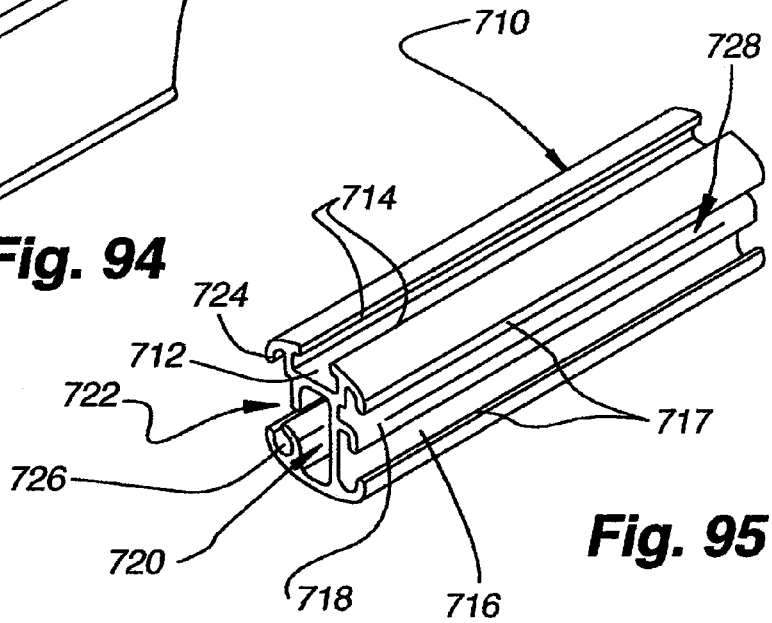

FIG. 95 is an isometric of the extrusion used for the rails in the shade of FIG. 74.

DETAILED DESCRIPTION OF THE INVENTION

The cellular shade of the present invention includes a control system and a fabric supported on and manipulated by the control system. The fabric is disclosed in different embodiments wherein it includes a support structure on which a plurality of slats or vanes are supported in a manner such that the movement of the slats or vanes is responsive to retraction or extension of the support structure on which they are mounted and operatively associated. As will be appreciated from the detailed descriptions that follow, the slats or vanes can be in the form of flexible, rigid, or semi-rigid strips of material connected to the support structure at spaced locations. The slats or vanes are operatively connected to the support structure to move in response to movement of the support structure. As used in this Specification, the term "flexible" refers to materials that are capable of being flexed with examples of such materials being sheets of vinyl, woven or non-woven fabric, cords of natural or synthetic fibers, monofilaments, and the like. The term "semi-rigid" refers to materials that are somewhat stiff but can be flexed or folded. Examples of such materials would be resin reinforced fabric, polyvinyl chloride, and the like. The term rigid refers to stiff materials which could be resin reinforced fabrics (to a greater degree than the "semi-rigid" fabrics), polyethylene, wood, aluminum or other metals, and the like.

With reference first to FIGS. 1-4, a first embodiment 30 of the shade or covering of the present invention can be seen to include a headrail 32 having an arcuate rigid valence 34 supported thereon and a fabric 36 that includes a support structure in the form of a plurality of suspended flexible cords or elements 38 that carry a weighted bottom rail or ballast bar 40 at their lower ends and a plurality of interconnected slats 42 suspended from the headrail and in operative engagement with the support structure.

Figure 1:
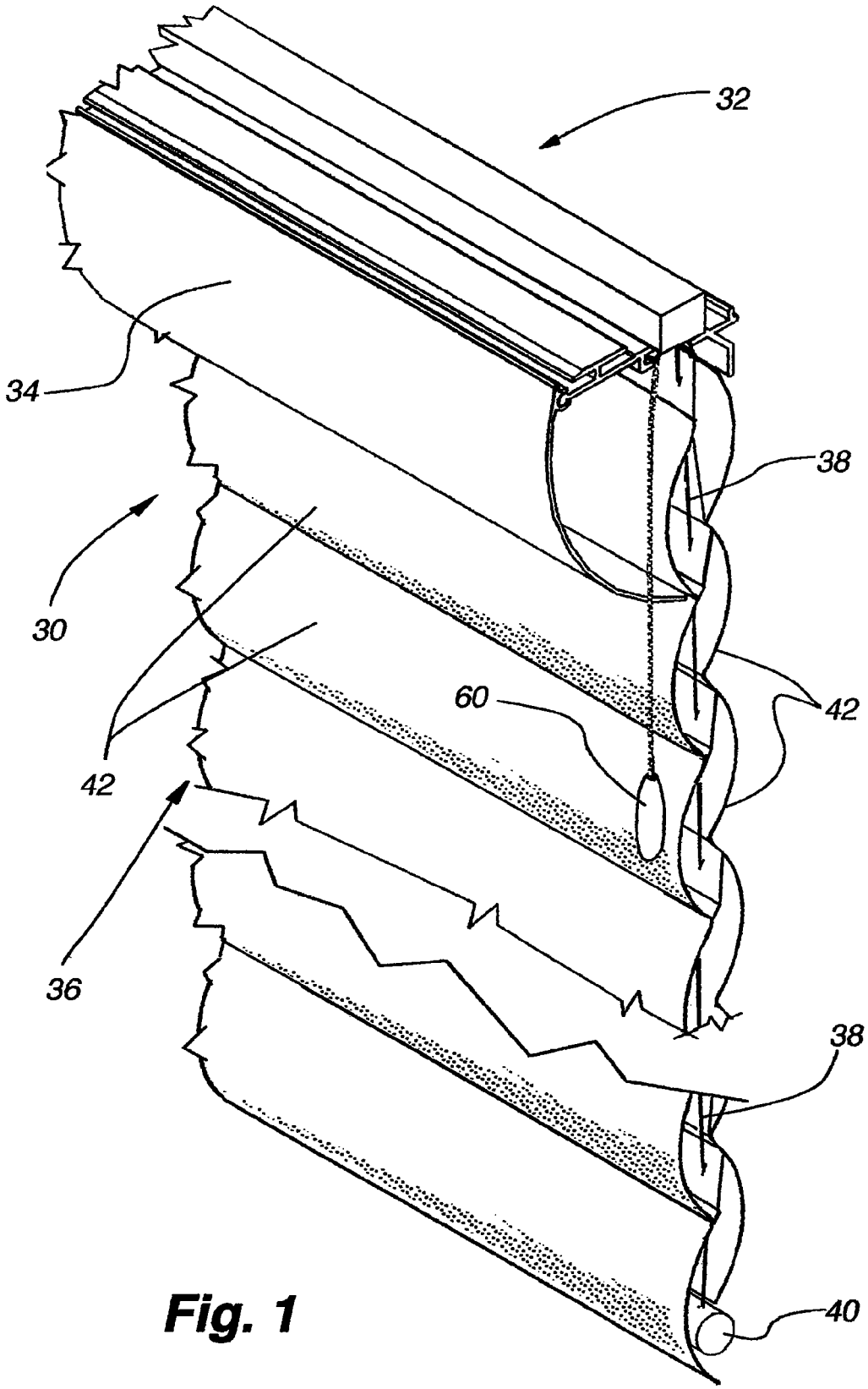
FIG. 1 is a fragmentary isometric illustrating a first embodiment of a covering in a fully extended position in accordance with the present invention.
Figure 2:
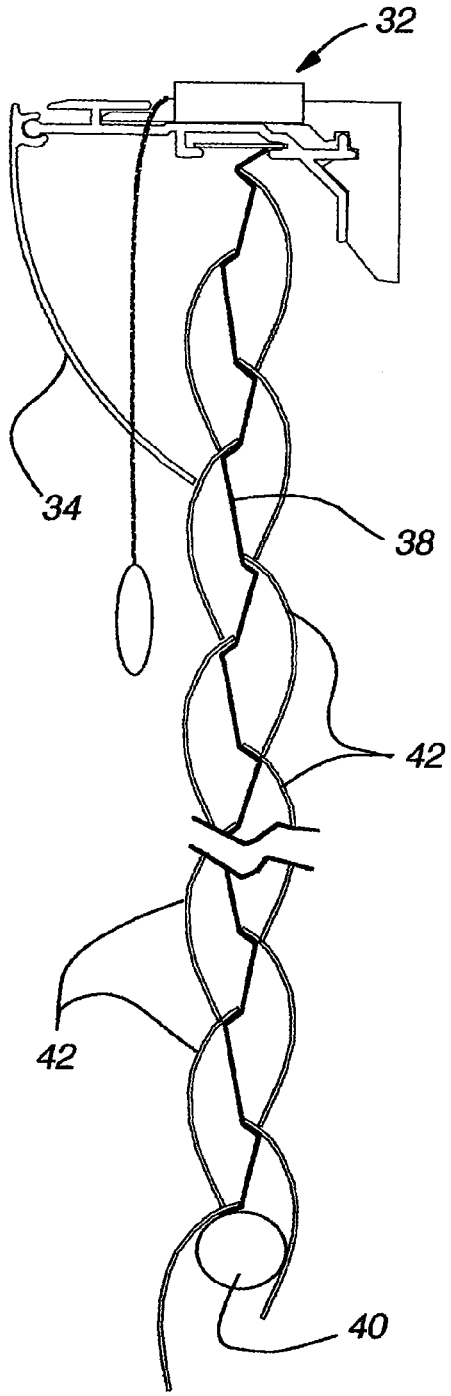
FIG. 2 is a side elevation of the covering as shown in FIG. 1.
Figure 3A:
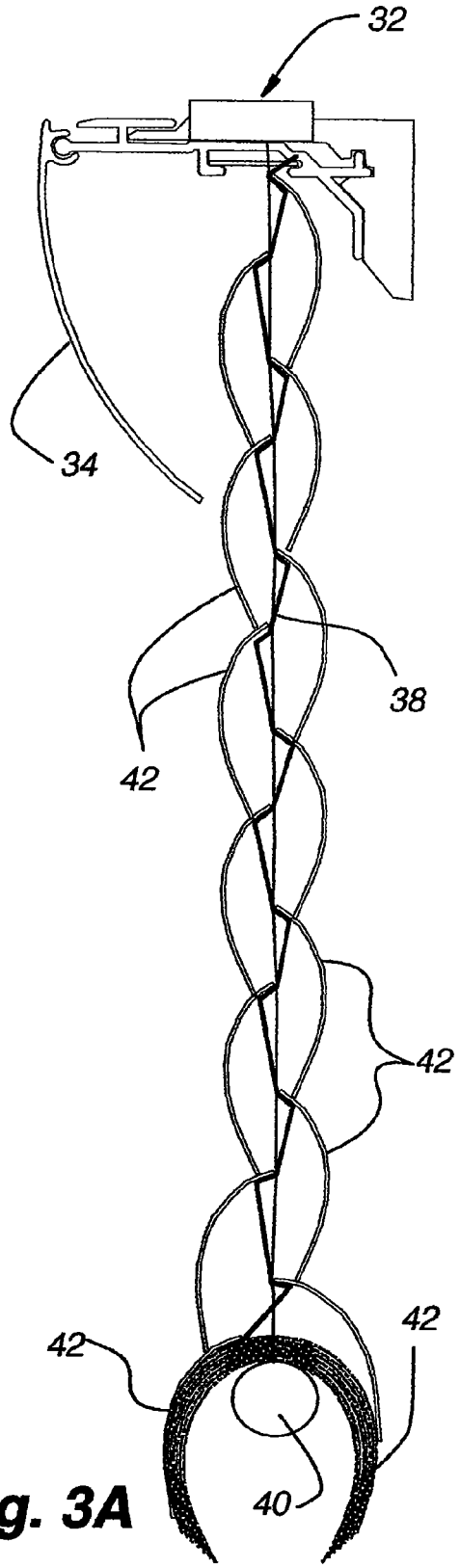
FIG. 3A is a side elevation similar to FIG. 2 with the covering partially retracted.
Figure 3B:
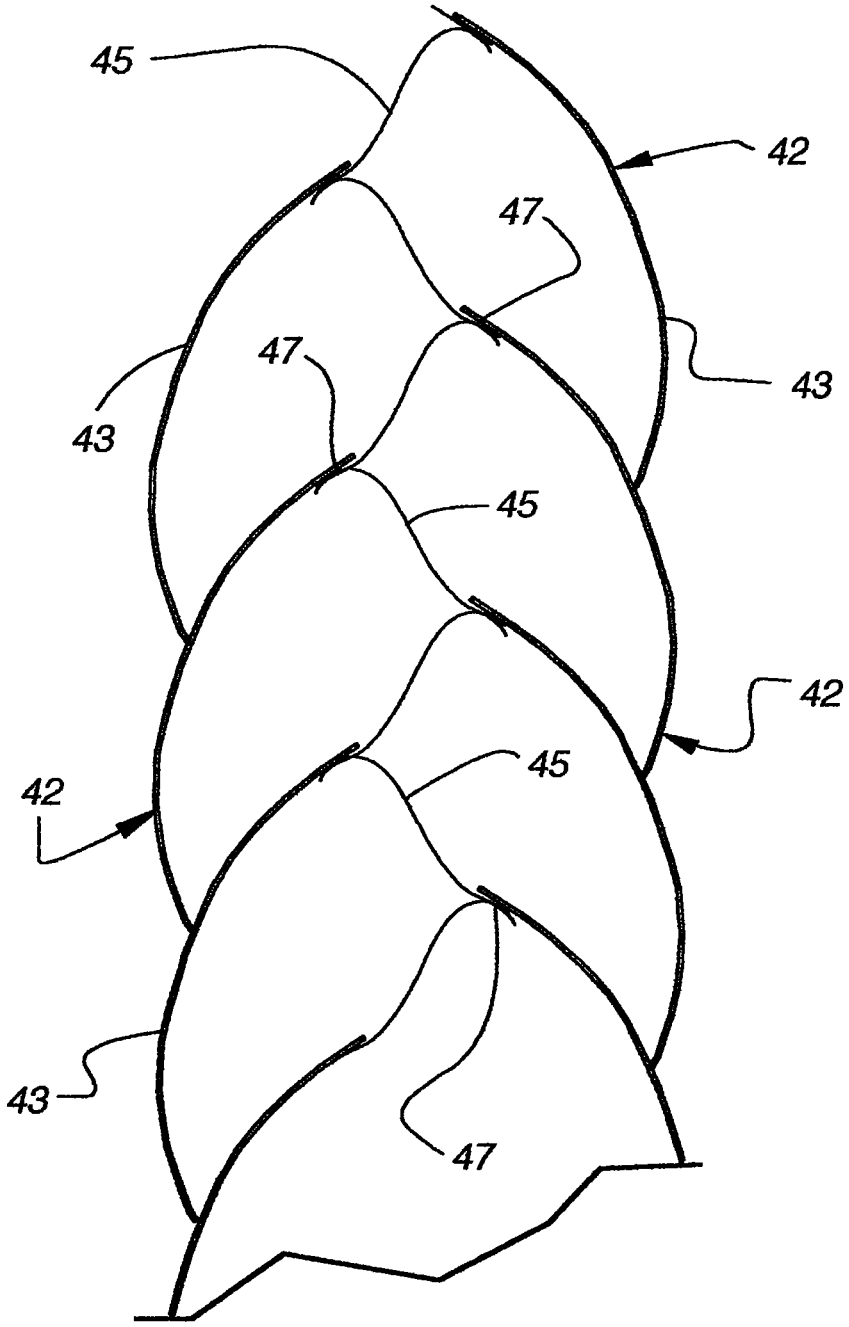
FIG. 3B is an enlarged fragmentary side elevation of the covering of FIG. 1 in a partially retracted position.
Figure 3C:
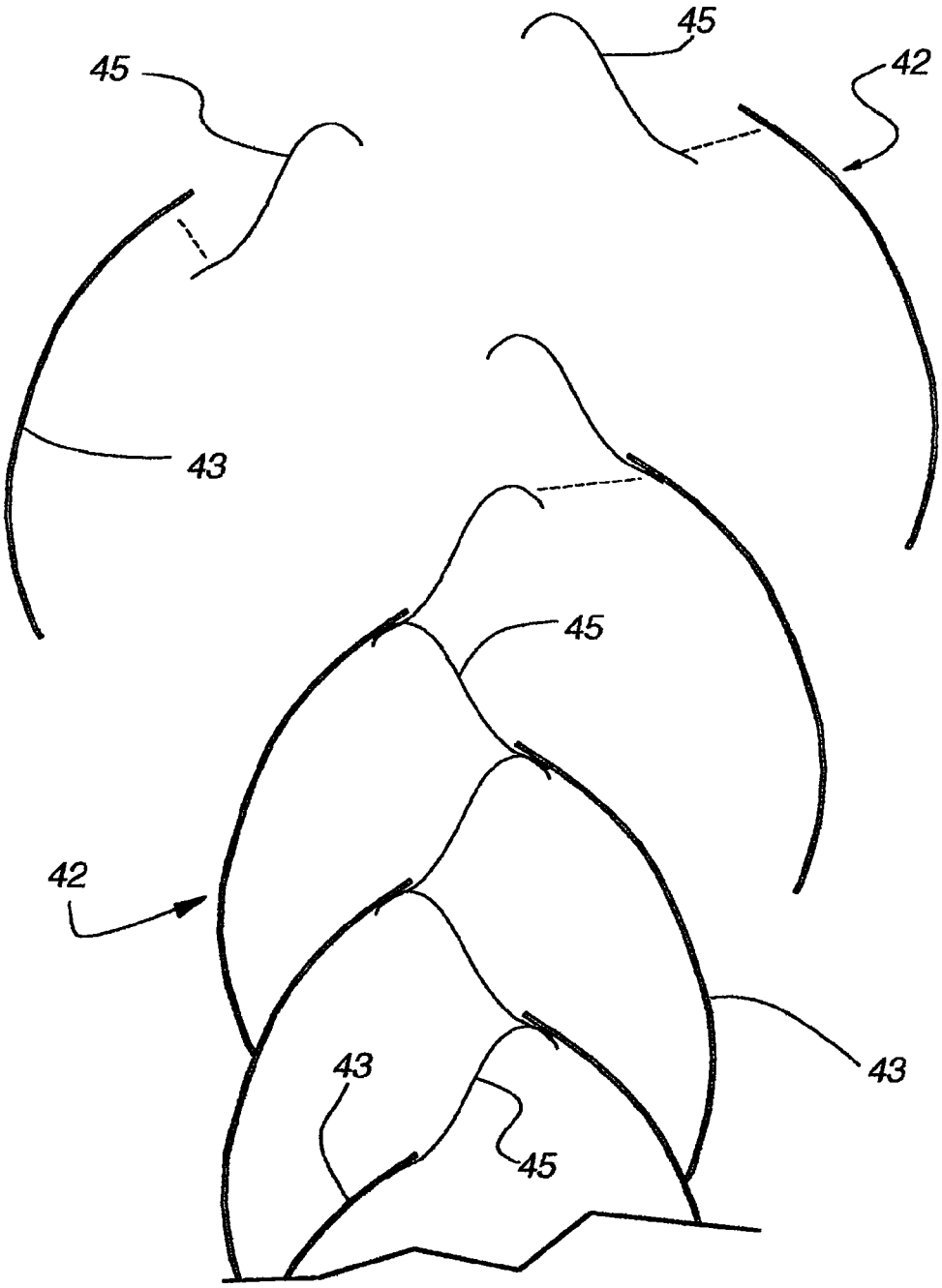
FIG. 3C is a partially exploded side elevation similar to FIG. 3B.
Figure 4:
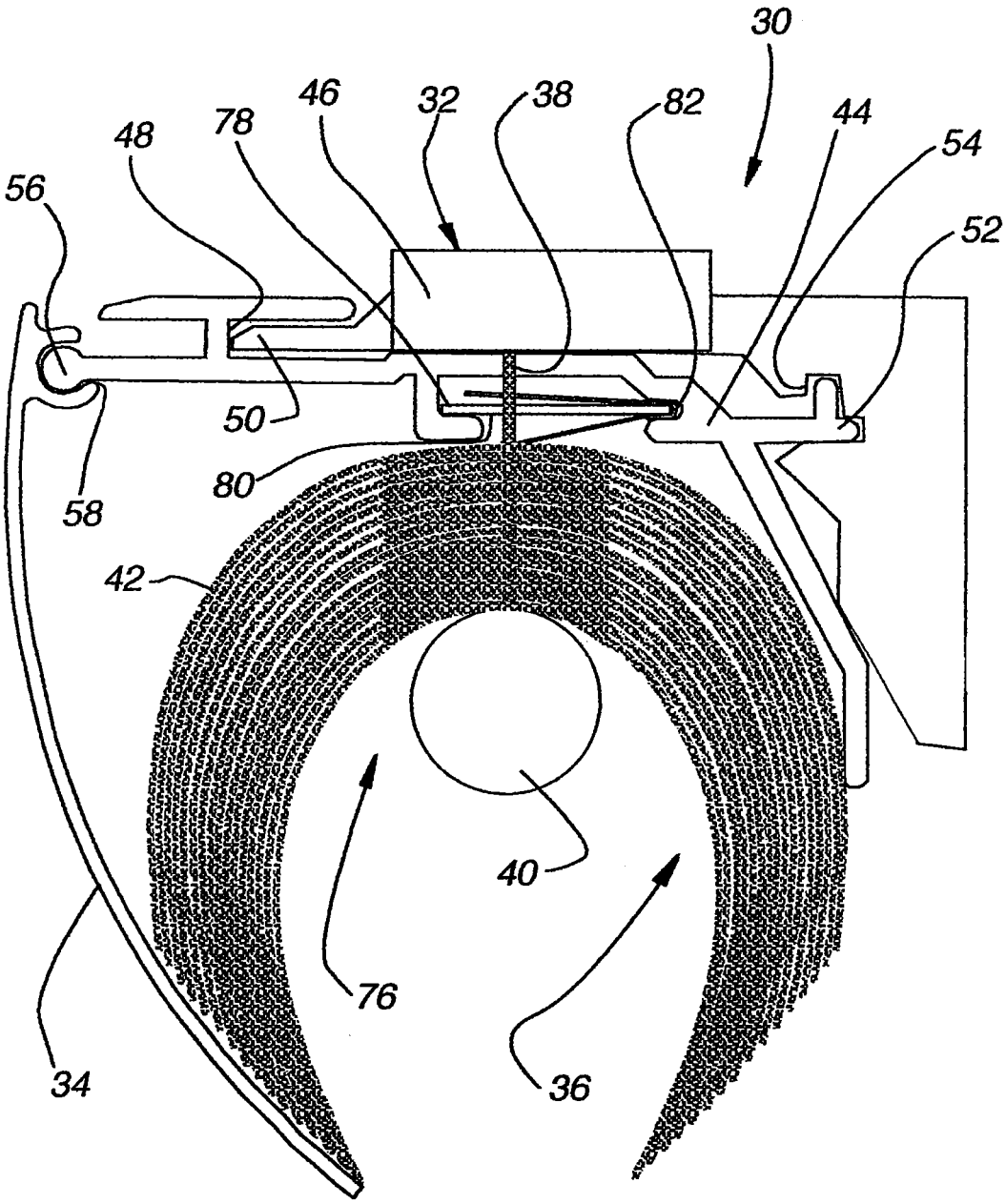
FIG. 4 is a side elevation of the covering of FIG. 1 in a fully retracted position.

As best seen in FIGS. 2 and 4, the headrail 32, which is adapted to be mounted to a frame (not shown) of an architectural opening in any conventional manner includes an extruded element 44 that is interlocked with a base member 46 with the extruded element including channels, beads, and other formations for various purposes. The extruded element has one channel 48 formed therein to receive an outer free edge 50 of the base member 46 and a ridge 52 that is received in a channel 54 formed in the base member so the extruded element is suspended from the base member but can be slid longitudinally of the base member to mount on or remove the extruded element from the base member. The extruded element further has a rounded elongated bead 56 along its forwardmost free edge adapted to be received in a channel 58 formed along the inside upper edge of the valence 34 so the valence, which is arcuate in transverse cross-section, can depend therefrom to conceal the fabric and the remainder of the headrail when the shade or covering is in the retracted position of FIG. 4. When the shade is extended as shown in FIGS. 1-3C, the valence provides a decorative finish to the shade while blocking the view of the headrail components from inside a room in which the shade is mounted.

The support structure, as mentioned previously, includes a plurality of vertically extending flexible elements 38 which may be microfibers, cords, ribbons, tapes, or the like, which are suspended from a control system (not seen) mounted in the headrail 32. The control system may be a conventional system wherein the elements 38 can be accumulated within the headrail when the shade is retracted or extended therefrom when the shade is extended. The control system includes a pull cord 60 (FIGS. 1, 2 and 3A) for operating the control system. Pulling downwardly on the pull cord causes the flexible elements 38 to be raised and accumulated within the headrail as the weighted bottom rail 40 is lifted. Upward movement of the bottom rail causes it to engage the lowermost slats and lift the interconnected slats into the retracted position of FIG. 4 as will be described in more detail later. By releasing a brake (not seen) commonly used in such control systems for holding the shade at any degree of extension, the weighted bottom rail can fall by gravity allowing the interconnected slats to expand from the retracted position of FIG. 4 through an intermediate position of FIG. 3A to the fully expanded position of FIG. 2.

The interconnected slats 42 are probably best described by reference to FIGS. 3B and 3C. Each slat has a lower rigid or semi-rigid component 43 and an upper flexible component 45, the lower end of the flexible component being secured as by adhesive, ultrasonic bonding, or the like, to the upper edge of the lower component at an intermediate location 47 on the slat. While the upper component needs to be durable, its flexibility is preferably extreme such as might be found in fabrics such as silk. The lower component is illustrated as being arcuate in transverse cross-section, even though as will be appreciated with the description that follows, the slat could be of any desired transverse cross-sectional configuration such as flat, serpentine, wavy, or the like. The lower component 43 has an inner concave surface to which the lower edge of the associated upper flexible component can be secured. Further, each slat is secured to the next adjacent upper slat by attaching the upper end of the upper component 45 to the intermediate location 47 where an upper component was secured along its lower edge to a lower component of the next adjacent upper slat. This attachment can also be with adhesive, ultrasonic bonding, or the like. As viewed in FIG. 3C, the sequential steps for assembling a slat 42 and connecting it to the next adjacent upper slat is shown moving from the top of FIG. 3C to the bottom. As will be appreciated, the illustrated upper two slats show the upper and lower components 45 and 43, respectively, separated with the next adjacent lower aligned slats showing the upper component of each slat connected to its lower component. Moving downwardly, the upper edge of each upper component is secured to the intermediate location 47 of the next adjacent upper slat where its upper component and lower component are connected. It is also important to note the adjacent intermediate locations in the fabric are offset on either side of a vertical plane for a purpose to be described hereafter.

In this manner, a fabric structure made from interconnected slats 42 having flexible upper components 45 and semi-rigid or rigid lower components 43 is assembled into a unified body. As appreciated by reference to FIG. 3A, substantially vertically aligned holes (not seen) can be provided in the flexible upper components of the interconnected vanes through which the flexible elements 38 of the support system can be passed. As can be appreciated by reference to FIGS. 1, 2, 3A and 4, once the slats are mounted on these flexible support elements, which are preferably centered laterally in the fabric, and with the weighted bottom rail or ballast 40 positioned in the crotch beneath the two lowermost slats in the fabric with alternate intermediate locations being on either side of the elements 38, the fabric can be extended or retracted between the positions of FIGS. 1 and 4, respectively, with the control system. As mentioned previously, when the brake on the control system is released, the weighted bottom rail 40 descends by gravity allowing the interconnected slats to expand from the retracted position of FIG. 4 to the extended position of FIG. 1. Of course, when the flexible support elements 38 are drawn into the headrail by pulling downwardly on the pull cord 60, the weighted bottom rail is raised from its lowermost position of FIG. 1 to its uppermost position of FIG. 4 and in passing between the positions gathers the slats into a compact stack as seen in FIG. 4. It is best appreciated by reference to FIG. 3A, which shows the fabric of the covering in a partially retracted position, that the slats 42 are only gathered on the bottom rail 40, which are physically forced to gather so that all slats above the gathered slats remain in their fully extended position. In this manner, only a lower group of slats that are being raised and gathered on the bottom rail begin to flair outwardly while the unaffected slats thereabove remain unmoved until physically forced into the gathered stack on the bottom rail as it is raised.

It will also be appreciated that the upper component 45 of each slat is connected to the lower component 43 at the intermediate location 47 over a marginal area which encourages or biases, to some degree, the upper and lower components to be aligned and coplanar for some small distance beyond their interconnection. The more flexible the upper component the smaller the distance. The bias created at the intermediate location functions as a lever to bias the associated lower component upwardly but in the case of the illustrated embodiment of FIGS. 1-4, the bias is not great enough to raise the lower edge of the lower component off the surface of the slat therebeneath with which it is slidingly engaged.

The uppermost slat in the illustrated embodiment is secured to the extruded element 44 by a flat bar 78 received on a ledge 80 within a groove 82 in the extruded element so that the uppermost slat is suspended from the extruded element with the remaining underlying interconnected slats in operative supported relationship.

Figure 5:
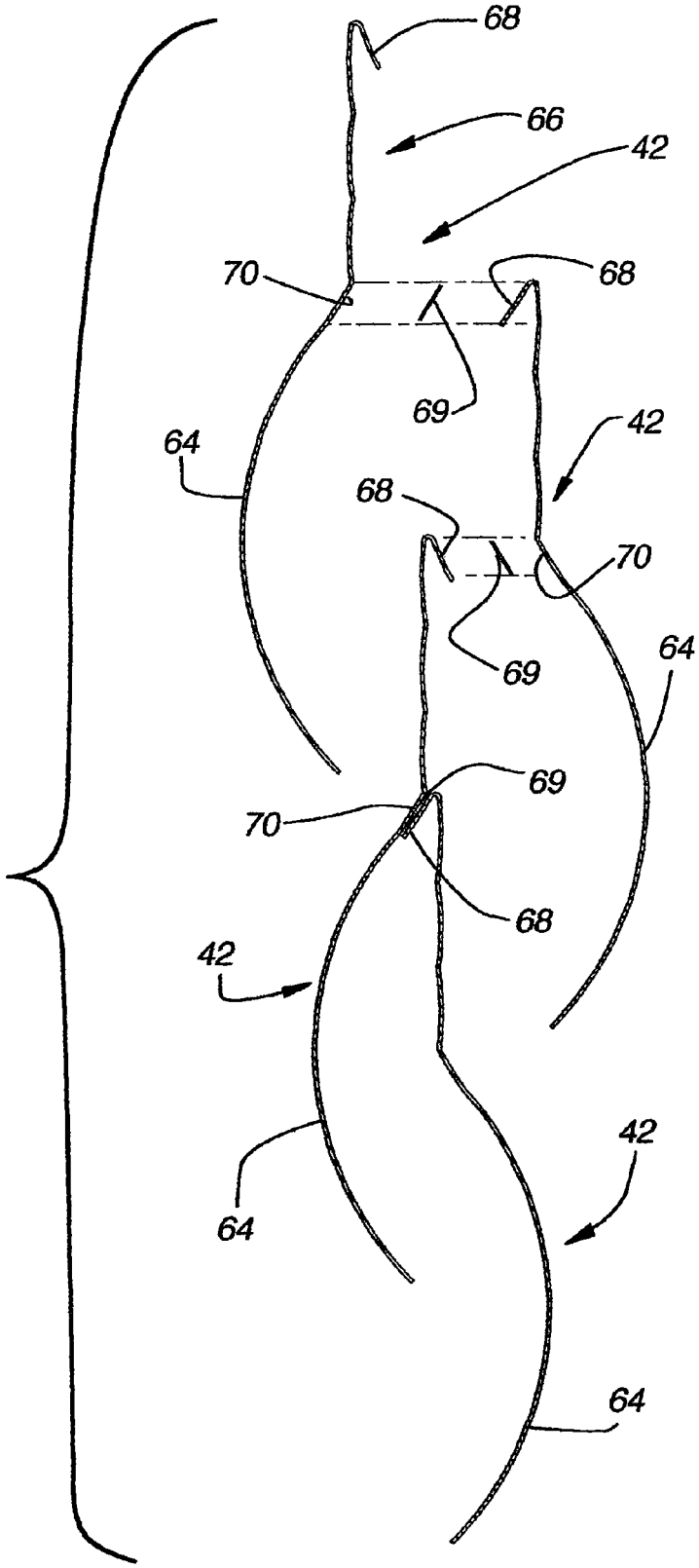
FIG. 5 is an exploded side elevation of a plurality of vanes used in a second embodiment of the covering of the present invention illustrating the manner in which the vanes are interconnected.
Figure 6A:
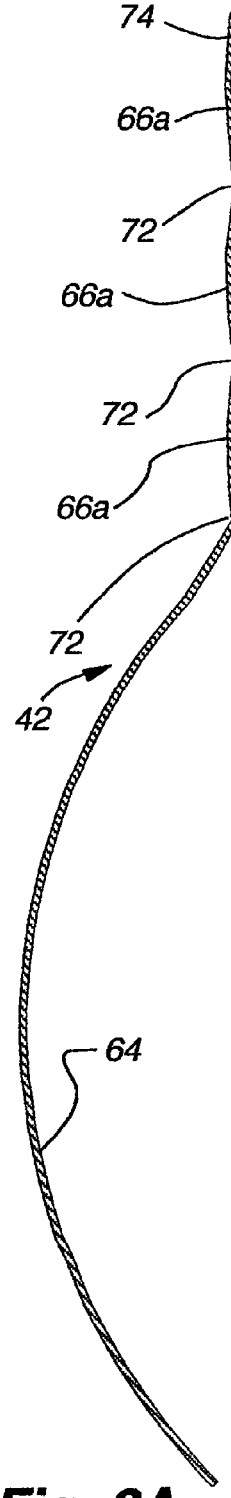
FIG. 6A is an enlarged side elevation of a vane used in the covering of FIG. 5.
Figure 6B:
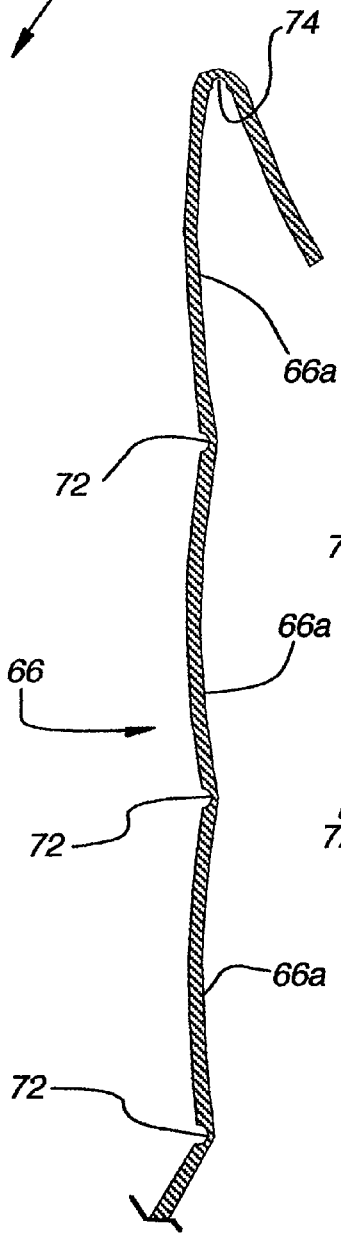
FIG. 6B is a further enlarged fragmentary side elevation of an upper segment of the vane as shown in FIG. 6A.
Figure 6C:
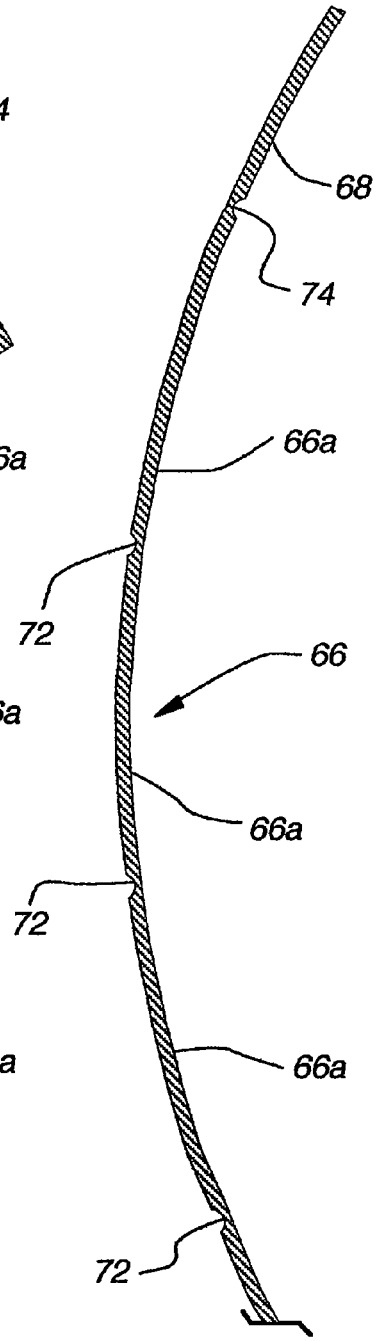
FIG. 6C is a fragmentary elevation similar to FIG. 6B showing the upper segment before folding.

A second embodiment of the covering in accordance with the present invention utilizes slats 63 as illustrated in FIGS. 5-6C. It will there be seen that each slat is made of rigid or semi-rigid material and has a lower segment 64 that is arcuate in transverse cross-section, an upper segment 66 that is substantially flat or planar, and a downturned tab 68 at the upper edge of the upper segment. The downturned tab is adapted to be secured with adhesive 69 or otherwise to an intermediate location 70 on the next adjacent upper slat as best illustrated in FIG. 5. As will be appreciated, the tab is secured to the next adjacent upper slat along an uppermost region of the lower arcuate segment 64 of the slat such that the upper segment 66 of each slat hangs substantially vertically when the fabric is extended similarly to the fabric illustrated in FIGS. 1 and 2. While each slat could be formed, as by extrusion, such that the upper segment of each slat is perfectly flat or planar, in the disclosed embodiment, the slat is originally formed from a semi-rigid strip of material such as polyethylene, polyvinyl chloride, or the like, having preformed crease lines as best seen in FIGS. 6B and 6C. FIG. 6C illustrates the upper segment of the slat before it has been straightened into the configuration shown in FIGS. 6A and 6B and as will be appreciated, there are, for example, three creases 72 formed in the convex side of the slat along the upper segment 66 thereof and one crease 74 formed in the concave side adjacent to the top of the slat. The crease 74 in the concave side allows the tab 68 at the top of the slat to be easily defined by folding the uppermost edge of the slat material downwardly, and the three creases 72 in the convex side allow an opposite bend in the slat material, as best appreciated by reference to FIG. 6B, so as to form three small slightly arcuate sections 66*a* which in combination form the substantially planar upper segment of the slat. As will be appreciated in the illustrations, the slat size is exaggerated so the slightly curved nature of the three slat sections 66*a* appears pronounced even though in the actual product, the upper segment 66 of each slat appears substantially flat or planar.

By interconnecting or securing each slat 63 to the next adjacent upper slat as shown in FIG. 5, it will be appreciated a series of interconnected slats are formed with alternating slats being concave in opposite directions. In other words, the uppermost slat as seen in FIG. 5 is concave to the right while the next adjacent lower slat is concave to the left and the next adjacent slat is again concave to the right.

After the slats have been interconnected in this manner, they will have a relationship similar to that illustrated in FIGS. 1-4 but due to the flexibility of the slats as created at least partially by the crease lines 72 and 74 which allow pivotal movement particularly along the uppermost crease line 74 where the tab 68 is formed, the slats when fully extended have an appearance similar to that illustrated in FIGS. 1 and 2. When partially retracted by raising the bottom rail 40 which is received in a pocket or crotch 76 defined between the lowermost two slats, the slats begin to expand away from each other so that alternate slats move in the same direction but opposite to that of an adjacent slat. The fully retracted position of the fabric would be similar to that illustrated in FIG. 4 where the slats are neatly stacked in a compact manner adjacent to a headrail such as the headrail 32 and behind a valence 34.

Figure 7:
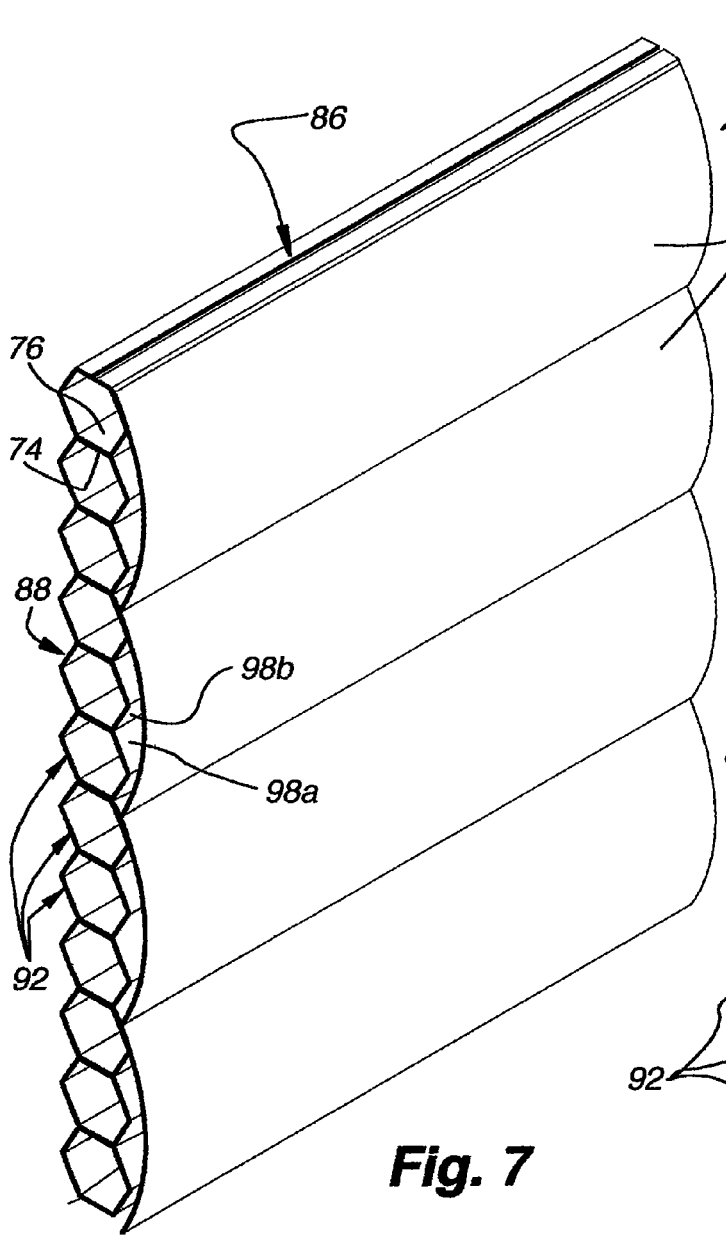
FIG. 7 is an isometric of a third embodiment of a fabric for use in a covering in accordance with the present invention and with the fabric in a fully extended, position.

A third embodiment 84 of the present invention is illustrated in FIGS. 7 and 8. In this embodiment, the headrail has not been illustrated but rather only the fabric 86 which comprises a support structure 88 and a plurality of interconnected slats 90.

Figure 7A:
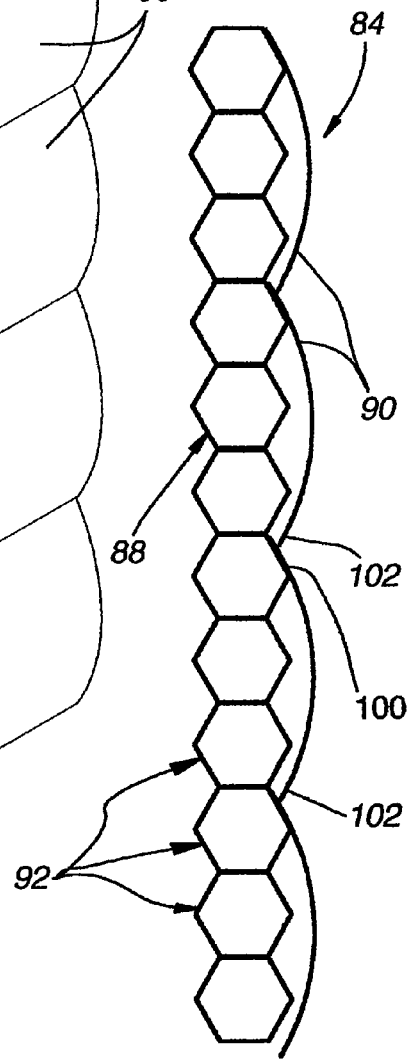
FIG. 7A is a side elevation of the fabric as shown in FIG. 7.
Figure 7B:
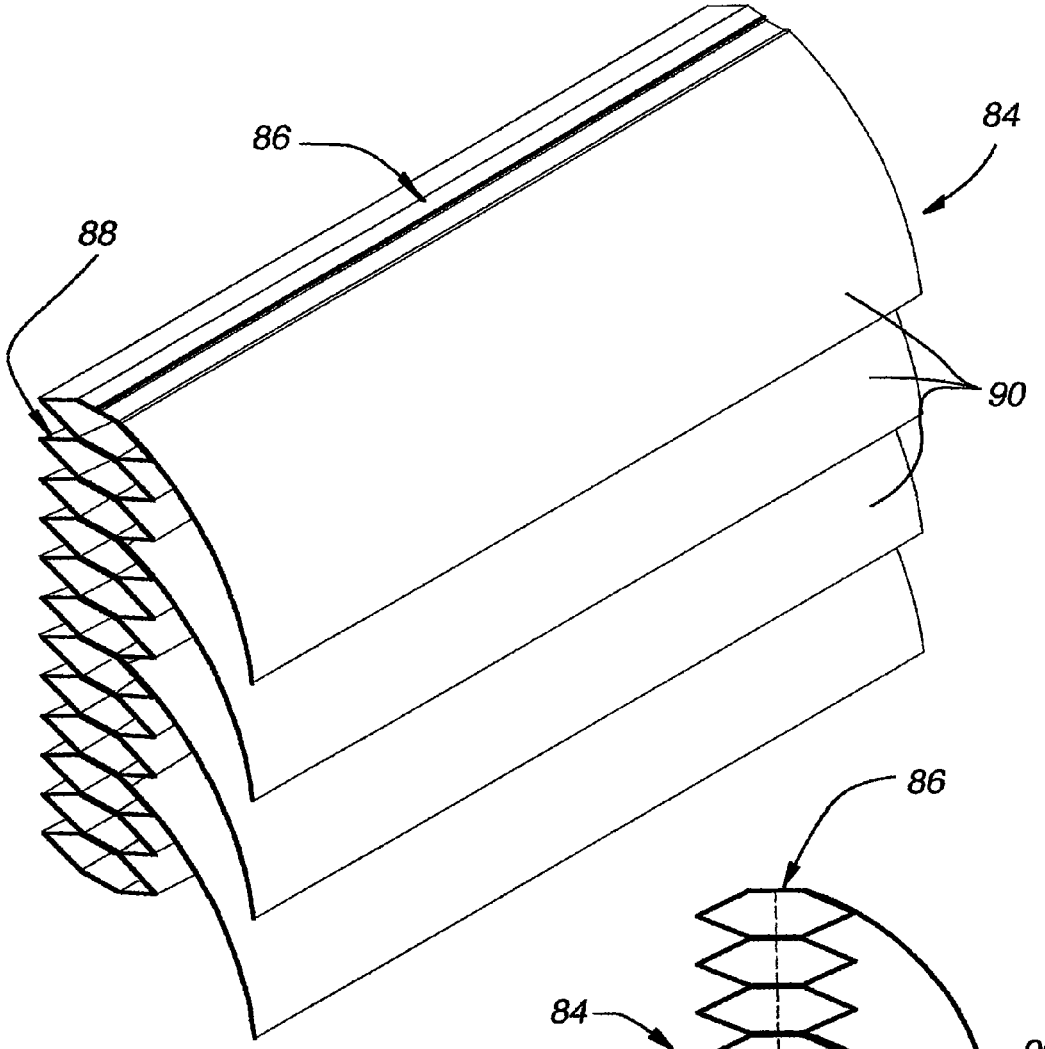
FIG. 7B is an isometric of the fabric of FIG. 7 shown in a partially retracted position.

With reference first to FIGS. 7 and 7A, the support structure for this embodiment comprises a plurality of superimposed and interconnected closed cells 92 of hexagonal transverse cross-sectional configuration. The cells are made of a semi-rigid material such as resin reinforced fabric or the like, and can be formed in accordance with the teachings in U.S. Pat. No. 6,572,725. Each cell includes a top wall 94 and a bottom wall 96 with the bottom wall of a cell being secured, as with adhesive or the like, to the top wall of the next adjacent lower cell. The cells further have side walls 98 having upper 98*a* and lower 98*b* segments with fold lines between the segments of each side wall so that the cells can be transversely compressed as shown in FIGS. 7B-7E. When referencing the cells as closed, it is in reference to the transverse cross-sectional shape of the cell.

The slats 90, which are supported on the cellular support structure 88 are elongated rigid or semi-rigid slats of arcuate transverse cross-section having an upper margin 100 that is secured to the upper segment 98*a* of the front side wall 98 of an associated cell. The slat can be secured as with adhesive or any other suitable means such as ultrasonic welding or the like. In the disclosed embodiment, the slats are secured to every fourth cell so as to protrude forwardly from the cellular support structure but when the cellular support structure is fully extended as shown in FIGS. 7 and 7A, the slats hang substantially vertically with the lower edge 102 of each slat slightly overlapping the upper margin 100 of the next adjacent lower slat as shown in FIG. 7A so that the cellular support structure is not visible from the front of the fully extended fabric.

Figure 7C:
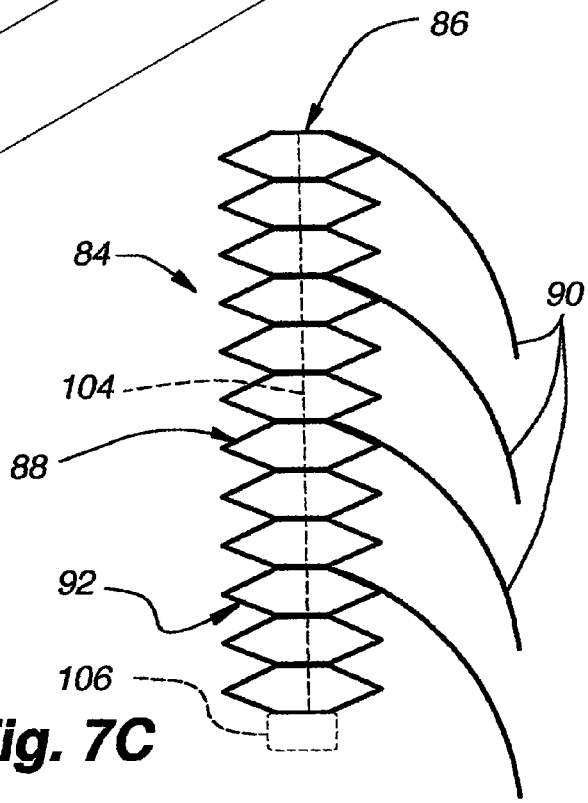
FIG. 7C is a side elevation of the fabric as shown in FIG. 7B with a lift mechanism shown in dashed lines.
Figure 7D:
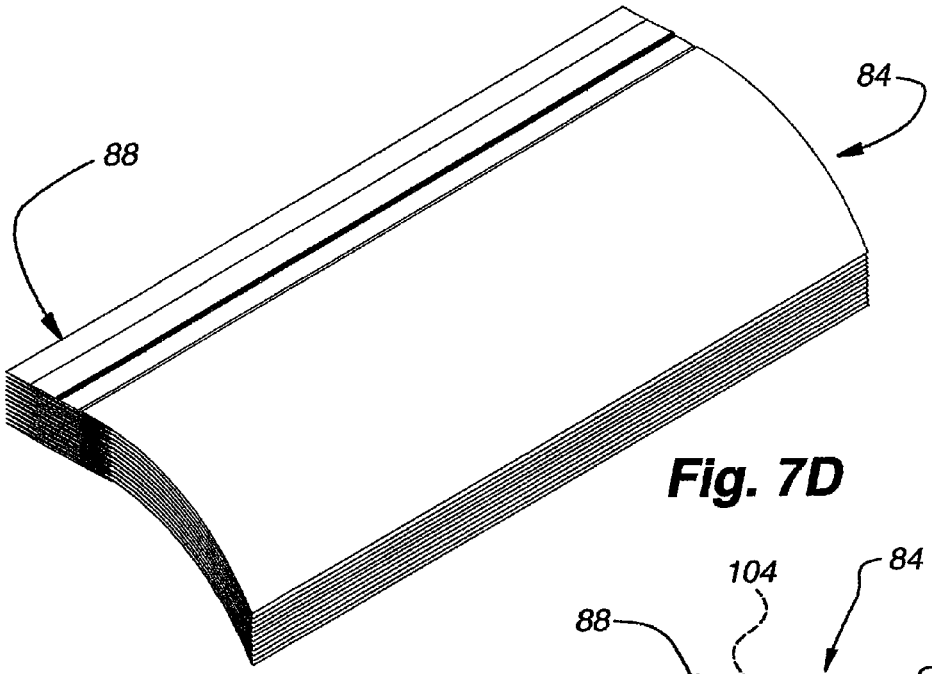
FIG. 7D is an isometric of the fabric of FIG. 7 in a fully retracted position.
Figure 7E:
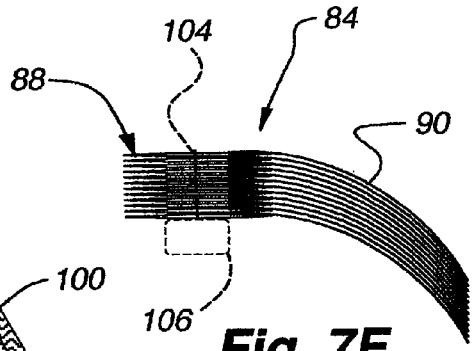
FIG. 7E is a side elevation of the fabric as shown in FIG. 7D with a lift mechanism shown in dashed lines.

While the fabric could be moved from the fully extended position of FIG. 7A to the fully retracted position of FIG. 7D or 7E in any suitable manner, a lift system is shown in dashed lines in FIGS. 7C and 7E which would encompass a plurality of vertically extending lift cords 104 supporting a bottom rail or ballast 106 which would be positioned beneath the lowermost cell in the support structure. By raising the lift cords and consequently the bottom rail, each cell is caused to collapse transversely as the fabric is moved from the fully extended position of FIG. 7A through a partially retracted position of FIGS. 7B and 7C to the fully retracted position of FIGS. 7D and 7E. As will be appreciated, in the fully extended position of FIGS. 7 and 7A, the shade has the general appearance of a roman shade but when retracted as shown in FIGS. 7D and 7E, the shade is very compactly stacked with the slats 90 protruding forwardly away from the support structure 88. It should be noted that the upper segment 98*a* of the cell, to which a slat is connected, serves as a lever in moving the connected vane substantially unitarily therewith. In other words, as a cell is compressed during retraction of the covering, the acute angle of the upper segment 98*a* relative to horizontal gets smaller thereby raising the slat toward a horizontal orientation.

Figure 7F:
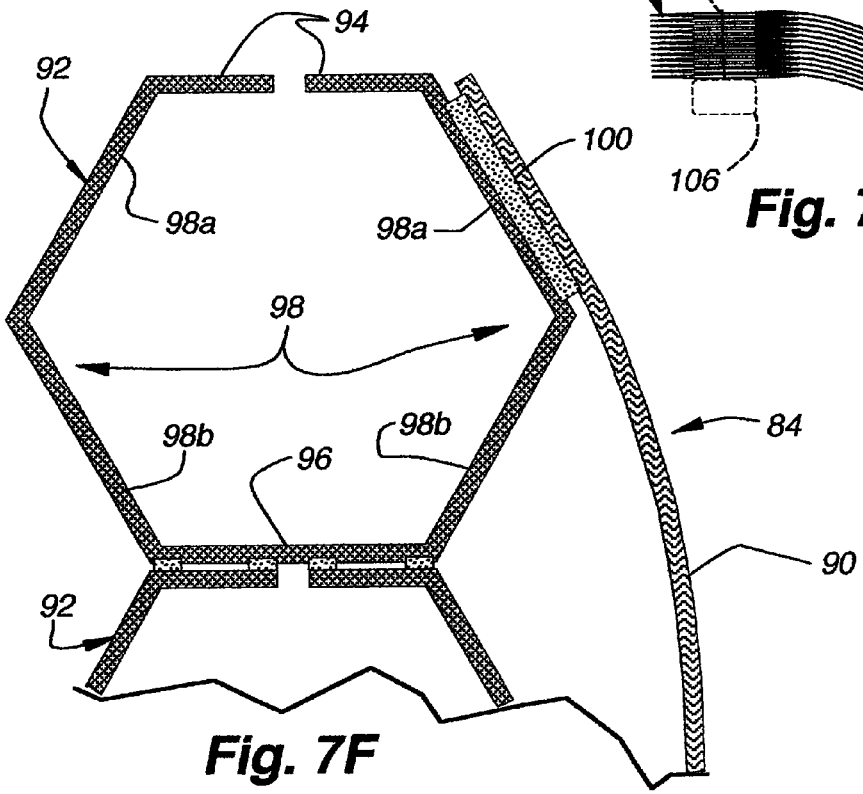
FIG. 7F is an enlarged fragmentary elevation of an uppermost cell in the support structure of the fabric of FIG. 7 connected to the next lower cell and with a slat connected to the uppermost cell.
Figure 8A:
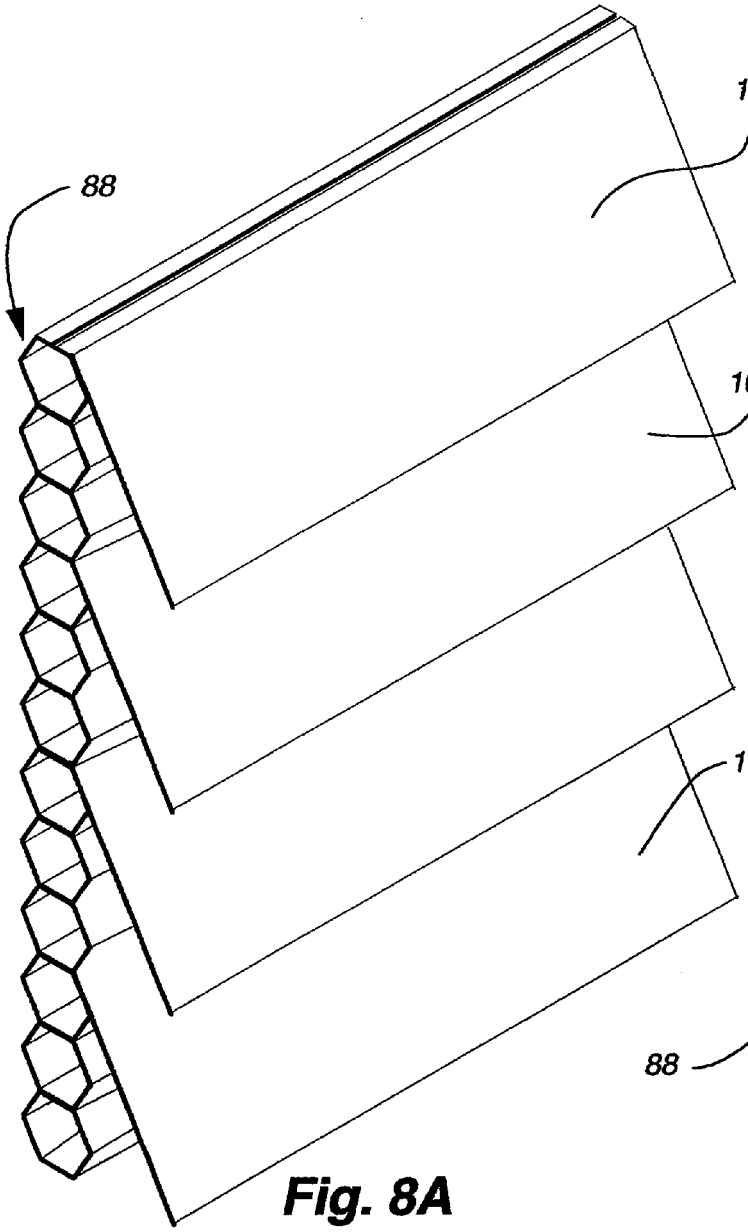
FIG. 8A is an isometric of a fabric similar to that of FIG. 7 in a fully extended position but wherein the slats are flat in cross section rather than arcuate.
Figure 8B:
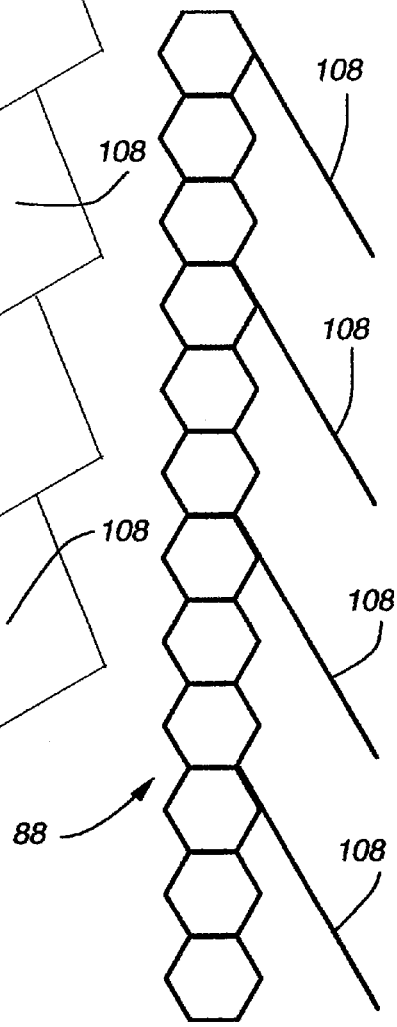
FIG. 8B is a side elevation of the fabric of FIG. 8A.

A slightly different arrangement is illustrated in FIGS. 8A and 8B with this arrangement having an identical support structure 88 to that of FIGS. 7-7F, but the slats 108 are flat in transverse cross-section rather than arcuate. Such an arrangement provides a different aesthetic.

Figure 9A:
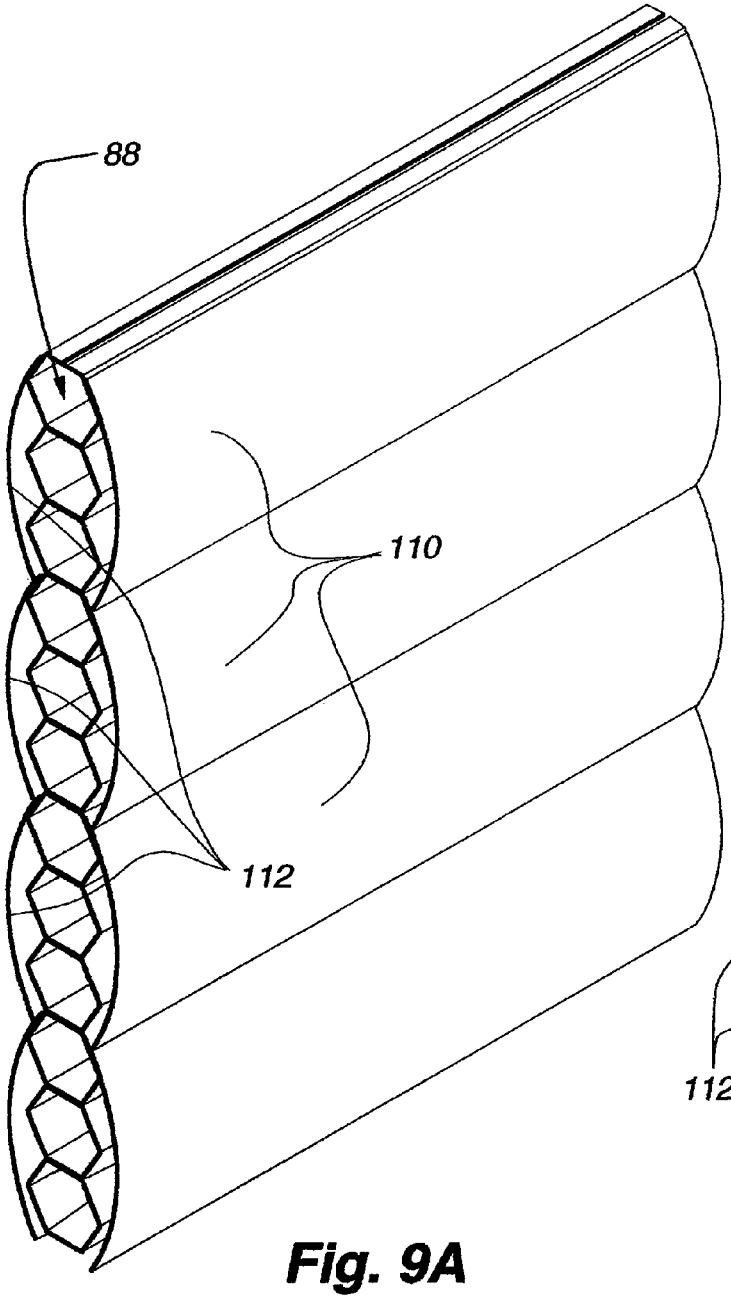
FIG. 9A is an isometric view of a fourth embodiment of a fabric in accordance with the present invention shown in a fully extended position.
Figure 9B:
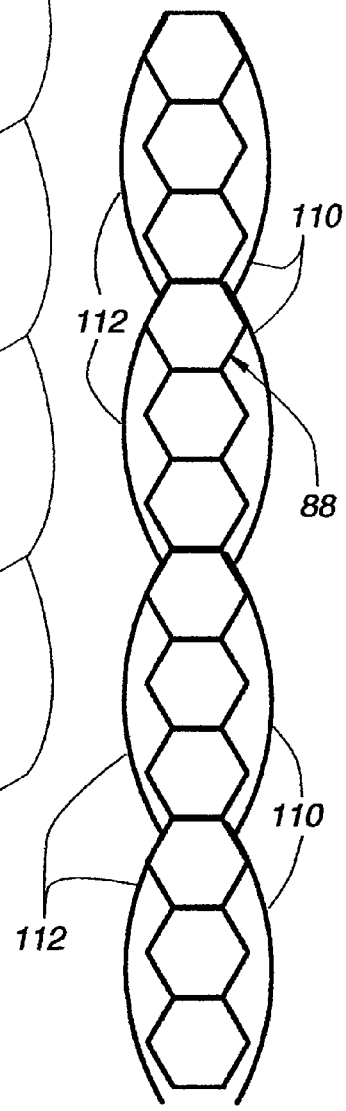
FIG. 9B is a side elevation of the fabric as shown in FIG. 9A.
Figure 9C:
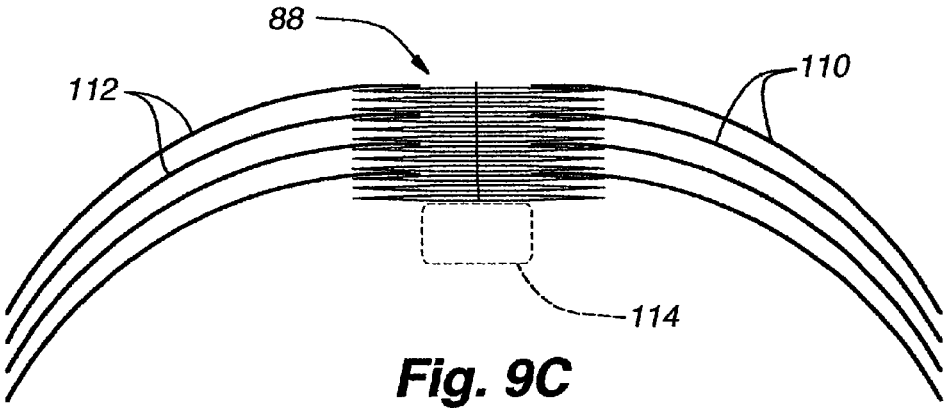
FIG. 9C is an enlarged side elevation of the fabric of FIG. 9A in a fully retracted position and showing a lift system in dashed lines.
Figure 9D:
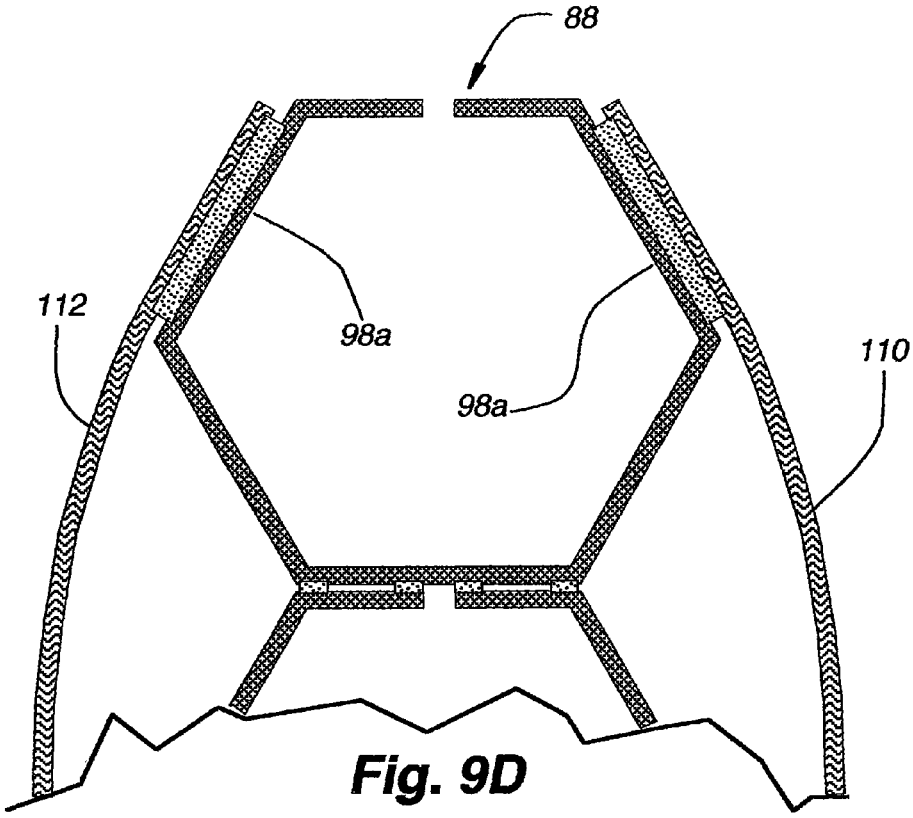
FIG. 9D is a further enlarged fragmentary side elevation of the fabric of FIG. 9A showing the uppermost cell of the support structure connected to the next lower cell and with the slats connected to opposite sides of the uppermost cell.
Figure 10A:
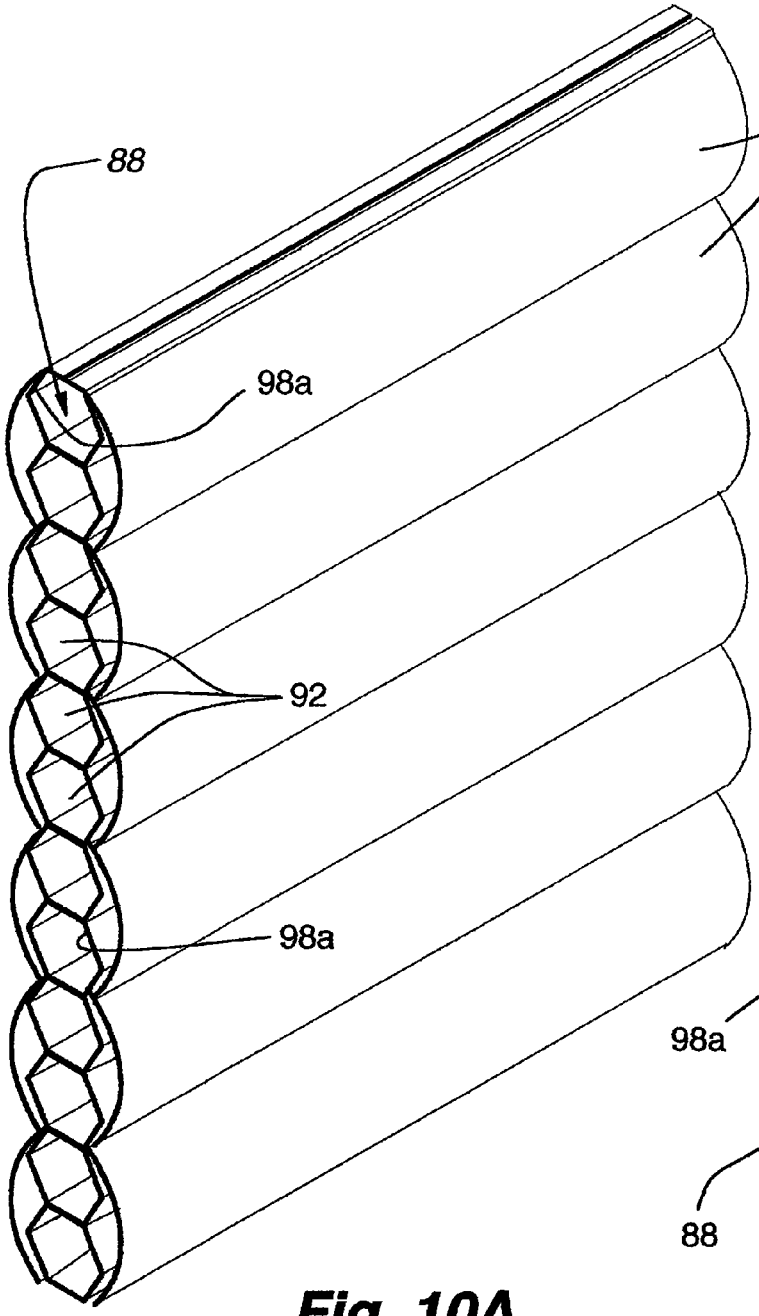
FIG. 10A is an isometric of a fifth embodiment of a fabric in accordance with the present invention shown in a fully extended position.
Figure 10B:
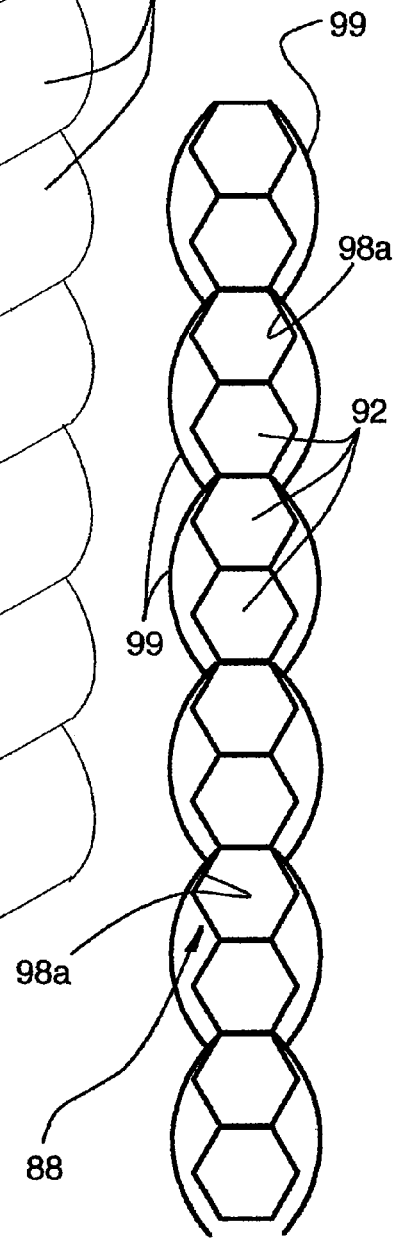
FIG. 10B is a side elevation of the fabric as shown in FIG. 10A.
Figure 10C:
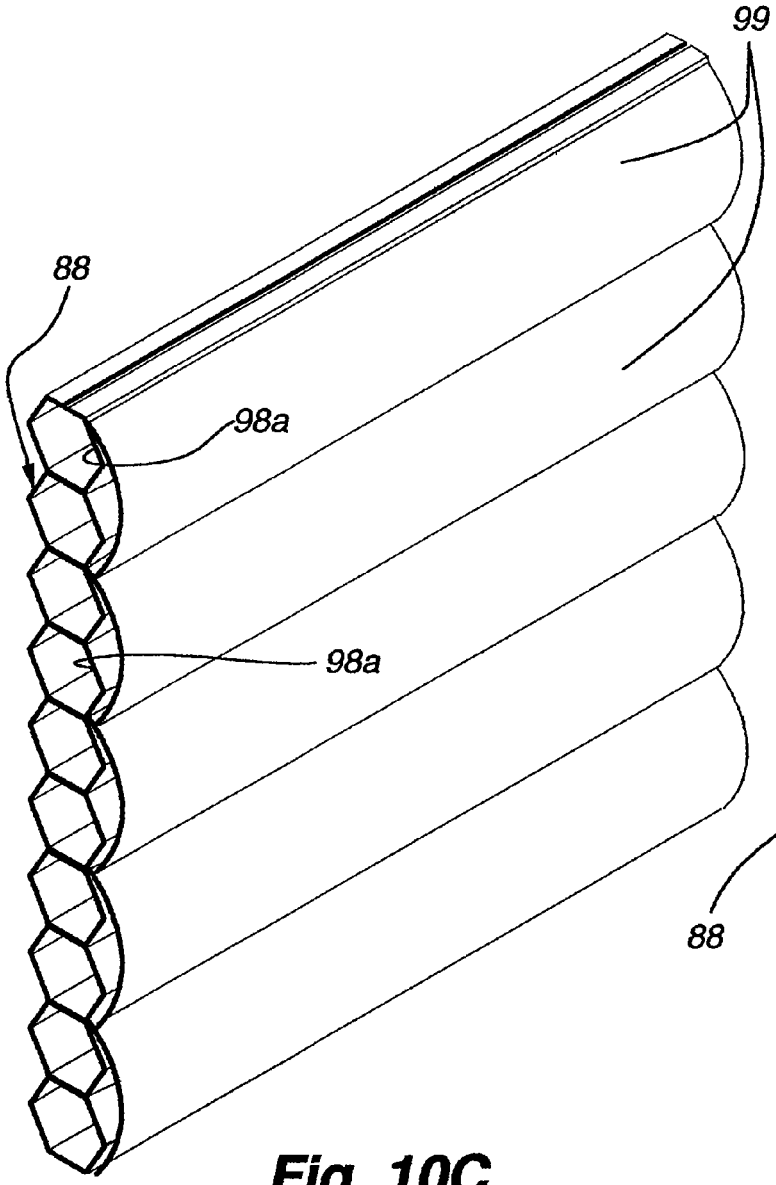
FIG. 10C is an isometric of a variation of the fabric of FIG. 10A in a fully extended position with slats on only one side of the cellular support structure.
Figure 10D:
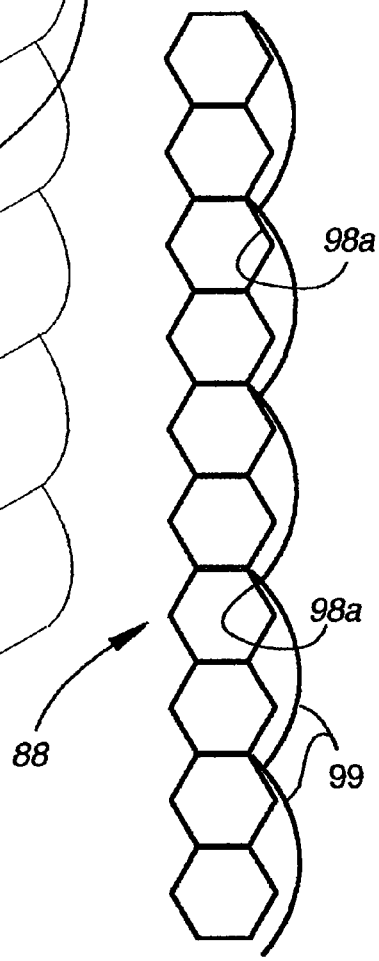
FIG. 10D is a side elevation of the fabric shown in FIG. 10C.
Figure 11A:
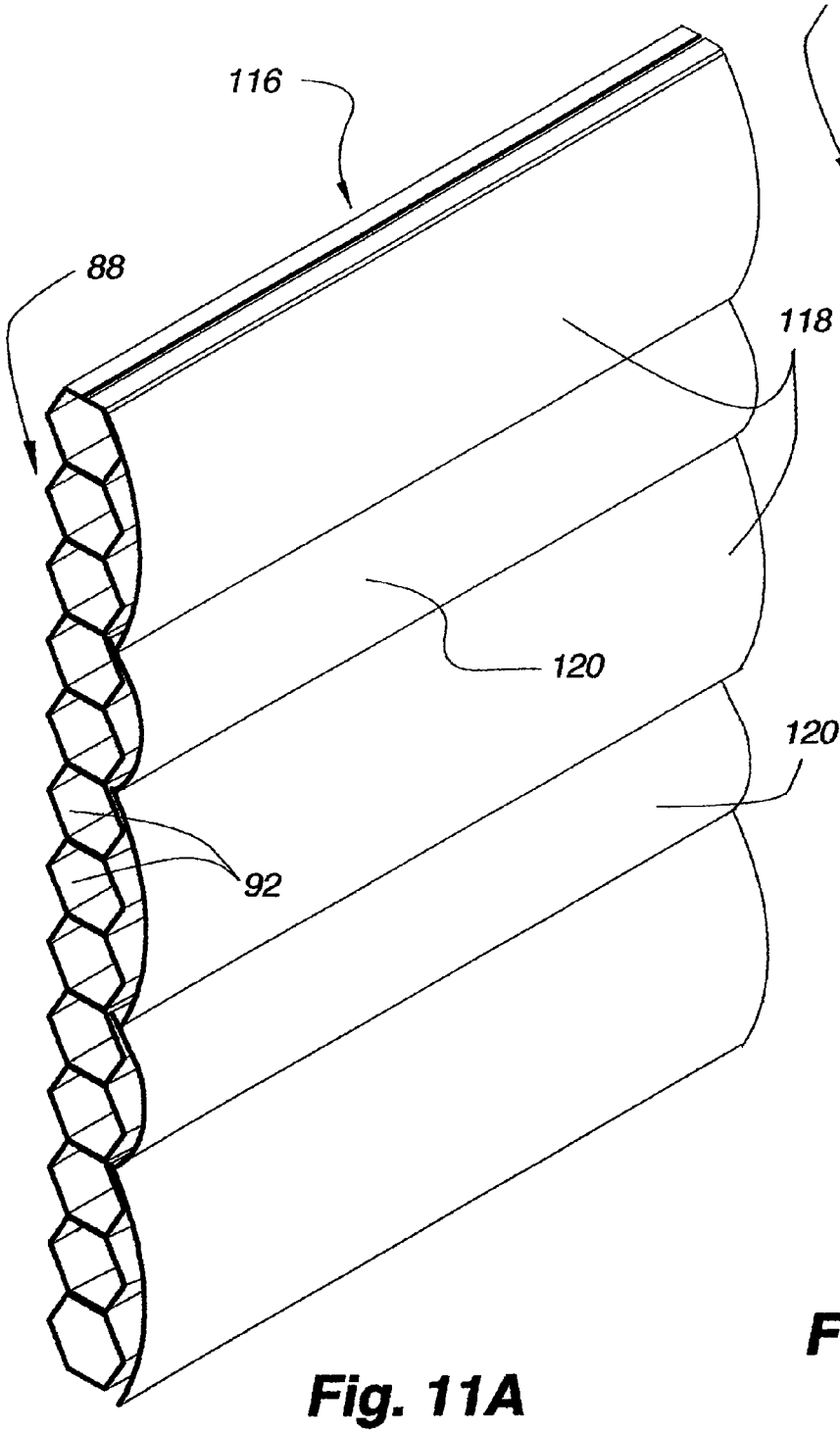
FIG. 11A is an isometric of a fully extended variation of the embodiment of FIGS. 9A and 9B with slats on only one side of the cellular support structure.
Figure 11B:
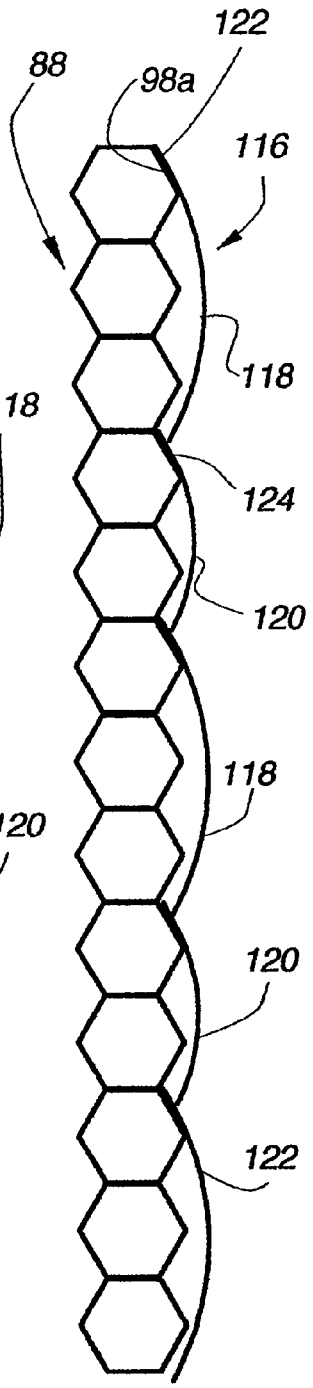
FIG. 11B is a side elevation of the fabric as shown in FIG. 11A.
Figure 11C:
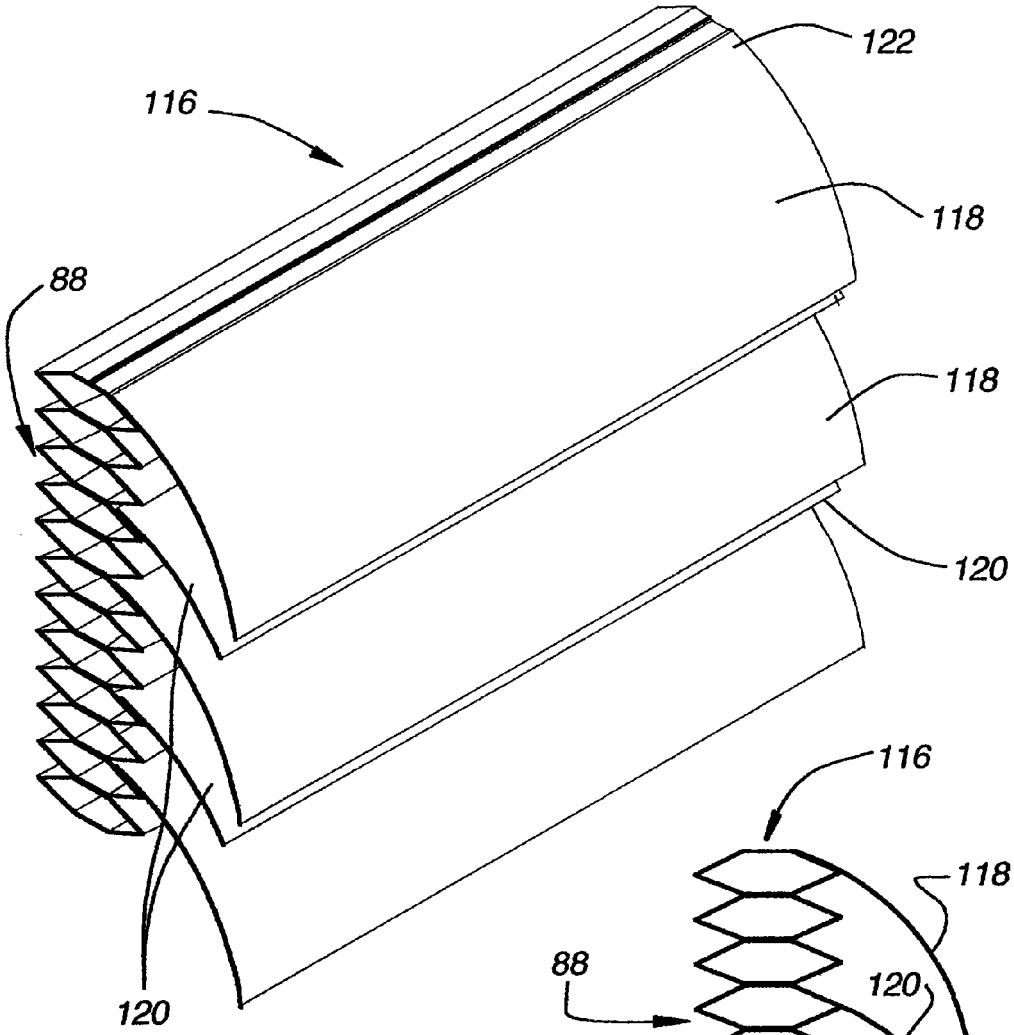
FIG. 11C is an isometric of the fabric of FIG. 11A in a partially retracted position.
Figure 11D:
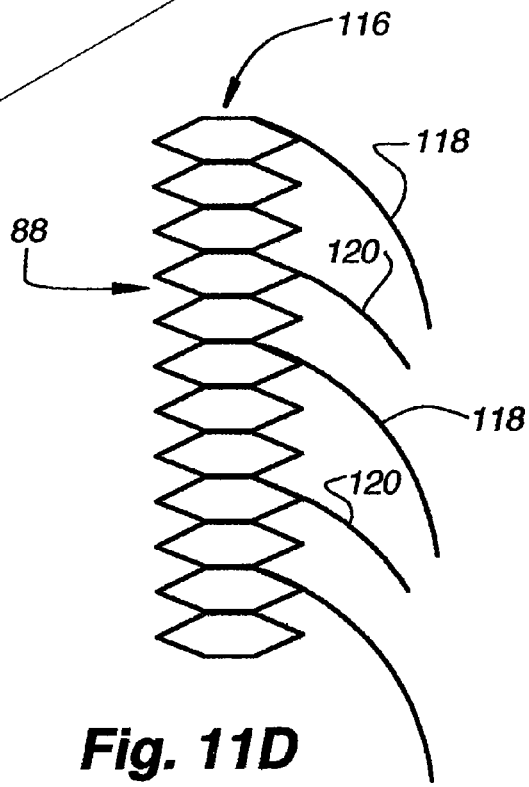
FIG. 11D is a side elevation of the fabric of FIG. 11A in a partially retracted position.

FIGS. 9A-9D illustrate a fourth embodiment of the invention very similar to that of FIG. 7 wherein a support structure 88 in the form of a collapsible cellular material supports a plurality of rigid or semi-rigid slats 110 off the upper segment 98*a* of the side wall of every fourth cell on the front side of the support structure. The embodiment of FIGS. 9A-9D, however, has an additional corresponding slat 112 on the rear side of the support structure with each rear slat being suspended from a corresponding top segment 98*a* of a side wall of a cell on the rear side of every fourth cell as shown in FIG. 9D. The slats suspended from the front and rear of the support structure 88 are identical and, as with the embodiment of FIG. 7, overlap the next adjacent lower slat so that when the fabric is fully extended as shown in FIGS. 9A and 9B, the cellular support structure is hidden from view. The structure is shown in a fully retracted position in FIG. 9C and a lift system 114 of the type previously described with the embodiment of FIG. 7 is shown in dashed lines. Again, the top segment 98*a* of each cell to which a slat is connected serves as a lever to raise the slat during retraction of the covering.

With reference to FIGS. 10A-10D, a fifth embodiment of the invention is shown similar to the embodiment of FIGS. 9A-9D with a support structure 88 in the form of collapsible interconnected hexagonal cells 92, but in this embodiment there are rigid or semi-rigid slats 99 secured to the top segment 98*a* of every third cell rather than every fourth cell and being disposed on the front and rear of the support structure, respectively.

With reference to FIGS. 11A-11D, a variation 116 of the invention is shown similar to the embodiment of FIG. 7 with a support structure 88 in the form of collapsible interconnected hexagonal cells 92 but in this embodiment there are two sizes of rigid or semi-rigid slats 118 and 120 that are utilized to obtain a different aesthetic. The first slat 118 has an upper margin 122 secured to the top segment 98*a* of the front side wall of a cell with adhesive, ultrasonic bonding or the like and is arcuate in cross section as in the embodiment of FIG. 7 and overlaps three cells. The next adjacent lower slat 120, however, has a shallower depth than the first-described slat 118 but also has an upper margin 124 secured to the top segment of the side wall of an associated cell but this slat only overlaps two hexagonal cells rather than the three cells overlapped by the first or uppermost slat. Every other slat moving downwardly is of the same size with the fabric so formed creating a different aesthetic as viewed in the fully extended position of FIGS. 11A and 11B and the partially retracted positions of FIGS. 11C and 11D. As will be appreciated again, the top segment 98*a* serves as a lever in raising a connected slat during retraction of the covering.

Figure 12A:
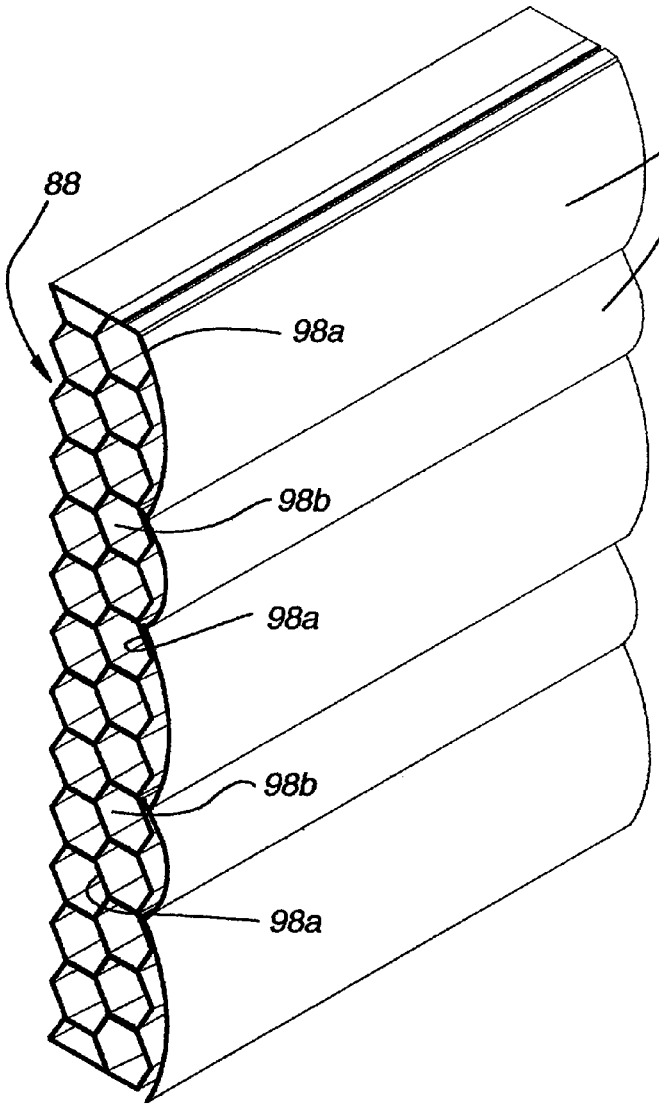
FIG. 12A is an isometric of a sixth embodiment of a fabric in accordance with the present invention shown in a fully extended position.
Figure 12B:
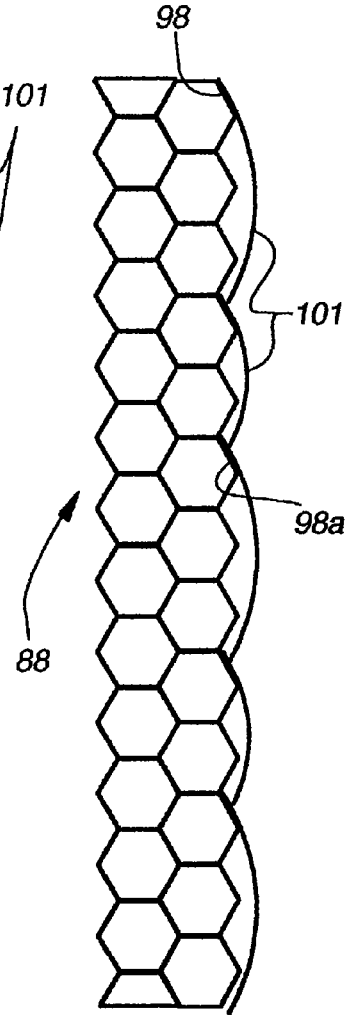
FIG. 12B is a side elevation of the fabric as shown in FIG. 12A.

A sixth embodiment of the present invention is shown in FIGS. 12A and 12B wherein the support structure is a double row of interconnected hexagonal cellular structures with each row being identical to a hexagonal structure 88 described previously but with each row being secured to the adjacent row along contiguous faces such as where an upper segment 98*a* of a cell engages a lower segment 98*b* of the next adjacent upper cell of the adjacent row. In this embodiment, the slats are similar to those illustrated in FIGS. 11A-11D wherein alternating slats 101 overlap either two or three cells, respectively, with each slat being secured to the upper segment 98*a* of its associated slat so that the upper segment 98*a* can serve as a lever in moving the associated slat. The lower edges of each slat slightly overlap the upper edge of the next adjacent lower slat so that when in the fully extended position illustrated in FIGS. 12A and 12B, a double row cellular structure is hidden from view from one side of the fabric.

Figure 13A:
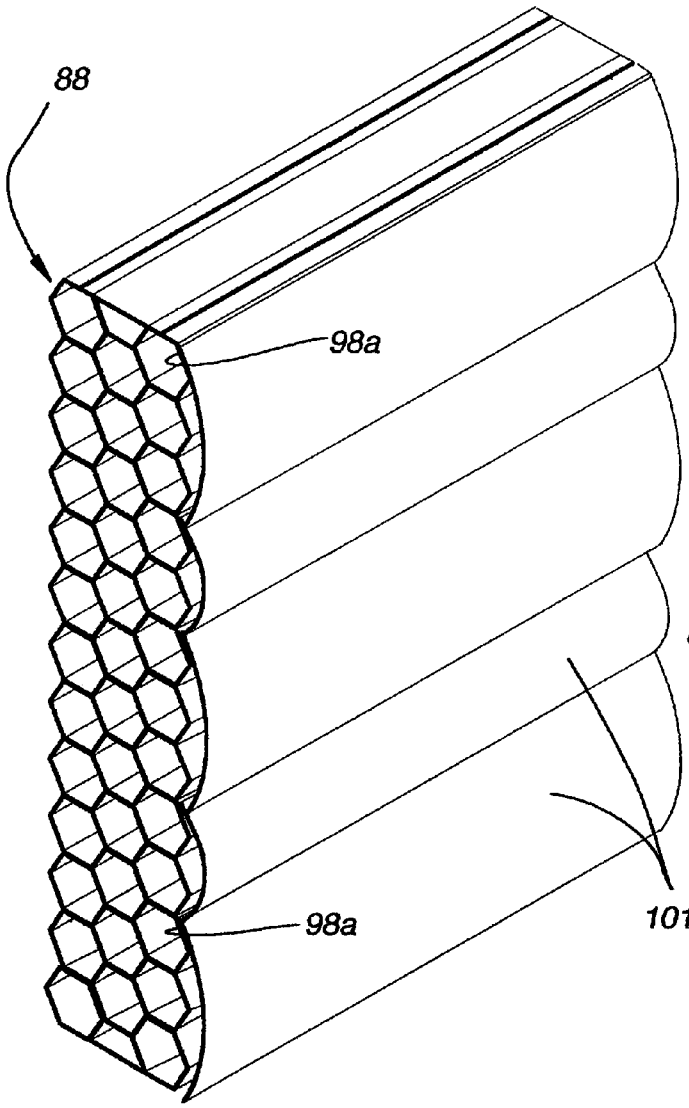
FIG. 13A is an isometric of a seventh embodiment of a fabric in accordance with the present invention in a fully extended position.
Figure 13B:
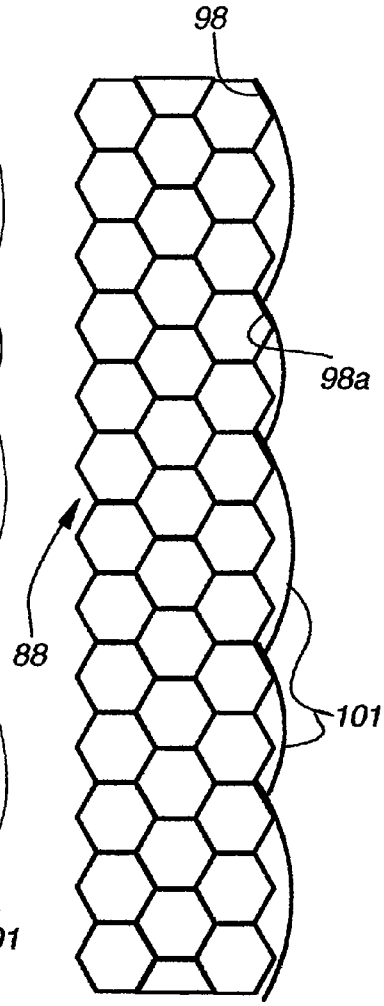
FIG. 13B is a side elevation of the fabric of FIG. 13A.

A seventh embodiment of the present invention is illustrated in FIGS. 13A and 13B, which is similar to that of the sixth embodiment except the support structure 88 is in the form of three rows of interconnected cellular structures with each row having superimposed interconnected cells of transverse hexagonal configuration and with each row interconnected with an adjacent row along the upper segments of the cells where they engage with the lower segment of the next adjacent upper cell of the adjacent row. Again the slats 101, as in the sixth embodiment, alternate in size with every other slat bridging two cells or three cells, respectively, and being connected along its upper edge to the upper segment 98*a* of an associated cell in a manner such that the upper segment 98*a* serves as a lever in moving an associated slat.

Figure 14A:
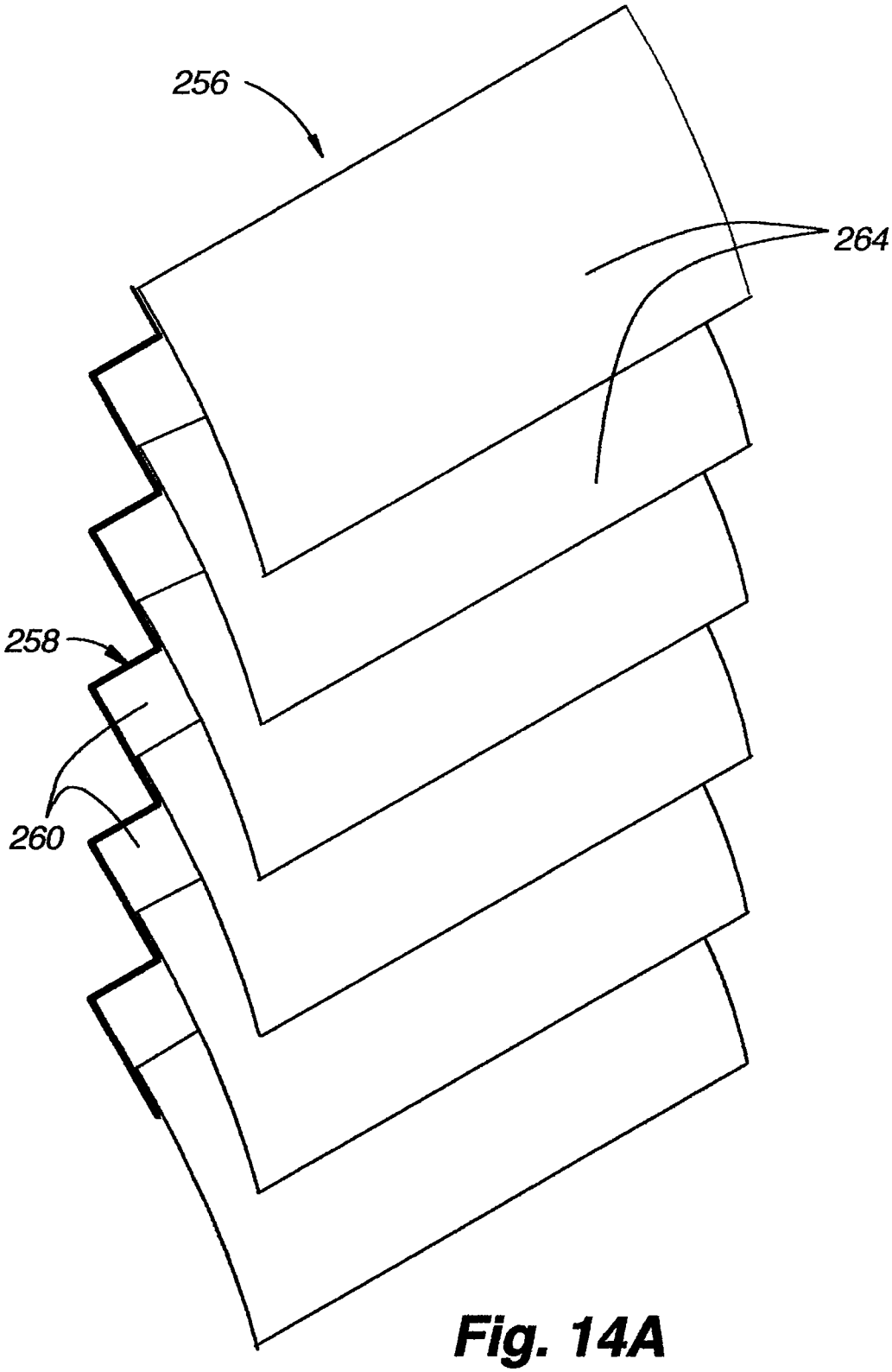
FIG. 14A is an isometric of an eighth embodiment of a fabric in accordance with the present invention in a partially extended position.
Figure 14D:
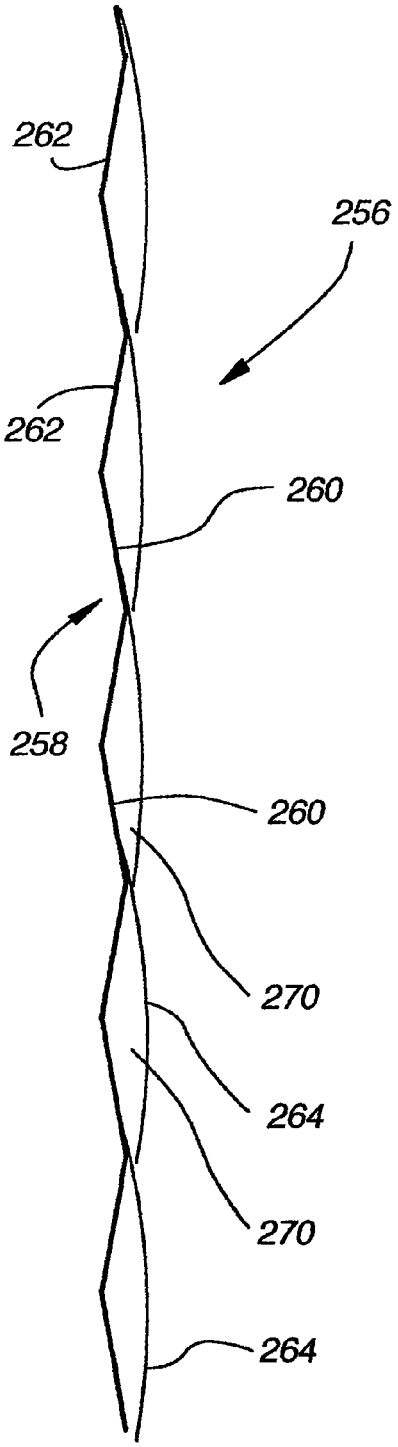
FIG. 14D is a side elevation of the fabric of FIG. 14A in a fully extended position.
Figure 14B:
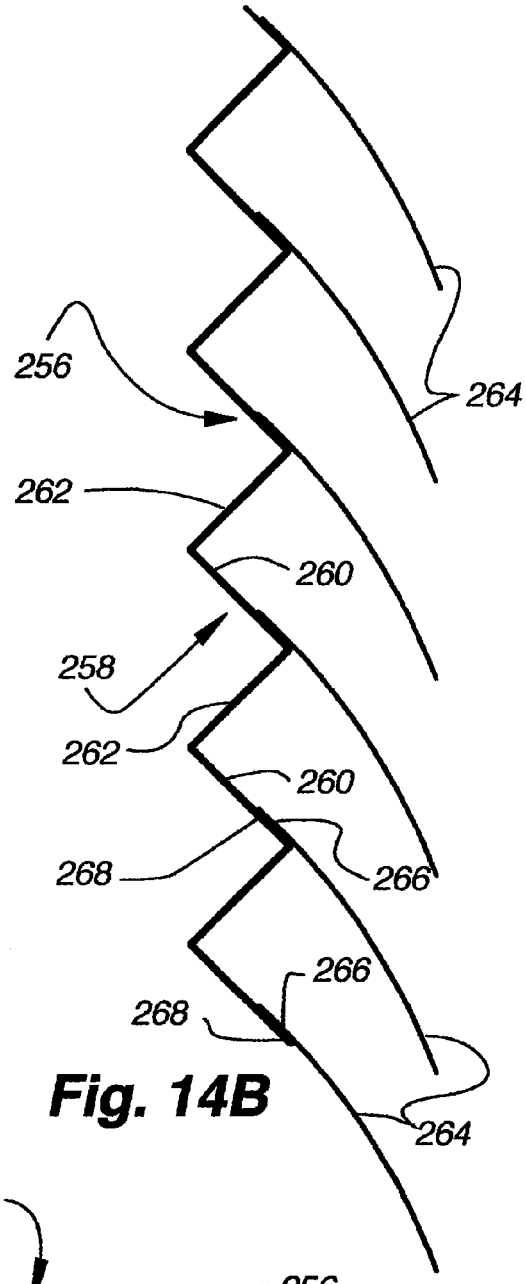
FIG. 14B is a side elevation of the fabric as shown in FIG. 14A.
Figure 14C:
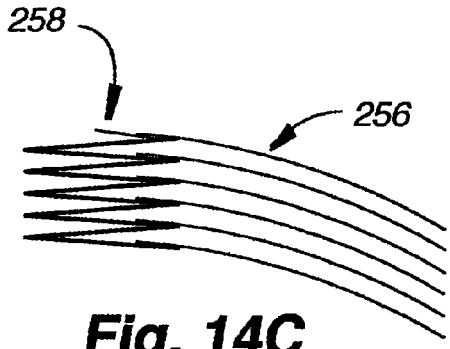
FIG. 14C is a side elevation of the fabric shown in FIG. 14A in a fully retracted position.
Figure 15A:
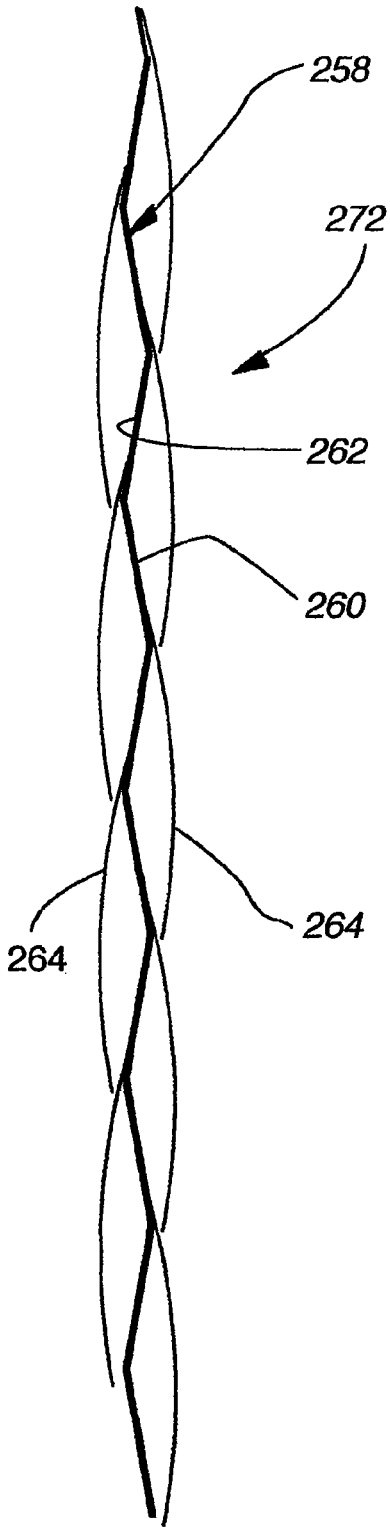
FIG. 15A is a side elevation of a variation of the fabric of FIG. 14A with slats on both sides of the pleated support structure and with the fabric fully extended.
Figure 15B:
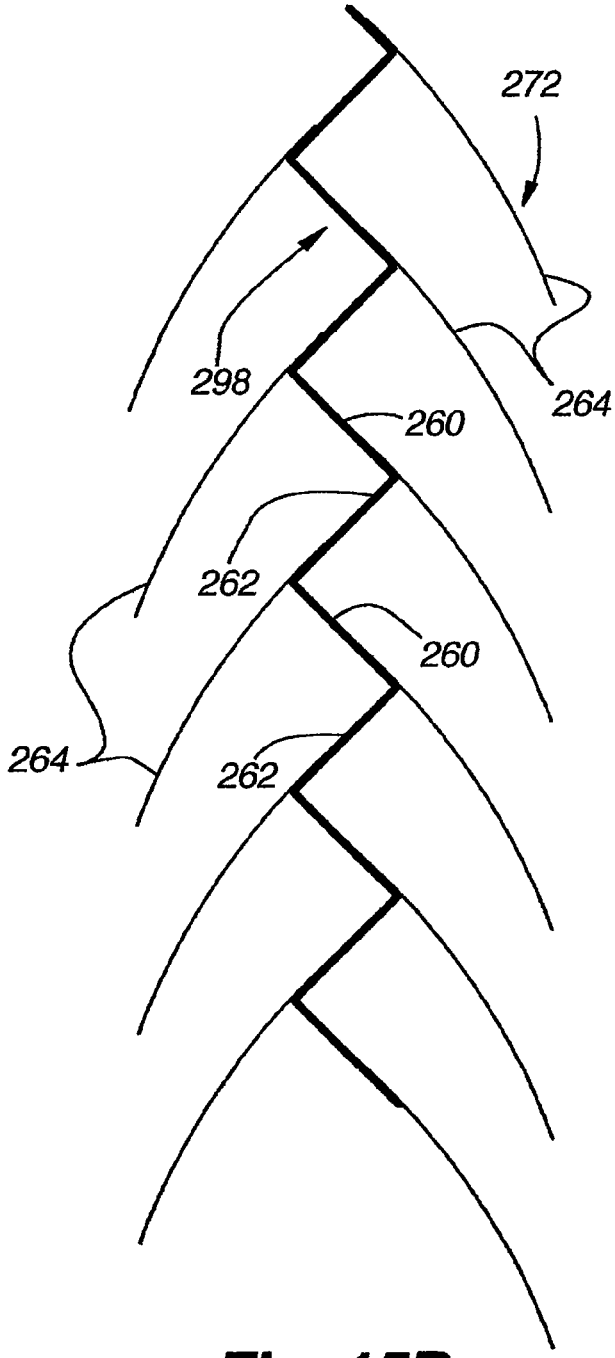
FIG. 15B is an isometric of the fabric as shown in FIG. 15A in a partially retracted position.
Figure 15C:
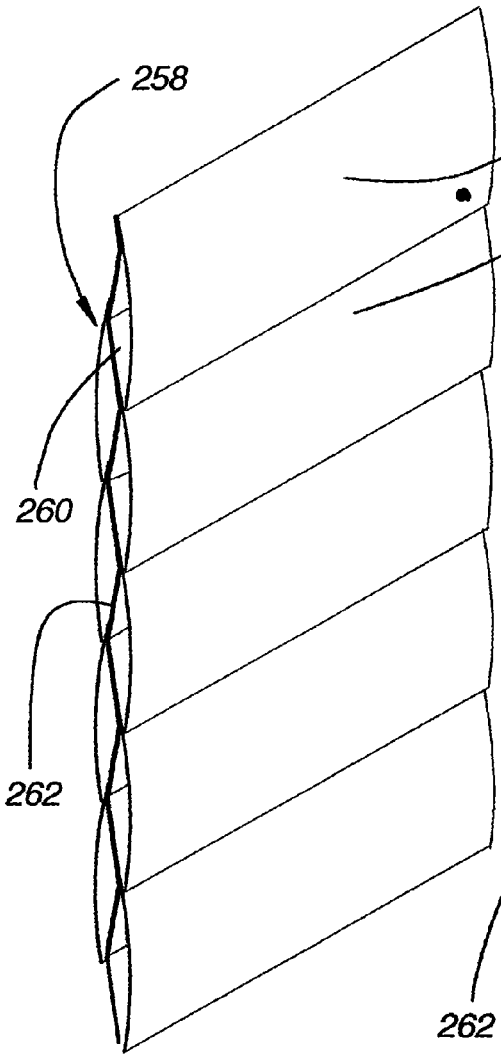
FIG. 15C is an isometric of the fabric shown in FIG. 15A in a fully extended position.
Figure 15D:
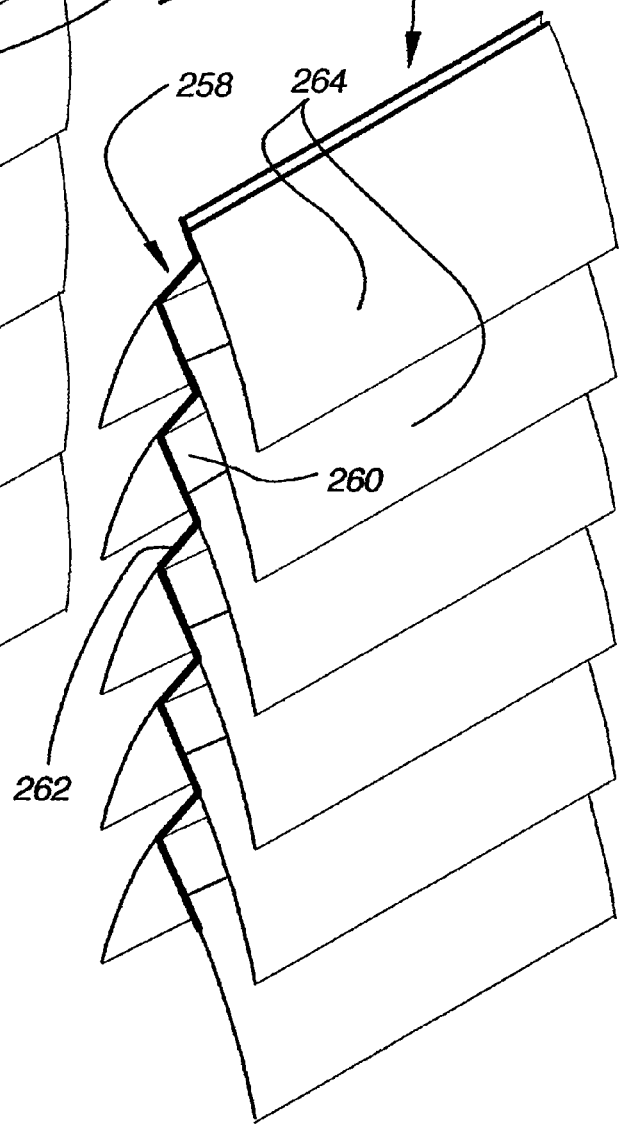
FIG. 15D is an isometric of the fabric of FIG. 15A.

An eighth embodiment 256 of the present invention is illustrated in FIGS. 14A-14D. In this embodiment, the support structure 258 is in the form of a pleated semi-rigid sheet of material which may be of the type found in pleated-shades for window coverings. The support structure thereby defines forwardly downwardly sloped surfaces 260 as well as rearwardly downwardly sloped surfaces 262. The slats 264 for this embodiment of the invention comprise semi-rigid elongated strips of material of slightly arcuate transverse cross-section with each slat having an upper marginal zone 266 secured to a lower marginal zone 268 of a forwardly downwardly sloped surface 260 of the support structure. FIG. 14D shows the fabric 256 in a fully expanded position where the pleated support structure can be seen to extend almost vertically and with each slat overlapping the next adjacent lower slat and with the slats themselves in combination defining a substantially planar wall parallel with the support structure while defining relatively thin cells 270 therebetween. FIGS. 14A and 14B illustrate the fabric in a partially retracted condition with FIG. 14C showing the fabric in a fully retracted position with the slats forming substantially horizontal extensions away from the compressed support structure. It should be appreciated that the surfaces 260 to which a slat is connected serves as a lever in unitarily moving a slat therewith.

FIGS. 15A-15D illustrate a variation 272 of the present invention that is very similar to that illustrated in FIG. 14A wherein the support structure 258 is again a pleated material of semi-rigid construction having horizontal fold lines to define forwardly downwardly 260 and rearwardly downwardly 262 sloped surfaces. There are a set of semi-rigid slats 264 of slightly arcuate transverse cross-section having marginal zones 266 along their upper edges secured to the forwardly downwardly sloping surfaces 260 and another set of identical slats 264 secured to the lower edge of the rearwardly downwardly sloping surfaces. The fabric is shown in a fully extended condition in FIGS. 15A and 15D, and in a partially retracted condition in FIGS. 15B and 15D. In this variation, the surfaces 260 and 262 serve as levers in moving associated slats in unison therewith.

Figure 16A:
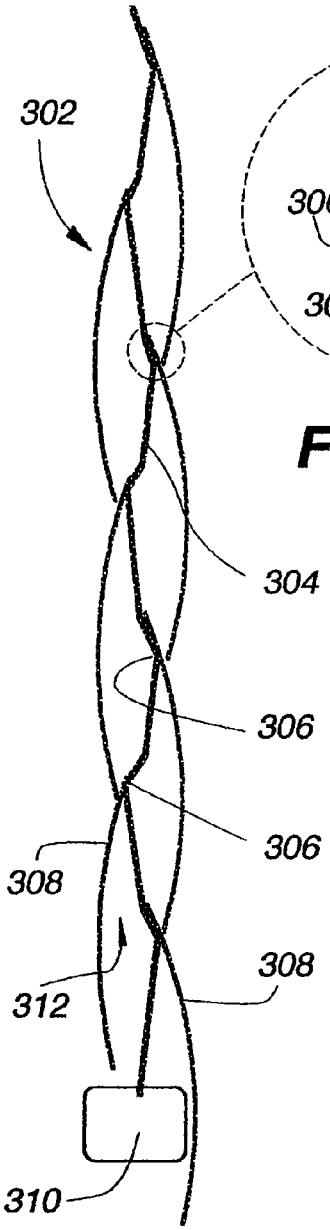
FIG. 16A is a side elevation of a ninth embodiment of a fabric in accordance with the present invention shown in a fully extended position.
Figure 16B:
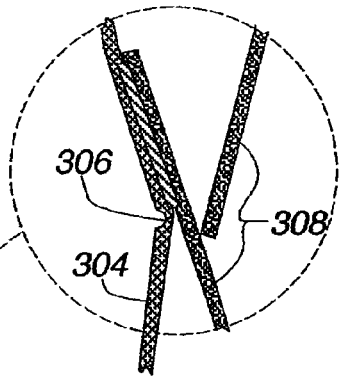
FIG. 16B is an enlarged side elevation of the fabric shown in the circled area of FIG. 16A.
Figure 16C:
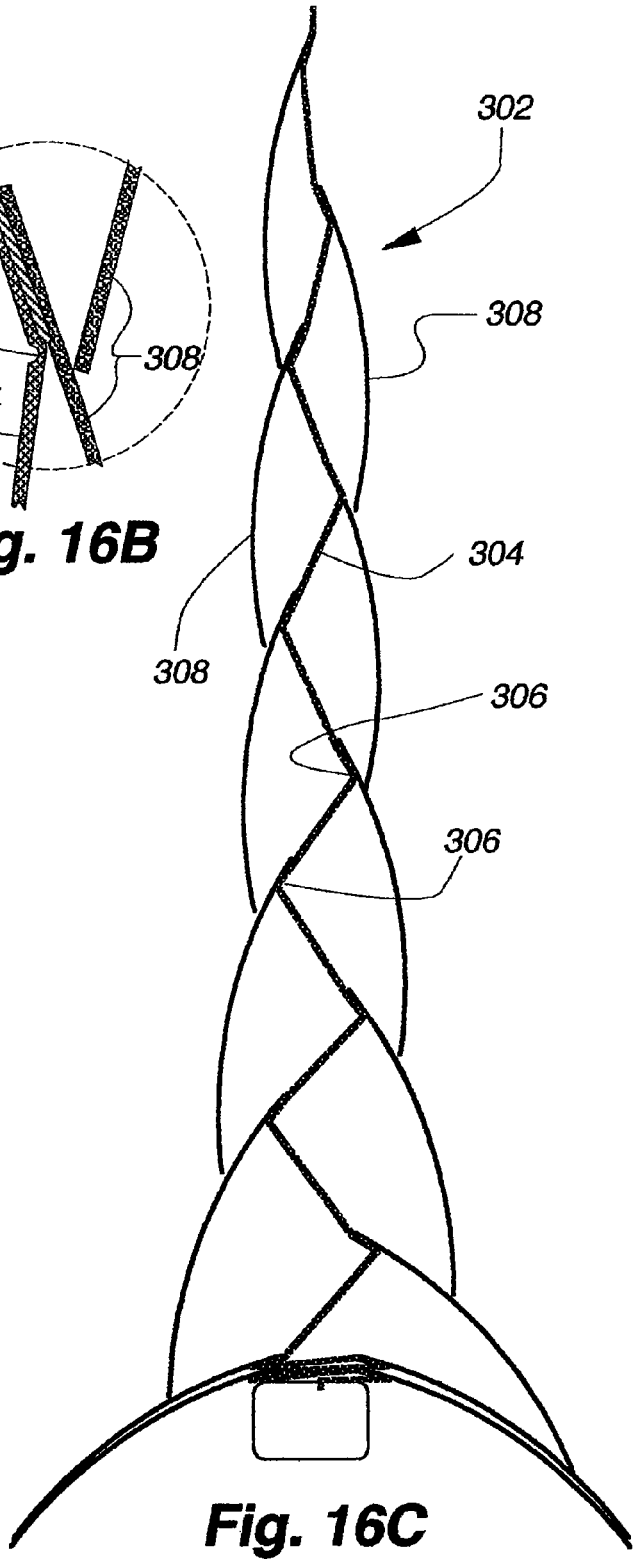
FIG. 16C is a side elevation of the fabric shown in FIG. 16A in a partially retracted position.

A ninth embodiment of the invention is illustrated in FIGS. 16A-16C and utilizes a sheet of flexible or semi-rigid material 304 as the support structure with the sheet of material being creased at 306 in opposite surfaces at vertically spaced locations so the sheet of material will easily fold at the crease line as shown best in FIG. 16B. The slats or vanes 308 are rigid or semi-rigid and are connected to opposite sides of the support sheet and are of arcuate transverse cross-section but have no tabs. Rather, the vanes are secured directly to the associated side of the support sheet 304 immediately above a crease 306. In this arrangement, when the fabric is fully extended, which might be assisted by a weighted bottom rail 310, the fabric has the appearance illustrated in FIG. 16A. The bottommost slat on the front face of the sheet of support material overlaps the bottom rail 310 for aesthetic purposes. As the weighted bottom rail is lifted, the bottom rail is drawn into a gap 312 between the lowermost slat on the front and rear face of the support sheet causing the slats to flare outwardly in opposite directions and the support sheet to fold in an accordion-like manner as viewed in FIG. 16C in a partially retracted condition of the fabric. The sheet of material, along the surface where a slat is connected, serves as a lever in moving the slats during extension and retraction of the covering.

Figure 17A:
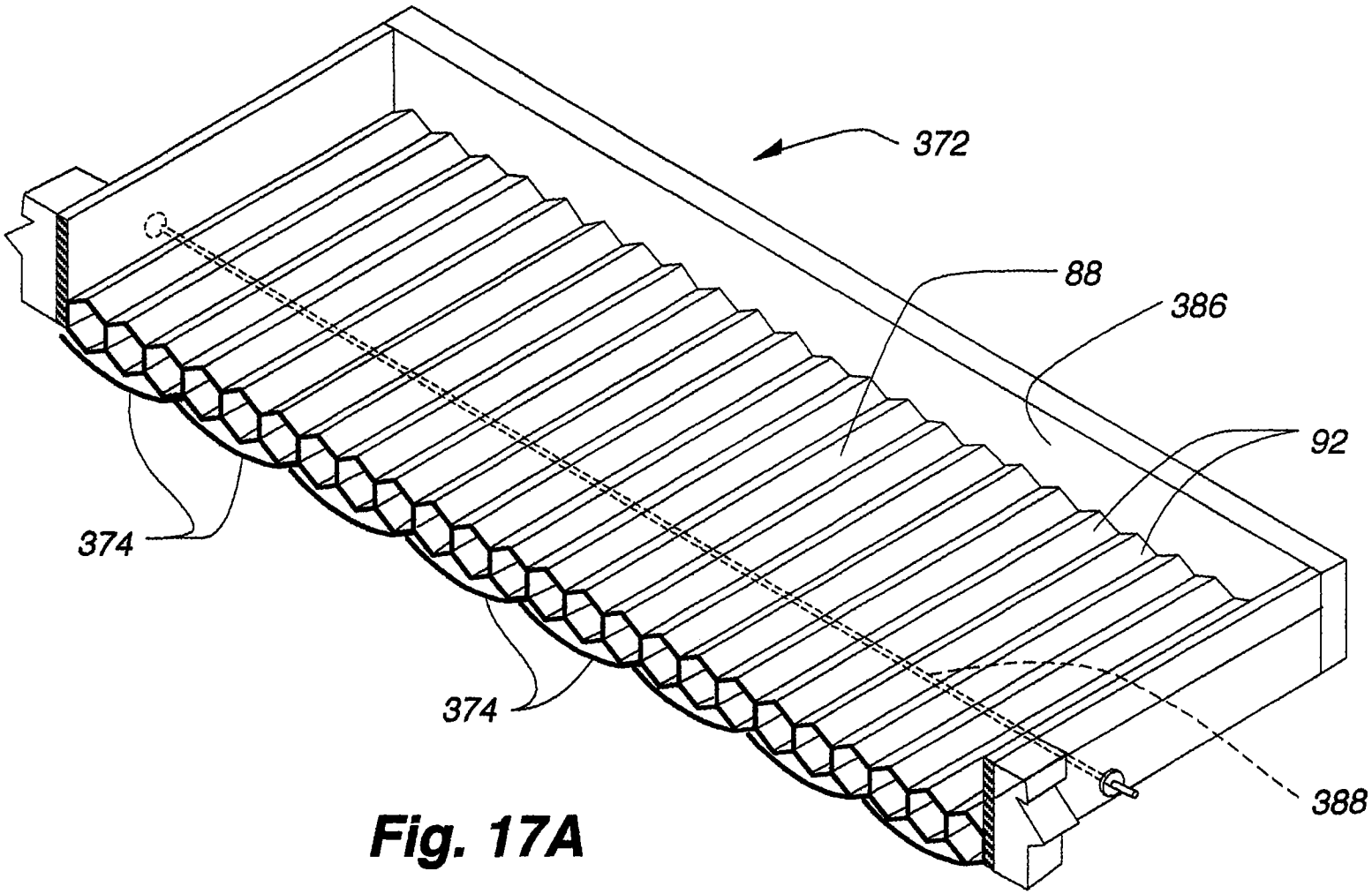
FIG. 17A is a fragmentary isometric showing a tenth embodiment of a fabric in accordance with the present invention mounted horizontally and in a fully extended position.
Figure 17B:
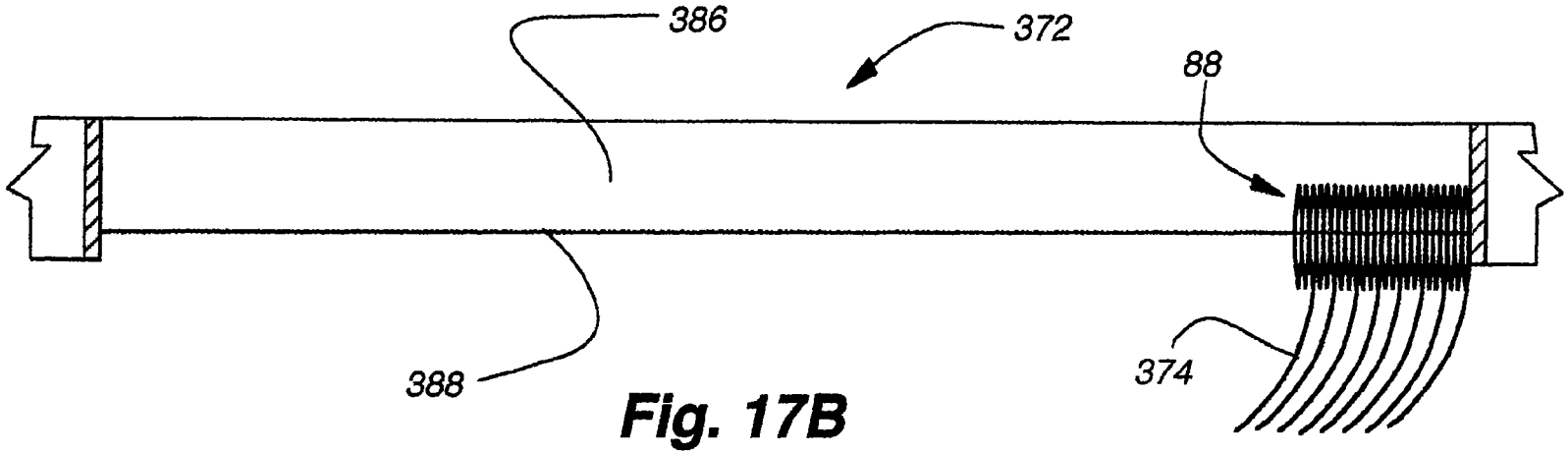
FIG. 17B is a fragmentary vertical section of the fabric of FIG. 27A in a fully retracted position.
Figure 17C:
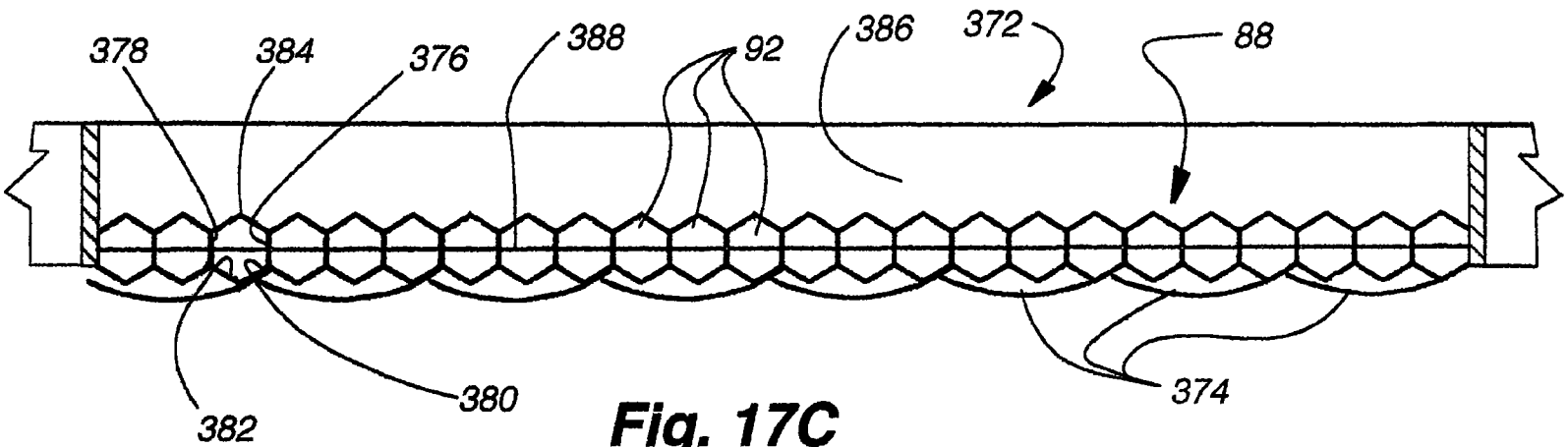
FIG. 17C is a fragmentary vertical section of the fabric of FIG. 27A in a fully extended position.

A tenth embodiment 372 of the present invention is shown in FIGS. 17A-17C. In this embodiment of the invention, the support structure 88 is again formed from a plurality of interconnected semi-rigid cells 92 of hexagonal transverse cross-section which are transversely collapsible and wherein a plurality of rigid or semi-rigid slats 374 of arcuate transverse cross-section are secured to selected cells along one edge of the slat. The cells have top 376 and bottom 378 walls that are interconnected by side walls having upper 380 and lower 382 segments formed on opposite sides of creased fold lines 384. The slats 374 are secured to an upper segment 380 of one side wall along one edge so as to overlap an adjacent slat along the opposite edge when the fabric is extended as in FIG. 17A. The surfaces 380 to which a slat is connected serve as levers in moving the slats in unison therewith. This fabric arrangement can be seen to be identical to that illustrated in FIG. 7 except the fabric in FIGS. 17A-17C is mounted horizontally and can be supported in a horizontal position within a framework 386 by horizontal support rods 388 extending through the cells 92 of the support structure. The fabric is shown in FIG. 17C in a fully expanded condition across the opening defined by the framework and as will be appreciated the slats extend in substantially parallel relationship with the cellular support structure. When the fabric material is retracted, as shown in FIG. 17B, the cells are transversely compressed and the slats hang downwardly therefrom in parallel relationship.

Figure 18C:
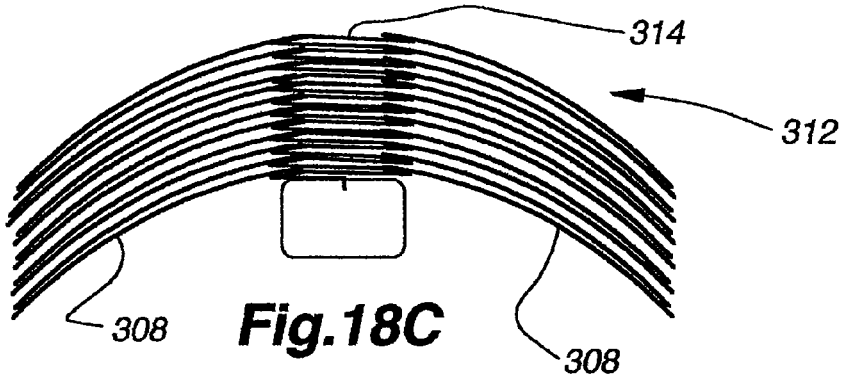
FIG. 18C is a side elevation of the fabric of FIG. 18A in a fully retracted position.
Figure 18B:
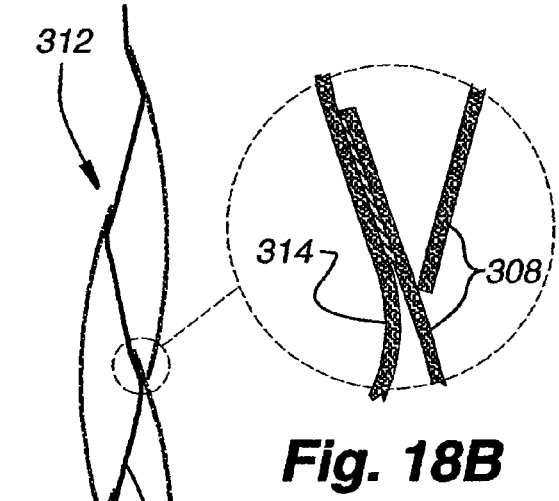
FIG. 18B is an enlarged side elevation showing the encircled area of FIG. 18A.
Figure 18A:
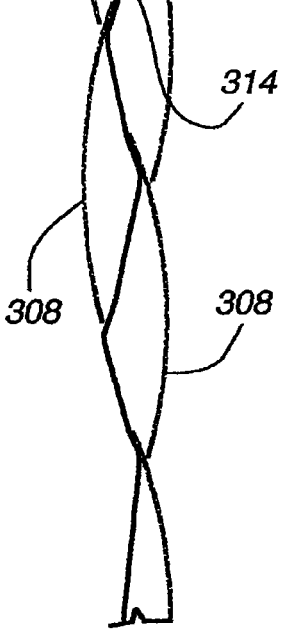
FIG. 18A is a fragmentary side elevation of an eleventh embodiment of a fabric in accordance with the present invention in a fully extended position.
Figure 18D:
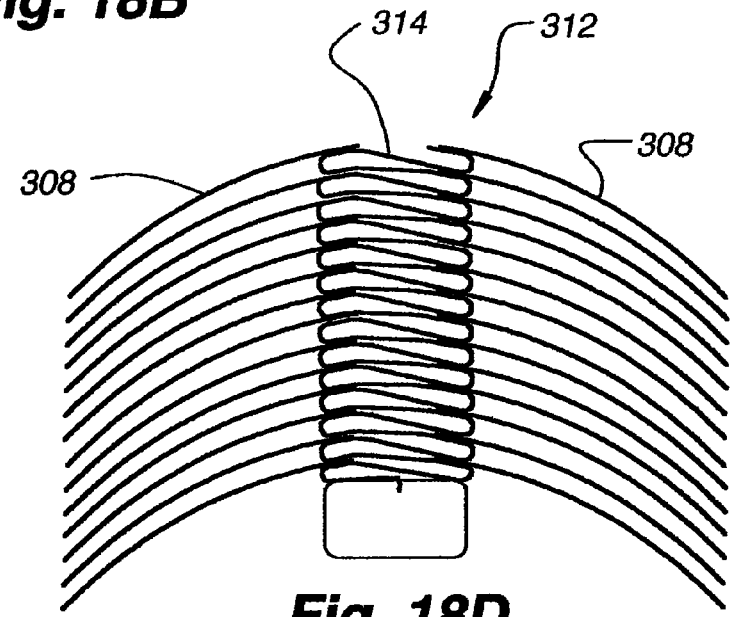
FIG. 18D is a side elevation of the fabric of FIG. 18A in a partially retracted position.

FIGS. 18A-18D illustrate another arrangement 312 similar to that of FIGS. 16A-16C except the support sheet 314 is preferably flexible and has not been horizontally creased at vertically spaced locations, but again the slats 308 which are rigid or semi-rigid and arcuate in cross-section are secured to the sheet at alternating locations on the front and rear of the sheet so the fabric resembles that of FIG. 16A except the support sheet passes through smooth curving lines rather than the folding lines established by the creases 306 of FIG. 16A. As in other embodiments, the sheet, at the locations where it is connected to a slat, serves as a lever in moving the slats during extension and retraction of the covering. FIG. 18D shows the fabric of FIG. 18A in a partially retracted position with the slats flaring outwardly in opposite directions and the support sheet folded in a zigzag pattern above the bottom rail. FIG. 18C shows the fabric in a fully retracted position.

Figure 19A:
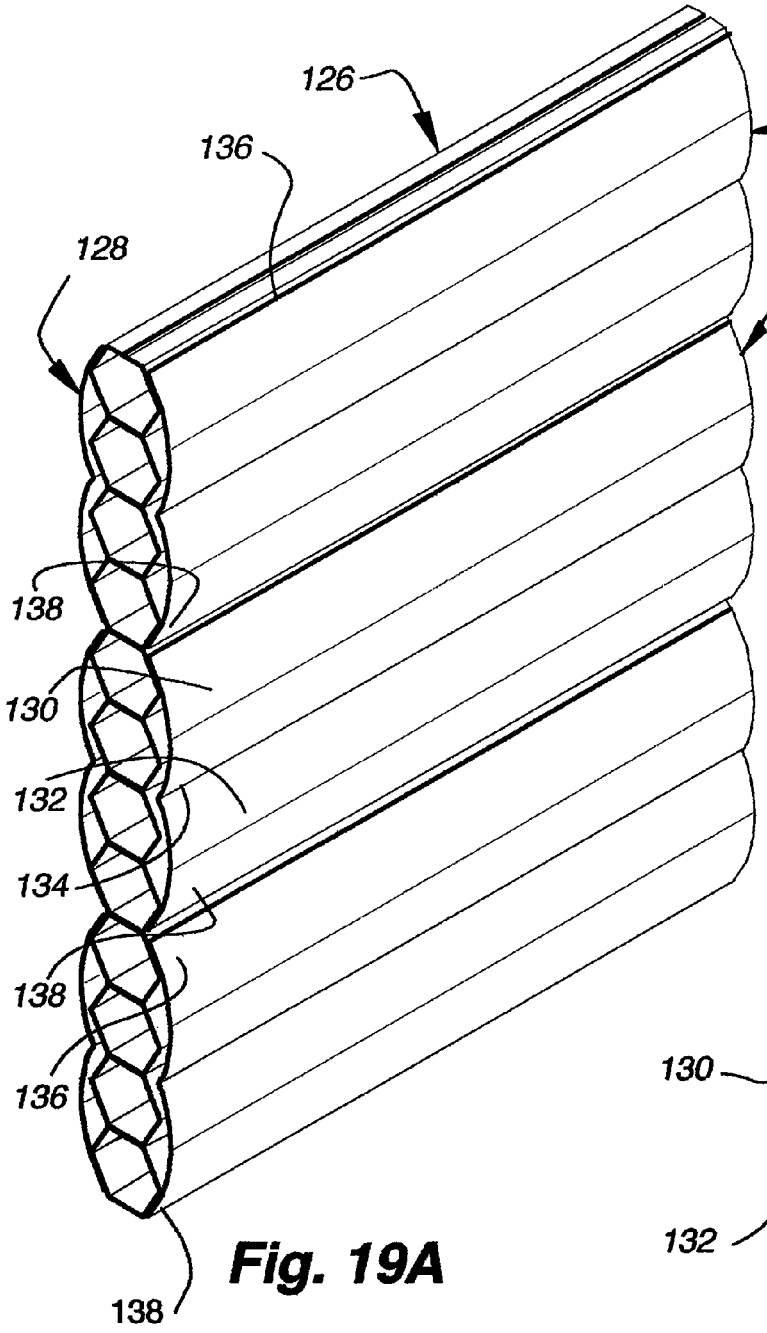
FIG. 19A is an isometric of a twelfth embodiment of a fabric in accordance with the present invention shown in a fully extended position.
Figure 19B:
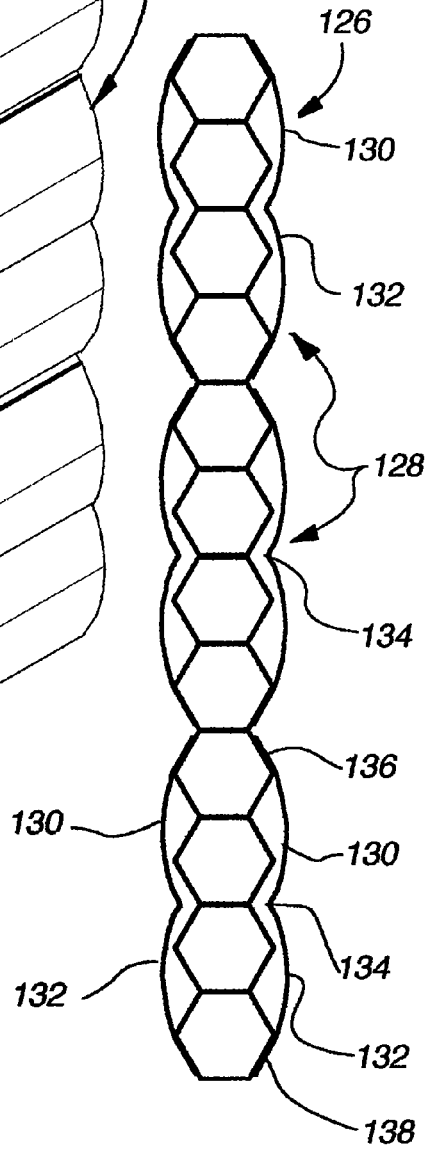
FIG. 19B is a side elevation of the fabric as shown in FIG. 19A.
Figure 19C:
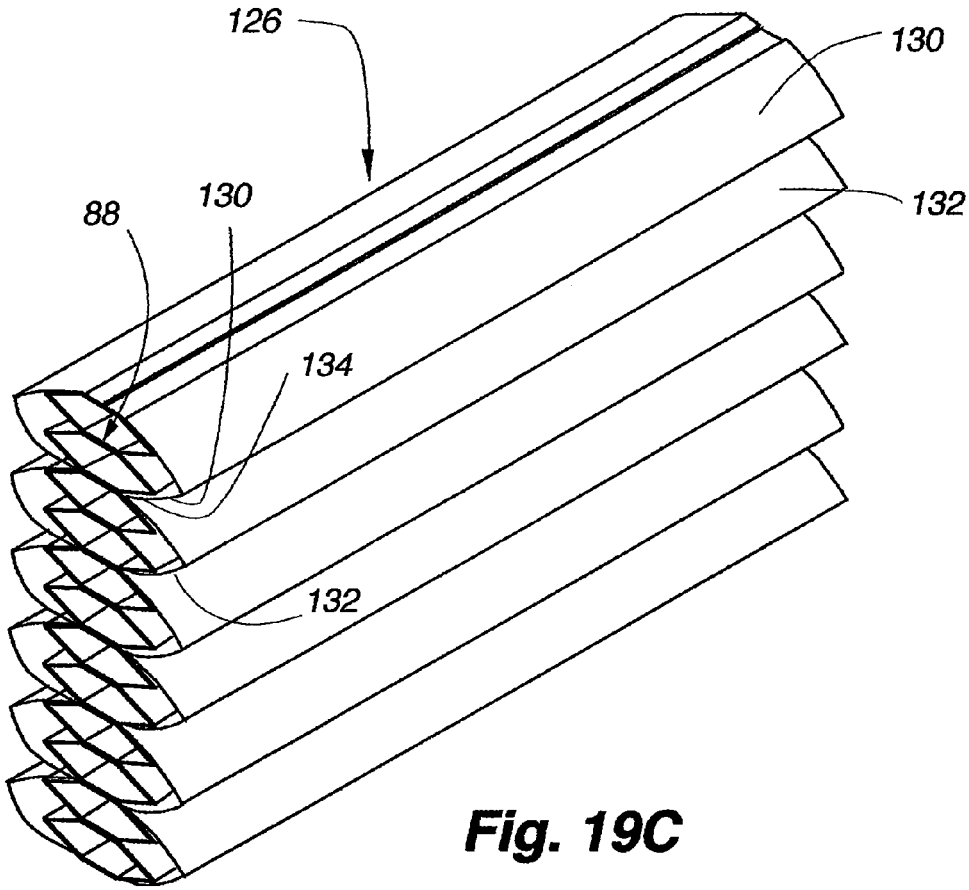
FIG. 19C is an isometric of the fabric of FIG. 19A in a partially retracted position.
Figure 19D:
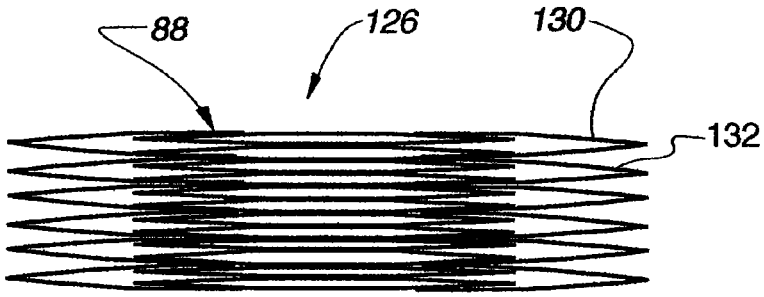
FIG. 19D is an enlarged side elevation of the fabric of FIG. 19A in a fully retracted position.
Figure 20A:
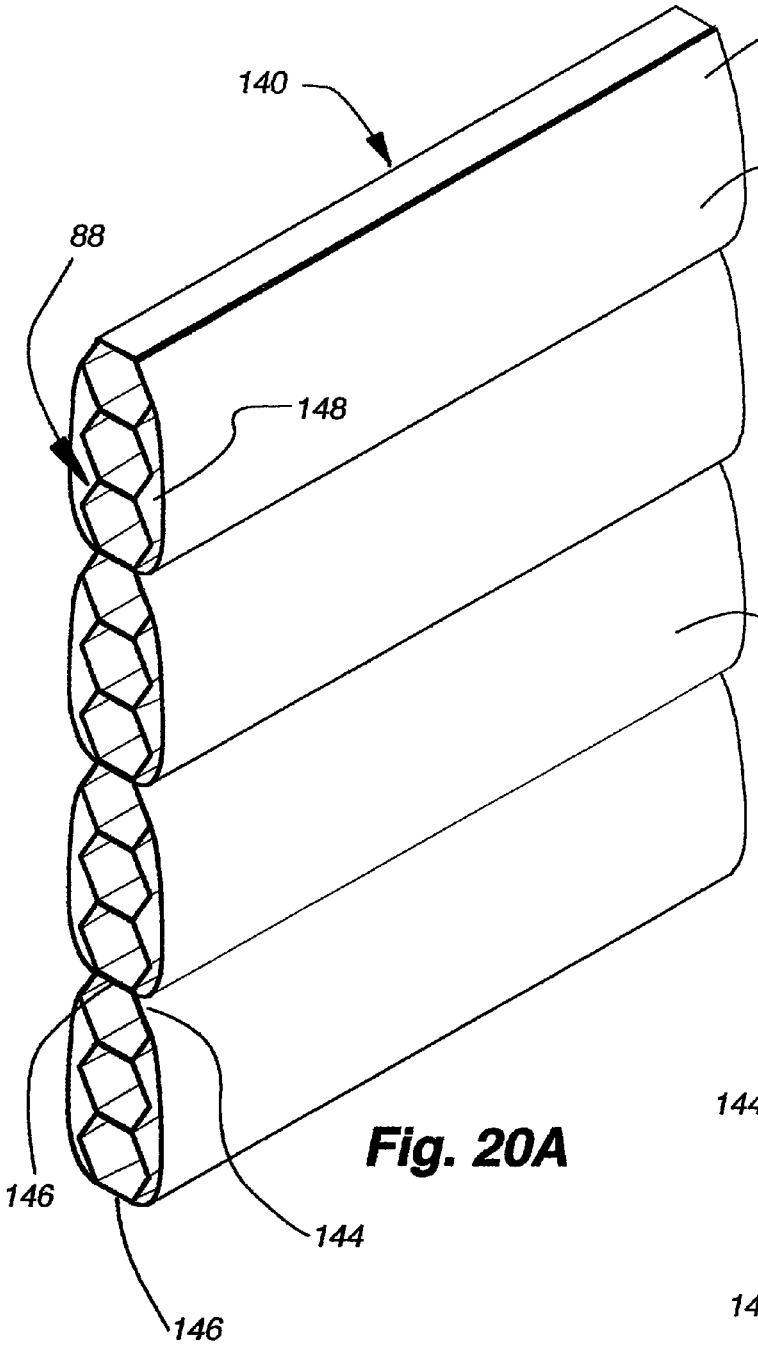
FIG. 20A is an isometric of a thirteenth embodiment of a fabric in accordance with the present invention shown in a fully extended position.
Figure 20B:
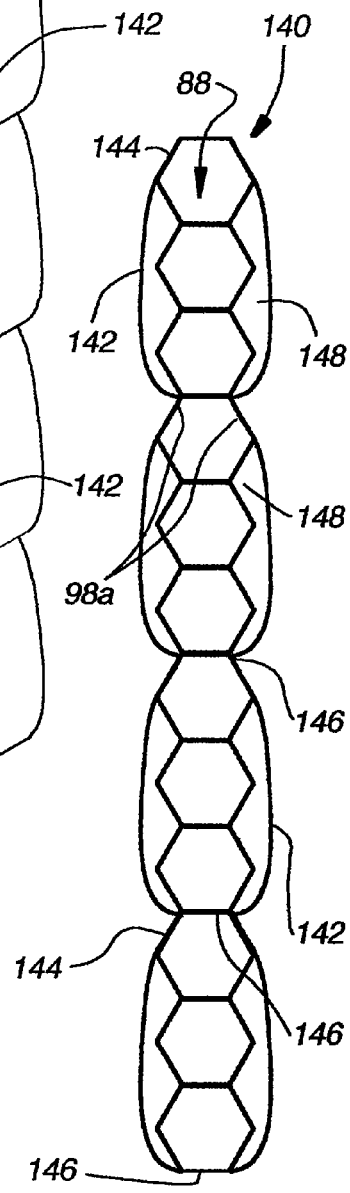
FIG. 20B is a side elevation of the fabric as shown in FIG. 20A.
Figure 20C:
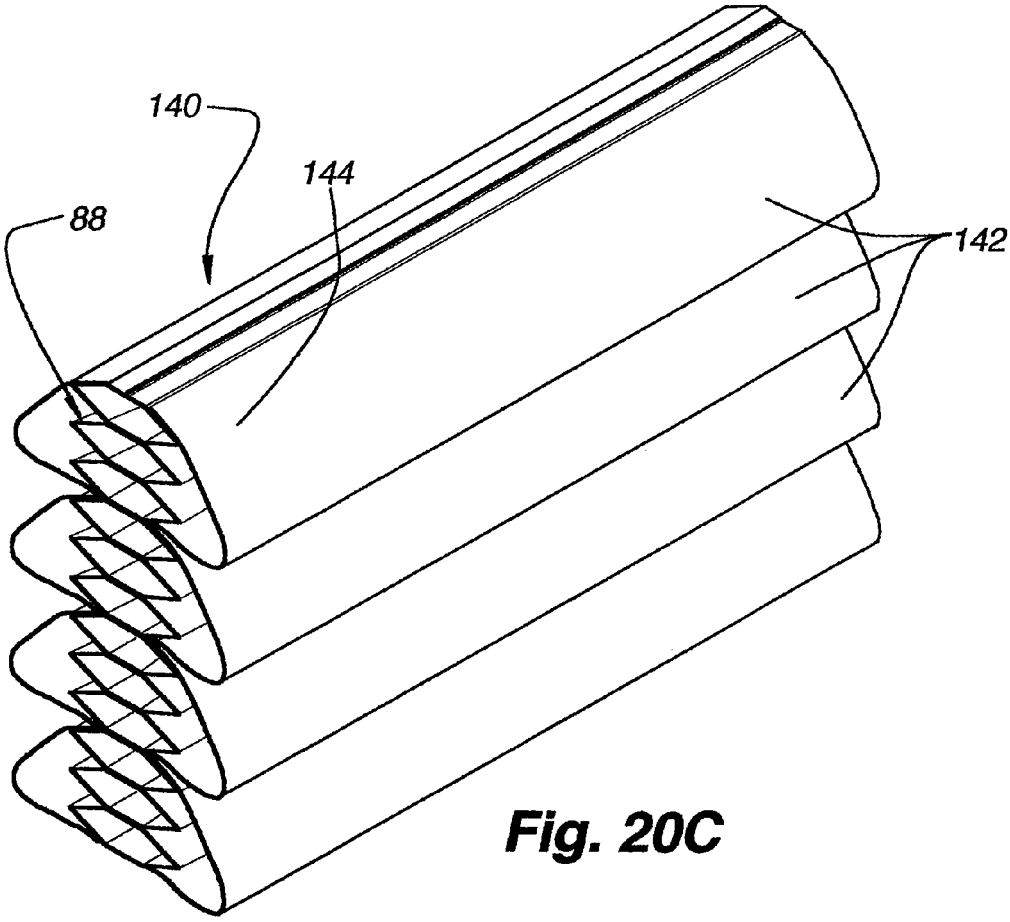
FIG. 20C is an isometric of the fabric of FIG. 20A in a partially retracted position.
Figure 20D:
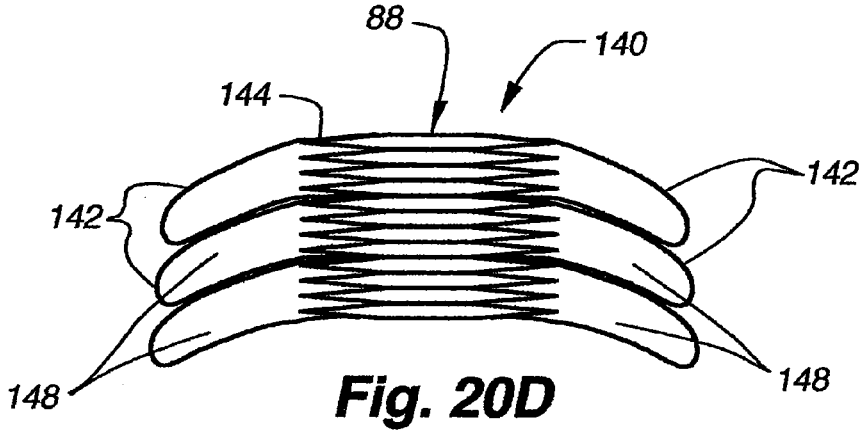
FIG. 20D is a side elevation of the fabric of FIG. 20A in a fully retracted position.
Figure 21A:
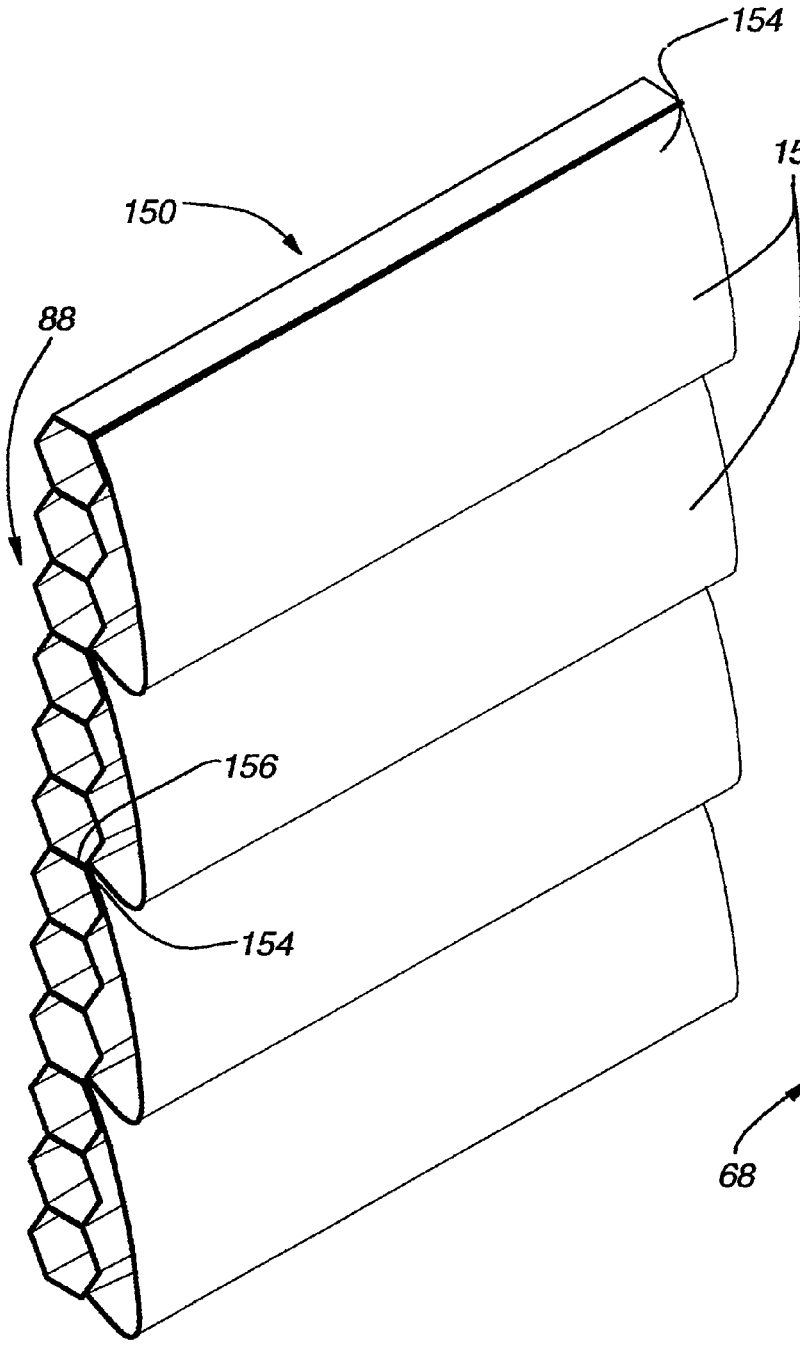
FIG. 21A is an isometric of a fourteenth embodiment of a fabric in accordance with the present invention in a fully extended position.
Figure 21B:
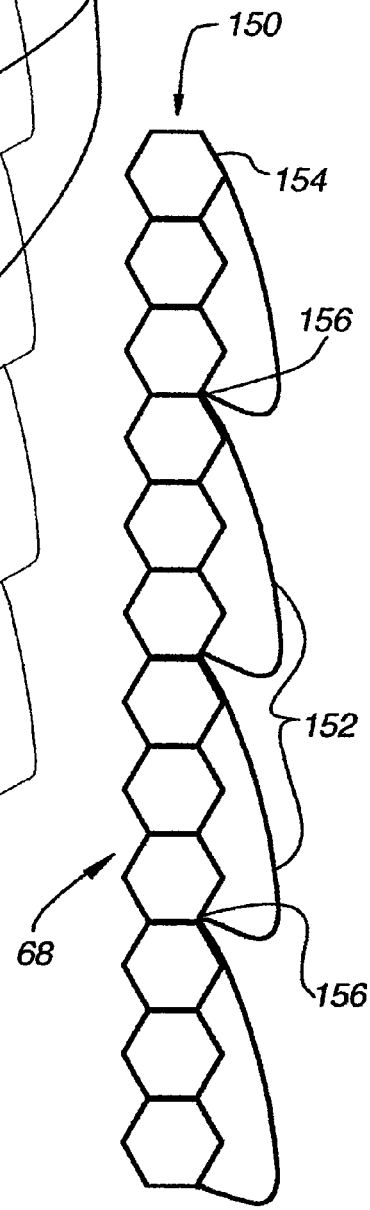
FIG. 21B is a side elevation of the fabric shown in FIG. 21A.
Figure 21C:
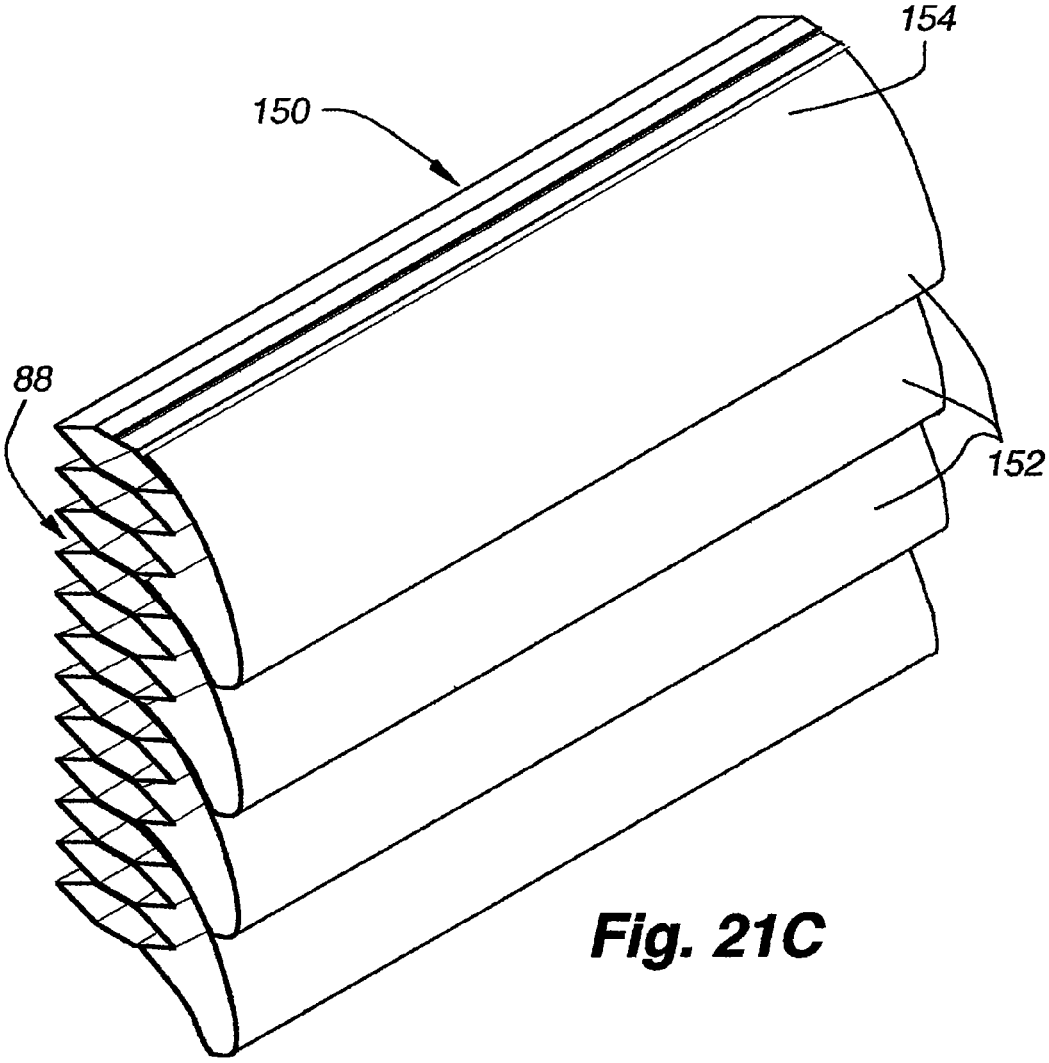
FIG. 21C is an isometric of the fabric shown in FIG. 21A in a partially retracted position.
Figure 21D:
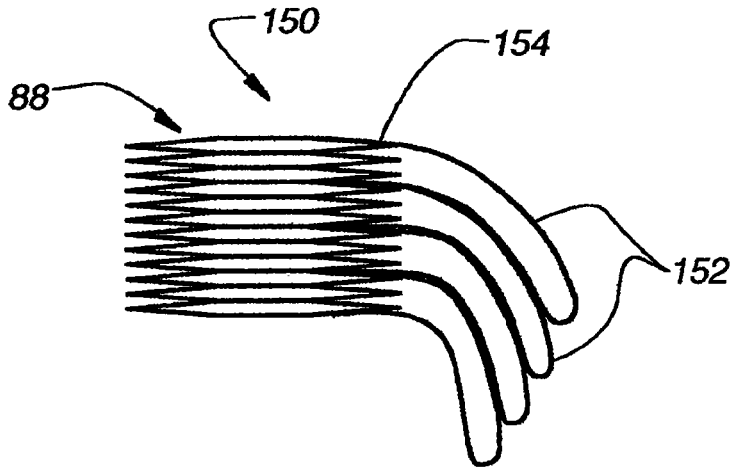
FIG. 21D is a side elevation of the fabric of FIG. 21A in a fully retracted position.

An eleventh embodiment 126 of the invention is shown in FIGS. 19A-19D where again the support structure 88 is in the form of superimposed closed hexagonal cells which are transversely collapsible. Semi-rigid slats 128 are suspended from spaced cells off the front and rear face of the cellular support structure with each slat being of the same size and cross section. Each slat 128 in cross-section, as best viewed in FIGS. 19A and 19B, includes upper 130 and lower 132 arcuate sections that are concave toward the cellular support structure and have a crease line 134 between arcuate sections. An upper marginal zone 136 of each slat is secured, as with adhesive, ultrasonic bonding or the like, to the upper side wall 98*a* segment of a hexagonal cell with a lower marginal zone 138 secured in a similar manner to the lower side wall segment 98*b* of a cell spaced downwardly four cells from the cell to which the upper marginal zone is secured. Accordingly, along the front face of the support structure, there are a plurality of slats made of a semi-rigid material which are secured to every fourth cell and a corresponding set of slats on the rear face of the support structure with the slats on the front and rear of the support structure being concave inwardly toward the support structure. The fabric comprised of the cellular support structure 88 and the double-curved slats 128 is shown in a fully extended position in FIGS. 19A and 19B, partially retracted in FIG. 19C, and fully retracted in FIG. 19D. As will be appreciated, as the cells are collapsed transversely the crease line 134 between the upper and lower arcuate sections of each slat allows the slat to bend or flex inwardly so that the crease line becomes confined between two cells of the support structure as they are partially and fully collapsed.

In a twelfth embodiment 140 of the invention illustrated in FIGS. 20A-20D, a cellular support structure 88 is again provided with the cells being closed and of hexagonal transverse cross-sectional configuration. The slats 142 in this embodiment are semi-rigid strips of material mounted on the front of the cellular support structure and the rear in confronting relationship. Each slat is identical having an upper marginal zone 144 secured in any suitable manner to the upper segment 98*a* of the side wall of an associated hexagonal cell and a lower marginal zone 146 secured between adjacent cells. In the disclosed embodiment, the strip of slat material is secured at the upper marginal zone to one cell and between the third and fourth cells therebeneath along the lower marginal zone. In this manner, each pair of slats associated with the same set of cells defines a closed cell 148 surrounding three cells of the cellular support structure even though as mentioned previously the closed cells are only closed in transverse cross-section and are open on their ends. When the fabric defined by the cellular support structure 88 and the confronting pairs of semi-rigid slats 142 are moved from the extended position of FIGS. 20A and 20B through the partially retracted position of FIG. 20C to the fully retracted position of FIG. 20D, it will be appreciated that the slats bulge outwardly in both directions from the cellular support material and while there is some slight droop in the slat material, due to their semi-rigid nature, they project away from the cellular support material substantially horizontally.

A thirteenth embodiment 150 of the present invention is illustrated in FIGS. 21A-21D where it will be appreciated the support structure 88 is again in the form of a plurality of superimposed interconnected transversely collapsible hexagonal cells. A plurality of slats 152 are suspended from a front face of the cellular support structure with an upper marginal zone 154 of each slat secured to an associated upper segment 98*a* of the front side wall of an associated cell and a lower marginal zone 156 of the same slat secured between a pair of cells which in the disclosed embodiment are between the third and fourth cells therebeneath that to which the upper marginal zone is attached. The slats are made of a flexible material so as to droop off the front face of the support structure. As will be appreciated from FIGS. 21A and 21B which show the fabric in a fully extended position, FIG. 21C where it is partially retracted, and FIG. 21D where it is fully retracted, the slats always droop from the front face of the support structure to provide a different aesthetic from that of the fabric of FIGS. 20A-20D.

A fourteenth embodiment 158 of a fabric in accordance with the present invention is illustrated in FIGS. 22A-22D. In this embodiment, the support structure 160 is a cellular support structure with interconnected cells 162 of quadrilateral transverse cross-section with each cell having a top wall 164, bottom wall 166, front wall 168, and rear wall 170. The top wall of one cell is secured to the bottom wall of the next adjacent upper cell, as with adhesive 172, so that the entire support structure is integrated with each cell being made from a flexible material. The vanes 174 associated with each cell in this embodiment are formed from the same strip of material as an associated cell in the support structure.

Figure 22B:
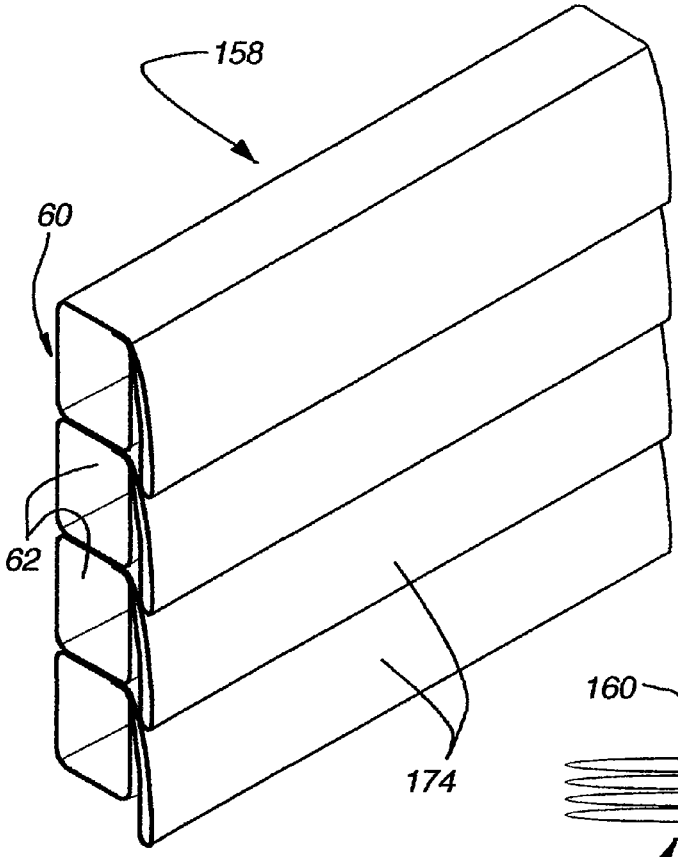
FIG. 22B is an isometric of the fabric as shown in FIG. 22A.
Figure 22A:
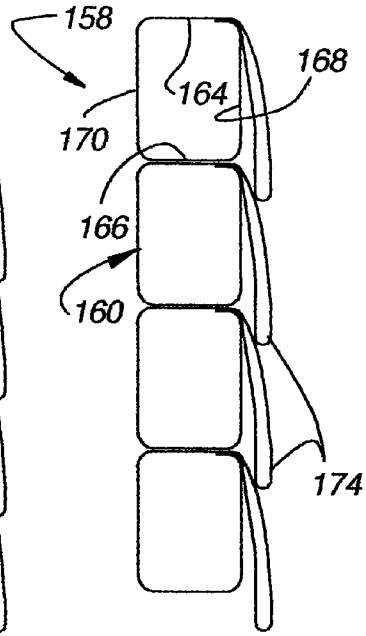
FIG. 22A is a side elevation of a fifteenth embodiment of a fabric in accordance with the present invention in a fully extended position.
Figure 22C:
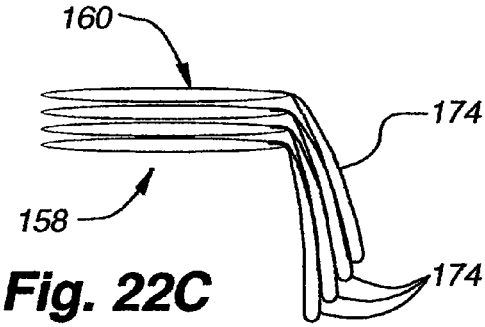
FIG. 22C is a side elevation of the fabric shown in FIG. 22A in a fully retracted position.
Figure 22D:
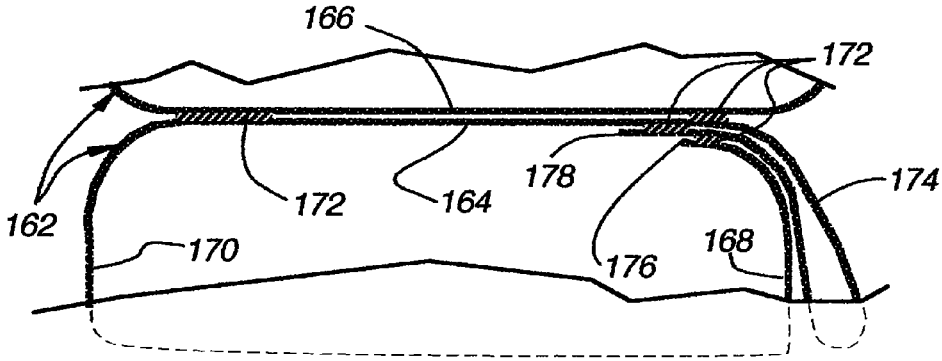
FIG. 22D is an enlarged fragmentary side elevation showing the formation of a cell in the support structure and a vane from a common strip of material.

As is probably best appreciated by reference to FIG. 22D, each cell/vane combination are formed by a strip of material that has a first edge 176 positioned in the top wall 164 of the cell adjacent to the front thereof and then drops downwardly to form the front wall 168 of the cell, then rearwardly to form the bottom wall 166 of the cell, then upwardly to form the rear wall 170 of the cell, and finally horizontally to form the remainder of the top wall of the cell before dropping downwardly in front of the front wall of the cell and then inwardly and upwardly to form a looped vane 174 with the opposite edge 178 of the strip of material from which the cell/vane combination is made being secured between the top wall 164 and the first edge 176 of the strip of material. Of course, since the cell/vane combinations are made of a flexible material, the vanes hang or droop downwardly across the front face of the associated cells so as to overhang to a small degree the next lower adjacent vane whereby in the fully expanded condition illustrated in FIGS. 22A and 22B, the cells in the support structure are shown as generally rectangular in transverse cross section with a closed-loop drooping vane hanging across the front of the associated cell from its top wall. When the fabric is moved to the fully retracted position of FIG. 22C, it will be seen that each cell in the support structure is fully collapsed transversely with the closed-loop vanes projecting from the front of the support structure.

Figure 23A:
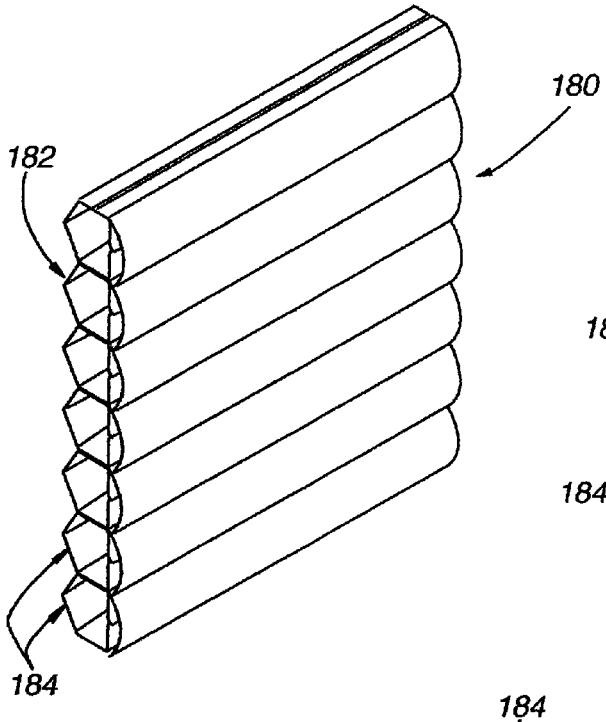
FIG. 23A is an isometric of a sixteenth embodiment of a fabric in accordance with the present invention shown in a fully extended position.
Figure 23B:
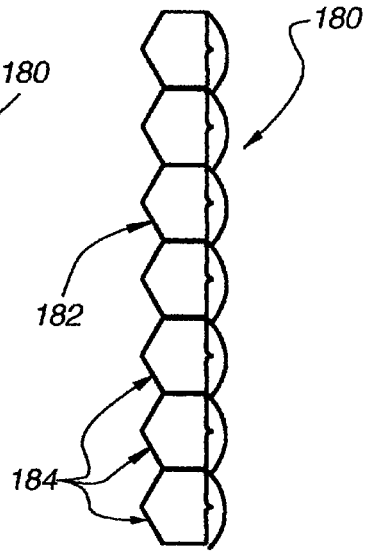
FIG. 23B is a side elevation of the fabric as shown in FIG. 23A.
Figure 23C:
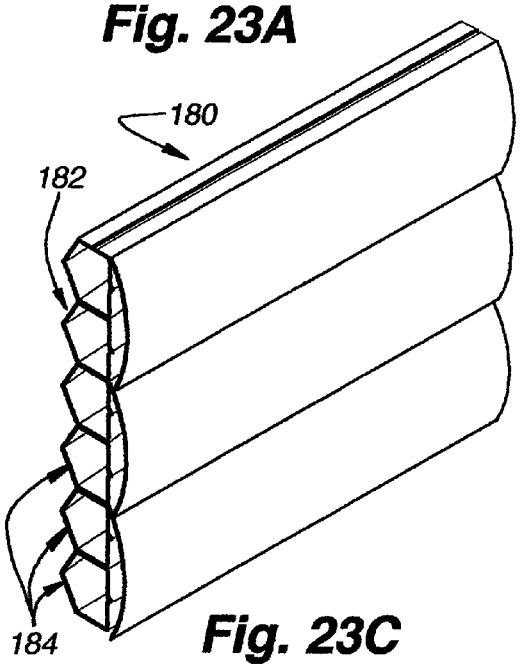
FIG. 23C is an isometric of a variation of the fabric shown in FIG. 23A in a fully extended position.
Figure 23D:
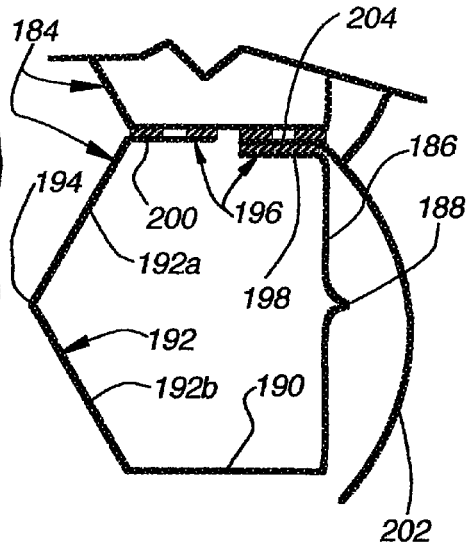
FIG. 23D is an enlarged fragmentary side elevation of the lowermost cell and slat of the fabric of FIG. 23A.

A fifteenth embodiment 180 of a fabric in accordance with the present invention is illustrated in FIGS. 23A-23D. In this embodiment, the support structure 182 is again a cellular support structure with each cell 184, as best seen in FIG. 23D, being formed from a single strip of material. The material is folded and creased so as to define a substantially flat front wall 186 with a forwardly projecting crease 188 therein, a flat bottom wall 190, a pleated rear wall 192 composed of upper 192*a* and lower 192*b* segments above and below a fold line 194 and a flat top wall 196 formed by tabs 198 and 200 extending inwardly from the front wall and the rear wall respectively. The vanes 202 are suspended from the front of the cellular support structure with each vane being made of a semi-rigid material having an arcuate transverse cross-section and a flat tab 204 that is inserted between the top wall 196 of an associated cell and the bottom wall 190 of the next adjacent upper cell. The tab 204 of course is adhesively or otherwise secured to the top wall tab 198 of its associated cell and the bottom wall of the next adjacent upper cell. Each slat is adapted to slightly overlap the next adjacent lower slat so as to conceal the juncture between adjacent cells.

Figure 24A:
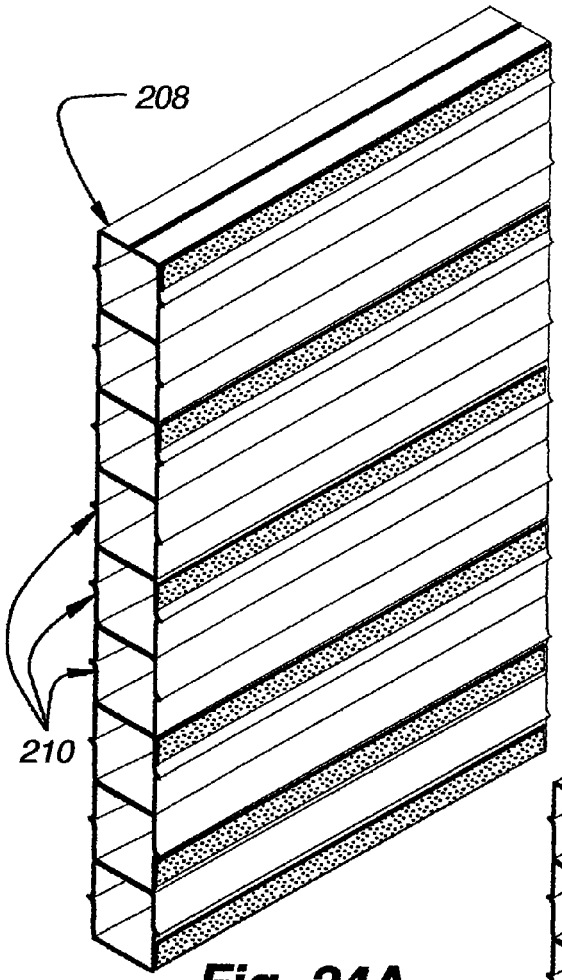
FIG. 24A is an isometric of a cellular support structure used in a seventeenth embodiment of a fabric in accordance with the present invention.
Figure 24B:
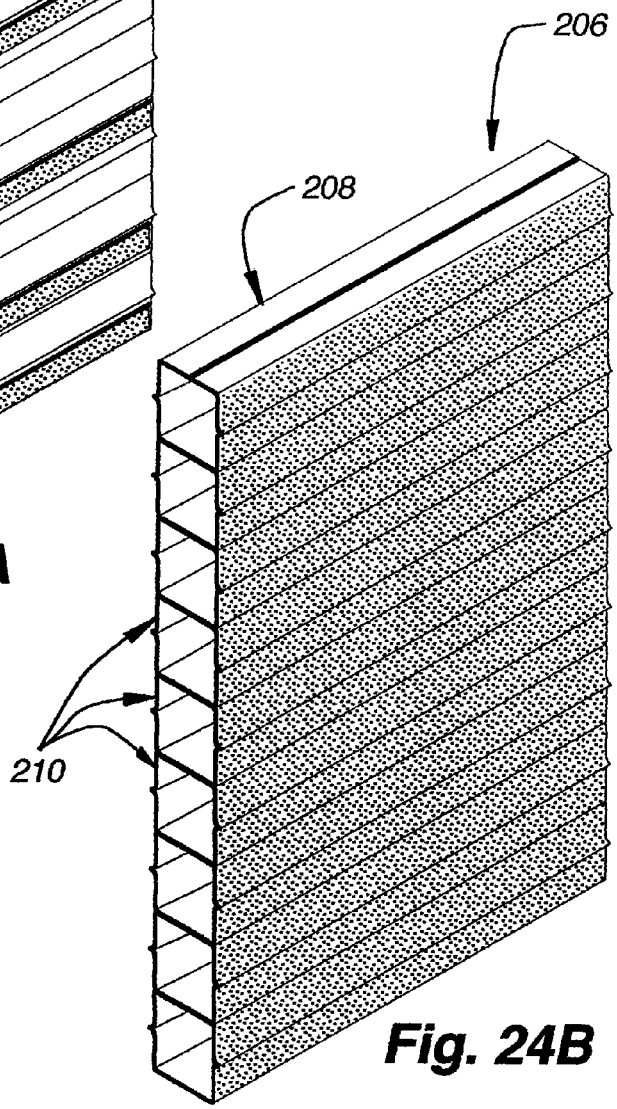
FIG. 24B is an isometric of a variation of the support structure of FIG. 24A.
Figure 24C:
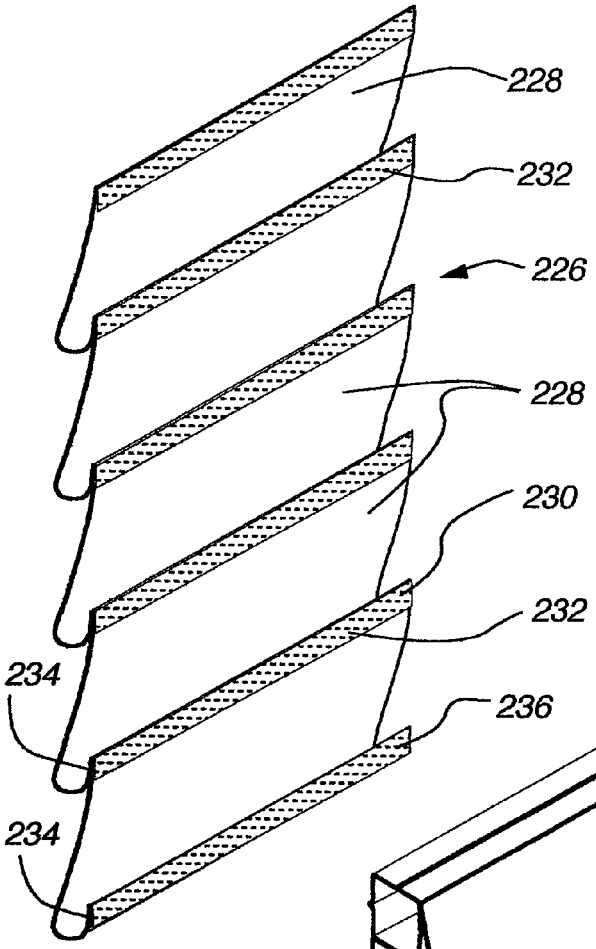
FIG. 24C is an isometric of an interconnected vane panel for use with the support structure of FIG. 24A or 24B.
Figure 24D:
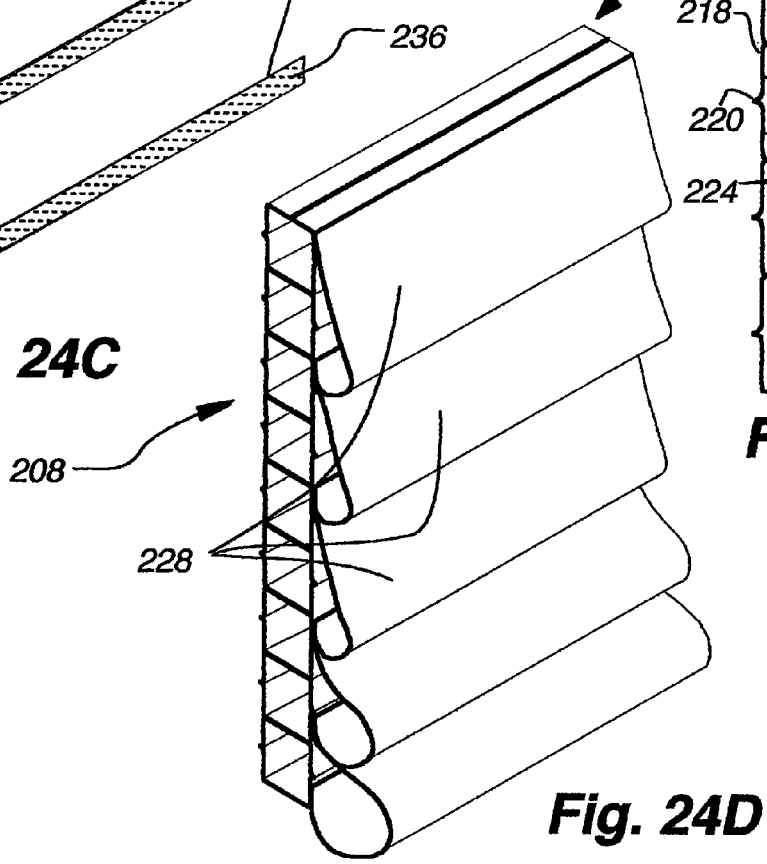
FIG. 24D is an isometric showing the panel of FIG. 24C mounted on the cellular support structure of FIG. 24E.
Figure 24E:
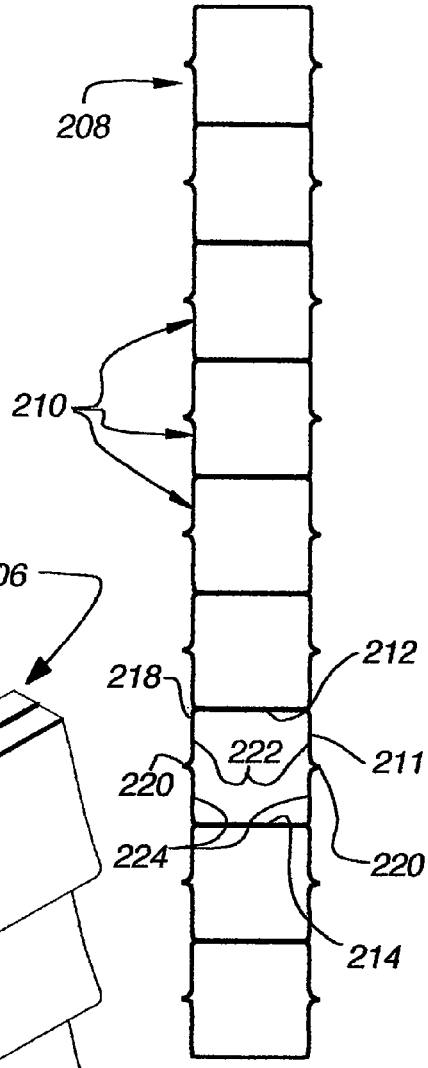
FIG. 24E is a side elevation of the support structure of FIG. 24A.

A sixteenth embodiment 206 of the present invention is illustrated in FIGS. 24A-24E. In this embodiment, the support structure 208 as illustrated in FIG. 24E is a plurality of superimposed cells 210 of quadrangular cross-section which are transversely collapsible but when suspended as shown in FIG. 24E assume a quadrangular, transverse cross-section which in the illustrated embodiment is square. Each cell in the support structure has a top wall 212, an identical bottom wall 214, a front wall 216, and a rear wall 218 that is the mirror image of the front wall. The front and rear walls have a crease line therein forming an outwardly protruding rib 220 that extends horizontally along the length of the cell so as to define upper 222 and lower 224 segments of each cell for the front and rear walls thereof. FIG. 24C shows a panel 226 of flexible vanes 228 which are interconnected such that the entire panel can be secured to the support structure 208 in one of numerous ways. In the illustrated arrangement, an upper marginal zone 230 of each vane has half 232 of a hook-and-loop type fastener such as Velcro® secured to a front face thereof while the reverse side of a lower marginal zone 234 on the same strip has the same half 232 of a hook-and-loop material. The reverse face of the top marginal zone 230 has a strip of the opposite half 236 of a hook-and-loop material so that the lower marginal zone of one strip of vane material can be secured to the front face of the next lower strip of vane material to form the panel 226 of interconnected strips. This panel of interconnected strips of vane material can be secured to the support structure such that the interconnected vanes are suspended from one face of the support structure even though it will be appreciated that similar panels could be suspended from both the front and rear faces of the support structure.

In FIG. 24A, the support structure 208 is shown with a strip of the opposite 236 half of hook-and-loop material secured to the upper segment 222 of the front wall 216 of every other cell of the support structure (except for the two lowermost cells) so that the panel of interconnected vanes can be releasably connected thereto by securing the upper marginal zone 230 of each vane strip to an associated one of the attachment materials 236 on the support structure so that the vanes 228 droop or hang downwardly as viewed in FIG. 24D. It will also be appreciated that in the support structure illustrated in FIG. 24A, the lower two cells in the support structure each have the fastener material secured thereon so that when the panel of vanes is secured thereto, the protruding loop of vane material protrudes further away from the support structure to illustrate variations in use of this embodiment.

FIG. 24B illustrates the support structure 208 wherein the first-mentioned half 232 of the hook-and-loop material covers one entire face of the support structure so that the vane panel 226 can be secured in any desired way to the front face of the support structure so the vane loops are drooped in any desirable pattern. Obviously the hook-and-loop material could also be placed on the rear face of the support structure if it was desired to hang vane panels on both sides of the support structure. In addition, hook-and-loop type fastener materials would not necessarily have to be used as adhesives having the desirable release properties could be used or a permanent adhesive or ultrasonic bonding could be used to secure the vane panel to the support structure if the removable feature was not needed or desired.

Figure 25A:
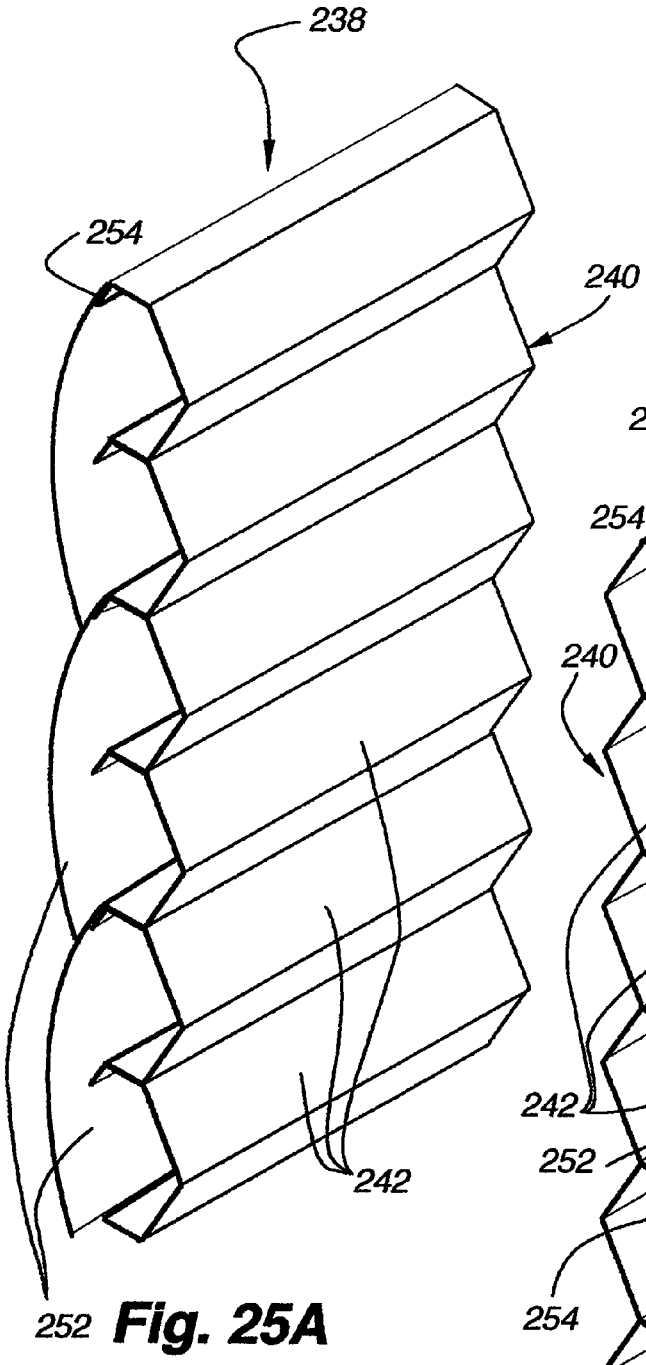
FIG. 25A is an isometric of an eighteenth embodiment of a fabric in accordance with the present invention looking at the rear side of the fabric with the fabric fully extended.
Figure 25C:
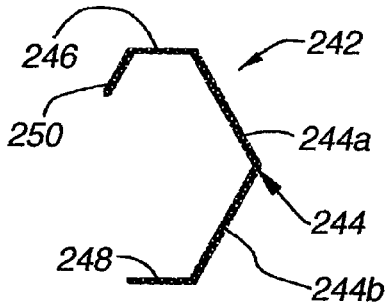
FIG. 25C is an end elevation of an open cell used in the support structure of the fabric of FIG. 25A.
Figure 25B:
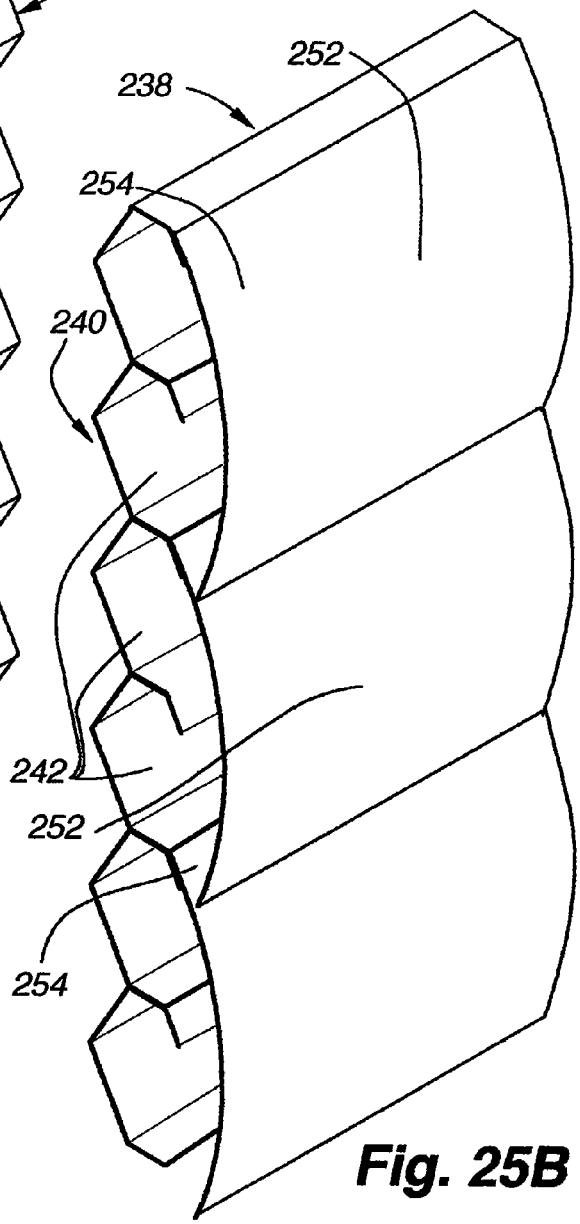
FIG. 25B is an enlarged isometric looking at the front side of the fabric of FIG. 25A.

A seventeenth embodiment 238 of a fabric in accordance with the present invention is illustrated in FIGS. 25A-25C wherein the support structure 240 is in the form of a plurality of superimposed interconnected open cells 242 having a pleated rear wall 244 defining upper 244*a* and lower 244*b* segments, top 246 and bottom 248 walls, and a flap 250 forming the front wall which hangs downwardly at an obtuse angle from the top wall. The slats 252 utilized in this embodiment are arcuate in transverse cross section and semi-rigid with an upper marginal zone of 254 each slat being secured to the flap 250 on selected cells such that a lower edge of the slat overlaps the next adjacent lower slat. In this disclosed embodiment, the slats are designed to be connected to every other cell even though it will be appreciated that other arrangements could be made consistent with the teachings in the present application.

Figure 26A:
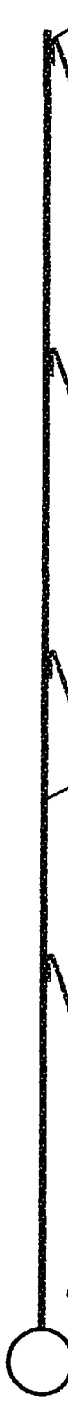
FIG. 26A is a side elevation of a nineteenth embodiment of a fabric in accordance with the present invention shown in a fully extended position.
Figure 26B:
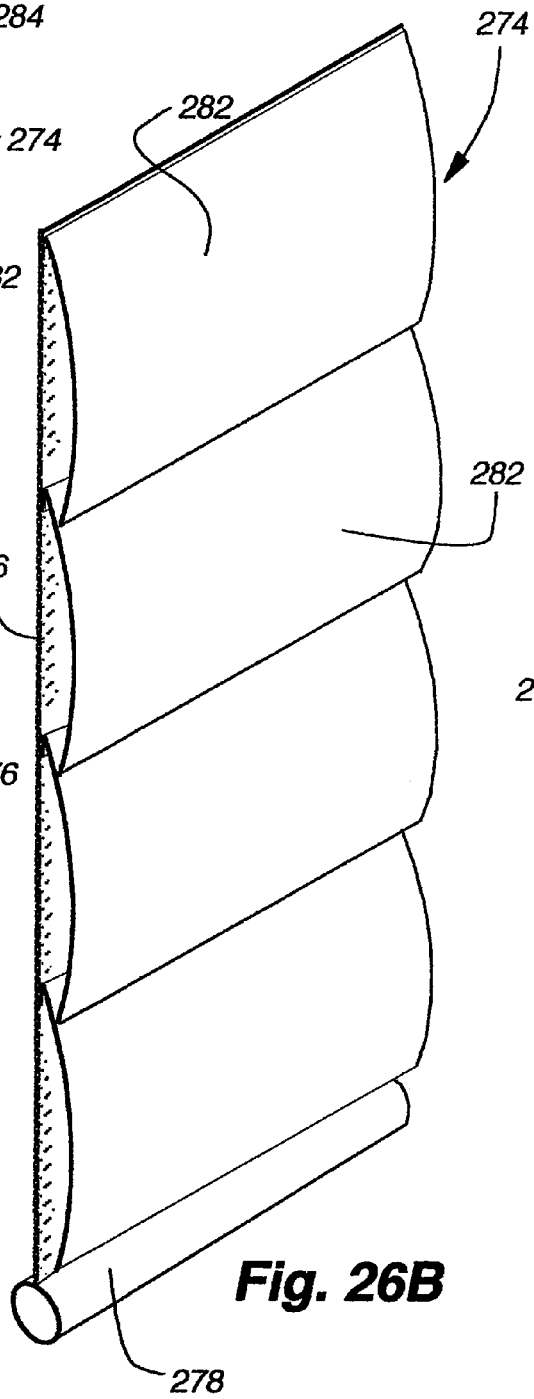
FIG. 26B is an isometric of the fabric as shown in FIG. 26A.
Figure 26C:
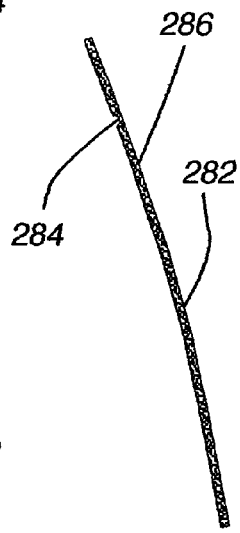
FIG. 26C is a side elevation of a strip of material from which a slat used in the fabric of FIG. 26A is formed.
Figure 26D:
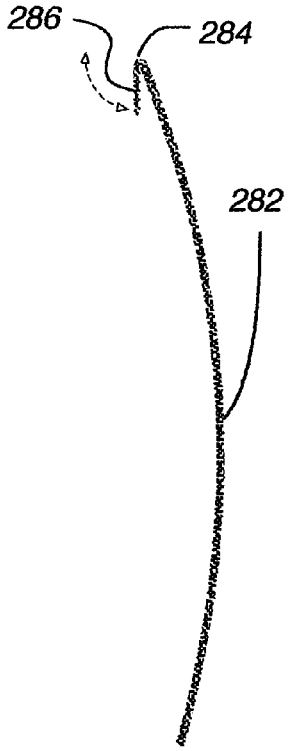
FIG. 26D is an enlarged side elevation similar to FIG. 26C with the slat having been fully formed.

An eighteenth embodiment 274 of the fabric of the present invention and its various arrangements is illustrated in FIGS. 26A-26H and 26J-26L. In this embodiment, the support structure is in the form of a sheet of material 276 such as sheer fabric or the like. The support sheet could have a weighted bottom rail of various configurations but by way of example, in FIG. 26A, the bottom rail 278 is cylindrical in configuration or in FIG. 26J the bottom rail 280 is of arcuate transverse cross-section. With reference specifically to FIGS. 26A-26D, the slats or vanes 282 in the fabric are slightly arcuate in transverse cross-section and made of a semi-rigid material with a crease 284 spaced a short distance from the upper edge of the vane so the vane can be folded to define a flap 286 as illustrated in FIG. 26D. Each vane can then be secured in any suitable manner such as with adhesive, ultrasonic welding or the like, to the support sheet 276 at vertically spaced locations with the vanes extending horizontally across the sheet. Each vane has a height such that it slightly overlaps the next adjacent lower vane with the fabric being shown in a fully extended condition in FIGS. 26A and 26B.

Figures 26E, 26F, 26G, 26H:
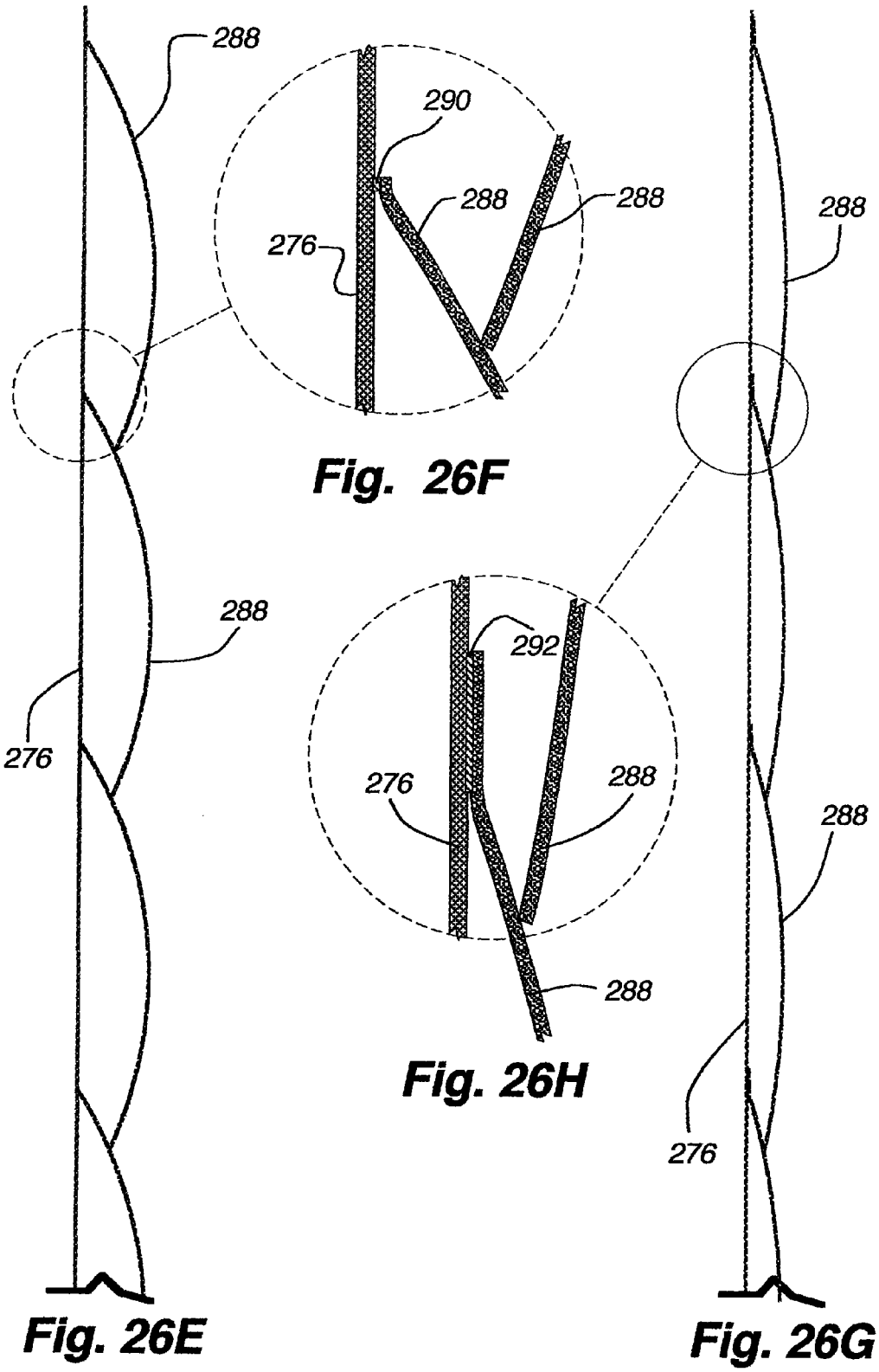
FIG. 26E is a side elevation of a different arrangement of the embodiment of FIG. 22A wherein the slats used in the arrangement do not have downturned flaps.
FIG. 26F is an enlarged elevation showing the encircled area of FIG. 26E.
FIG. 26G is a side elevation of a still further arrangement similar to FIG. 26E wherein the slats are mounted to assume a flatter arcuate configuration.
FIG. 26H is an enlarged elevation showing the encircled area of FIG. 26G.

FIGS. 26E and 26F illustrate an alternate arrangement but again where the support structure is a sheet of material 276 such as sheer fabric but the slats or vanes 288 rather than having a folded tab along the upper edge, are simply secured to the fabric sheet with adhesive 290 or the like along a thin line of connection so the slats bow outwardly away from the support sheet as best seen in FIG. 26E.

FIGS. 26G and 26H illustrate a system by which the slats 288 as used in FIG. 26E can be made to appear flatter in arcuate cross-section and this is accomplished by enlarging the line of adhesion 292 between the upper edge of a slat and the support sheet 276 as shown best in FIG. 26H. Flattening an arch in the slats is accomplished partly because of the semi-rigid nature of the slats but also through the width of the line of adhesion 292. As will be appreciated, the bow or curvature in the slats can be varied depending upon the width of the connection of the upper edge of the slat to the support sheet.

Figure 26J:
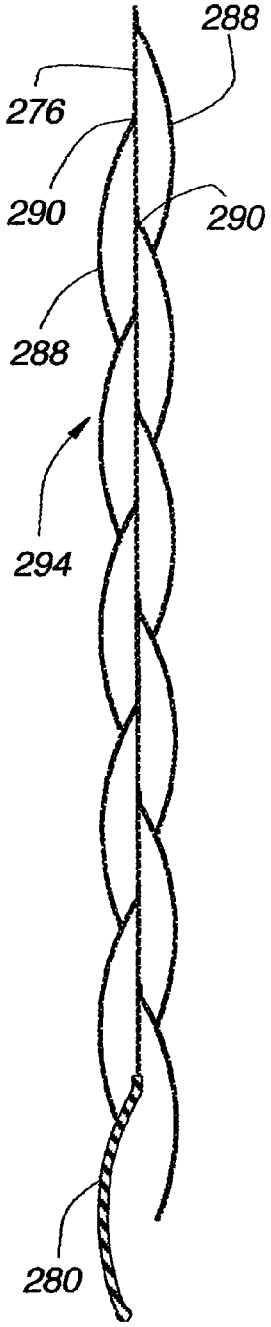
FIG. 26J is a side elevation of a still further arrangement of the fabric that is similar to that of FIG. 26G wherein there are slats on opposite sides of the support structure and an arcuate slat appearing weighted bottom rail.
Figure 26K:
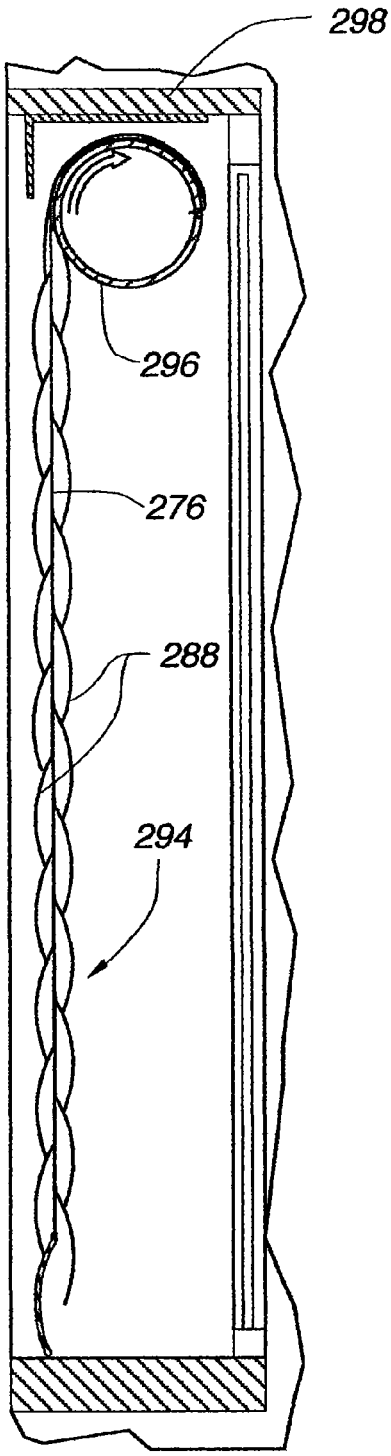
FIG. 26K is a side elevation of a covering incorporating the fabric of FIG. 26J with the covering in a fully extended position.
Figure 26L:
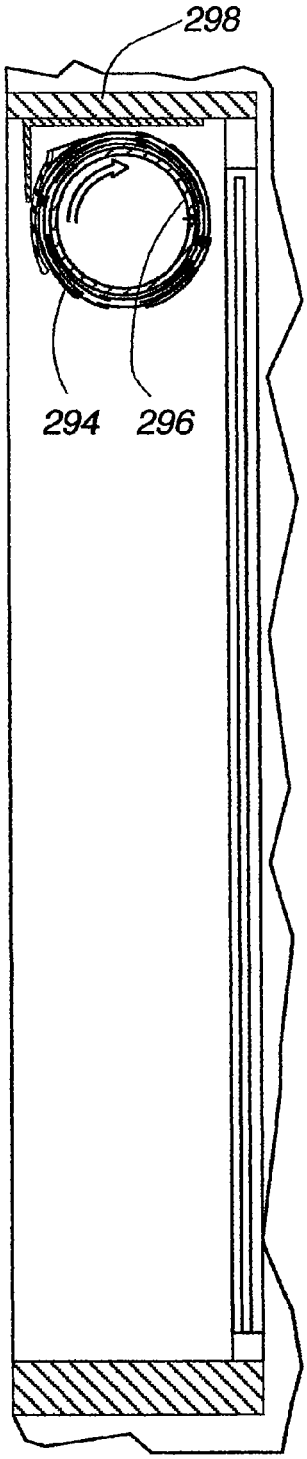
FIG. 26L is a side elevation similar to FIG. 26K with the covering in a fully retracted position.

Another arrangement 294 or variation off the embodiment of FIG. 26A, 26E, or 26G is shown in FIG. 26J where slats 288 are connected to both the front and rear face of the support sheet of material 276 as in FIG. 26E with the adhesive attachment lines 290 of the slats on the front of the sheet being offset from the attachment lines off the rear of the sheet but with the vanes again overlapping the next adjacent lower vane. As will be appreciated, the bottom rail 280, as mentioned previously, is of arcuate transverse cross-section similar to that of the slats 288 to provide aesthetic continuity.

The fabric 294 illustrated in FIG. 26J can be rolled onto a roller 296 provided in a headrail 298 with the roller being of any conventional type used in roller shades. As will be appreciated in FIG. 26K, the fabric is fully extended and depends from the roller while in FIG. 26L the fabric is completely retracted and wrapped around the roller. The semi-rigid nature of the slats 288 on the flexible sheet of support material 276 allows the fabric structure to be wrapped on the roller and once unwrapped the slats will again expand to their original configuration due to the resiliency of the semi-rigid material from which the slats are made.

A nineteenth embodiment 300 and its variations of a fabric in accordance with the present invention is shown in FIGS. 27A, 27B, 27K-27N, 27P and 27S-27U. In this embodiment, the support structure is again a sheet of flexible fabric material 276 which may have a weighted bottom rail 278. The vanes or slats 282 for the fabric consist of semi-rigid strips of material of arcuate transverse cross-section having folded tabs 286 along their upper edge identical to those illustrated in the embodiment of FIG. 26A. The vanes are secured to the front and back face of the support sheet in any suitable manner at vertically spaced locations along horizontal lines of connection with the vanes on each face slightly overlapping the next adjacent lower vane. The vanes on the front face and rear face of the support sheet are mounted in offset relationship with each other and wherein the lowermost vane on the front of the sheet of fabric material hangs over the bottom rail 278 for aesthetic reasons.

Figure 27A:
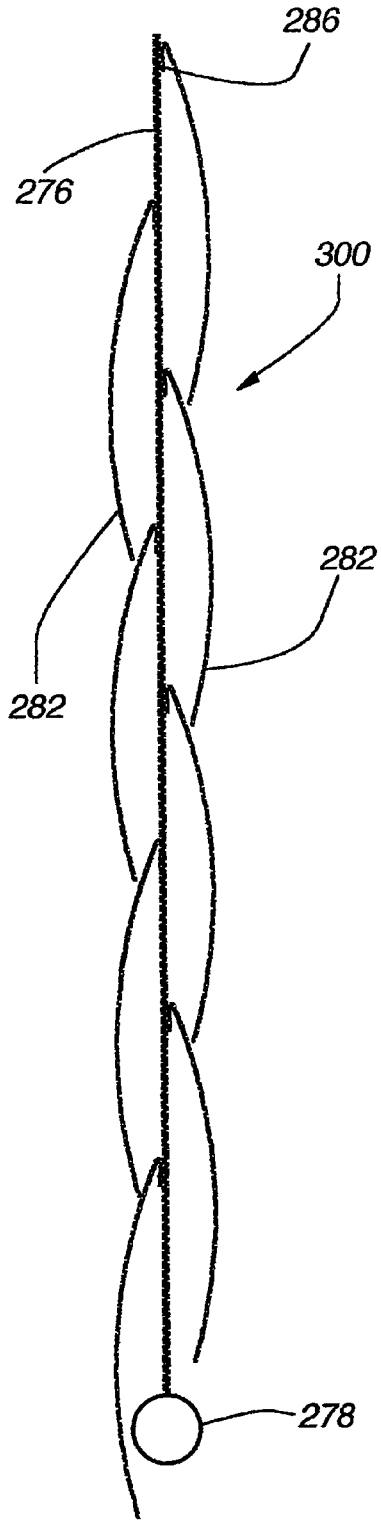
FIG. 27A is a side elevation of a twentieth embodiment of a fabric in accordance with the present invention.
Figure 27B:
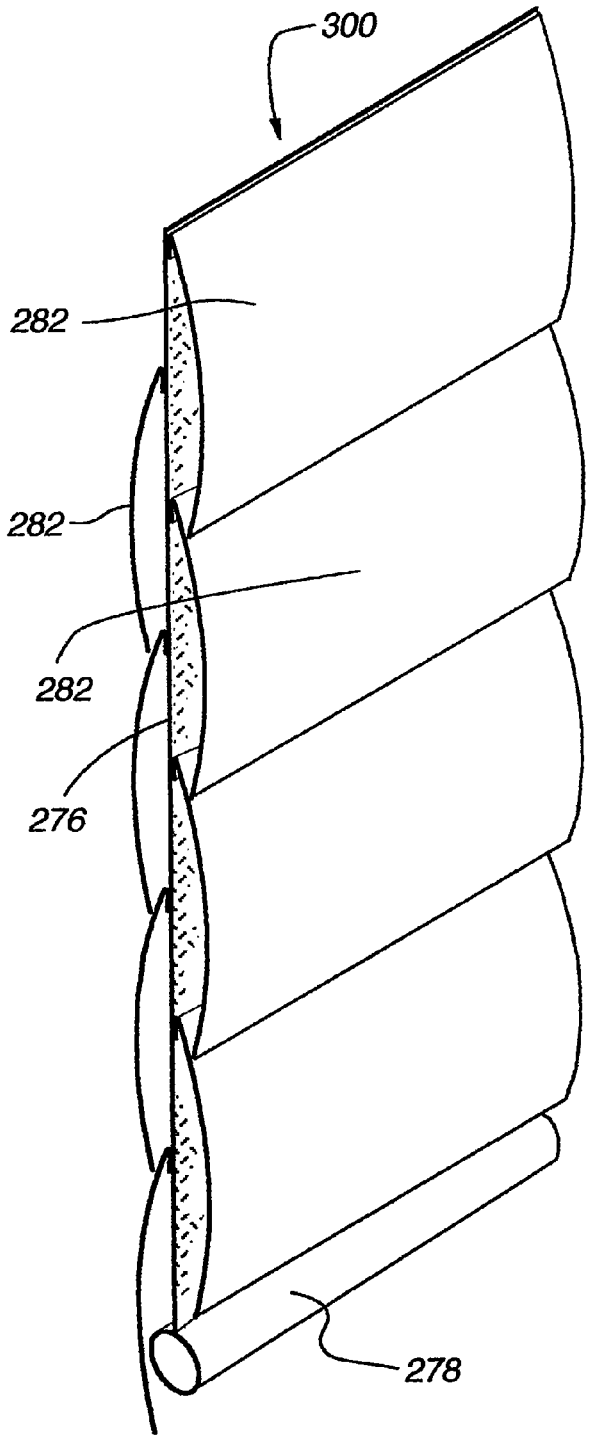
FIG. 27B is an isometric of the fabric as shown in FIG. 27A.
Figure 27K:
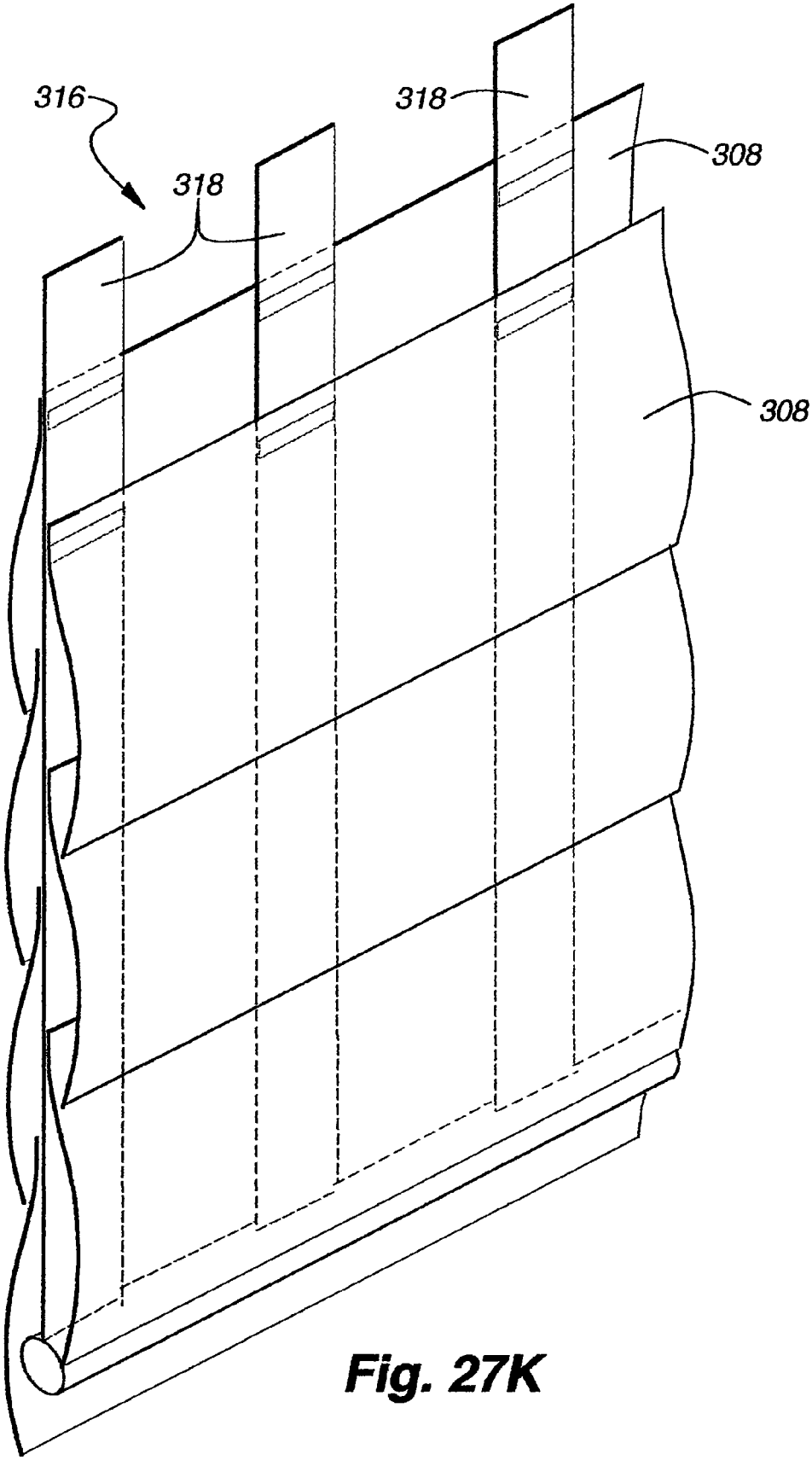
FIG. 27K is an isometric of another embodiment of a fabric in accordance with the present invention which is similar to the arrangement of FIG. 27A except the support structure is in the form of a plurality of tapes or ribbons.

FIG. 27K shows another arrangement 316 of the fabric of the present invention wherein the support structure is a plurality of horizontally spaced vertically extending ribbons or tapes 318 of flexible material which again could be sheer fabric or other suitable material such as woven or nonwoven materials. The vanes or slats 308 are semi-rigid and secured to the support tapes identically to that of FIG. 27G and are of arcuate transverse cross-section.

Figure 27L:
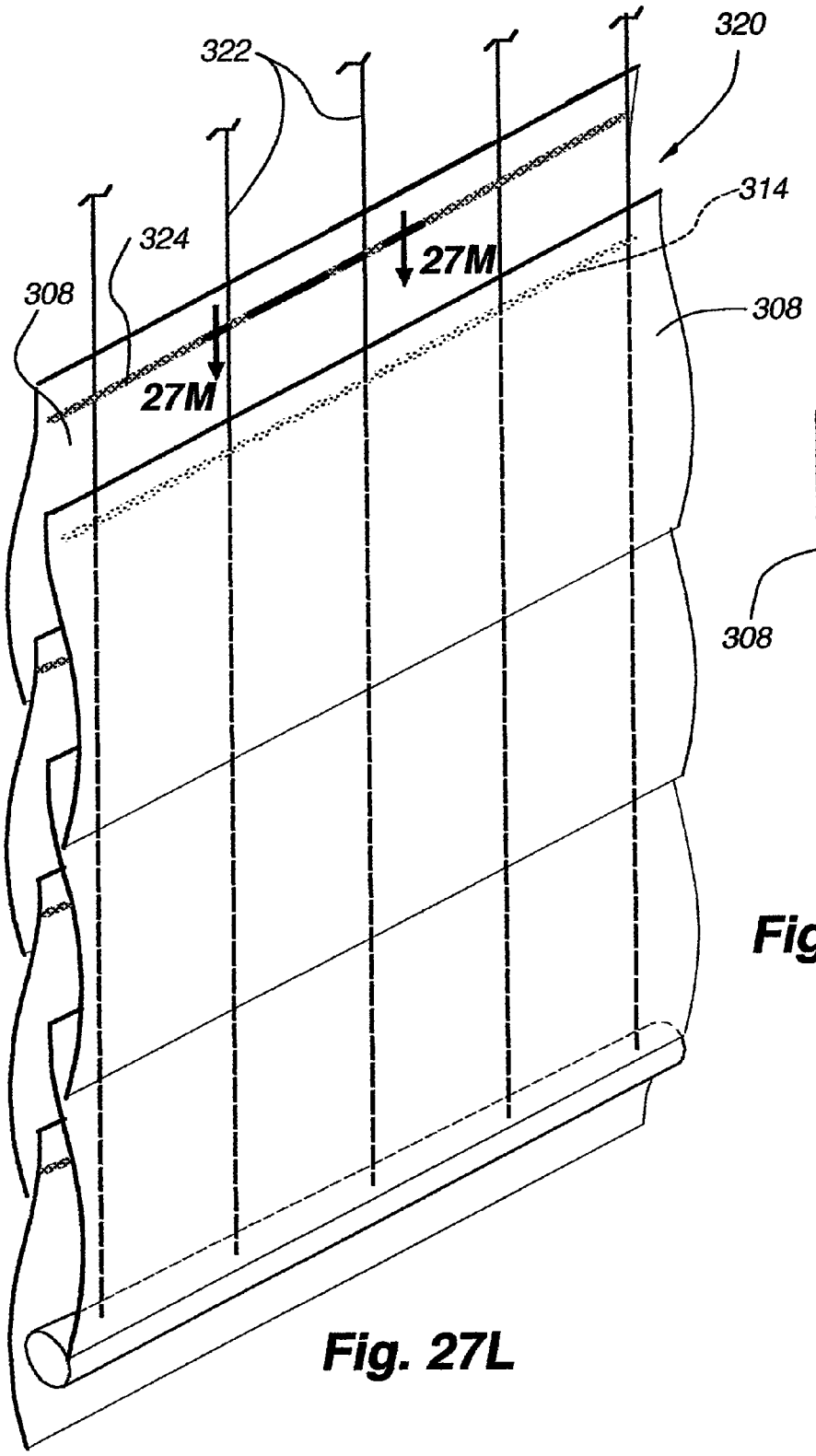
Figure 27M:
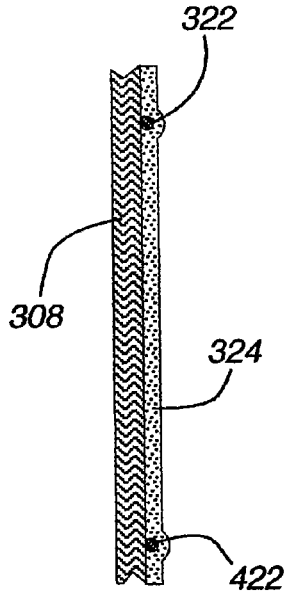
FIG. 27M is an enlarged fragmentary section taken along line 27M-27M of FIG. 27L.
Figure 27N:
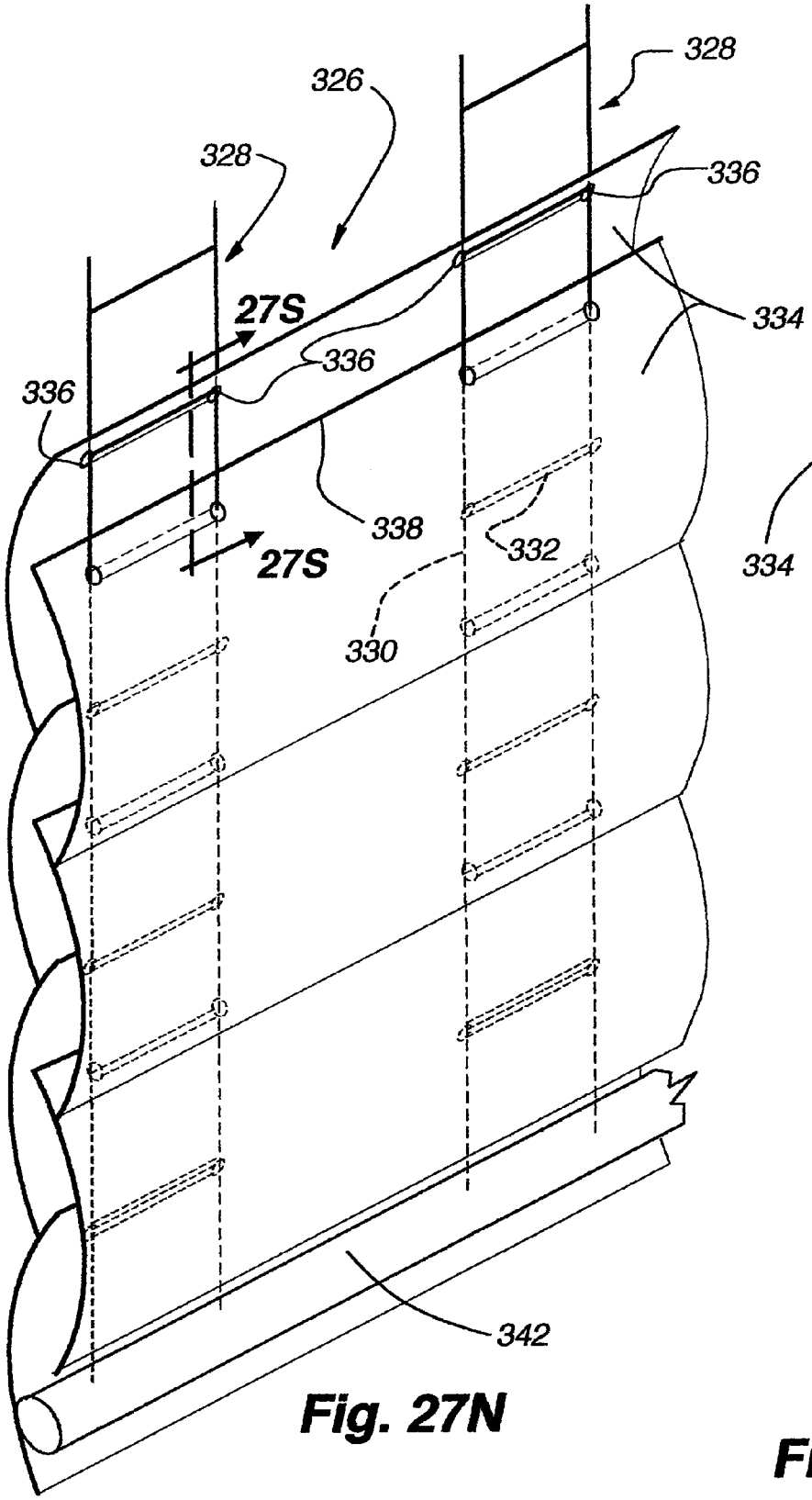
FIG. 27N is an isometric of another arrangement of a fabric in accordance with the present invention.
Figure 27P:
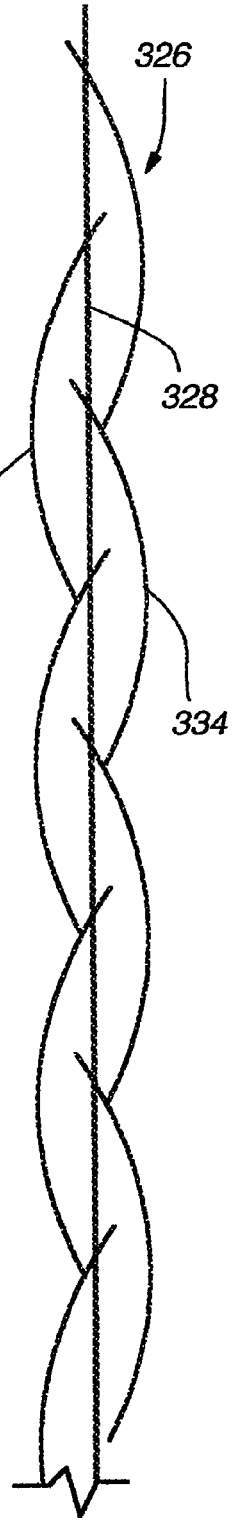
FIG. 27P is a side elevation of the fabric of FIG. 27N.
Figure 27S:
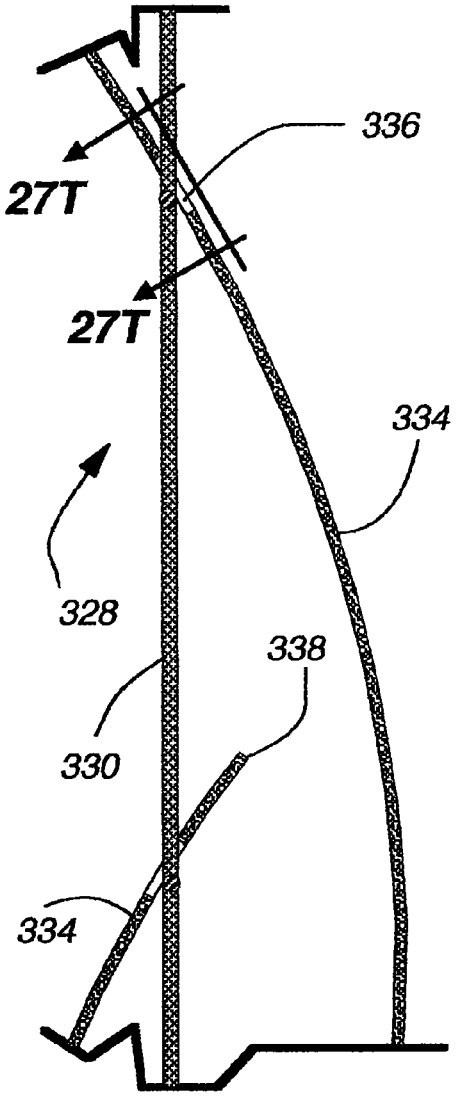
FIG. 27S is an enlarged fragmentary section taken along line 27S-27S of FIG. 27N.
Figure 27T:
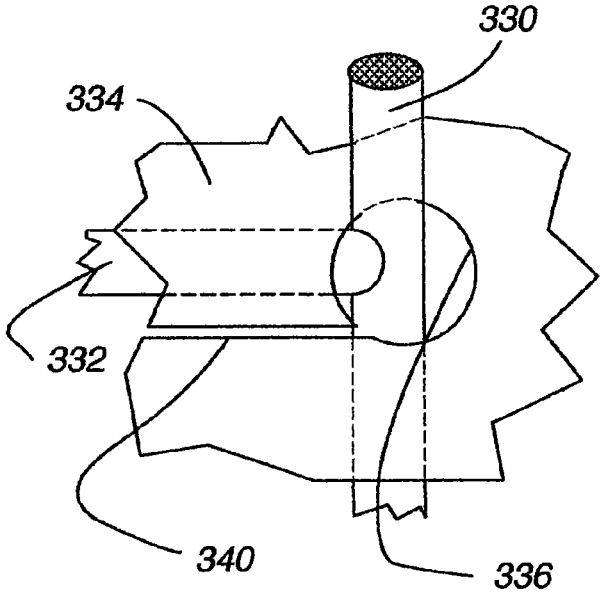
FIG. 27T is a section taken along line 27T-27T of FIG. 27S.

Still another arrangement 320 of the fabric of the invention is shown in FIGS. 27L and 27M with this arrangement being similar to that of FIG. 27K except the ribbons or tapes of flexible material have been replaced with monofilaments 322 or other suitable cords which may be of natural of synthetic fibers. The support elements extend vertically and are horizontally spaced with the slats 308 having a line of adhesive 324 adjacent their upper edges so as to be secured to the support elements at vertically spaced locations which alternate between the slats on the front and rear of the support elements.

Figure 27U:
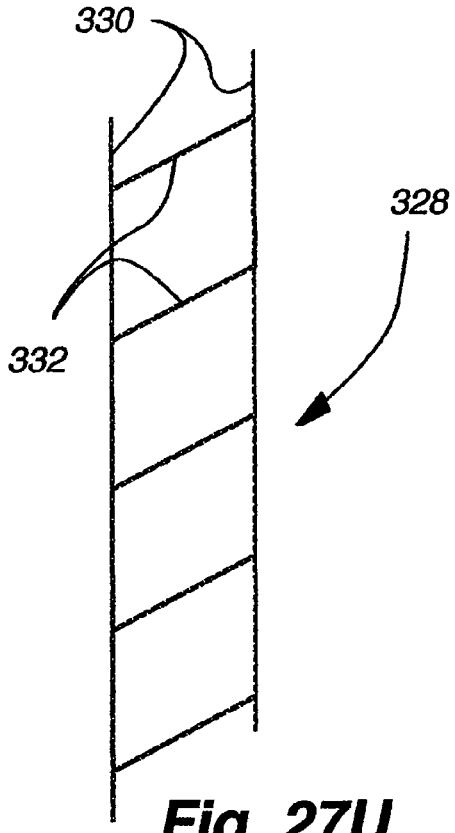
FIG. 27U is an isometric of a cord ladder used in the fabric of FIG. 27N.

A further arrangement 326 of the present invention is shown in FIGS. 27N-27U and in this arrangement the support structure is in the form of conventional cord ladders 328 used in venetian blinds with an illustration of such a cord ladder seen in FIG. 27U to include a pair of parallel vertical riser cords 330 and a plurality of vertically spaced horizontally extending rungs 332 interconnecting the riser cords. The slats 334 are rigid or semi-rigid and arcuate in transverse cross-section having a pair of holes 336 adjacent to the upper edge 338 of the slats at spaced locations along the horizontal length of the slat aligned with the cord ladders. As is best appreciated by reference to FIG. 27T, the upper edge 338 of each slat has slots 340 interconnecting the upper edge with each of the holes 336 to facilitate mounting of the slats on the cord ladders at each location of a rung in the cord ladder. In other words, the riser cords 330 are inserted through the slots 340 so as to be slidably received in the holes 336 but the slat extending between the holes 336 will be supported on the associated rung 332 to hold the slat in a desired position. In the arrangement illustrated, there are slats extending off the front and rear side of the cord ladders with the slats on the front side alternating with those on the rear side from rung to rung. A weighted bottom rail 342 can be secured to the bottoms of the cord ladders to keep the support structure vertically extended.

Figure 28A:
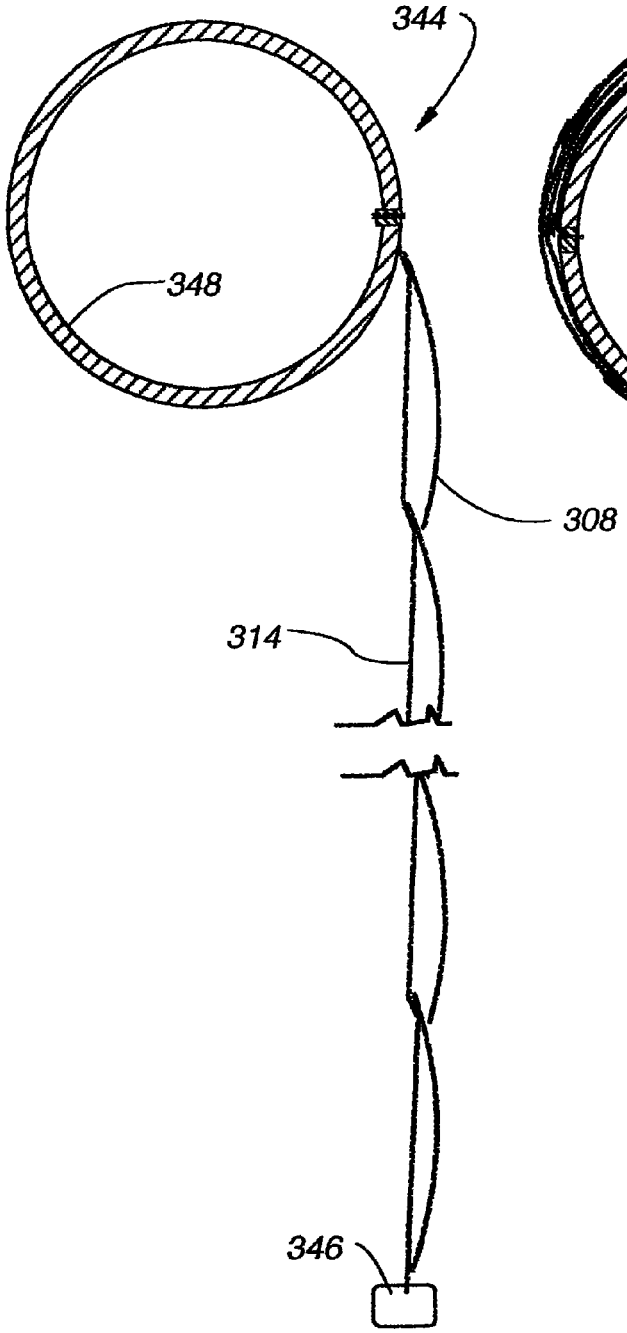
FIG. 28A is a side elevation of a twenty-first embodiment of a fabric in accordance with the present invention connected to a roller and with the fabric fully extended.
Figure 28B:
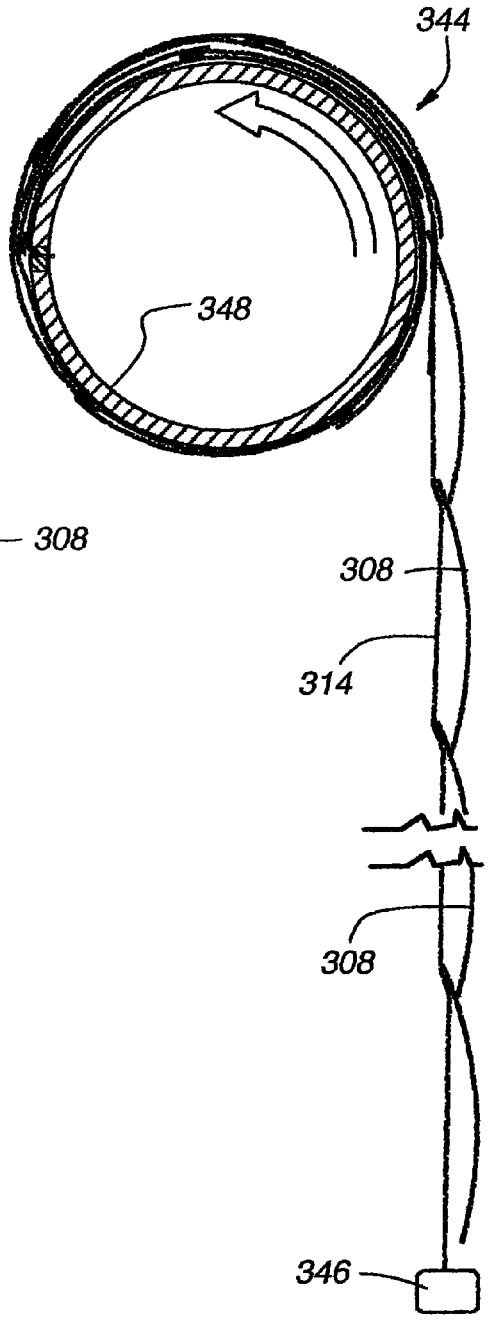
FIG. 28B is a side elevation similar to FIG. 28A with the fabric partially retracted onto the roller.

A twentieth embodiment 344 of the invention is illustrated in FIGS. 28A and 28B which is very similar to the arrangement of FIG. 27G except slats 308 are only mounted on one side of a flexible support sheet 314 which carries a weighted bottom rail 346. The slats are mounted on the sheet at vertically spaced horizontally extending locations with each slat slightly overlapping the next adjacent lower slat. The covering is shown mounted on a roller 348 as is conventionally found in roller shades in the fully extended position in FIG. 28A and partially wrapped around the roller in FIG. 28B. The resilient semi-rigid nature of the slats allows them to be rolled around the roller but they will resume their arcuate transverse cross-sectional configuration when unrolled from the roller.

Figure 29A:
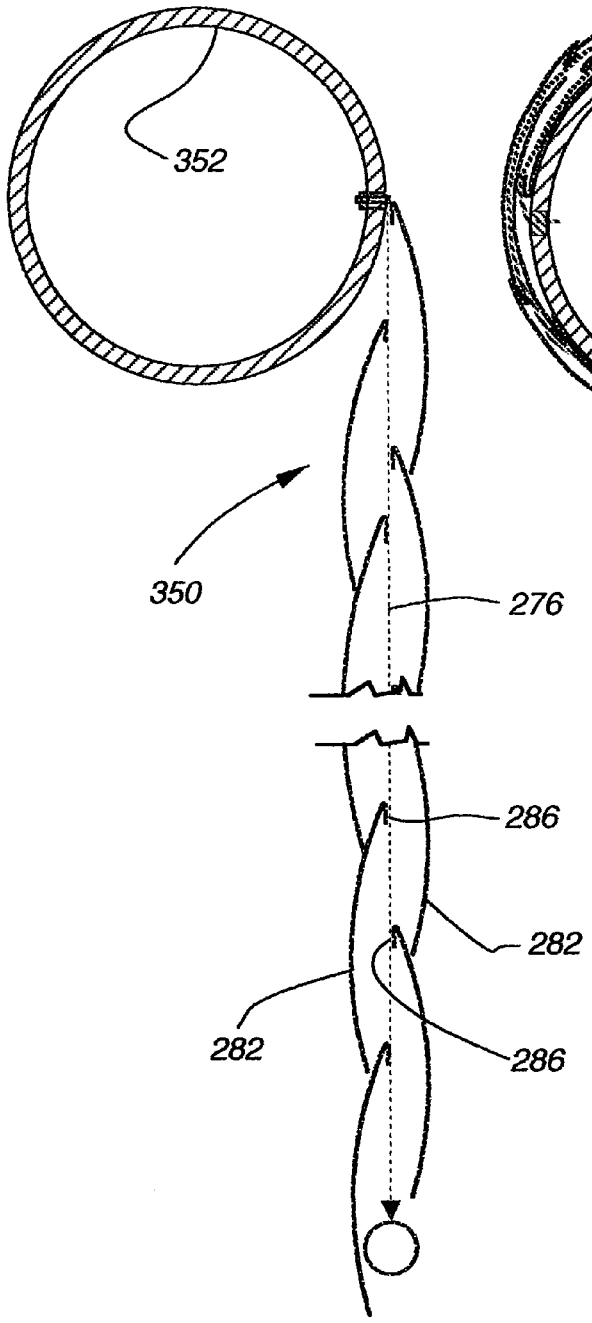
FIG. 29A is a fragmentary side elevation of a twenty-second embodiment of a fabric in accordance with the present invention mounted on a roll bar and with the fabric fully extended.
Figure 29B:
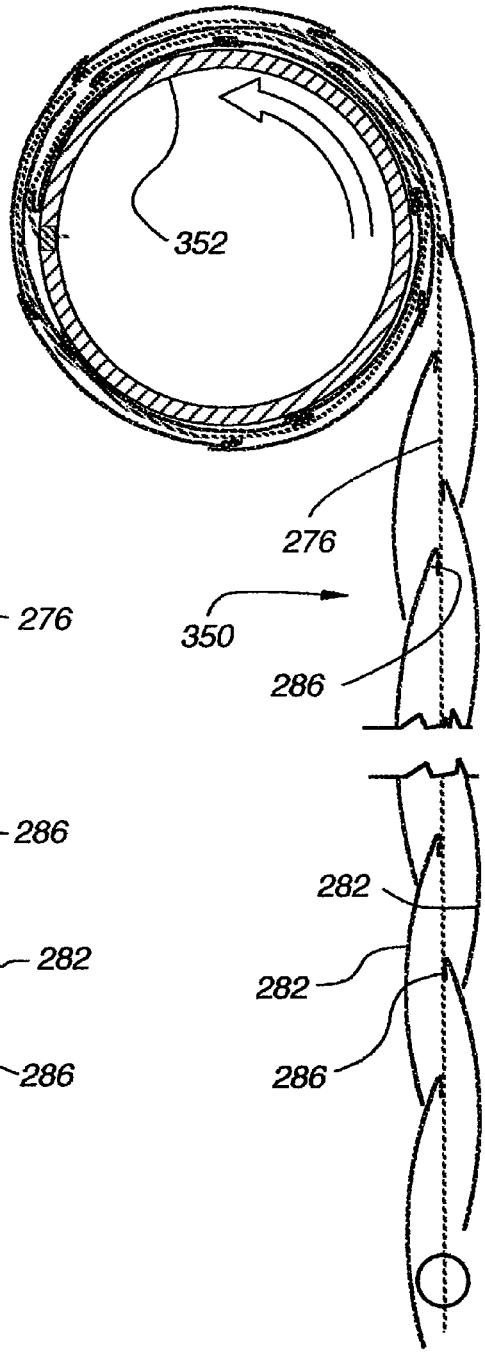
FIG. 29B is a side elevation similar to FIG. 29A with the fabric partially retracted onto the roller.

FIGS. 29A and 29B illustrate a twenty-first embodiment 350 of the present invention which is very similar to that of FIG. 26A except the semi-rigid slats 282 are mounted on a flexible support sheet of material 276 on both sides of the support sheet of material with tabs 286 along the top edges of each slat being secured in any suitable manner to the support sheet at vertically spaced horizontally extending locations. The slats on the front face of the support sheet are mounted in alternating spaced locations from those on the rear face of the support sheet and the fabric so formed is shown fully extended and supported from a conventional roller for a roller shade in FIG. 29A and with that fabric partially wrapped around the roller in FIG. 29B. Again, the resilient semi-rigid nature of the slats allows them to fully expand and resume their normal configuration once unrolled from a roller 352.

Figure 30A:
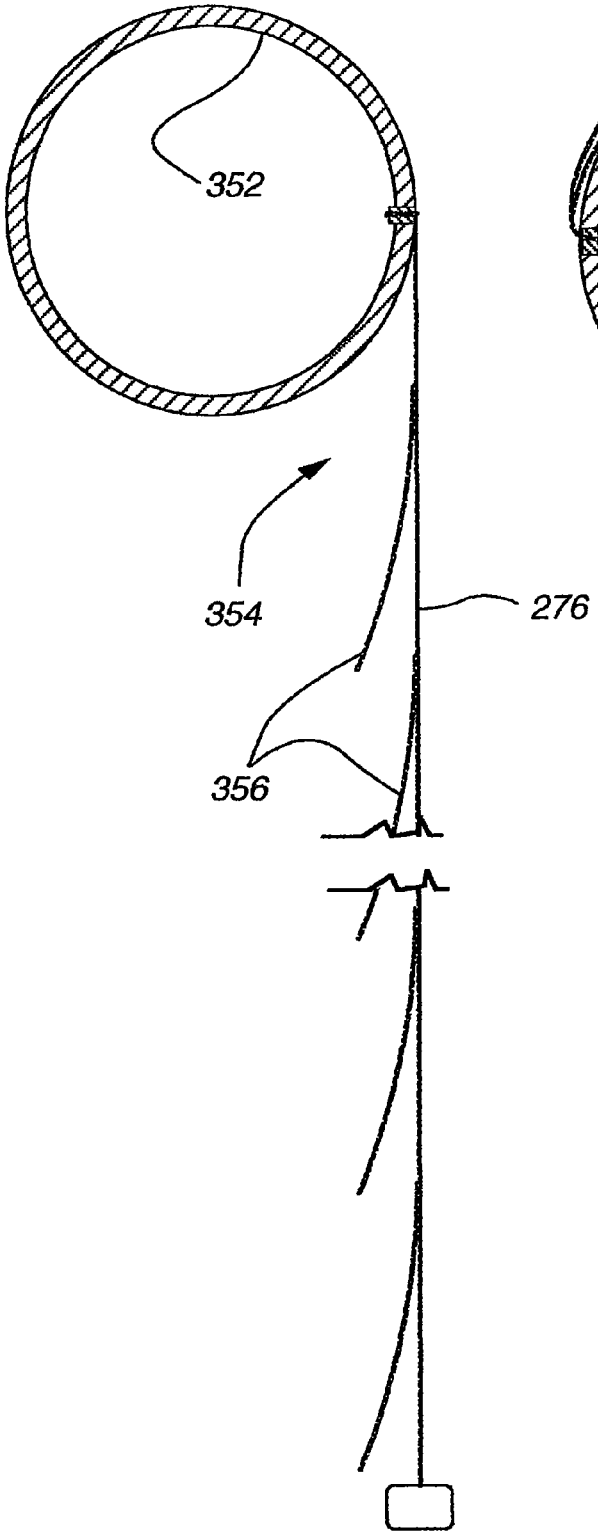
FIG. 30A is a side elevation of a twenty-third embodiment of a fabric in accordance with the present invention mounted on a roller and with the fabric fully extended.
Figure 30B:
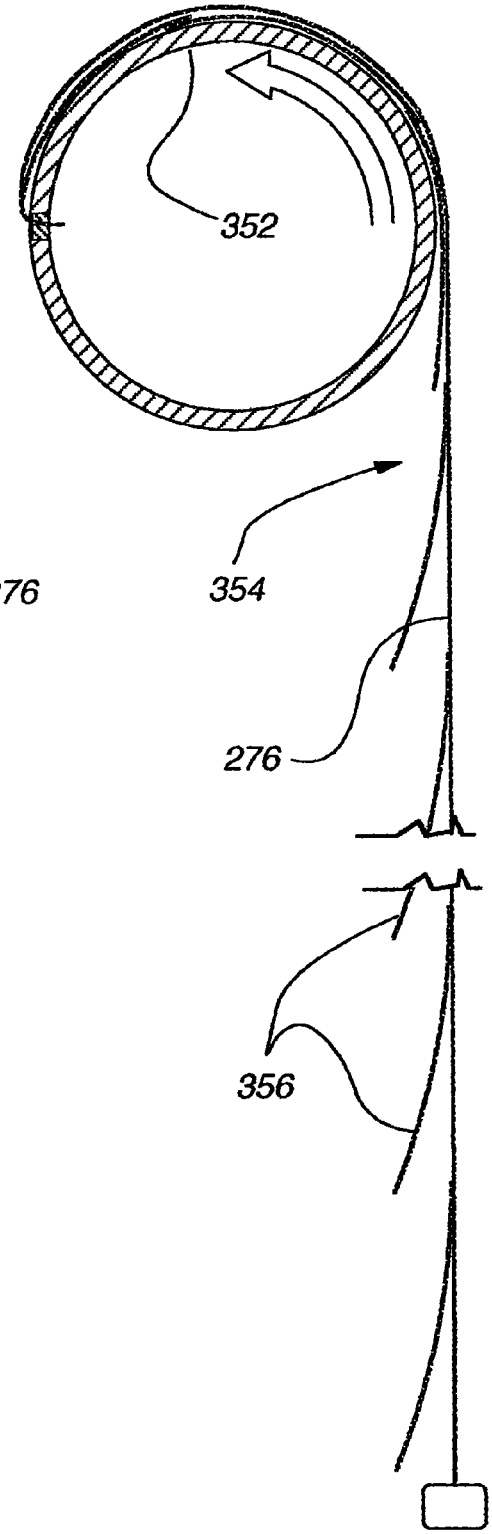
FIG. 30B is a side elevation similar to FIG. 30A with the fabric partially retracted onto the roller.

FIGS. 30A and 30B illustrate a twenty-second embodiment 354 of the present invention wherein a flexible support sheet 276 is suspended from a roller 352 in a conventional manner and a plurality of slats 356 that are arcuate in transverse cross-section are secured to the support sheet at vertically spaced horizontally extending locations. The slats, however, have their convex side facing the support sheet rather than the concave side as in the previously described embodiments. The covering is shown fully extended in FIG. 30A and partially wrapped around the conventional shade roller in FIG. 30B. Again, the resilient semi-rigid nature of the slats allows them to resume their normal configuration once removed from the roller.

Figure 31A:
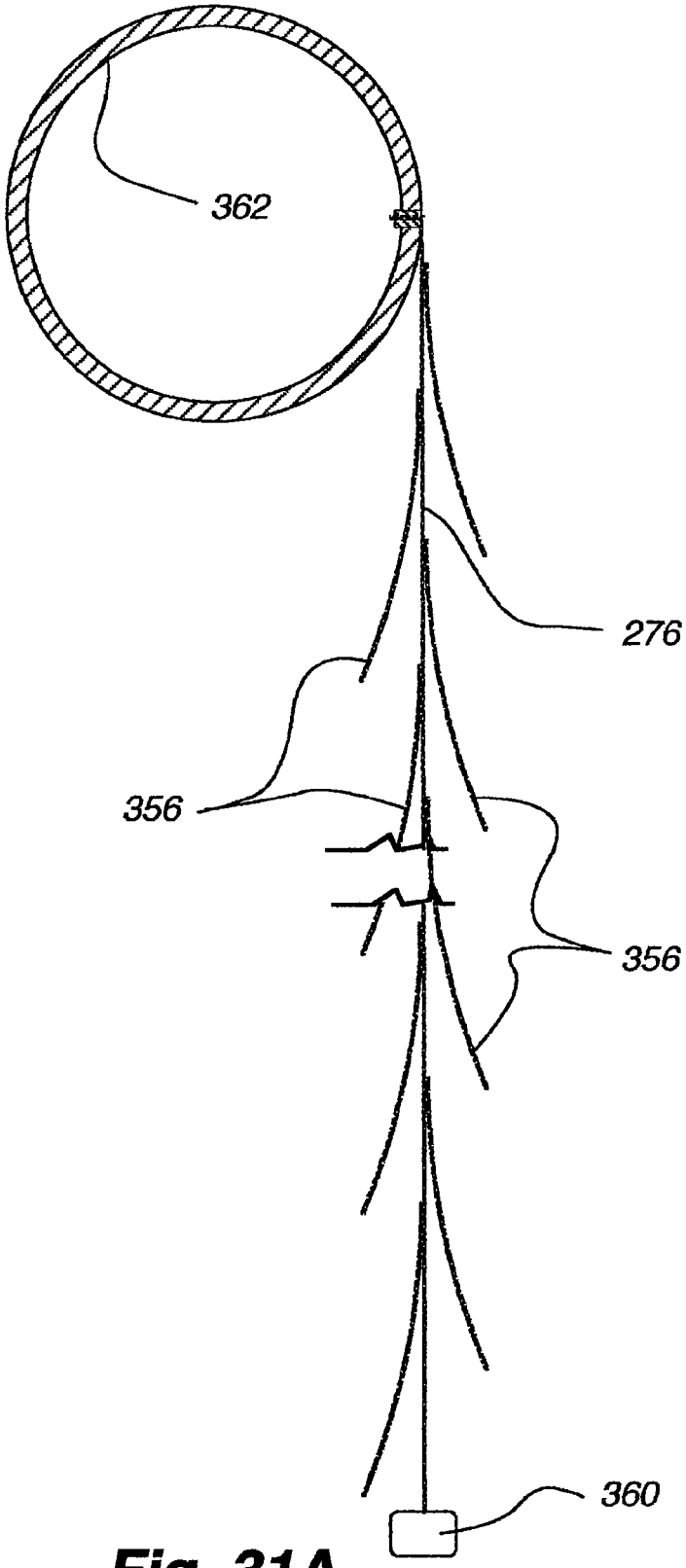
FIG. 31A is a side elevation of a twenty-fourth embodiment of a fabric in accordance with the present invention shown in a fully extended position and supported by a roller.

FIG. 31A shows a twenty-third embodiment 358 of the present invention which is similar to that of FIG. 30A except there are slats 356 provided on the front and rear face of a support sheet 276 having a weighted bottom rail 360 and again with the slats having their convex side facing the support sheet. The support sheet is again shown supported on a shade roller 362 in a conventional manner.

Figure 32B:
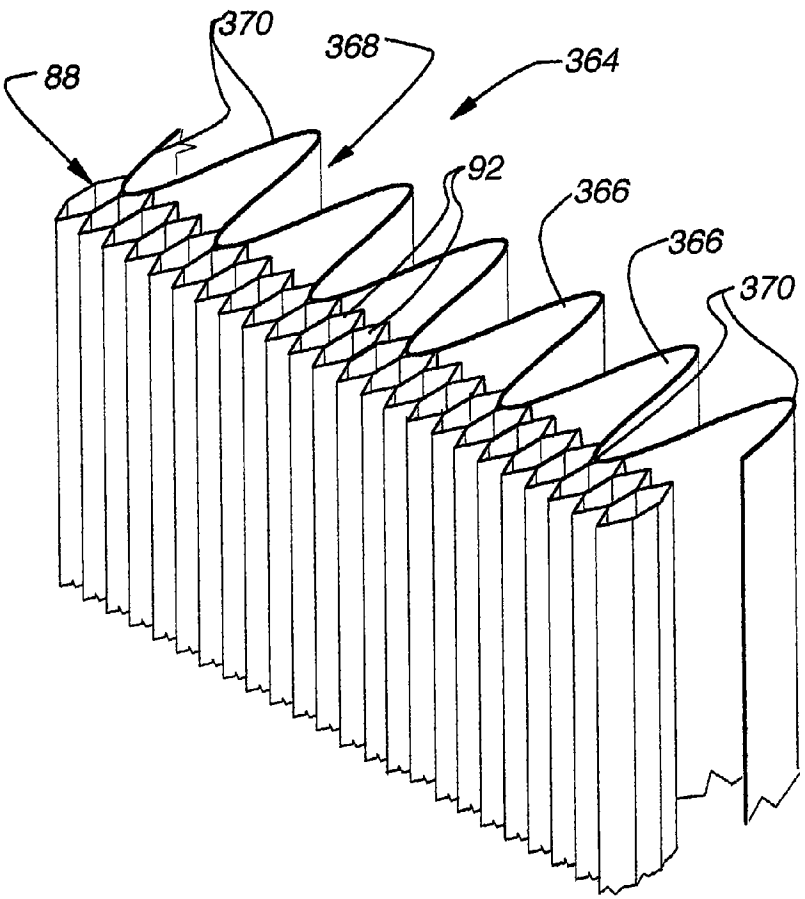
FIG. 32B is an isometric of the fabric of FIG. 32A looking at the rear of the fabric.
Figure 32A:
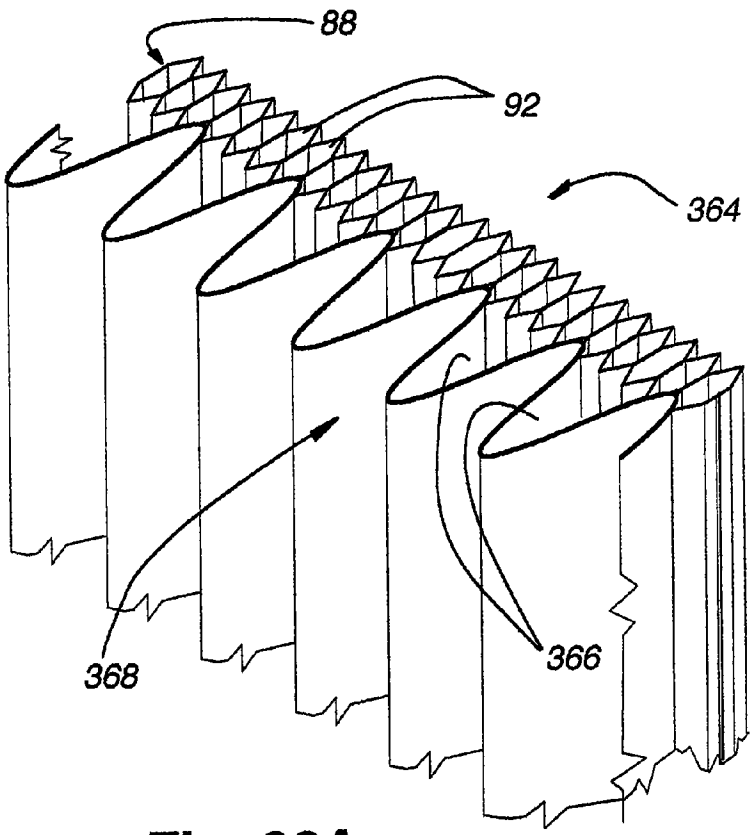
FIG. 32A is a fragmentary isometric of a twenty-fifth embodiment of a fabric in accordance with the present invention looking at the front of the fabric.
Figure 32D:
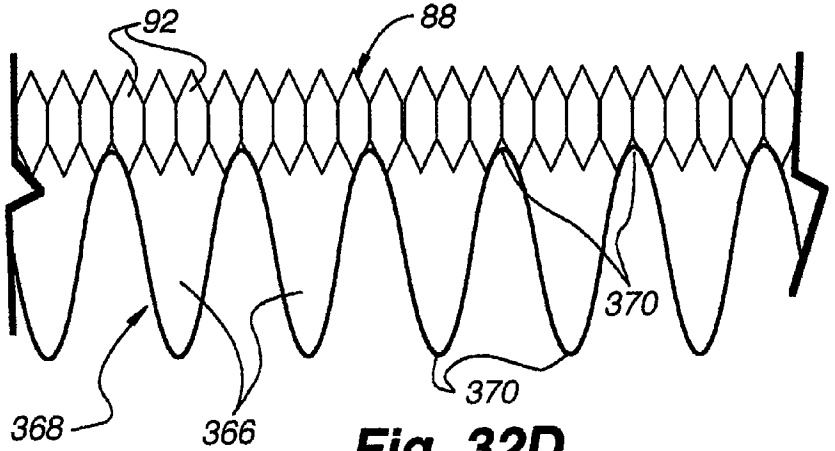
FIG. 32D is a side elevation of the fabric of FIG. 32A in a partially retracted position.
Figure 32C:
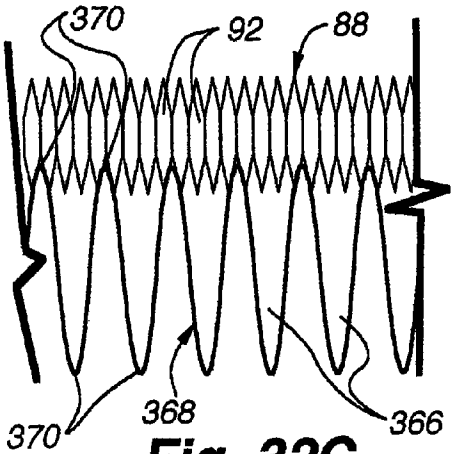
FIG. 32C is a side elevation of the fabric of FIG. 32A in a substantially retracted position.
Figure 32E:
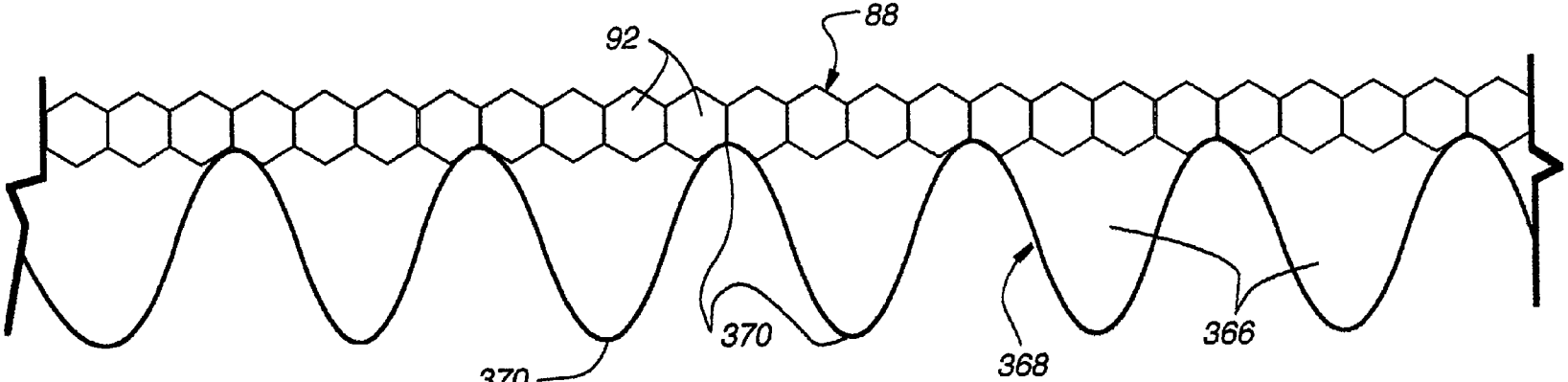
FIG. 32E is a side elevation of the fabric of FIG. 32A in a fully extended position.

FIGS. 32A-32E illustrate a twenty-fourth embodiment 364 of the present invention wherein the support structure 88 is illustrated as being superimposed transversely compressible semi-rigid cells 92 that are interconnected and are hexagonal in transverse cross-section. The vanes 366 in this embodiment are formed from a continuous sheet of flexible fabric material 368 that is formed into a zigzag pattern having apexes 370 facing in opposite directions and with each of the apexes facing in one direction secured to the support structure 88 at spaced locations along the length of the support structure. In the illustrated embodiment, there are four cells 92 between each location where the vane material is secured. As will be appreciated from the illustration, the fabric formed in this manner can be mounted horizontally or vertically. FIG. 32E illustrates the fabric in a fully expanded position, FIG. 32D shows the fabric in a partially retracted position, and FIG. 32C shows the fabric in a substantially fully retracted position.

Figure 33A:
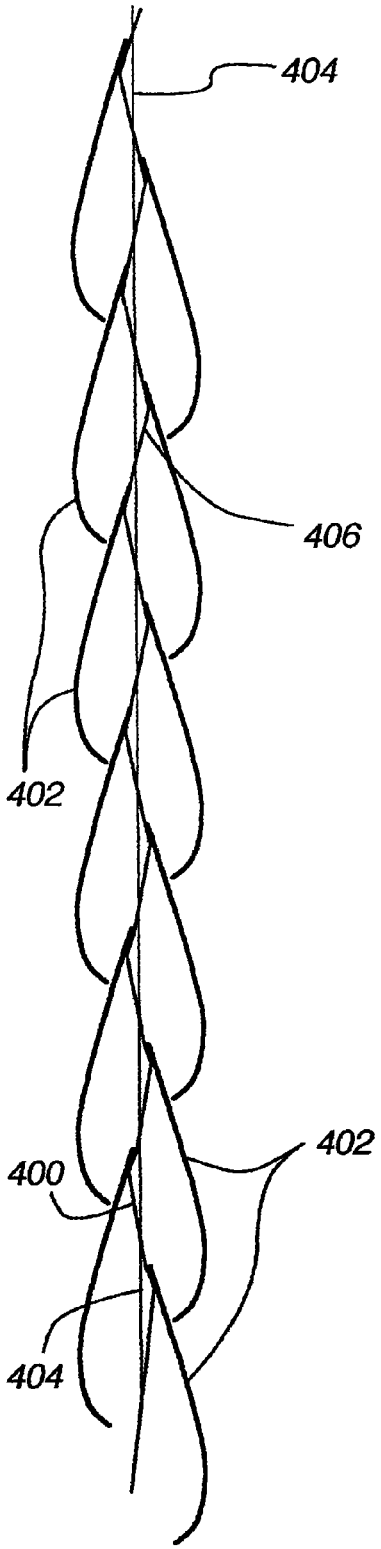
FIG. 33A is a side elevation of a twenty-sixth embodiment of a fabric in accordance with the present invention wherein the fabric is fully extended.
Figure 33B:
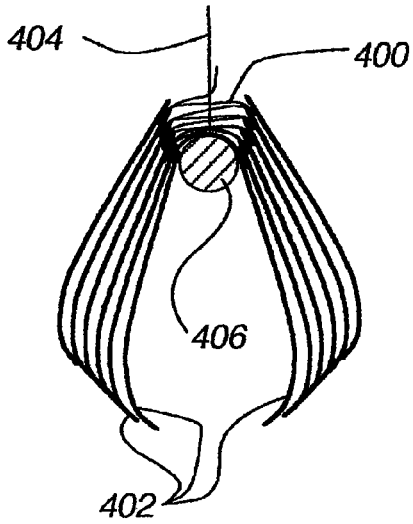
FIG. 33B is a side elevation of the fabric shown in FIG. 33A in a fully retracted position.
Figure 33C:
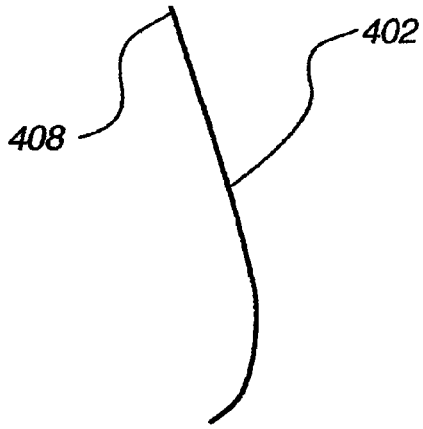
FIG. 33C is a side elevation of a slat used in the fabric of FIG. 33A.

FIGS. 33A-33C illustrate a twenty-fifth embodiment of a fabric in accordance with the present invention. In this embodiment, the support structure 400 can be in the form of a continuous sheet, ribbons, cords, microfibers, or the like to which slats 402 are attached at spaced locations and alternately from the front and rear face of the support structure. The slats are elongated and disposed horizontally and in cross-section are shaped similarly to half a tear drop. Each slat on the front of the fabric is adapted to slightly overlap the next adjacent lower slat on the front of the fabric and the same is true of the slats on the rear face of the fabric. A lift cord or cords 404 slidably extends vertically through the fabric and supports at its lower edge a horizontally disposed bottom rail 406 of circular transverse cross-section. When the bottom rail is lifted as when the lift cord is raised upwardly, the bottom rail gathers the support structure 400 and slats 402 as illustrated in FIG. 33B. The half tear-drop shape of each slat is illustrated in FIG. 33C and as will be appreciated by reference to FIG. 33A, a small marginal zone 408 along the top edge of each slat is secured to the support structure in any suitable manner. The slats are preferably made of a rigid or semi-rigid material. It should also be appreciated that the fabric would not necessarily have to be gathered with a bottom rail as illustrated in FIG. 33B, but could conceivably not include a lift cord and the entire support structure with attached slats could be rolled about a roller (not shown) at the top of the fabric if desired.

Figure 34A:
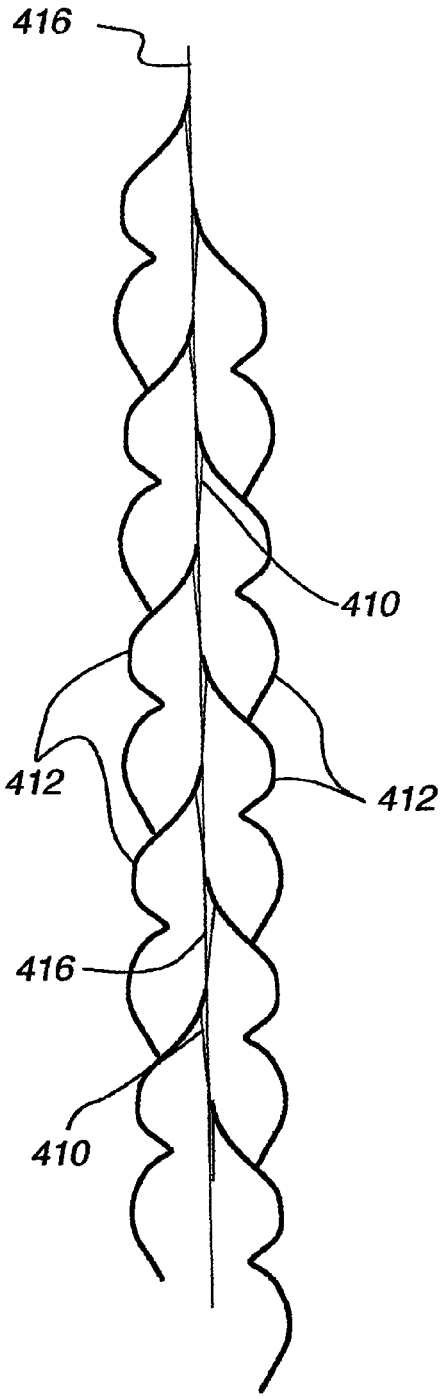
FIG. 34A is a side elevation of a twenty-seventh embodiment of a fabric in accordance with the present invention in a fully extended position.
Figure 34B:
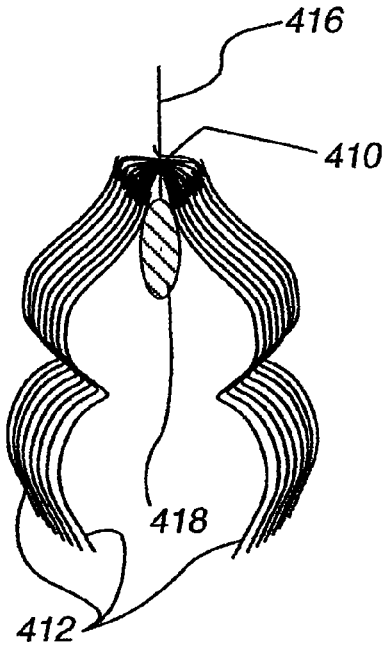
FIG. 34B is an enlarged side elevation of the fabric of FIG. 34A in a fully retracted position.
Figure 34C:
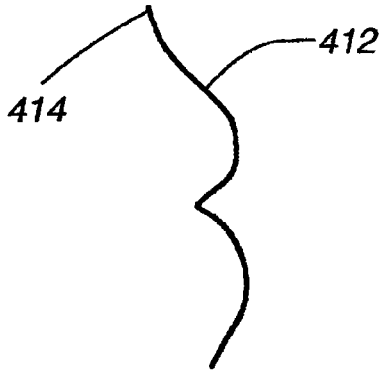

FIGS. 34A-34C illustrate a twenty-sixth embodiment of a fabric in accordance with the present invention. As can be appreciated by reference to FIG. 34A, the fabric includes a support structure 410 that could be in the form of a continuous sheet of material, strips of material, cords, ribbons, microfibers, or the like to which a plurality of vertically spaced slats 412 are mounted on the front and rear faces thereof. Each slat, as seen best in FIG. 34C, is of a generally wavy configuration simulating the letter W turned on its side. Each slat has a marginal zone 414 along an upper edge thereof which is attached to the front or rear face of the support structure and with the slats along the front and rear of the support structure overlapping the next adjacent lower slat and being alternated with slats on the other side of the support structure. A lift cord 416 could be extended downwardly through the support structure terminating in a weighted bottom rail 418 so that when the lift cord is raised upwardly, the bottom rail would engage the lowermost slats in the fabric and as the lower rail is further raised, gather the slats thereabove into a completely retracted condition as shown in FIG. 34B. It would not be necessary to use the lift cord, however, as the fabric could in fact be wrapped around a roller (not shown) positioned at the top of the fabric as has been described with previous embodiments. The slats would preferably be made of a rigid or semi-rigid material.

Figure 35A:
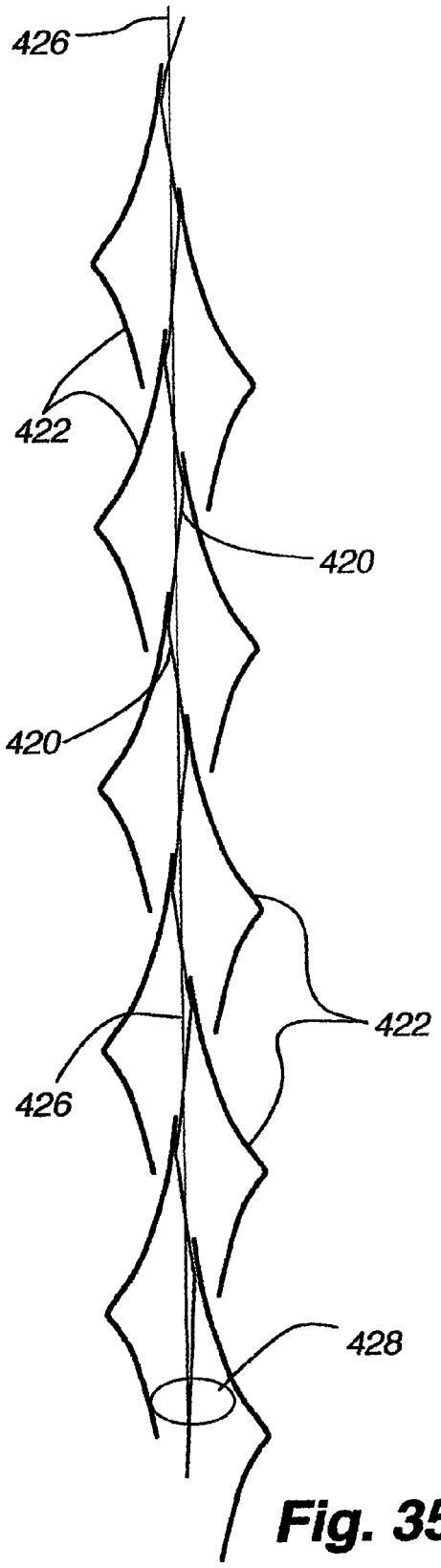
Figure 35B:
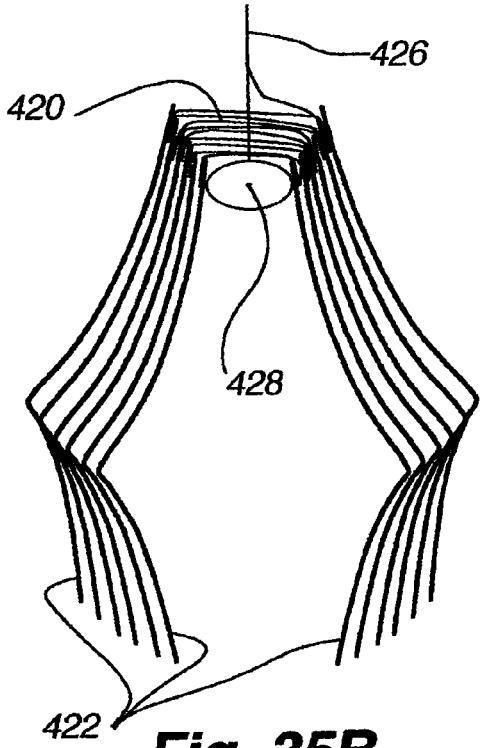
Figure 35C:
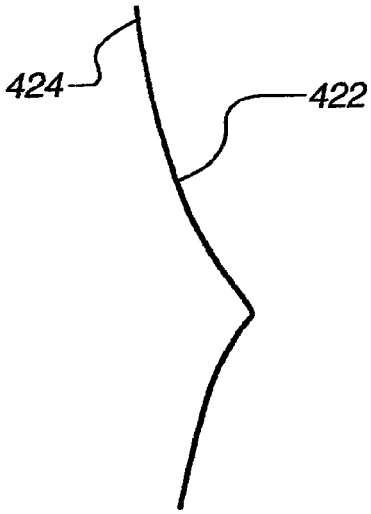

FIGS. 35A-35C illustrate a twenty-seventh embodiment of a fabric in accordance with the present invention. In this embodiment, a support structure 420 in the form of a sheet of material, ribbons, cords, microfibers, or the like supports overlapping slats 422 on the front and rear faces thereof. The slats as best seen in FIG. 35C resemble a flattened letter V turned on its side and define a marginal zone 424 along the upper edge which can be secured to the support structure. The slats on both the front and rear faces overlap the next adjacent lower slat and are alternated with slats on the opposite face of the support structure. The slats would preferably be made of a rigid or semi-rigid material. A lift cord 426 could be extended downwardly through the support structure terminating in a weighted bottom rail 428 so that when the lift cord was raised, the bottom rail would accumulate the slats and when the fabric was fully retracted it would assume the position illustrated in FIG. 35B. The lift cord would not be necessary, however, as the fabric could be attached at its upper end to a roller (not shown) whereby it could be rolled into a retracted position.

Figure 36A:
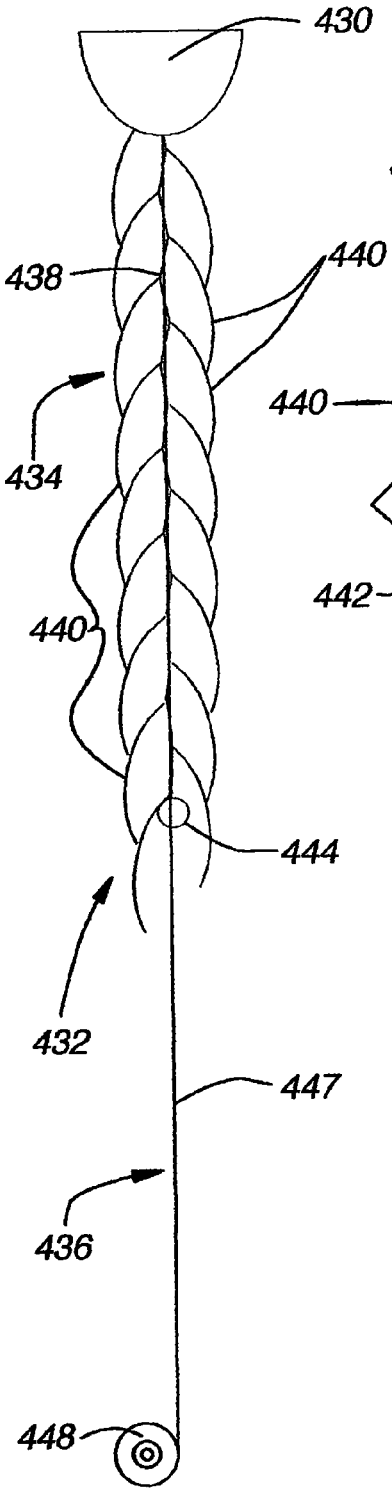
Figure 36B:
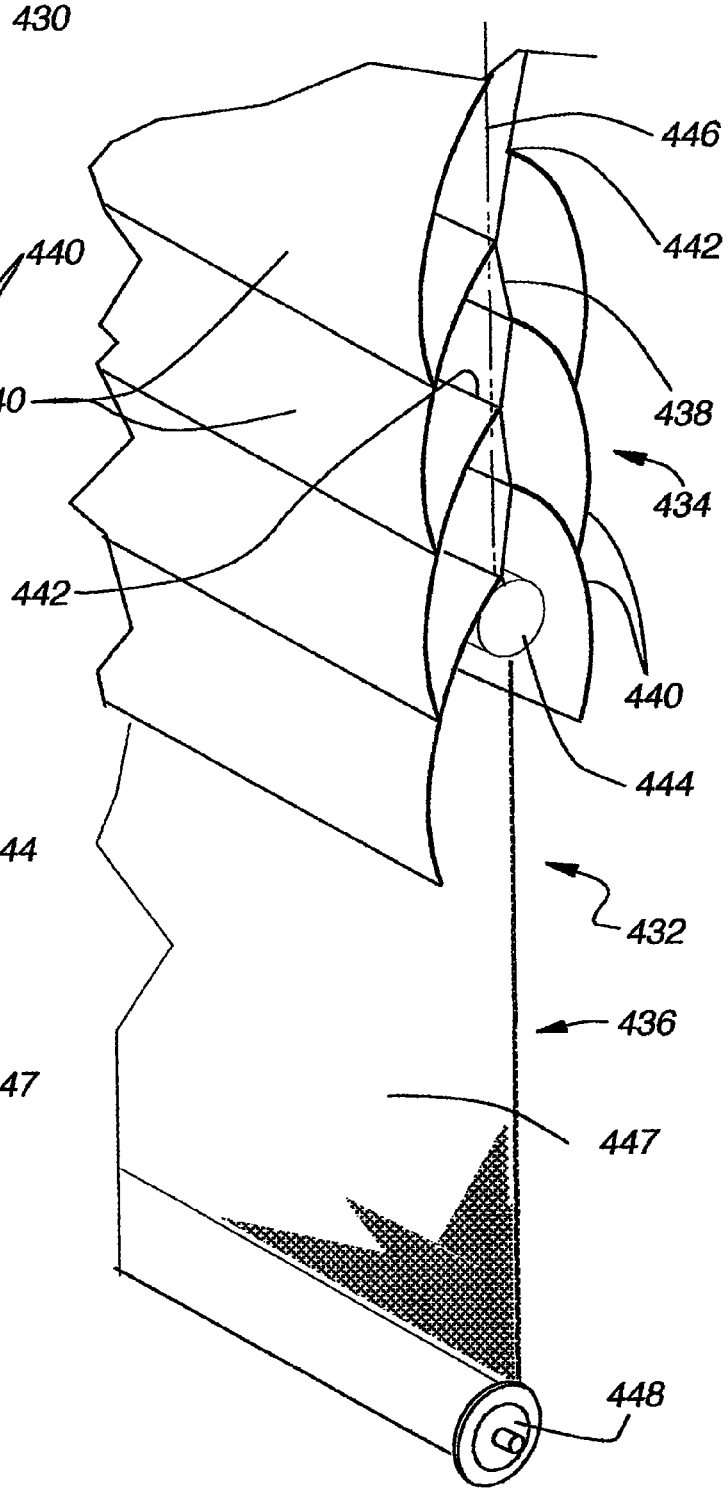

FIGS. 36A and 36B illustrate a shade for an architectural opening in accordance with the present invention which is hybrid in incorporating two different components of fabric material. The shade as best seen in FIG. 36A would be suspended from a headrail 430 into which it could be retracted with the fabric 432 including an upper component 434 and an interconnected lower component 436. The upper component is illustrated as having a support structure 438 in the form of a sheet of material but could be ribbons, cords, microfibers, or the like. The support structure has supported on both front and rear faces thereof elongated slats 440 of arcuate cross section with the slats being connected to the support structure along an upper edge 442 and with each slat overlapping the next adjacent lower slat. The slats on the front face of the support structure are alternated with slats on the rear face as in previously described embodiments. The upper component 434 terminates at its lower edge in a weighted lift rail 444 which may be suspended by lift cords 446 so that as the weighted rail is raised by the lift cords, the slats 440 are accumulated on the lift rail as in previously described embodiments. The lift rail in turn supports the lower component 436 of the fabric which is illustrated as a sheet of flexible material 447 that could be a sheer fabric or the like, with the sheet of material being connected along its lower edge to a roller 448. The roller could be a spring-biased roller of the type found in some retractable roller shades or could be a spring balanced roller which would allow the roller to be manually raised to and maintained at any location across the sheet of material. It will therefore be appreciated that the shade could be a bottom-up type shade suspended from the upper headrail 430 as illustrated or the roller 448 could be attached adjacent to the bottom of an architectural opening leaving the top edge of the fabric free to move up and down so that the shade is a top-down type shade which could be lowered from the top edge toward the roller 448 in any conventional manner. It will be appreciated from the above that the fabric for the shade could incorporate numerous combinations of fabric components and even more than two different components could be utilized.

Figure 37A:
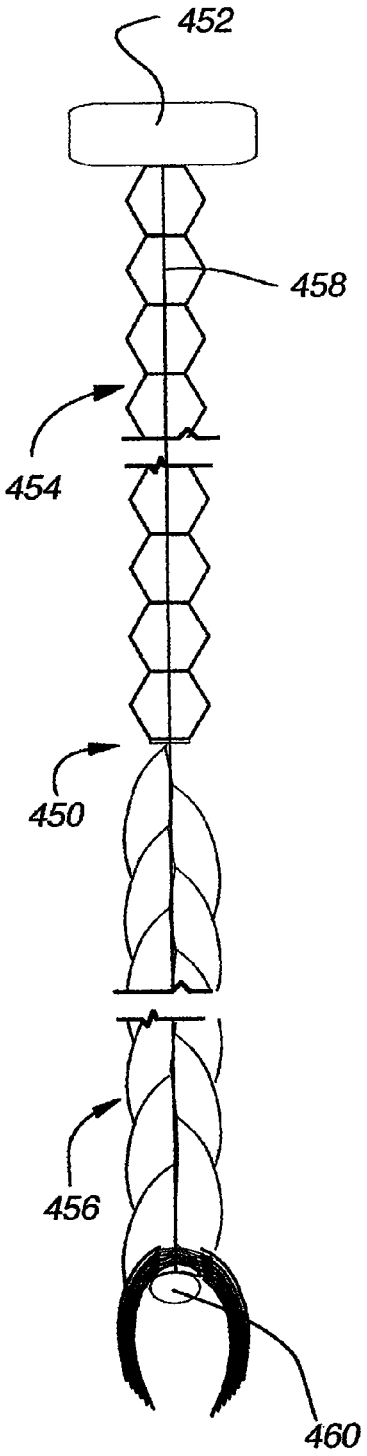
Figure 37B:
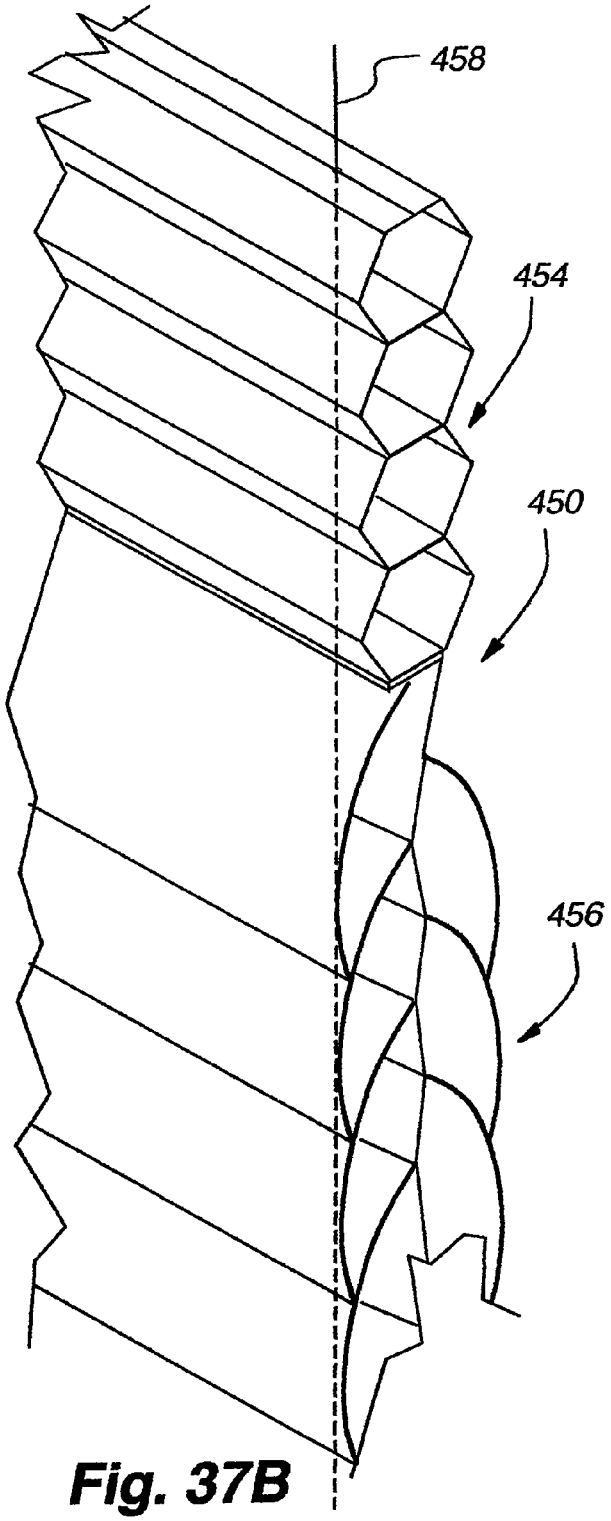

As an alternative to the hybrid shade shown in FIGS. 36A and 36B, a different hybrid shade 450 is illustrated in FIGS. 37A and 37B. In this hybrid shade, a headrail 452 supports an upper component 454 of the hybrid fabric which is an interconnected cellular fabric of the type described previously with other embodiments, and the lower component 456 is the same as the upper component disclosed in the hybrid shade of FIG. 36A. In this arrangement, a lift cord 458 would extend vertically from the headrail downwardly to a weighted bottom rail 460 which would allow the hybrid fabric to extend by gravity but could be retracted by raising the bottom rail with the lift cord. This shade is simply another illustration of ways of combining different fabrics some or all of which may be of the type disclosed in this invention to make a single shade for an architectural opening.

Figure 38A:
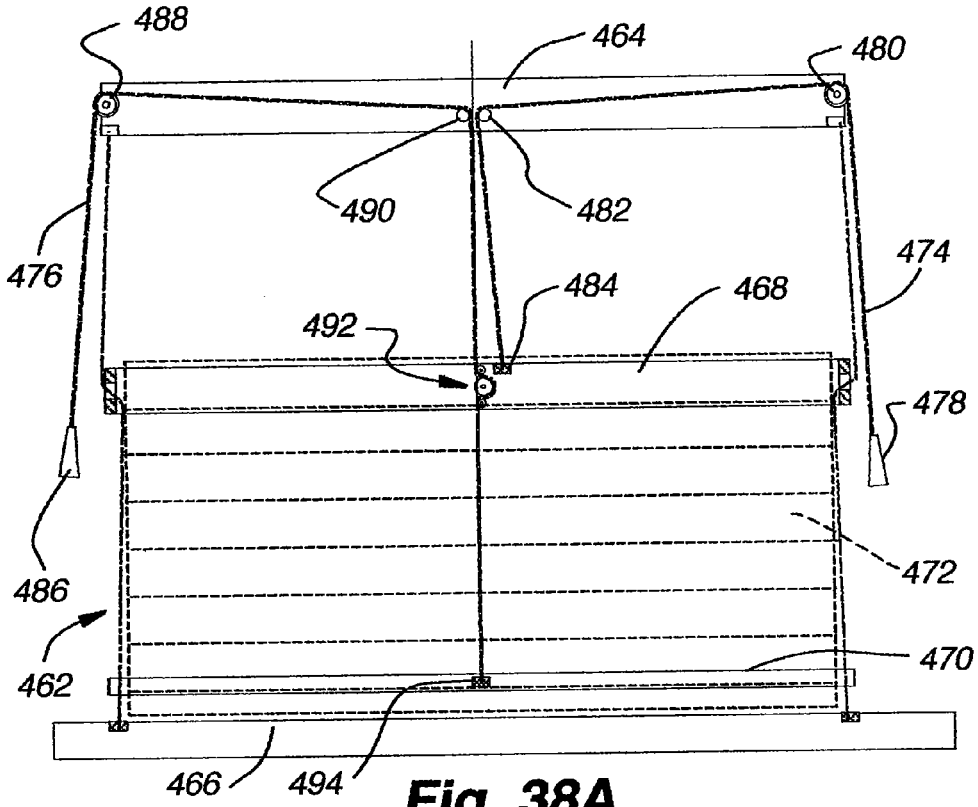
Figure 38B:
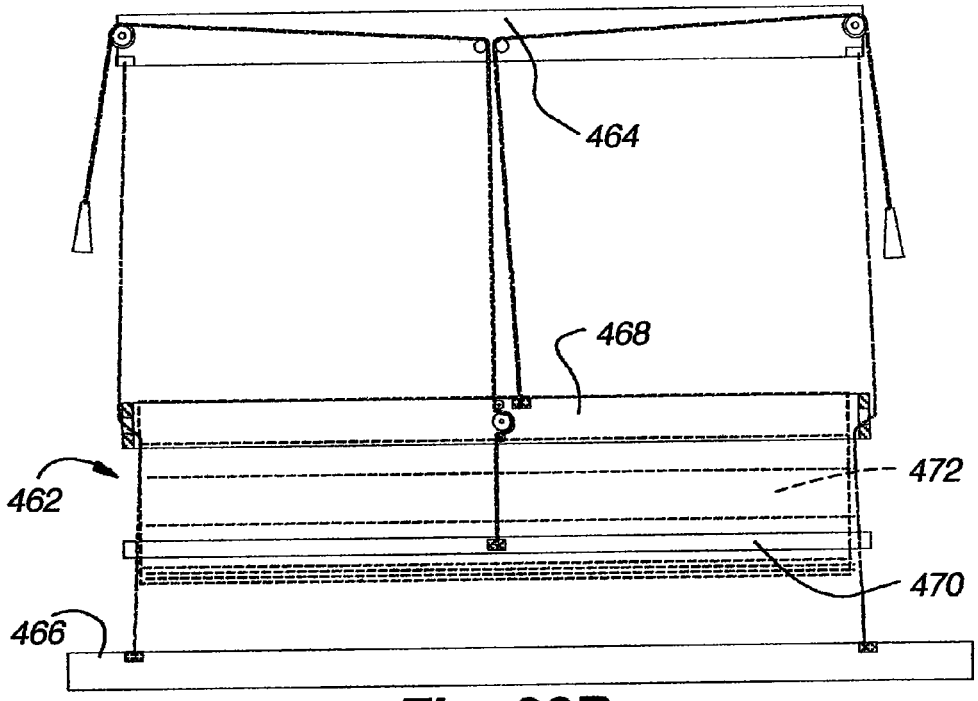

FIGS. 38A and 38B illustrate a control system for a shade wherein the fabric 462 used in the shade could be, for example, of the type illustrated in FIGS. 1-4. The control system is of a top-down/bottom-up type. The shade would include a headrail 464 that would be mounted adjacent to the top of an architectural opening to partially house a control system that would be anchored to a bottom frame member or sill 466 of the architectural opening. The shade would include an upper movable rail 468 and a lower movable rail 470 and a fabric 472, for example, of the type disclosed in FIGS. 1-4 extending between the upper and lower movable rails. A pair of pull cords 474 and 476 in the control system operate the shade with one pull cord 474 extending from a tassel 478 at the right side of the shade upwardly around a pulley 480 at the right end of the headrail 464, then horizontally around a right one 482 of a pair of centered pulleys of the headrail and downwardly from the right centered pulley to an anchor 484 in the upper movable rail 468. It will therefore be appreciated that pulling downwardly on the right tassel 478 would raise the upper movable rail while raising the tassel would allow the upper movable rail to drop by gravity. A conventional brake system (not seen) could be incorporated into the pulley 480 at the right end of the headrail to lock the right lift cord and thus the upper movable rail in any desired position.

The left lift cord 476 commences with a tassel 486 at the left side of the shade and extends upwardly around a left side pulley 488 which could incorporate a conventional releasable lock system (not seen), horizontally and around the left one 490 of the centered pair of pulleys and then downwardly along the center of the shade to pass around a series of three guide pulleys 492 to an anchored location 494 on the lower movable rail 470. It will therefore be appreciated that a downward pull on the left tassel 486 would raise the lower movable rail 470 and raising the left tassel would allow the lower movable rail to drop by gravity. Of course, the lock in the pulley 488 could secure the lower movable rail at any desired vertical position. The lower vertical rail, when raised relative to the upper movable rail, is used to gather or accumulate the slats in the fabric so whether or not the lower movable rail is raised or the upper movable rail is lowered, the slats can be gathered as described in connection with FIGS. 1-4 on the lower movable rail.

Figure 39A:
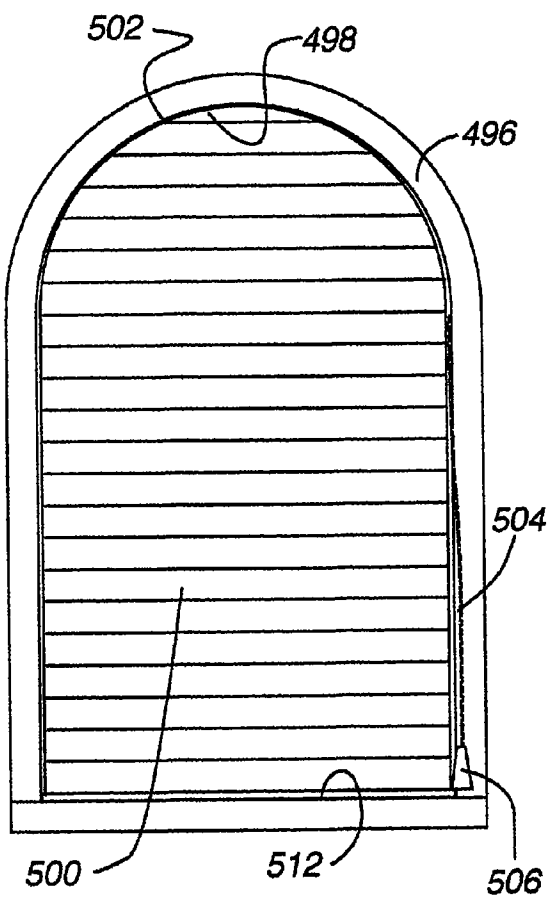

FIGS. 39A-39C and 40-44 illustrate an arrangement of a fabric of the type described, for example, in FIGS. 1-4 wherein the architectural opening 496 in which the shade is mounted has a semi-circular top edge 498. A fabric 500 formed as described in connection with FIGS. 1-4, for example, having a support structure 38 and slats 42 would be cut to conform with the shape and size of the architectural opening so that the top edge 502 of the fabric is also of a semi-circular configuration. A lift cord 504 having a tassel 506 at one end would extend into an opening 508 (FIG. 40) in one side of the frame around the architectural opening and be slidingly confined within a groove 510 (FIG. 40) in the frame and subsequently pass out of the framework at a centered location in the semi-circular top edge 498 of the architectural opening. From there the lift cord would extend downwardly for attachment to a centered location on the top edge 502 of the fabric. Pulling the tassel 506 downwardly would therefore raise the top edge of the fabric while allowing the tassel to move upwardly would permit the fabric to drop by gravity downwardly from the fully extended position of FIG. 39 through an intermediate position as shown in FIG. 39B to a substantially fully retracted position as shown in FIG. 39C. A conventional lock (not seen) for the pull cord could be incorporated into the framework for the architectural opening so the fabric could be releasably positioned at any desired position within the architectural opening. The framework for the architectural opening would have a ledge or sill 512 along the lower edge thereof on which an I-beam type accumulating rail 514 as shown in FIG. 41 could be mounted and to which the lower edge of the fabric 500 would be attached. This rail would provide a structure on which the slats in the fabric could accumulate as the fabric was lowered with the lift cord and off which the fabric could be lifted as the lift cord raised the upper edge of the fabric toward the top of the architectural opening.

As an alternative to the I-beam accumulating rail 514 shown in FIG. 41, a rail 516 of ovular cross-sectional configuration could be provided of the type shown in FIGS. 42-44. This rail could be made of a semi-rigid pre-creased flat piece of material 518 as illustrated in FIG. 44 wherein the strip of material has a main portion 520 and a base portion 522 defined by a crease 524 which defines a fold line with the base portion being secured, for example, on its undersurface to a strip of double-faced adhesive 526. The edge 528 of the main portion 520 opposite the base portion 522 could define a flap 530 having a strip of double-faced adhesive 532 so the main portion could be folded through a generally egg-shaped loop as shown in FIGS. 42 and 43 and secured to the opposite side edge 534 of the base from where the main portion 520 is pivotally connected to the base 522. In reality, the pivotal connection would simply be a crease and a similar crease would be defined between the main portion and the flap. The accumulator rail 516 when desirably folded would have a look as shown in FIG. 43 and could then be adhesively stuck to the sill 512 of the architectural opening as shown in FIG. 42 and define an aesthetically pleasing gathering rail to which the lower edge of the fabric is secured and on which the fabric for the shade could be accumulated or removed depending upon whether or not the shade is retracted or extended respectively.

FIGS. 45-47 disclose still another use of a fabric in accordance with the present invention which may be of the type described, for example, in FIGS. 1-4 and in this arrangement, four identical shade components 536 are mounted in one architectural opening 538 in vertically aligned relationship. Each shade component would be, for example, of the type shown in FIGS. 1-4 so that its fabric component 540 could be raised or lowered across the portion of the architectural opening to which it is associated. Each shade could be operated independently or in unison by either leaving the lift cords for the shades separate or by combining the lift cords, respectively. FIG. 45 shows all four shade components fully extended so that the entire architectural opening is covered by slats. FIG. 46 shows each shade component partially extended. FIG. 47 shows each shade component fully retracted. Of course, when fully retracted, the headrail 542 for each shade component would still be visible.

FIGS. 48A and 48B illustrate the fact that a fabric in accordance with the present invention and such as, for example, the embodiment shown in FIGS. 1-4 could be mounted in an architectural opening 543 of a triangular configuration. The fabric 544 would be cut into a shape and size commensurate with the opening in which it is to be mounted and an accumulating rail (not seen) could be positioned along the base of the triangular opening to which the lower edge of the fabric 544 is attached. A lift cord 546 would be connected to the top edge or apex 548 of the fabric so the apex could be raised or lowered allowing all the slats thereunder to be removed from the accumulating rail or accumulated thereon in a fully retracted position. Of course, FIG. 48A shows the shade fully extended across the opening and FIG. 48B shows the shade partially extended.

FIGS. 49A and 49B illustrate another use for a shade in accordance with the present invention and which again could be of the type disclosed in FIGS. 1-4 with this embodiment having upper 550 and lower 552 shade components and accumulating rails 554 and 556, respectively, associated therewith across the vertical center of a circular opening 557 in which the shade is mounted. The upper and lower shade components are cut in semi-circular configurations and inverted relative to each other. Operating cords 558 and 560, respectively, are attached to vertically aligned centered locations at the top and bottom of the upper and lower respective shade components. FIG. 49A shows both shade components fully extended but when retracted, the pull cords would be operated to draw the top and bottom edges of the upper and lower shade components, respectively, toward a centered horizontal location in the architectural opening (FIG. 49B) where the accumulating rails would face upwardly and downwardly to receive the slats in stacked relationships. In other words, the fabric material would extend away from the vertically centered, horizontally extending accumulating rails when the shade was being moved from a retracted to an extended position. Obviously, either the upper shade component or the lower shade component could be operated independently if desired.

FIGS. 50A and 50B illustrate a shade in accordance with the present invention, which could again be of the type shown in FIGS. 1-4, mounted in an architectural opening 561 in the shape of a right triangle having a vertical side, a lower base side perpendicular thereto and a hypotenuse. The fabric 562 for the shade would be cut in the same size and shape as the opening and would have its slats oriented horizontally. A mounting rail (not seen) would be mounted on the base of the triangle to which the lower edge of the fabric would be connected and onto which the slats could accumulate when the shade was retracted by allowing the slats to drop by gravity onto the accumulating rail. A lift cord 564 would be incorporated into the vertical side of the fabric so as to lift the apex 566 of the fabric upwardly when extending the shade or lower the apex when retracting the shade onto the accumulating rail.

FIGS. 51A and 51B illustrate still another possible use of a fabric in accordance with the present invention with the fabric again possibly being of the type illustrated in FIGS. 1-4. In this use, there are three adjacent architectural openings 566, 568, and 570 in which independent shades 572, 574, and 576, respectively, are mounted while each of the shades are shown as bottom-up type shades, they could be reversed so as to be top-down type shades or a top-down/bottom-up type shade. In the illustrated bottom-up arrangement, each shade might have a lift rail (not seen) mounted above at 578, but near, a lower contoured edge 580 of the fabric of each shade. The lower edge of each fabric is contoured in a complementary manner to the adjacent fabrics so that when the fabrics are positioned in selected positions, a continuous non-linear contour of the three combined shade components is established. In FIG. 51A, each fabric component is shown substantially extended across the architectural opening in which it is mounted while in FIG. 51B each shade component is substantially retracted. It should also be appreciated that since the bottom rail for each shade is not along the bottom edge of the fabric but rather just above the lower contoured edge, the shades are never fully retracted but look as shown in FIG. 51B when substantially fully retracted so as to always show the lower contoured edges. As an alternative, the shades could be mounted on rollers in a headrail so as to be fully retractable.

FIGS. 52-73B are directed to a further arrangement of the shade of the present invention wherein a fabric of the type shown in the embodiment of FIG. 1 is incorporated into a system that does not include rollers or lift cords for moving a bottom rail upwardly or a top rail downwardly in the operation of the shade. Rather, the embodiment of FIGS. 52-73B includes a fabric 590 of the type shown in FIG. 1 incorporated into a system with a rail that is manually movable with a handle connected directly to the rail between extended and retracted positions. As will also be appreciated with the description that follows, this arrangement of the invention can be made into a top down system, a bottom up system, or a top down/bottom up system. Further, as will be appreciated from the description that follows, the arrangement can utilize a top rail, bottom rail, and midrail(s) which are uniformly designed but can be mounted in different orientations depending upon their use in the covering.

With reference first to FIG. 52, the covering can be seen to include a top rail 592 that is securable in an architectural opening with end brackets 594, a bottom rail 596 that is also securable in the architectural opening (not shown) with end brackets 594 which may be identical to those supporting the top rail 592, and a midrail 598. The top rail and bottom rail anchor the ends of two vertically extending guide cords 600 which are disposed near the ends of the rails with the guide cords being operatively connected to the midrail 598 as will be described hereafter so that the midrail can be moved vertically to any selected position with a manually gripable handle 602 that is secured thereto. The fabric 590 for the covering is suspended along its top edge from the top rail 592 and anchored along its bottom edge to the midrail 598 so that when the midrail is raised, as illustrated in FIG. 53, the fabric material is accumulated adjacent to the top of the material and when lowered the fabric is expanded across the architectural opening. The midrail can be positioned adjacent to the bottom rail similarly to FIG. 52, or with the midrail lowered even further so that the bottom vane 604 of the fabric overlaps the bottom rail.

The mounting brackets 594 which might best be seen in FIGS. 54, 57, and 58 are universal and are interchangeable between use for supporting the top rail 592 and/or the bottom rail 596. Each bracket has a base 606 with perpendicular vertical walls 608 having holes therethrough for receiving fasteners that anchor the bracket to the framework around the architectural opening. The bracket further has a tongue 610 extending from the base and a curved securement finger 612 lying thereover. The tongue is adapted to receive an insert 614 at the associated end of a top or bottom rail as will be described later. The bracket can be mounted either horizontally as shown in FIGS. 57 and 58 or vertically as shown at the top of FIG. 55.

As mentioned previously, each of the top 592, bottom 596, and midrails 598 are of identical construction and as probably best seen in FIGS. 52, 52B, 52G, and 52H, are extruded members of generally H-shaped transverse cross section so as to define an upper groove 616 with overhanging lips 618, a bottom groove 620 with overhanging lips 622, and a center groove 624 that opens through a rear wall 626. A notch 628 is formed in the front wall 630 that also has overhanging lips 632 and as will be appreciated in FIG. 52B, the height of the rail is greater than the width. For purposes of the present disclosure, the orientation shown in FIG. 52B will be referred to as a vertical orientation of the rail. When the rail is turned 90 degrees in either direction, it will be referred to as a horizontal orientation. By way of example, with reference to FIG. 52, the top rail 592 and the midrail 598 are both vertically oriented, and the bottom rail 596 is horizontally oriented.

With reference to the top rail 592 as shown in FIG. 52B, the top 616 and bottom 620 grooves are devoid of any operative components except that they receive the previously mentioned inserts 614. The notch 628 in the front wall is used to anchor the top edge of the support members 38 in the fabric 590 with an anchor strip 634 that is secured to the support members with a strip of adhesive 636. The anchor strip is flexible and confinable behind the inturned lips 632 of the notch 628 so that the top of the fabric is anchored to the front of the top rail with the uppermost vane 42 abutting the upper lip 632 of the top rail so as to essentially cover the top rail from view. A guide cord 600 is also seen in FIG. 52B as passing through the center groove 624 in the top rail member as will also be described in more detail hereafter.

As is probably best seen in FIG. 55, and as mentioned previously, there are two guide cords 600 each having one end anchored in the top rail 592 and an opposite end in the bottom rail 596 with an intermediate portion of each guide cord passing slidably through the midrail 598. The top ends of the guide cords are interconnected with a coil spring 640 seated in the center groove 624 and pass through the center groove in the top rail in opposite directions so as to extend through the inserts 614 at the ends of the top rail, then downwardly and into the insert 614 at the associated end of the midrail 598 where each cord extends laterally across the covering and through the insert 614 at the opposite end of the midrail before extending downwardly and into the insert 614 at the associated end of the bottom rail 596 and subsequently inwardly toward the opposite end of the bottom rail. Finger clamps 642, which will be described in more detail later, secure the lower ends of the guide cords to the bottom rail.

Referring to FIG. 54, the midrail 598, top rail 592, and bottom rail 596 have been incorporated into the skeletal system shown in FIG. 55 and as will be appreciated, the midrail can be moved upwardly or downwardly and through friction of the guide cords with the inserts 614 at the end of the midrail and support of the midrail by the guide cords, the midrail will remain in any position in which it is placed. The handle 602 mentioned previously, which is secured to the midrail, as will be described later, is used to move the midrail up or down so as to position it in any desired location.

The covering shown in FIGS. 52-56 is a bottom up system wherein the midrail 598 is positioned adjacent to the bottom rail 596 when the covering is fully extended but adjacent to the top rail 592 when the covering is fully retracted. FIGS. 52C and 52D as well as FIGS. 52E and 52F illustrate the passage of the guide cords 600 through the top rail, middle rail, and bottom rail and their interconnections therewith. With regard to FIGS. 52E and 52F, and with further reference to FIGS. 52G, 52H, 52I, and 52K, the finger clamps or locks 642 are elongated bodies having pivot arms 644 and a pair of transverse passages 646 at one end through which a guide cord can be reversibly extended to hold it in place on the finger lock. The finger lock is adapted to be slid into the end of the upwardly opening groove 616 in the bottom rail and can be positioned at any location along the length of the bottom rail when the finger lock is vertically oriented as shown in FIG. 52F. In other words, the fingers will slide in the upwardly opening groove when vertically oriented as in FIG. 52F but can be pivoted about the pivot arms 644 into the position of FIG. 52E to pinch the guide cord 600 within the upwardly opening groove and hold the finger lock in a locking position. FIG. 52G shows the guide cord being pinched at the pivot arm end thereof and unpinched adjacent the opposite end of the lock finger. Of course, the lock fingers are positioned along the length of the bottom rail at a position to obtain a desired tension in the guide cords which should be sufficient to retain a dependable vertical orientation of the cords as they extend between the top and bottom rails and through the midrail so that the midrail can be easily slid along their length in moving the covering between extended and retracted positions.

The previously mentioned inserts 614 for the ends of the rails are probably best illustrated in FIGS. 56-58 and can be seen to have an enlarged hollow projection 648 for receipt in an open end of the center groove 624 through an associated rail, and smaller projections 650 for receipt in the upper 616 and lower 620 grooves of the rail with the projections being sized to frictionally fit within the grooves of the rail to be releasably retained therein. The opposite end of each insert has bifurcated legs 652 defining a slot 654 therebetween that receives the tongue 610 of the associated mounting bracket 594. The exploded view of FIG. 57 probably best illustrates the insert with a mounting bracket and once in place on the tongue, is prevented from easy removal by the overlying curved securement finger 612 as seen in FIG. 58. FIG. 56 is also illustrative of the interconnection of the top of the fabric 590 to the front groove or notch 628 in the top rail as described previously. The inserts are made of a somewhat rigid material.

The handle 602 used to raise or lower the midrail 598 in operation of the covering is probably best seen in FIGS. 54 and 55 to include an upstanding back wall 656, a horizontal forwardly extending lower flange 658 and an integral horizontal rib 660 along the top of the back wall which can be slidably received in the downwardly opening groove 620 of the midrail so as to be supported therefrom. The back wall 656 also has downwardly and forwardly flaring ribs 662 adapted to confine a bottom edge of a dummy vane 664 (FIGS. 56, 73A, and 73B) in the fabric material to hold the dummy vane in a desired orientation as will be explained later. An arcuate finger tab 666 projects forwardly from the flange 658 in a position where it can be gripped by an operator of the covering at a location outwardly from the fabric 590 as probably best seen in FIG. 53.

From the above, it will be appreciated the midrail 598 can be moved between any desired position with the handle 602 and will retain any position in which it is placed due to the friction of the midrail with the guide cords 600 and the support of the guide cords. The spring 640 interconnecting the top ends of the guide cords is of sufficient strength to provide desired tension in the guide cords as is also determined by the positioning of the finger locks 642 in the bottom rail. As in the previously described uses of the fabric, when the midrail is raised, the fabric 590 will gather and be supported on the midrail and as the midrail is lowered, the fabric will become unstacked and distributed vertically across the architectural opening from the top rail to the midrail regardless of its position.

Referring to FIGS. 59-62, the same components described with regard to the arrangement of FIG. 52 are utilized in a top down shade by anchoring the lower end of the fabric material 590 to the bottom rail 596 similarly to the manner in which the top edge of the fabric was anchored to the top rail 592 in the embodiment of FIG. 52. The top edge of the fabric is in turn anchored to the front of the midrail 598. An inverted handle 668 having simply a finger tab 670 with a horizontal rib 672, for retention in the top groove of the midrail, is provided for movement of the midrail. The guide cords 600 are also reversely mounted so that the finger locks 642 are in the top rail 592 and the coil spring 640 in the bottom rail 596 but again pass through and along the length of the midrail so that the midrail can be positioned at any location between the top and bottom rails to move the covering between extended and retracted positions. As shown in FIG. 59, the midrail has been fully elevated so as to fully extend the covering across the architectural opening whereas in FIG. 60, the midrail has been lowered adjacent to the bottom rail to retract the awning relative to the architectural opening.

FIGS. 61 and 62 show the guide cords 600 with the finger locks 642 being in the top rail 592 and the coil spring 640 in the bottom rail 596 and the handle 668 on the intermediate rail 598. The handle, as mentioned previously, is raised slightly so that a back plate is not necessary but rather only the rib 672 which is slidably secured in the open groove 616 along the top of the midrail for attachment of the handle to the midrail.

FIGS. 63-66 show an arrangement of the covering of FIG. 52 wherein it functions as both a top down and a bottom up covering. In this arrangement, as probably best illustrated by reference to FIG. 66, there are two sets of guide cords 600 on each side of the covering with one set having its upper ends secured in the top rail 592 with finger locks 642 and its lower ends to a coil spring 640 in the bottom rail 596 while the opposite set has its lower ends secured to the bottom rail with lock fingers and its top ends to each other in the top rail with a coil spring. The cords 600 pass in reverse directions through an upper midrail 598U and a lower midrail 598L as they extend between the top and bottom rails. The upper midrail has a handle 668 of the type used in the embodiment of FIG. 59 while the lower midrail has a handle 602 of the type used in the embodiment of FIG. 52. The fabric 590 is anchored at its upper end to the upper midrail 598U and at its lower end to the lower midrail 598L in the manner described previously in connection with the embodiment of FIG. 52. As can be appreciated by reference to FIGS. 64 and 65, the upper midrail can be lowered toward the lower midrail allowing the fabric to accumulate on the lower midrail or the lower midrail can be raised relative to the upper midrail again allowing the fabric to gather on the lower midrail. The covering can therefore be fully retracted adjacent the top rail or fully retracted adjacent the bottom rail or positioned at any degree of extension at any location between the top and bottom rails.

FIGS. 67-69 show still another use of the covering of the type shown in FIG. 52 wherein a pair of guide cords 600 are anchored at the top of an architectural opening in any suitable manner such as with fasteners 674 shown diagrammatically in FIGS. 67 and 68. The guide cords extend downwardly and are anchored in a bottom rail 596 with the finger locks 642 in the manner described previously. In their downward passage, each guide cord crosses to the opposite side through the midrail 598 which has a handle 668 anchored in the upper groove 616 thereof so that the midrail can be raised or lowered. In the embodiment illustrated in FIGS. 67-69, the covering is a top down covering even though it will be appreciated that the reverse could be accommodated in a manner which would be well known to those skilled in the art. It will also be seen that the bottom rail is supporting a dummy vane 664 from its bottom groove 620 with the dummy vane being fabricated to simulate each of the vanes 42 in the fabric 590 except that it is of tubular construction as will be described in more detail later.

FIG. 70 shows another arrangement utilizing the fabric 590 of FIG. 1 wherein a pair of vertically suspended guide cords 600 support the fabric with the guide cords being anchored with fasteners (not shown) to the top of the framework around an architectural opening. The covering includes a top rail 592 identical to that shown in FIG. 52 with the top edge of the fabric connected to the top rail in the manner previously described and further including a handle 668 of the type utilized in the embodiment of FIG. 59. The covering of FIG. 70 includes a dummy vane 664 along the bottom thereof which is overlapped by the lowermost vanes 42 on the front and back of the fabric in the covering. The dummy vane is anchored to the bottom ends of the guide cords in a manner to be described hereafter and is weighted so as to retain the fabric for the covering in a vertically extended somewhat taut position when the top rail 592 is raised relative to the dummy vane as shown in FIG. 70. The top rail can be lowered by gripping the handle 668 and pulling the top rail downwardly so that it slides along the guide cords as described previously in connection with FIG. 52. As the covering is retracted by lowering the handle connected to the top rail, the vanes accumulate on the dummy vane. The dummy vane is probably best illustrated in the exploded views of FIGS. 73A and 73B to include an extruded base 676 having an upwardly opening groove 678 along its top edge with overhanging lips 680 in which finger locks 642 of the type previously described can be anchored to secure the lower ends of the guide cords. The extruded base further has a downwardly opening groove 682 for a purpose to be described hereafter and downwardly flared side walls 684 to confine a generally V-shaped semi-rigid strip 686 that can be attached to the extruded base to define the desired contour of the dummy vane. A ballast bar 688 is slidably positionable within the downwardly opening groove by inserting the ballast bar into one end of the groove 682. Spring-biased clips 690 are slidably inserted into the same groove 682 at opposite ends of the ballast to retain the ballast in a desired position. Movement of the ballast along the length of the base and positively positioning it encourages the fabric in the covering to hang vertically as desired. If the fabric is skewed in its natural suspension, proper positioning of the ballast will facilitate straightening of the fabric for aesthetic purposes.

The generally V-shaped strip of semi-rigid material 686 can be affixed to the base 676 with adhesive or any other suitable means or can be provided with barbs or tabs 692 as shown in FIG. 73B which are adapted to catch on ridges 694 formed along the outside walls of the downwardly opening groove 682 with the sides of the V-shaped strip confined by the downwardly flared side walls 684. In other words, inserting the top edges of the tubular strip into the gap between the flared sides of the base and the walls of the downwardly opening groove so that the barbs catch on the ridges, the tubular strip is reliably secured to the base and suspended therefrom.

Identical end caps 696 of generally ovular configuration are insertable into the open ends of the extruded base 676 and the strip material 686 with the end caps including a large projection 698 along a lower portion that inserts into the associated open end of the strip material and a pair of protrusions 700 adjacent to the top which are frictionally received in the upwardly opening 678 and downwardly opening 682 grooves of the base.

With reference to FIGS. 74-95, an embodiment of the invention similar to that shown in FIGS. 52-73B is illustrated. This embodiment is similar to that of FIGS. 52-73B in that the shade incorporates a fabric 590 of the type shown in the embodiment of FIG. 1 and again does not include rollers or lift cords for moving a bottom rail upwardly or a top rail downwardly in the operation of the shade. Rather, the fabric 590 is incorporated into the system with top 702 and bottom 704 rails as well as at least one midrail 706 with the midrail being movable along guide cords 600 which extend between the top and bottom rails. The rails have been designed slightly differently than those of FIGS. 52-73B as will be described hereafter even though the mounting brackets 594 can be identical.

FIGS. 74-80 illustrate a top-down version of the embodiment of FIGS. 74-95 wherein it will be seen that the fabric 590 is identical to the type shown in FIG. 1 wherein a support structure 708 (FIG. 79) of the fabric carries a plurality of slats 42 are suspended from the midrail. The shade includes the fixed top rail and the fixed bottom rail which are mounted on brackets 594 of the type described previously and the midrail which is movable along a pair of the guide cords 600 extending between the top and bottom rails.

The rails have an extruded main body 710 as probably best seen in FIGS. 78-80 and 95. It will be seen that the extrusion is somewhat rectangular in cross-section and can be oriented vertically as shown in FIGS. 79 and 95 or horizontally as shown in FIGS. 78 and 80. As will be appreciated by reference to FIG. 77, the top and bottom rails are oriented horizontally while the midrail is oriented vertically. By referencing the vertical orientation in FIG. 95, the extruded main body of the rail can be seen to have an upwardly opening or top channel 712 with partially overlying lips 714, a forwardly opening or front channel 716 with partially overlying lips 717 and an intermediate generally L-shaped support rib 718, a center passage 720 of generally rectangular configuration and a rearwardly opening or rear channel 722 having an inturned lip 724 along one edge and a generally C-shaped groove 726 along the other edge. The channels, grooves, and openings in the extrusions serve various purposes to be described hereafter. It is important to note, however, that the L-shaped support rib 718 in the middle of the forwardly opening channel 716 cooperates with an adjacent lip 717 in defining a subgroove 728 within the forwardly opening or front channel, the purpose for which will also become clear hereafter.

With reference to FIGS. 78-80, in the top-down version of this embodiment, it will be appreciated that the top rail 702 is oriented horizontally and serves only to anchor the upper ends of the guide cords 600 with finger locks 642 of the type utilized in the embodiment of the invention shown in FIGS. 52-73B as will be discussed later. It will be appreciated, however, that since the top rail is oriented horizontally, the top channel 712 is directed to the left or rearwardly as shown for example in FIG. 78. The ends of the guide cords are anchored within this channel with the lock fingers 642 as described previously. The bottom rail 704 is similarly horizontally oriented with the top channel 712 opening rearwardly or to the left and the bottom rail serves only to guide and house the opposite ends of the guide cords 600 along with the spring 640 to which the opposite ends are attached as in the prior described embodiment of FIGS. 52-73B. The guide cords 600 and spring 640 are confined within the center generally rectangular passage 720 through the bottom rail. Of course, the top and bottom rails are fixed in position on their associated mounting brackets 594 and the tension in the guide cords is set as described previously.

The midrail 706 is oriented vertically so that the front channel 716 opens to the right or forwardly and the subgroove 728 is disposed adjacent the top of the front channel. The subgroove is used to anchor and support the top edge of the fabric 590 by inserting the top edge of the support structure 708 into the subgroove and releasably securing it in the groove with an anchor strip 730 having a larger dimension than the spacing between the L-shaped rib 718 and the adjacent lip 717. As in the previously described embodiments of FIGS. 52-73B, the guide cords criss-cross through the central passage 720 in the midrail thereby enabling the midrail to be positively but movably positioned at any location between the top and bottom rails. As best appreciated by reference to FIGS. 76 and 94, an arcuate protective shield 732 having a bead 734 extending along opposite longitudinal edges is supported from the C-shaped groove 726 in the rear channel 722 of the midrail extrusion and hangs downwardly a slighter greater distance than the uppermost slat 42 in the fabric. The protective shield serves several purposes but primarily is a spacer so that when the midrail is lowered, the lower beaded edge of the protective shield engages the bottom rail to define a lowermost position for the midrail so as to always provide a uniform appearance for the shade while protecting the uppermost slat in the fully retracted or lowermost position.

The top channel 712 in the midrail removably receives a handle 735 for operating the shade by moving the midrail 706 vertically along the guide cords 600. The handle, which can be seen in FIGS. 76 and 92, includes a main body 736 adapted to be gripped by an operator and a pair of curving rearwardly projecting legs 738 having upstanding semi-rigid ribs 740 with beveled catches 742 on their upper edges. The ribs and catches are adapted to be inserted into the top channel 712 (which opens downwardly in the midrail) and due to the semi-rigid nature of the ribs and the beveled top edges of the catches, the handle will snap into the top groove or can be slid into the groove from one end or the other of the midrail. The uppermost slat 42 in the fabric 590 has a pair of holes 744 formed therein as seen best in FIG. 75 through which the legs 738 on the handle can be inserted prior to connection to the midrail. Once the handle is connected, it has a very pleasing aesthetic as seen in FIG. 74.

Referencing FIGS. 81-85, a bottom-up version of this embodiment is illustrated. In the bottom-up version, and as best appreciated in FIGS. 83-85, the top rail 746 has the extrusion 710 oriented horizontally with the top channel 712 opening to the right or forwardly of the shade. The top channel is utilized to anchor the top edge of the fabric 590 in a manner similarly described by inserting the top edge of the support structure for the fabric into the top channel along with an anchor strip 730. The front channel 716, which opens upwardly in the top rail 746, can be left open or can receive a decorative strip 748 with the decorative strip being tucked beneath the inturned lips 717 along opposite edges of the channel. As can also be seen in FIG. 83, the center passage 720 through the extrusion receives the spring 640 along with the opposite upper ends of the guide cords 600 as will be described in more detail later.

The bottom rail 750 which is shown best in FIG. 85 serves only to anchor the lower ends of the guide cords 600 with the bottom rail being oriented horizontally but opposite to that of the top rail so that the top channel 712 opens to the left or rearwardly. The bottom ends of the guide cords pass into the top channel and are fixed into position with lock fingers 642 as described previously.

The midrail 752 as seen best in FIG. 84 has the guide cords 600 criss-crossing through the center passage 720 and has a handle 754 affixed to the top channel 712 (which opens downwardly inasmuch as the midrail is vertically oriented). The handle for the bottom-up version of this embodiment is probably best seen in FIGS. 81, 82 and 93 to have a main body 756 that can be gripped by the operator and an L-shaped support plate 758 with reinforcing gussets 760. The support plate projects rearwardly from the main body 756. Along the top edge of the support plate are spaced pairs of semi-rigid ribs 762 having beveled catches 764 on their upper edges which can be removably received in the top channel (which opens downwardly) as described previously with the top down version of this embodiment. The support plate 758 on the handle has a vertical dimension such that it extends beyond the lower edge of the lowermost slat 42 in the fabric 590 so that when the shade is fully extended with the midrail at its lowermost position as seen in FIG. 82, the handle abuts the bottom rail 750 leaving the bottom most slat in the fabric desirably positioned for aesthetics. The midrail is positioned in the space between the two lowermost slats 42 in the fabric so that as the midrail is lifted with the handle, the slats in the fabric are gathered on and supported by the midrail.

Each end of the top, bottom, and midrails of both the top-down and bottom-up versions have inserts or end caps 766 frictionally received therein with the inserts being identical and shown best in FIGS. 86-91. The insert can be seen to have an enlarged head 768 having criss-crossing slots 770 formed therein with either one of the slots being adapted to receive the tongue 610 on a mounting bracket 594. Accordingly, since the criss-crossing slots are perpendicular to each other, the rail in which the insert is received can be mounted on a mounting bracket in either a vertical or horizontal orientation depending upon which slot in the insert receives the tongue 610. The insert further includes a large generally rectangular hollow protrusion 772 from an inner end of the head which communicates with the criss-crossing slots. The protrusion is adapted to be frictionally received in the central passage 720 of a rail extrusion at open ends. A smaller protrusion 774 of generally channel-shaped configuration also protrudes from the inner end of the head of the insert and is frictionally receivable in the top channel 712 of the extrusion. The inserts provide an aesthetically pleasing covering for the open ends of the extrusions and further provide means by which the guide cords 600 can be either anchored to a rail or extended through the central passage of the rail. In other words, the guide cords, which depend from opposite ends of the top rail, pass through one of the criss-crossing slots in the top rail and extend downwardly therefrom before entering a slot in the insert of the midrail and extending through the central passage of the midrail to the opposite end of the midrail. The guide cords subsequently extend downwardly and through a slot in the corresponding end of the bottom rail for connection to the bottom rail. The ends of the guide cords which are secured to the coil spring 640 pass through a slot 770 in an insert 766 and into the central passage of the extrusion while the free ends of the guide cords which are anchored with the lock fingers 642 extend through a slot in the insert and into the top channel of the extrusion even though the top channel may not be on the top of the extrusion depending upon the vertical or horizontal orientation of the rail.

It should be appreciated that the versions of the embodiment shown in FIGS. 74-95 could also be converted into a top-down/bottom-up shade similarly to that shown in FIGS. 63-66.

It will be appreciated from the above, that a shade for an architectural opening has been described that includes many different variations wherein a support structure has mounted thereon a plurality of slats and wherein the support structure can be extended or retracted with an appropriate control system. It is evident from the above that the slats could take numerous configurations or sizes and the support structure could also be varied as well as the system employed for extending and retracting the fabric material. It will also be appreciated that hybrid fabrics can be used for varied aesthetics and further the fabric can be cut to any desirable shape to accommodate any configuration of an architectural opening. The shades can also be disposed for bottom-up operation, top-down operation, or both top-down and bottom-up operations. Accordingly, the shade is extremely versatile and while illustrative embodiments have been disclosed, it will be apparent to those skilled in the art that many variations and combinations of embodiments and arrangements disclosed herein could be employed.

Although the present invention has been described with a certain degree of particularity, it is understood the disclosure has been made by way of example, and changes in detail or structure may be made without departing from the spirit of the invention as defined in the appended claims.

What is claimed is:

1. A fabric for use in a covering for a building structure comprising in combination:

a flexible vertically extending support structure comprised of a plurality of interconnected, transversely collapsible cells, each of said cells having a top wall, a bottom wall, and a front side wall extending between said top wall and said bottom wall, said front side wall having an upper segment and a lower segment, said upper segment having a longitudinal dimension extending along a length of said cells and a lateral dimension extending orthogonally to said longitudinal dimension; and a plurality of parallel elongated vanes supported at spaced locations along said support structure, said vanes secured to said support structure along an interface that extends along a majority of said lateral dimension of said upper segment, each of said vanes including a free end cantilevered from said support structure.

2. The fabric of claim 1 wherein said cells are hexagonal in transverse cross-section.

3. The fabric of claim 1 wherein said cells are elongated and connected to adjacent cells along longitudinal lines of connection.

4. The fabric of claim 3 wherein said vanes are secured to said support structure along said lines of connection.

5. The fabric of claim 4 wherein there is at least one line of connection between the two locations where a vane is secured to said support structure.

6. The fabric of claim 5 wherein there are two lines of connection between the two locations where a vane is secured to said support structure.

7. The fabric of claim 1 wherein said vanes are made of a semi-rigid material.

8. The fabric of claim 3 wherein said cells have their longitudinal dimension extending horizontally.

9. The fabric of claim 1, further comprising a length of adhesive positioned along said interface, wherein said adhesive secures said vanes to said upper portion and said length of said adhesive extends along a length of said interface.

10. The fabric of claim 1, further comprising a first adhesive length positioned along a top edge of said upper portion and a second adhesive length positioned along a bottom edge of said upper portion, wherein said first adhesive length and said second adhesive length secure said vanes along said interface of said upper portion.

11. A covering for an architectural opening comprising:

a plurality of cells, at least one cell including a side wall having a first segment and a second segment separated by a fold line, said first segment having a longitudinal dimension extending along a length of said at least one cell and a lateral dimension extending orthogonally to said longitudinal dimension; and at least one vane including a vane length having a first vane length connected to said at least one cell along an interface that extends along a majority of said lateral dimension of said first segment and a second vane length cantilevered from said at least one cell and terminating at a free end; wherein said at least one cell is movable between a retracted position and an extended position;

said at least one vane moves substantially unitarily with said at least one cell when said at least one cell transitions between said retracted position and said extended position; and said interface levers said second vane length of said at least one vane causing said second vane length to move while said at least one cell transitions between said retracted position and said extended position.

12. The covering of claim 11, wherein said plurality of cells further comprises a first cell having a first cell length and a second cell having a second cell length, wherein said vane length is longer than said first cell length and said second cell length, such that said at least one vane overlaps said first cell and said second cell.

13. The covering of claim 11, wherein said vane length encompasses more than one of said plurality of cells.

14. The covering of claim 11, wherein said vane length extends vertically along said plurality of cells and encompasses more than three cells of said plurality of cells.

15. The covering of claim 11, wherein said at least one cell is hexagonal in cross section.

16. The covering of claim 11, wherein said lateral dimension of said interface extends along substantially an entirety of said lateral dimension of said first segment.

17. The covering of claim 11, wherein said at least one vane is an at least partially rigid material.

18. The fabric of claim 1 wherein said interface extends along substantially an entirety of said lateral dimension of said upper segment.

19. The fabric of claim 1 wherein said cells are movable between a retracted position and an extended position; and when said cells are in said extended position, said free end of said vanes abuts against a next adjacent lower vane.

20. The fabric of claim 1 wherein said interface is configured such that said upper segment of each of said cells serves as a lever in moving said vanes unitarily with said upper segment.

* * * * *